US010733946B2

(12) United States Patent
Kurokawa

(10) Patent No.: US 10,733,946 B2
(45) Date of Patent: Aug. 4, 2020

(54) DISPLAY DEVICE AND ELECTRONIC DEVICE

(71) Applicant: Semiconductor Energy Laboratory Co., Ltd., Atsugi-shi, Kanagawa-ken (JP)

(72) Inventor: Yoshiyuki Kurokawa, Sagamihara (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 224 days.

(21) Appl. No.: 15/682,919

(22) Filed: Aug. 22, 2017

(65) Prior Publication Data

US 2018/0061344 A1 Mar. 1, 2018

(30) Foreign Application Priority Data

Aug. 26, 2016 (JP) ..... 2016-165511
Aug. 26, 2016 (JP) ..... 2016-165512

(51) Int. Cl.
*G09G 3/36* (2006.01)
*G09G 3/3233* (2016.01)

(52) U.S. Cl.
CPC ..... *G09G 3/3648* (2013.01); *G09G 3/3233* (2013.01); *G09G 3/367* (2013.01);
(Continued)

(58) Field of Classification Search
CPC .. G09G 3/3648; G09G 3/3233; G09G 3/3629; G09G 3/367
See application file for complete search history.

(56) References Cited

U.S. PATENT DOCUMENTS 3,997,813 A * 12/1976 Chan ..... G09G 3/296 345/204
5,488,434 A * 1/1996 Jung ..... H04N 5/44 348/603

(Continued)

FOREIGN PATENT DOCUMENTS

CN 001858839 A 11/2006
CN 102394049 A 3/2012

(Continued)

OTHER PUBLICATIONS

International Search Report (Application No. PCT/IB2017/055051) dated Nov. 28, 2017.

(Continued)

*Primary Examiner* — Ariel A Balaoing
(74) *Attorney, Agent, or Firm* — Robinson Intellectual Property Law Office; Eric J. Robinson

(57) ABSTRACT

A display device that performs image correction in accordance with external light environment is provided. The display device includes a host device and an optical sensor. In addition, the display device includes a processing circuit. The host device has a function of performing arithmetic processing using a neural network on software and a function of performing supervised learning with the neural network. The processing circuit has a function of performing arithmetic processing using a neural network on hardware. The optical sensor has a function of obtaining illuminance of external light. The obtained illuminance of external light is inputted to the host device, and a luminance and color tone preferred by users are regarded as teacher data, whereby learning is performed on the neural network of the host device. A weight coefficient obtained through the learning is used as a weight coefficient of the neural network of the processing circuit. By inputting illuminance of external light to the processing circuit, set values of luminance and color (Continued)

tone selected by the users are calculated in the neural network of the processing circuit.

20 Claims, 52 Drawing Sheets

(52) U.S. Cl.
CPC ... *G09G 3/3629* (2013.01); *G09G 2300/0465* (2013.01); *G09G 2360/144* (2013.01)

(56) References Cited

U.S. PATENT DOCUMENTS 5,581,305 A * 12/1996 Min ..... H04N 5/20 348/571
5,712,930 A * 1/1998 Watanabe ..... H04N 1/407 358/519
5,978,107 A 11/1999 Murai et al.
6,011,295 A * 1/2000 Merrill ..... G06N 3/0635 257/443
7,248,235 B2 7/2007 Fujii et al.
7,457,458 B1 * 11/2008 Daniel ..... H04N 5/21 348/E17.005
8,455,868 B2 6/2013 Yamazaki et al.
8,854,286 B2 10/2014 Yamazaki et al.
8,890,781 B2 11/2014 Yamazaki et al.
9,165,502 B2 10/2015 Yamazaki et al.
9,349,735 B2 5/2016 Yamazaki et al.
9,368,082 B2 6/2016 Yamazaki et al.
2003/0053690 A1 * 3/2003 Trifonov ..... G06T 5/009 382/168
2003/0107688 A1 6/2003 Yamagishi
2006/0262147 A1 * 11/2006 Kimpe ..... G09G 3/20 345/690
2007/0075935 A1 4/2007 Mesmer et al.
2008/0084403 A1 4/2008 Kimura et al.
2008/0246780 A1 * 10/2008 Cho ..... G02F 1/133602 345/690
2008/0284768 A1 * 11/2008 Yoshida ..... G09G 3/2022 345/208
2011/0279426 A1 * 11/2011 Imamura ..... G02F 1/13336 345/207
2012/0212466 A1 * 8/2012 Kohtoku ..... G02F 1/133385 345/207
2015/0339977 A1 * 11/2015 Nathan ..... G01R 19/0092 345/78
2016/0035275 A1 2/2016 Yamazaki et al.
2016/0232868 A1 8/2016 Yamazaki et al.
2016/0260718 A1 9/2016 Yamazaki et al.
2017/0004788 A1 1/2017 Yamazaki et al.
2018/0005566 A1 * 1/2018 Kurokawa ..... G06N 3/0454

FOREIGN PATENT DOCUMENTS

JP 05-128082 A 5/1993
JP 08-102865 A 4/1996
JP 08-292752 A 11/1996
JP 2003-157026 A 5/2003
JP 2004-110421 A 4/2004
JP 2006-146017 A 6/2006
JP 2006-337992 A 12/2006
JP 2007-109918 A 4/2007
JP 2008-225381 A 9/2008
JP 2011-141522 A 7/2011
JP 2011-141524 A 7/2011
JP 2011-151383 A 8/2011
WO WO-2007/041150 4/2007

OTHER PUBLICATIONS

Written Opinion (Application No. PCT/IB2017/055051) dated Nov. 28, 2017.
Aslam-Siddiqi.A et al., "A 16 ×16 Nonvolatile Programmable Analog Vector-Matrix Multiplier", IEEE Journal of Solid-State Circuits, Oct. 1, 1998, vol. 33, No. 10, pp. 1502-1509.
Arima.Y et al., "A Self-Learning Neural Network Chip with 125 Neurons and 10K Self-Organization Synapses", IEEE Journal of Solid-State Circuits, Apr. 1, 1991, vol. 26, No. 4, pp. 607-611.

* cited by examiner

1000

WL
509
CS1
GND
MW1
BGL
LBL

451
LBL
LBLB
509
WL
WL
WL
503
BGL
SA
SA
SA
SA
504
506
507
GBLB
GBL
CSEL
505
502
508
Vbg_w1

1000A

713

750

1000B

100A

DISPLAY DEVICE AND ELECTRONIC DEVICE

TECHNICAL FIELD

One embodiment of the present invention relates to a display device and an electronic device.

Note that one embodiment of the present invention is not limited to the above technical field. The technical field of the invention disclosed in this specification and the like relates to an object, a method, or a manufacturing method. In addition, one embodiment of the present invention relates to a process, a machine, manufacture, or a composition of matter. Specifically, examples of the technical field of one embodiment of the present invention disclosed in this specification include a semiconductor device, a display device, a liquid crystal display device, a light-emitting device, a power storage device, an imaging device, a memory device, a processor, an electronic device, a method for driving any of them, a method for manufacturing any of them, a method for testing any of them, and a system including any of them.

BACKGROUND ART

Display devices included in mobile phones such as smartphones, tablet information terminals, and notebook personal computers (PC) have undergone various improvements in recent years. For example, there have been developed display devices with features such as higher resolution, higher color reproducibility (higher NTSC ratio), a smaller driver circuit, and lower power consumption.

As an example, an improved display device has a function of automatically adjusting the brightness of an image displayed on the display device in accordance with ambient light. An example of such a display device is a display device having a function of displaying an image by reflecting ambient light and a function of displaying an image by making a light-emitting element emit light. This structure enables the brightness of an image displayed on a display device to be adjusted in the following manner: the display device is set to a display mode for displaying an image with use of reflected light (hereinafter referred to as a reflective mode) when ambient light is sufficiently strong, whereas the display device is set to a display mode for displaying an image with light emitted from a light-emitting element (hereinafter referred to as a self-luminous mode) when ambient light is weak. In other words, the display device can display images in a display mode that is selected from the reflective mode, the self-luminous mode, and a mode using both the reflective and self-luminous modes in accordance with the intensity of ambient light sensed with an illuminometer (illuminance sensor).

As examples of a display device having a function of displaying an image by making a light-emitting element emit light and a function of displaying an image by reflecting ambient light, Patent Documents 1 to 3 each disclose a display device in which one pixel includes a pixel circuit for controlling a liquid crystal element and a pixel circuit for controlling a light-emitting element (such a display device is referred to as a hybrid display device).

For image processing for a display device to display an image, the utilization of a neural network has been considered. Furthermore, Non-Patent Document 1 discloses a technique relating to a chip having a self-learning function with the neural network.

REFERENCE

Patent Document

[Patent Document 1] United States Patent Application Publication No. 2003/0107688

[Patent Document 2] PCT International Publication No. WO2007/041150

[Patent Document 3] Japanese Published Patent Application No. 2008-225381

Non-Patent Document

[Non-Patent Document 1] Y. Arima et al., "A Self-Learning Neural Network Chip with 125 Neurons and 10K Self-Organization Synapses," *IEEE Journal of Solid-State Circuits*, Vol. 26, No. 4, April 1991, pp. 607-611

DISCLOSURE OF INVENTION

In a display device including one type of a display element, using a transistor including a metal oxide or an oxide semiconductor in a channel formation region (hereinafter, the transistor is referred to as "OS transistor") for a pixel circuit including a display element, a driver circuit, or the like has been proposed. The OS transistor has a characteristic of extremely low off-state current. Thus, when the OS transistor is used for a pixel circuit, for example, the frequency of refreshing image data held in the pixel circuit can be reduced in displaying a still image by a display device. Alternatively, when the OS transistor is used for a driver circuit, for example, the operation of the driver circuit is not necessary for displaying a still image by the display device. Thus, the necessary setting information or the like is stored in a nonvolatile memory using the OS transistor, which enables the block of supplying power.

For the above-described pixel circuit or driver circuit, a transistor including silicon in a channel formation region (hereinafter, the transistor is referred to as "Si transistor") can be used. In particular, to improve the performance of a buffer amplifier, a register circuit, a pass transistor logic circuit, or the like in the driver circuit, Si transistors are preferably used in some cases.

To utilize both the characteristics of OS transistors and the characteristics of Si transistors, the driver circuit of the display device, which is formed using both the OS transistors and the Si transistors, has been proposed. However, the conditions of heat treatment, such as a temperature, a time, and an atmosphere, are different between a process for forming the OS transistor and a process for forming the Si transistor with high withstand voltage in the driver circuit or the like. Thus, in some cases, it is difficult to form the OS transistor and the Si transistor with high withstand voltage in one circuit.

Another object of one embodiment of the present invention is to provide a novel display device. Another object of one embodiment of the present invention is to provide an electronic device including a novel display device.

Another object of one embodiment of the present invention is to provide a display device including a driver circuit with high driving performance. Another object of one embodiment of the present invention is to provide a display device with high pixel density. Another object of one embodiment of the present invention is to provide a display device with low power consumption. Another object of one embodiment of the present invention is to provide a display device having a function of adjusting a luminance and color tone of a display portion depending on an ambient light environment.

Note that the objects of one embodiment of the present invention are not limited to the above objects. The objects described above do not disturb the existence of other objects. The other objects are the ones that are not described above and will be described below. The other objects will be apparent from and can be derived from the description of the specification, the drawings, and the like by those skilled in the art. One embodiment of the present invention achieves at least one of the above objects and the other objects. One embodiment of the present invention does not necessarily achieve all the above objects and the other objects.

(1)

One embodiment of the present invention is a display device including a processing circuit and a host device, where the host device is configured to perform arithmetic operation using a neural network on software and to perform supervised learning with the neural network, where the processing circuit is configured to perform arithmetic operation using a neural network on hardware, where the host device is configured to generate a weight coefficient on the basis of a first data and a teacher data and to input the weight coefficient to the processing circuit, where the teacher data has a first set value corresponding to a first luminance and a first color tone, and where the processing circuit is configured to generate a second data on the basis of the first data and the weight coefficient.

(2)

Another embodiment of the present invention is the display device according to (1), including a sensor and a display portion, where the display portion includes a display element, where the sensor is configured to obtain the first data, where the second data has a second set value corresponding to a second luminance and a second color tone, and where the display element is configured to display an image corresponding to the second set value.

(3)

Another embodiment of the present invention is the display device according to (1), including a sensor and a display portion, where the display portion includes a first display element and a second display element, where the sensor is configured to obtain the first data, where the second data has a second set value corresponding to a second luminance and a second color tone and a third set value corresponding to a third luminance and a third color tone, where the first display element is configured to display an image corresponding to the second set value by reflection of external light, and where the second display element is configured to display an image corresponding to the third set value by self emission.

(4)

Another embodiment of the present invention is the display device according to any one of (1) to (3), where the processing circuit includes a first memory cell, a second memory cell, and an offset circuit, where the first memory cell is configured to output a first current corresponding to a first analog data stored in the first memory cell, where the second memory cell is configured to output a second current corresponding to a reference analog data stored in the second memory cell, where the offset circuit is configured to output a third current corresponding to a differential current between the first current and the second current, where the first memory cell is configured to output a fourth current corresponding to the first analog data stored in the first memory cell when a second analog data is supplied as a selection signal, where the second memory cell is configured to output a fifth current corresponding to the reference analog data stored in the second memory cell when the second analog data is supplied as the selection signal, where the processing circuit is configured to obtain a sixth current corresponding to a differential current between the fourth current and the fifth current and to output a seventh current depending on a sum of products of the first analog data and the second analog data by subtracting the third current from the sixth current, and where the first analog data is a data corresponding to the weight coefficient.

(5)

Another embodiment of the present invention is the display device according to (4), where each of the first memory cell, the second memory cell, and the offset circuit includes a first transistor, and where the first transistor includes a metal oxide in a channel formation region.

(6)

Another embodiment of the present invention is the display device according to any one of (1) to (3), where the processing circuit includes a first memory cell, a second memory cell, a first current generation circuit, and a second current generation circuit, where the first memory cell is configured to output a first current corresponding to a first analog data stored in the first memory cell, where the second memory cell is configured to output a second current corresponding to a reference analog data stored in the second memory cell, where the first current generation circuit is configured to generate a third current corresponding to a difference between the first current and the second current when an amount of the first current is smaller than an amount of the second current, and to retain a potential corresponding to the third current, where the second current generation circuit is configured to generate a fourth current corresponding to a difference between the first current and the second current when an amount of the first current is larger than an amount of the second current, and to retain a potential corresponding to the fourth current, where the first memory cell is configured to output a fifth current corresponding to the first analog data stored in the first memory cell when a second analog data is supplied as a selection signal, where the second memory cell is configured to output a sixth current corresponding to the reference analog data stored in the second memory cell when the second analog data is supplied as the selection signal, where the processing circuit is configured to obtain a seventh current corresponding to a differential current between the fifth current and the sixth current and to output an eighth current depending on a sum of products of the first analog data and the second analog data by subtracting the third current or the fourth current from the seventh current, and where the first analog data is a data corresponding to the weight coefficient.

(7)

Another embodiment of the present invention is the display device according to (6), where each of the first memory cell, the second memory cell, the first current generation circuit, and the second current generation circuit includes a first transistor, and where the first transistor includes a metal oxide in a channel formation region.

(8)

Another embodiment of the present invention is the display device according to (4) or (5), further including a base and a first integrated circuit, where the display portion is formed over the base, where the first integrated circuit is mounted over the base, where the processing circuit is formed over the base, where the first integrated circuit includes an image processing portion, and where the image processing portion is configured to process an image data on the basis of the second data.

(9)

Another embodiment of the present invention is the display device according to any one of (2) to (7), further including a base and a first integrated circuit, where the display portion is formed over the base, where the first integrated circuit is mounted over the base, where the first integrated circuit includes an image processing portion, where the image processing portion includes the processing circuit, and where the image processing portion is configured to process an image data on the basis of the second data.

(10)

Another embodiment of the present invention is the display device according to (8) or (9), where the first integrated circuit includes a second transistor, and where the second transistor includes silicon in a channel formation region.

(11)

Another embodiment of the present invention is the display device according to any one of (8) to (10), where the first integrated circuit includes a third transistor, and where the third transistor includes a metal oxide in a channel formation region.

(12)

Another embodiment of the present invention is the display device according to any one of (8) to (11), further including a first circuit, a second circuit, and a second integrated circuit, where the first circuit is formed over the base, where the second circuit is formed over the base, where the second integrated circuit is mounted over the base, where the first circuit is configured to operate as a gate driver of the display portion, where the second circuit is configured to shift a level of an inputted voltage on a high potential side, and where the second integrated circuit is configured to operate as a source driver of the display portion.

(13)

Another embodiment of the present invention is the display device according to (12), where each of the display portion, the first circuit, and the second circuit includes a fourth transistor, and where the fourth transistor includes a metal oxide in a channel formation region.

(14)

Another embodiment of the present invention is the display device according to (12) or (13), where the second integrated circuit includes a fifth transistor, and where the fifth transistor includes silicon in a channel formation region.

(15)

Another embodiment of the present invention is the display device according to any one of (12) to (14), where the first integrated circuit includes a controller, and where the controller is configured to control supplying power to at least one of the first circuit, the second circuit, the second integrated circuit, and the image processing portion.

(16)

Another embodiment of the present invention is an electronic device including the display device according to any one of (1) to (15), a touch sensor unit, and a housing.

According to one embodiment of the present invention, a novel display device can be provided. According to another embodiment of the present invention, an electronic device including a novel display device can be provided.

According to another embodiment of the present invention, a display device including a driver circuit with high driving performance can be provided. According to another embodiment of the present invention, a display device with high pixel density can be provided.

According to another embodiment of the present invention, a display device with low power consumption can be provided. According to another embodiment of the present invention, a display device having a function of adjusting a luminance and a color tone of a display device depending on an ambient light environment.

Note that the effects of one embodiment of the present invention are not limited to the above effects. The effects described above do not disturb the existence of other effects. The other effects are the ones that are not described above and will be described below. The other effects will be apparent from and can be derived from the description of the specification, the drawings, and the like by those skilled in the art. One embodiment of the present invention has at least one of the above effects and the other effects. Accordingly, one embodiment of the present invention does not have the aforementioned effects in some cases.

BEST MODE FOR CARRYING OUT THE INVENTION

An "electronic device", an "electronic component", a "module", and a "semiconductor device" are described. In general, an "electronic device" may refer to as a personal computer, a mobile phone, a tablet terminal, an e-book reader, a wearable terminal, an audiovisual (AV) device, an electronic appliance, a household appliance, an industrial appliance, a digital signage, a car, or an electric appliance including a system, for example. An "electronic component" or a "module" may include a processor, a memory device, a sensor, a battery, a display device, a light-emitting device, an interface device, a radio frequency (RF) tag, a receiver, a transmitter, or the like included in an electronic device. A "semiconductor device" may refer to a device including a semiconductor element or a driver circuit, a control circuit, a logic circuit, a signal generation circuit, a signal conversion circuit, a potential level converter circuit, a voltage source, a current source, a switching circuit, an amplifier circuit, a memory circuit, a memory cell, a display circuit, a display pixel, or the like which includes a semiconductor element and is included in an electronic component or a module.

In this specification and the like, a metal oxide means an oxide of metal in a broad sense. Metal oxides are classified into an oxide insulator, an oxide conductor (including a transparent oxide conductor), an oxide semiconductor (also simply referred to as an OS), and the like. For example, a metal oxide used in an active layer of a transistor is called an oxide semiconductor in some cases. That is to say, when a metal oxide is included in a channel formation region of a transistor that has at least one of an amplifying function, a rectifying function, and a switching function, the metal oxide can be called a metal oxide semiconductor, or OS for short. In addition, an OS FET is a transistor including a metal oxide or an oxide semiconductor.

In this specification and the like, a metal oxide including nitrogen is also called a metal oxide in some cases. Moreover, a metal oxide including nitrogen may be called a metal oxynitride.

Embodiment 1

In this embodiment, a structure of a display device of one embodiment of the present invention will be described.

<Configuration Example of Display Device>

Figure 1:
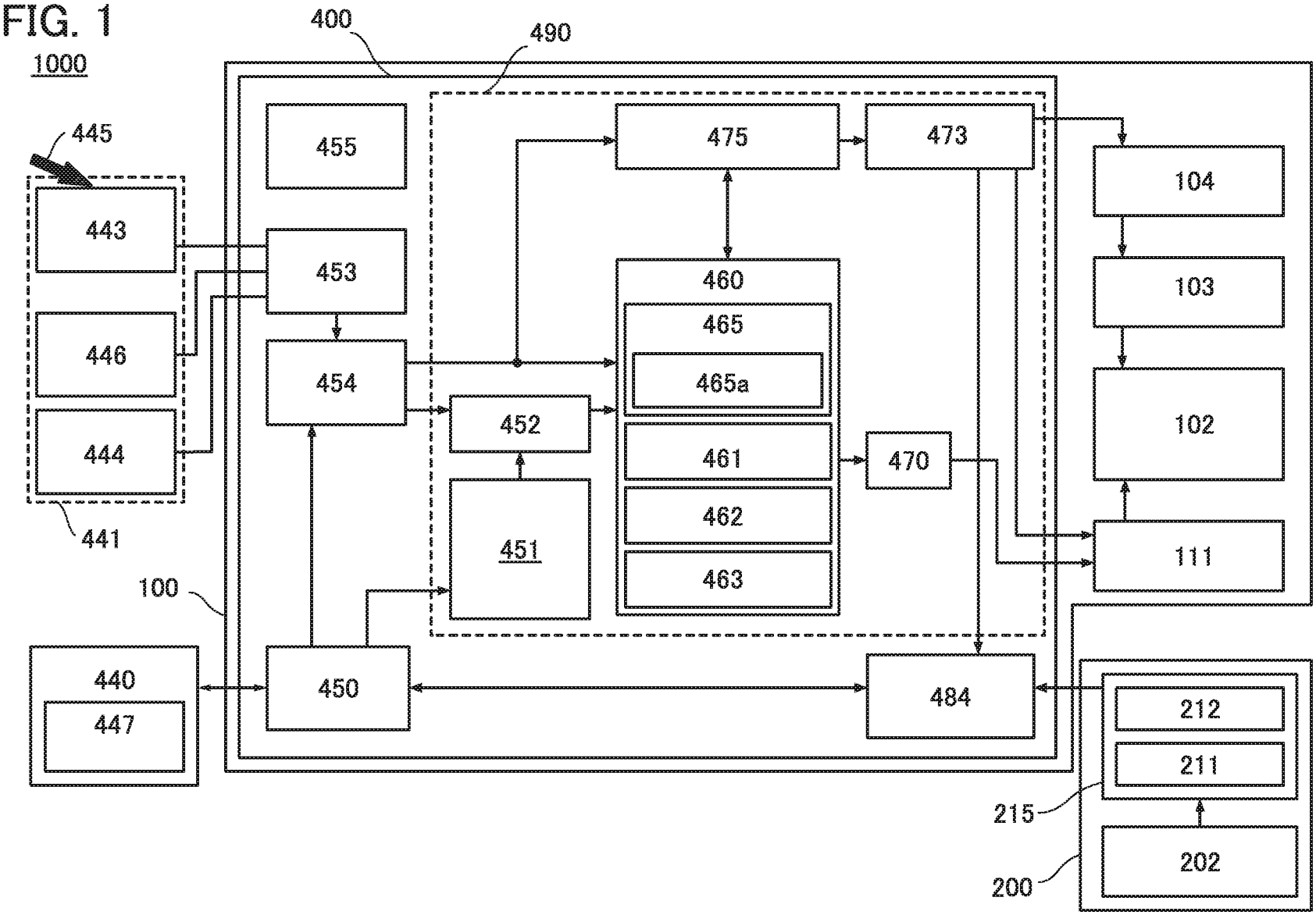
FIG. 1 is a block diagram illustrating a structure example of a display device.

FIG. 1 is a block diagram showing a configuration example of a display device 1000. The display device 1000 includes a display unit 100, a touch sensor unit 200, a sensor 441, and a host device 440. In particular, the details of a controller IC (integrated circuit) 400 included in the display unit 100 are shown. The display unit 100 is a display unit including one of a liquid crystal element, a light-emitting element, and the like as a display element.

The display unit 100 includes a display portion 102, a gate driver 103, a level shifter 104, and a source driver IC 111 in addition to the controller IC 400. Note that the display element is included in the display portion 102.

The controller IC 400 includes an interface 450, a frame memory 451, a decoder 452, a sensor controller 453, a controller 454, a clock generation circuit 455, an image processing portion 460, a memory 470, a timing controller 473, a memory circuit 475, and a touch sensor controller 484.

In the display unit 100, the source driver IC 111 and the controller IC 400 are preferably mounted over the base of the display unit 100 by a chip on glass (COG) method. Alternatively, the source driver IC 111 and the controller IC 400 may be mounted over a flexible printed circuit (FPC) or the like by a chip on film (COF) method. Furthermore, as described in detail in Embodiment 4, each of the level shifter 104, the gate driver 103, and the display portion 102 are preferably formed using OS transistors over the base.

The host device 440 is a computer for performing calculation, control, and the like and composed of a central processing unit (CPU), a memory, and the like. The host device 440 includes software 447, and to execute the software 447, the CPU and the memory are used. Examples of the software 447 that can be provided for the host device 440 include an Internet browser and software for reproducing videos. In the display device of one embodiment of the present invention, the software 447 of the host device 440 has a function of performing supervised learning of a neural network in addition to a function of performing arithmetic processing of the neural network. The supervised learning of the neural network will be described in Embodiment 2, and an operation of correcting an image of the display device of one embodiment of the present invention will be described in Embodiment 3.

Communication between the controller IC 400 and the host device 440 is performed through the interface 450. Image data, a variety of control signals, and the like are transmitted from the host device 440 to the controller IC 400. Information on a touch position or the like obtained by the touch sensor controller 484 is transmitted from the controller IC 400 to the host device 440. Note that which to use out of the circuits included in the controller IC 400 is determined as appropriate depending on, for example, the standard for the host device 440 and the specifications of the display unit 100, and the like.

The sensor 441 includes plural kinds of sensors. In the configuration example shown in FIG. 1, the sensor 441 includes an optical sensor 443, an open/close sensor 444, and an acceleration sensor 446. The sensor 441 is electrically connected to the controller IC 400.

The touch sensor unit 200 includes a sensing circuit 212, a TS driver IC 211, and a sensor array 202. In this specification, the sensing circuit 212 and the TS driver IC 211 are collectively called a peripheral circuit 215. As functions of the touch sensor unit 200, the motion of a user's finger, such as a touch, a flick, or a multi-touch, inputted to the sensor array 202 is sensed and transmitted to the touch sensor controller 484 of the controller IC 400 by the peripheral circuit 215.

The peripheral circuit 215 is preferably mounted over the base of the touch sensor unit 200 by a COG method. Alternatively, the peripheral circuit 215 may be mounted over the FPC or the like by a COF method.

Next, the controller IC 400 is described.

The frame memory 451 is a memory for storing the image data inputted to the controller IC 400. In the case where compressed image data is transmitted from the host device 440, the frame memory 451 can store the compressed image data. The decoder 452 is a circuit for decompressing the compressed image data. When decompression of the image data is not needed, processing is not performed in the decoder 452. Alternatively, the decoder 452 can be provided between the frame memory 451 and the interface 450.

The image processing portion 460 has a function of performing various kinds of image processing on the image data. The image processing portion 460 includes a gamma correction circuit 461, a dimming circuit 462, a toning circuit 463, and a data processing circuit 465, for example.

The image data processed in the image processing portion 460 is outputted to the source driver IC 111 in FIG. 1 through the memory 470. The memory 470 is a memory for temporarily storing image data and is called a line buffer in some cases. The source driver IC 111 has a function of processing the inputted image data and writing the image data to a source line of the display portion 102.

The timing controller 473 has a function of generating timing signals to be used in the source driver IC 111, the touch sensor controller 484, and the gate driver 103 in the display unit 100. In the configuration example of FIG. 1, the level of a timing signal inputted to the gate driver 103 is shifted by the level shifter 104 in the display unit 100, and then the signal is transmitted to the gate driver 103. The gate driver 103 has a function of selecting a pixel in the display portion 102.

The touch sensor controller 484 has a function of controlling the TS driver IC 211 and the sensing circuit 212 of the touch sensor unit 200 in FIG. 1. A signal including touch information read from the sensing circuit 212 is processed in the touch sensor controller 484 and transmitted to the host device 440 through the interface 450. The host device 440 generates image data reflecting the touch information and transmits the image data to the controller IC 400. Note that the controller IC 400 can reflect the touch information in the image data.

The clock generation circuit 455 has a function of generating a clock signal to be used in the controller IC 400. The controller 454 has a function of processing a variety of control signals transmitted from the host device 440 through the interface 450 and controlling a variety of circuits in the controller IC 400.

The controller 454 also has a function of controlling power supply to the circuits in a region 490 in the controller IC 400. Hereinafter, temporary stop of power supply to a circuit that is not used is referred to as power gating. Note that a circuit subjected to the power gating is not limited to the circuits in the region 490. For example, power gating may be performed on the gate driver 103, the level shifter 104, the source driver IC 111, and the display portion 102.

In particular, when the display portion 102 includes the OS transistor, image data can be stored in a display element for a long time because the off-state current of the OS transistor is extremely low. In other words, refresh operation of the image data is not necessarily performed in displaying a still image, and thus power gating can be performed on a predetermined circuit in the display unit 100. In this specification, such operation is referred to as idling stop (also referred to as IDS) driving.

The memory circuit 475 stores data used for the operation of the controller IC 400. The data stored in the memory circuit 475 includes a parameter used to perform correction processing in the image processing portion 460, parameters used to generate waveforms of a variety of timing signals in the timing controller 473, and the like. The memory circuit 475 is provided with a scan chain register including a plurality of registers.

The sensor controller 453 is electrically connected to the optical sensor 443. The optical sensor 443 senses external light 445 and generates a sensor signal. The sensor controller 453 generates a control signal on the basis of the sensor signal. The control signal generated in the sensor controller 453 is outputted to the controller 454, for example. Note that the optical sensor 443 is not necessarily provided.

The acceleration sensor 446 is electrically connected to the sensor controller 453. The acceleration sensor 446 has a function of determining the inclination of the display unit 100 including the controller IC 400 and generating an electric signal including the information. The sensor controller 453 generates a control signal in receiving the signal of information about the inclination, for example. The control signal is outputted to the controller 454, for example. Note that a module that determines inclination is not limited to the acceleration sensor 446 and a gyroscope sensor may be used, for example.

Furthermore, the open/close sensor 444, which is effective in the case where the display device 1000 is included in a foldable electronic device, is electrically connected to the sensor controller 453. When the electronic device is folded and the display device 1000 is not used, the open/close sensor 444 sends a signal to the sensor controller 453 so that power gating of circuits and the like in the controller IC 400 is performed. In the case where the electronic device is not foldable, the display device 1000 does not necessarily include the open/close sensor 444.

The dimming circuit 462 has a function of adjusting brightness (also called luminance) of image data displayed on the display portion 102. Here, the adjustment can be referred to as dimming or dimming treatment. In particular, the dimming treatment can be performed in combination with the optical sensor 443. In this case, measurement is performed using the optical sensor 443 and the sensor controller 453. The luminance of the image data displayed on the display portion 102 can be adjusted in accordance with the brightness of the external light 445.

The toning circuit 463 can correct a color (also called a color tone) of image data displayed on the display portion 102. Here, the correction can be referred to as toning or toning treatment.

The data processing circuit 465 has a function of optimizing the luminance and color tone of the display portion 102 in accordance with the preference of users. Furthermore, the data processing circuit 465 includes hardware constructing a neural network to be described later and may have a function of performing supervised learning. Note that the data processing circuit 465 includes a product-sum operation circuit 465*a* as hardware of the neural network.

In the neural network of the software 447 in the host device 440, data of external light measured with the optical sensor 443 and data of inclination measured with the acceleration sensor 446 are regarded as learning data, and the settings of the luminance and color tone preferred by users are regarded as teacher data. In addition, in the neural network of the software 447, learning is performed using the learning data and the teacher data, whereby a parameter (called a weight coefficient in some cases) is obtained. Then, in the neural network of the data processing circuit 465, data of external light measured with the optical sensor 443 and data of inclination measured with the acceleration sensor 446 are inputted as input data, and arithmetic processing is performed with use of the parameter obtained through the learning on the software 447, whereby the set values corresponding to the luminance and color tone preferred by the users can be obtained.

The configuration of the neural network constructed on the hardware of the data processing circuit 465 is compatible with the configuration of the neural network constructed on the software 447 of the host device 440. For example, in the case where each of the neural networks is a hierarchical perceptron neural network, the number of layers of the neural network of the data processing circuit 465 is equivalent to that of the neural network of the software 447. Furthermore, the number of neurons in each layer of the neural network of the data processing circuit 465 is equivalent to that in each layer of the neural network of the software 447.

The image processing portion 460 might include another processing circuit such as an RGB-RGBW conversion circuit depending on the specifications of the display unit 100. The RGB-RGBW conversion circuit has a function of converting image data of red, green, and blue (RGB) into image signals of red, green, blue, and white (RGBW). That is, in the case where the display unit 100 includes pixels of four colors of RGBW, power consumption can be reduced by displaying a white (W) component in the image data using the white (W) pixel. Note that in the case where the display unit 100 includes pixels of four colors of RGBY, an RGB-RGBY (red, green, blue, and yellow) conversion circuit can be used, for example.

<Parameter>

Image correction processing such as gamma correction, dimming, or toning corresponds to processing of generating output correction data Y with respect to input image data X. The parameter that the image processing portion 460 uses is a parameter for converting the image data X into the correction data Y.

Figure 2A:
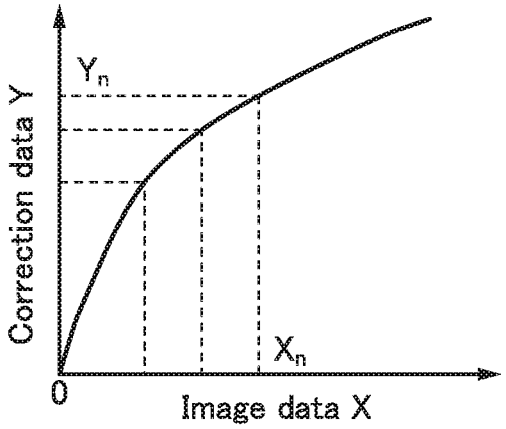
FIGS. 2A to 2C are graphs explaining a parameter.
Figure 2B:
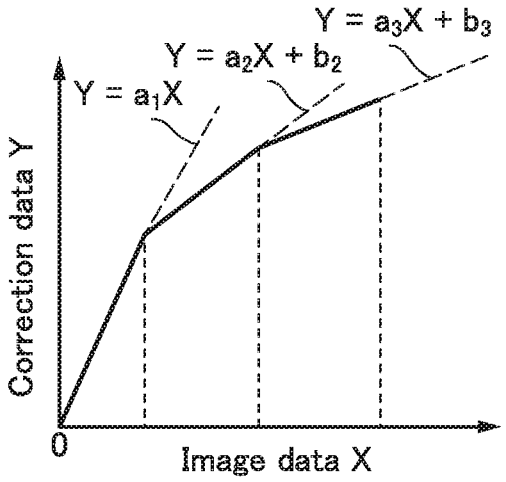

As a parameter setting method, there are a table method and a function approximation method. In a table method explained in FIG. 2A, correction data $Y_n$ with respect to image data $X_n$ is stored in a table as a parameter. In the table method, a number of registers for storing the parameters that correspond to the table is necessary; however, correction can be performed with high degree of freedom. In contrast, in the case where the correction data Y with respect to the image data X can be empirically determined in advance, it is effective to employ a function approximation method as shown in FIG. 2B. Note that $a_1$, $a_2$, $b_2$, and the like are parameters. Although a method of performing linear approximation in every period is shown here, a method of performing approximation with a nonlinear function can be employed. In the function approximation method, correction is performed with low degree of freedom; however, the number of registers for storing parameters that defines a function can be small.

Figure 2C:
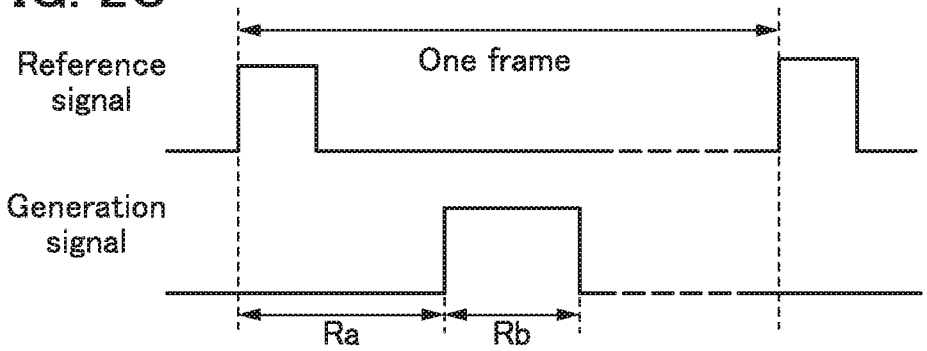

The parameter that the timing controller 473 uses indicates timing at which a generation signal of the timing controller 473 becomes a low-level potential "L" (or high-level potential "H") with respect to a reference signal as explained in FIG. 2C. A parameter Ra (or Rb) indicates the number of clock cycles that corresponds to timing at which the parameter becomes "L" (or "H") with respect to the reference signal.

The above parameter for correction can be stored in the memory circuit 475. Other parameters that can be stored in the memory circuit 475 include data of an EL correction circuit 464 in FIG. 6 described later, luminance, color tones, and setting of energy saving (time until display is made dark or turn off display) of the display unit 100 which are set by a user, sensitivity of the touch sensor controller 484, and the like.

<Power Gating>

In the case where image data transmitted from the host device 440 is not changed, the controller 454 can conduct power gating on some circuits in the controller IC 400. Specifically, for example, the circuits subjected to power gating are circuits in the region 490 (the frame memory 451, the decoder 452, the image processing portion 460, the memory 470, the timing controller 473, and the memory circuit 475). Power gating can be performed in the case where a control signal that indicates no change in the image data is transmitted from the host device 440 to the controller IC 400 and detected by the controller 454.

The circuits subjected to power gating are not limited to the circuits in the controller IC 400. For example, the power gating may be performed on the source driver IC 111, the level shifter 104, the gate driver 103, and the like.

The circuits in the region 490 are the circuits relating to image data and the circuits for driving the display unit 100; therefore, the circuits in the region 490 can be temporarily stopped in the case where the image data is not changed. Note that even in the case where the image data is not changed, a time during which a transistor used for a pixel in the display portion 102 can store data (time for idling stop) may be considered. Furthermore, in the case where a liquid crystal element is used as a reflective element in the pixel in the display portion 102, a time for inversion driving performed to prevent burn-in of the liquid crystal element may be considered.

For example, the controller 454 may be incorporated with a timer function so as to determine timing at which power supply to the circuits in the region 490 is restarted, on the basis of time measured by a timer. Note that it is possible to store image data in the frame memory 451 or the memory 470 in advance and supply the image data to the display portion 102 at inversion driving. With such a structure, inversion driving can be performed without transmitting the image data from the host device 440. Thus, the amount of data transmitted from the host device 440 can be reduced and power consumption of the controller IC 400 can be reduced.

Specific circuit configurations of the frame memory 451 and the memory circuit 475 will be described below. Note that the circuits that can be power gated are not limited to the circuits in the region 490, the sensor controller 453, the touch sensor controller 484, and the like, which are described here. A variety of combinations can be considered depending on the configuration of the controller IC 400, the standard of the host device 440, the specifications of the display unit 100, and the like.

<Frame Memory 451>

Figures 3A, 3B:
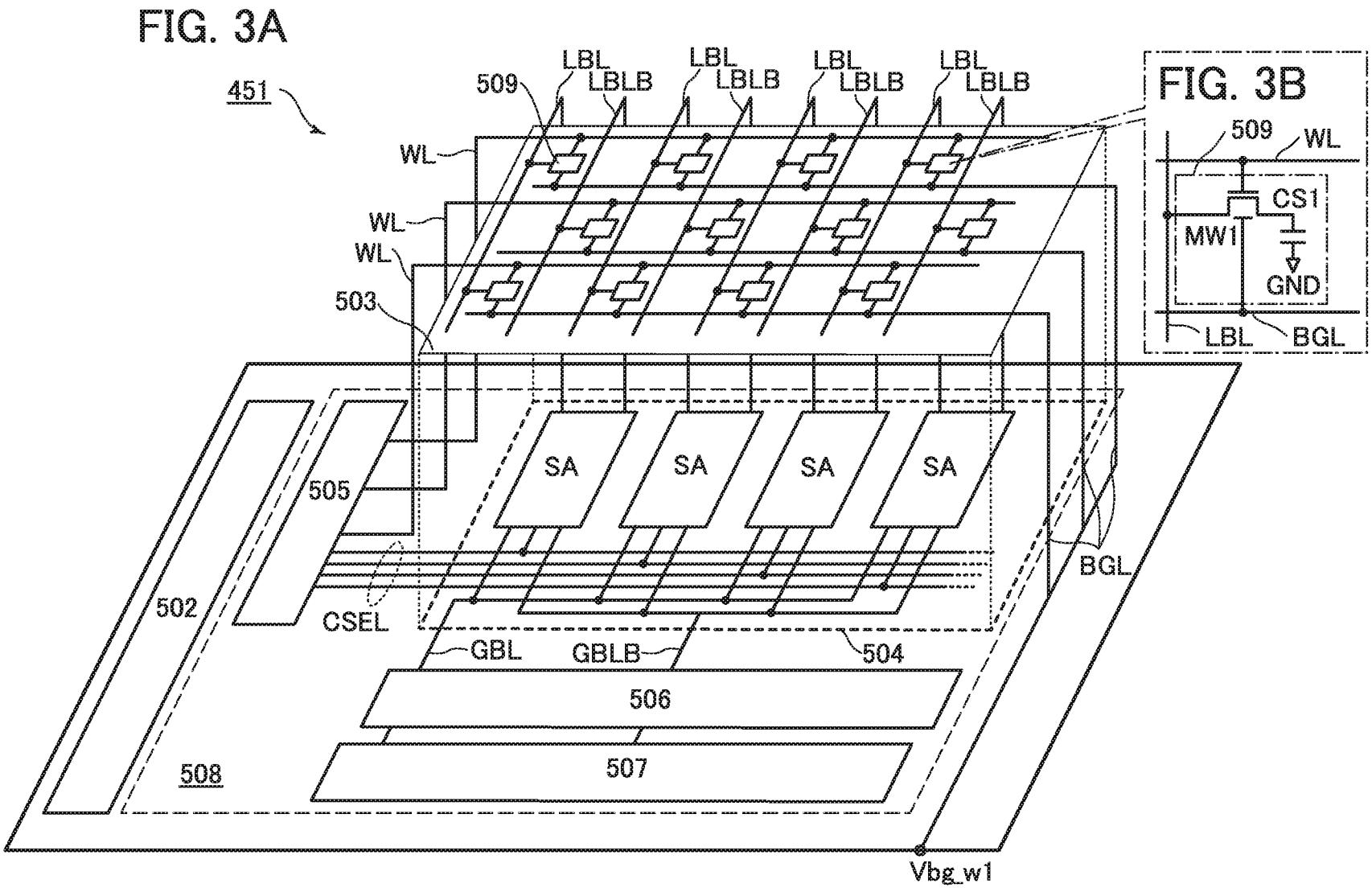
FIGS. 3A and 3B are block diagrams illustrating a configuration example of a frame memory.

FIG. 3A illustrates a configuration example of the frame memory 451. The frame memory 451 includes a control portion 502, a cell array 503, and a peripheral circuit 508. The peripheral circuit 508 includes a sense amplifier circuit 504, a driver 505, a main amplifier 506, and an input/output circuit 507.

The control portion 502 has a function of controlling the frame memory 451. For example, the control portion 502 controls the driver 505, the main amplifier 506, and the input/output circuit 507.

The driver 505 is electrically connected to a plurality of wirings WL and CSEL. The driver 505 generates signals outputted to the plurality of wirings WL and CSEL.

The cell array 503 includes a plurality of memory cells 509. The memory cells 509 are electrically connected to wirings WL, LBL (or LBLB), and BGL. The wiring WL is a word line, the wirings LBL and LBLB are local bit lines, and the wiring BGL is a wiring that applies a potential of a back gate of a transistor MW1 described later. Although a folded-bit-line method is employed for the configuration of the cell array 503 in the example of FIG. 3A, an open-bit-line method can also be employed.

FIG. 3B illustrates a configuration example of a memory cell 509. The memory cell 509 includes the transistor MW1 and a capacitor CS1. The memory cell 509 has a circuit configuration similar to that of a memory cell for a dynamic random access memory (DRAM).

The transistor MW1 is an OS transistor. Since an OS transistor has an extremely low off-state current, leakage of charge from the capacitor CS1 can be suppressed by forming the memory cell 509 using an OS transistor. Thus, the frequency of refresh operation of the frame memory 451 can be reduced because. The frame memory 451 can retain image data for a long time even when power supply is stopped. Moreover, by setting the voltage Vbg_w1 to a negative voltage, the threshold voltage of the transistor MW1 can be shifted to the positive potential side and thus the retention time of the memory cell 509 can be increased.

Here, an off-state current refers to a current that flows between a source and a drain of a transistor in an off state. In the case of an n-channel transistor, for example, when the threshold voltage of the transistor is approximately 0 V to 2 V, a current flowing between a source and a drain when a voltage of a gate with respect to the source is negative can be referred to as an off-state current. An extremely low off-state current means that, for example, an off-state current per micrometer of channel width is lower than or equal to 100 zA (z represents zepto and denotes a factor of $10^{-21}$). Since the off-state current is preferably as low as possible, the normalized off-state current is preferably lower than or equal to 10 zA/μm or lower than or equal to 1 zA/μm, further preferably lower than or equal to 10 yA/μm (y represents yocto and denotes a factor of $10^{-24}$).

A metal oxide (oxide semiconductor) in a channel formation region of an OS transistor has a bandgap of 3.0 eV or higher; thus, the OS transistor has a low leakage current due to thermal excitation and, as described above, an extremely low off-state current. The metal oxide in the channel formation region preferably contains at least one of indium (In) and zinc (Zn). Typical examples of such a metal oxide include an In-M-Zn oxide (M is Al, Ga, Y, or Sn, for example). By reducing impurities serving as electron donors, such as moisture or hydrogen, and also reducing oxygen vacancies, an i-type (intrinsic) or a substantially i-type oxide semiconductor can be obtained. Such a metal oxide can be referred to as a highly purified metal oxide. For example, by using a highly purified metal oxide, the off-state current of the OS transistor that is normalized by channel width can be as low as approximately several yoctoamperes per micrometer to several zeptoamperes per micrometer.

The transistors MW1 in the plurality of memory cells 509 included in the cell array 503 are OS transistors; Si transistors formed over a silicon wafer can be used as transistors in other circuits, for example. Consequently, the cell array 503 can be stacked over the sense amplifier circuit 504. Thus, the circuit area of the frame memory 451 can be reduced, which leads to miniaturization of the controller IC 400.

The cell array 503 is stacked over the sense amplifier circuit 504. The sense amplifier circuit 504 includes a plurality of sense amplifiers SA. The sense amplifiers SA are electrically connected to adjacent wirings LBL and LBLB (a pair of local bit lines), wirings GBL and GBLB (a pair of global bit lines), and the plurality of wirings CSEL. The sense amplifiers SA have a function of amplifying the potential difference between the wirings LBL and LBLB.

In the sense amplifier circuit 504, one wiring GBL is provided for four wirings LBL, and one wiring GBLB is provided for four wirings LBLB. However, the configuration of the sense amplifier circuit 504 is not limited to the configuration example of FIG. 3A.

The main amplifier 506 is connected to the sense amplifier circuit 504 and the input/output circuit 507. The main amplifier 506 has a function of amplifying the potential difference between the wirings GBL and GBLB. The main amplifier 506 is not necessarily provided.

The input/output circuit 507 has a function of outputting a potential corresponding to write data to the wirings GBL and GBLB or the main amplifier 506, and a function of reading potentials of the wirings GBL and GBLB or an output potential of the main amplifier 506 and outputting the potential(s) to the outside as data. The sense amplifier SA from which data is read and the sense amplifier SA to which data is written can be selected in accordance with the signal of the wiring CSEL. Consequently, there is no need to provide a selector circuit such as a multiplexer in the input/output circuit 507. Thus, the input/output circuit 507 can have a simple circuit configuration and a small occupied area.

<Memory Circuit 475>

Figure 4:
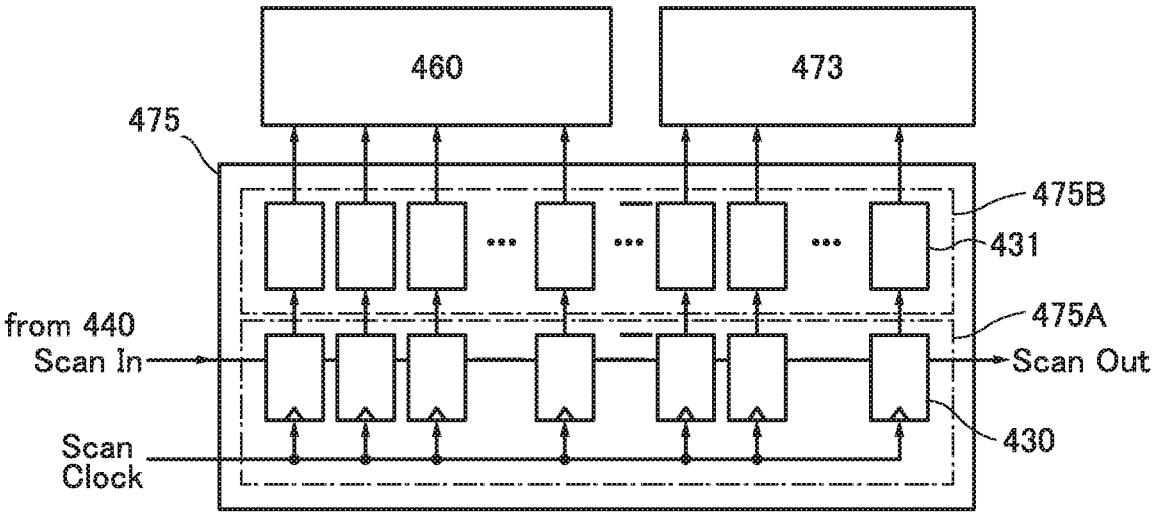
FIG. 4 is a block diagram illustrating a configuration example of a register.

FIG. 4 is a block diagram illustrating a configuration example of the memory circuit 475. The memory circuit 475 includes a scan chain register portion 475A and a register portion 475B. The scan chain register portion 475A includes a plurality of registers 430. The scan chain register is formed by the plurality of registers 430. The register portion 475B includes a plurality of registers 431.

The register 430 is a nonvolatile register which does not lose data even when power supply is stopped. Here, the register 430 is provided with a retention circuit including an OS transistor to be nonvolatile.

The other register 431 is a volatile register. There is no particular limitation on the circuit configuration of the register 431, and a latch circuit, a flip-flop circuit, or the like is used as long as data can be stored. The image processing portion 460 and the timing controller 473 access the register portion 475B and take data from the corresponding registers 431. Alternatively, the processing contents of the image processing portion 460 and the timing controller 473 are controlled in accordance with data supplied from the register portion 475B.

To update data stored in the memory circuit 475, first, data in the scan chain register portion 475A is changed. A change of data in the scan chain register portion 475A can be conducted by inputting a clock signal and data for overwriting to the scan chain register portion 475A. Data for overwriting is sequentially inputted (Scan In) in accordance with a frequency of the clock signal, whereby data for overwriting can be stored in each register 430. Note that FIG. 4 illustrates a state where data is outputted from the register 430 in the last stage (Scan Out). After the data in the registers 430 of the scan chain register portion 475A are rewritten, the data are loaded into the registers 431 of the register portion 475B at the same time.

Accordingly, the image processing portion 460, the timing controller 473, and the like can perform various kinds of processing using the data which are updated at the same time. The operation of the controller IC 400 can be stable because simultaneity can be maintained in updating data. By providing the scan chain register portion 475A and the register portion 475B, data in the scan chain register portion 475A can be updated even during the operation of the image processing portion 460 and the timing controller 473.

At the time when the power gating is executed in the controller IC 400, power supply is stopped after data is stored (saved) in the retention circuit of the register 430. After the power supply is restored, normal operation is restarted after data in the registers 430 are restored (loaded) in the register 431. Note that in the case where the data stored in the register 430 and the data stored in the register 431 do not match each other, it is preferable to save the data of the register 431 in the register 430 and then store the data again in the retention circuit of the register 430. For example, while updated data is inserting in the scan chain register portion 475A, the data do not match each other.

Figure 5:
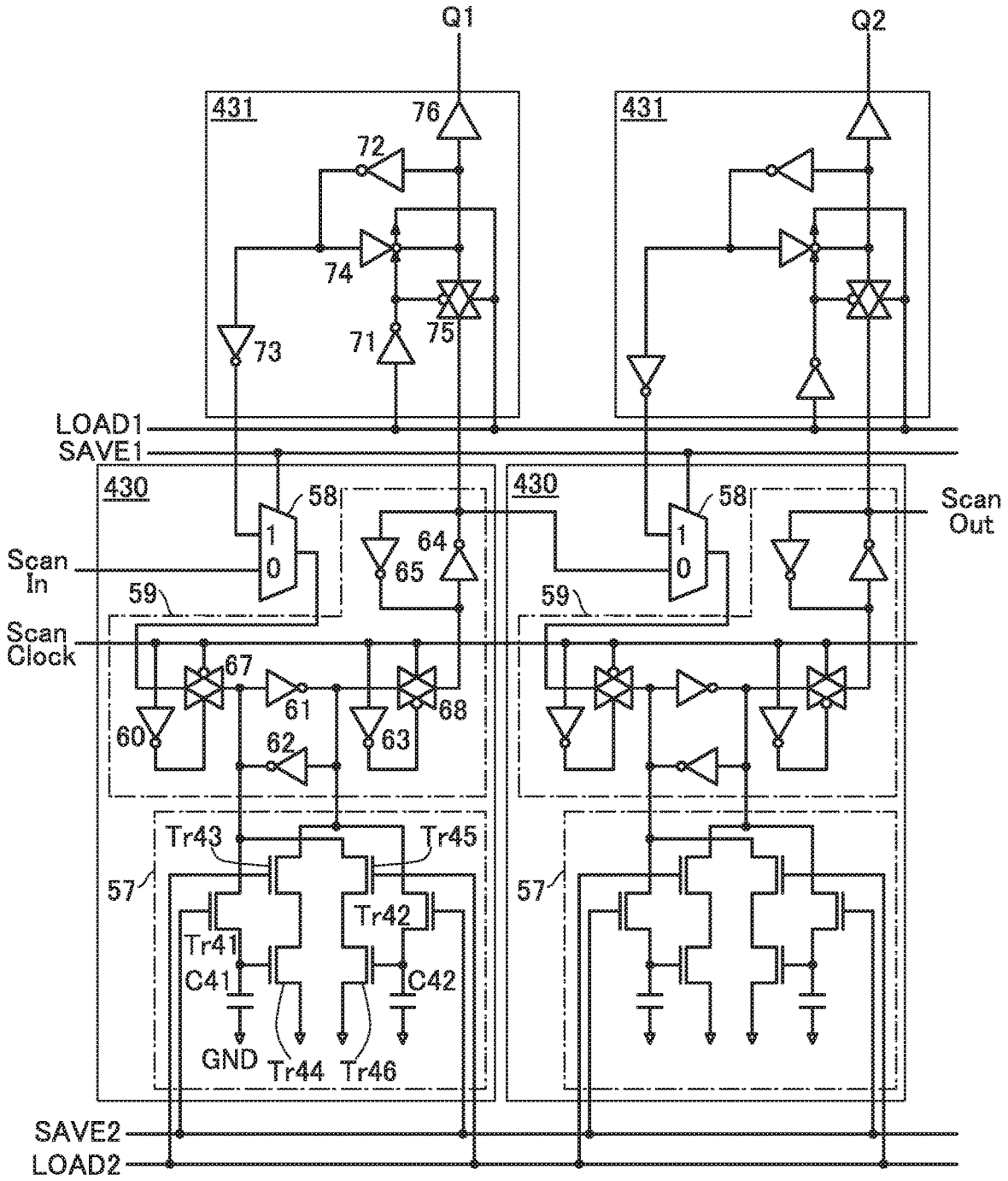
FIG. 5 is a circuit diagram illustrating a configuration example of a register.

FIG. 5 illustrates an example of a circuit configuration of the register 430 and the register 431. FIG. 5 illustrates two registers 430 of the scan chain register portion 475A and corresponding two registers 431.

The register 430 includes a retention circuit 57, a selector 58, and a flip-flop circuit 59. The selector 58 and the flip-flop circuit 59 form a scan flip-flop circuit.

A signal SAVE2 and a signal LOAD2 are inputted to the retention circuit 57. The retention circuit 57 includes transistors Tr41 to Tr46 and capacitors C41 and C42. Each of the transistors Tr41 and Tr42 is an OS transistor. The transistors Tr41 and Tr42 may each be an OS transistor having a back gate similar to the transistor MW1 of the memory cell 509 (see FIG. 3B).

A 3-transistor gain cell is formed by the transistor Tr41, the transistor Tr43, the transistor Tr44, and the capacitor C41. In a similar manner, a 3-transistor gain cell is formed by the transistor Tr42, the transistor Tr45, the transistor Tr46, and the capacitor C42. The two gain cells store complementary data retained in the flip-flop circuit 59. Since the transistor Tr41 and the transistor Tr42 are OS transistors, the retention circuit 57 can retain data for a long time even when power supply is stopped. In the register 430, the transistors other than the transistor Tr41 and the transistor Tr42 may be formed using Si transistors.

The retention circuit 57 stores complementary data retained in the flip-flop circuit 59 in response to the signal SAVE2 and loads the retained data in the flip-flop circuit 59 in response to the signal LOAD2.

An output terminal of the selector 58 is electrically connected to an input terminal of the flip-flop circuit 59, and an input terminal of the register 431 is electrically connected to a data output terminal. The flip-flop circuit 59 includes an inverter 60, an inverter 61, an inverter 62, an inverter 63, an inverter 64, an inverter 65, an analog switch 67, and an analog switch 68. The on or off state of each of the analog switch 67 and the analog switch 68 is controlled by a scan clock signal. The flip-flop circuit 59 is not limited to the circuit configuration in FIG. 5 and a variety of flip-flop circuits 59 can be employed.

An output terminal of the register 431 is electrically connected to one of two input terminals of the selector 58, and an output terminal of the flip-flop circuit 59 in the previous stage is electrically connected to the other input terminal of the selector 58. Note that data is inputted from the outside of the memory circuit 475 to the input terminal of the selector 58 in the first stage of the scan chain register portion 475A. The selector 58 outputs a signal from one of the two input terminals to the output terminal in accordance with a signal SAVE 1. Specifically, the selector 58 has a function of selecting either data transmitted from the flip-flop circuit 59 in the previous stage or data transmitted from the register 431 and inputting the selected data to the flip-flop circuit 59.

The register 431 includes an inverter 71, an inverter 72, an inverter 73, a clocked inverter 74, an analog switch 75, and a buffer 76. The register 431 loads the data of the flip-flop circuit 59 on the basis of a signal LOAD1. Then the loaded data is outputted from a terminal Q1 and a terminal Q2. The transistors of the register 431 may be formed using Si transistors.

<Other Configuration Examples of Display Device>

A configuration example of a display device different from the display device 1000 is described below.

Figure 6:
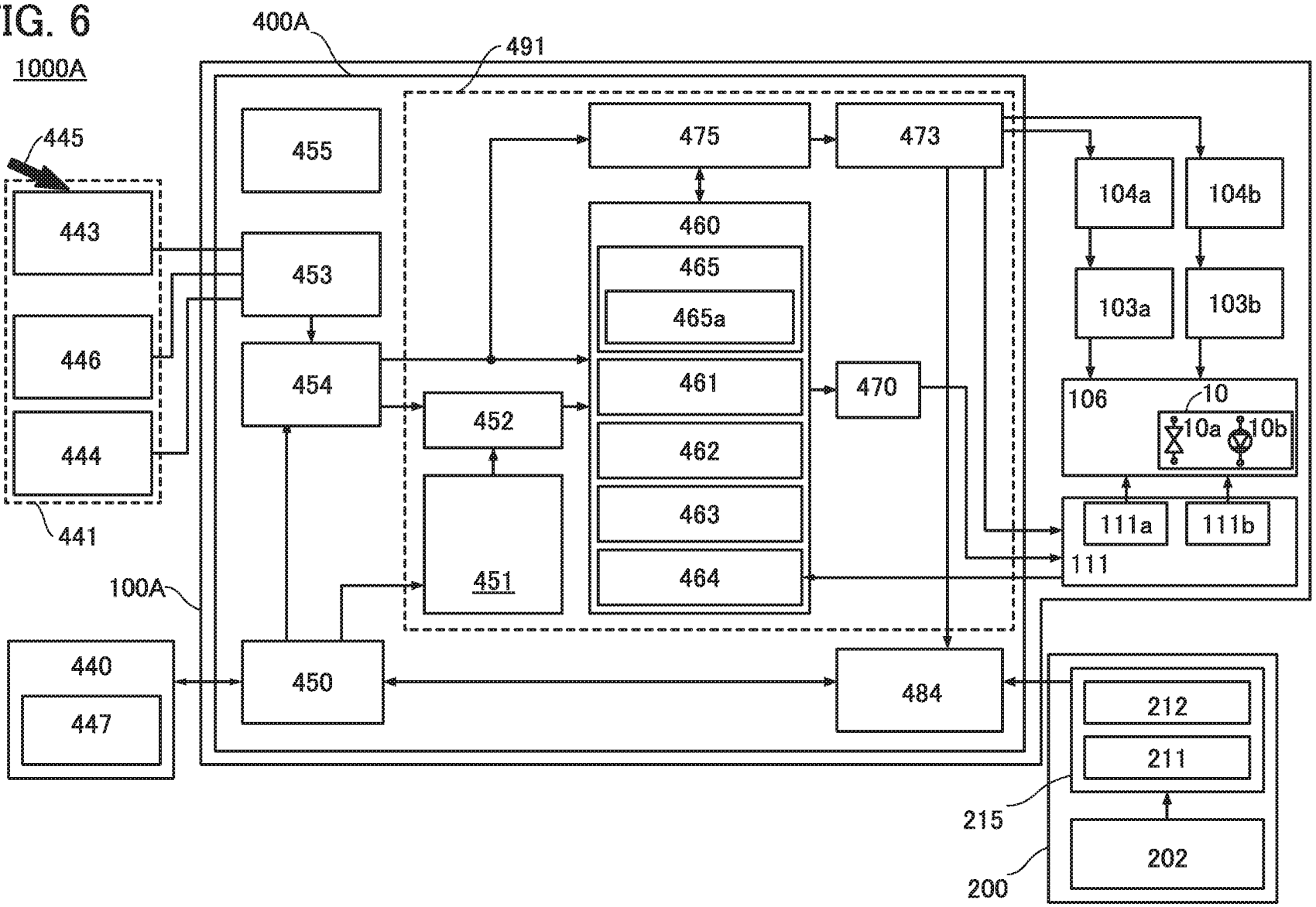
FIG. 6 is a block diagram illustrating a structure example of a display device.

FIG. 6 is a block diagram illustrating a configuration example of a display device 1000A. The display device 1000A includes a display unit 100A, the touch sensor unit 200, the sensor 441, and the host device 440. In particular, the details of the controller IC 400A included in the display unit 100A are shown. Note that the display device 1000A is a hybrid display device, and thus the display unit 100A includes a reflective element and a light-emitting element as display elements.

The display unit 100A includes a display portion 106, a gate driver 103*a*, a gate driver 103*b*, a level shifter 104*a*, a level shifter 104*b*, and the source driver IC 111, in addition to the controller IC 400A. The reflective element and the display element which are display elements are included in the display portion 106.

The controller IC 400A is a modification example of the controller IC 400. Thus, in this specification, as the description of the controller IC 400A, only portions different from those of the controller IC 400 are made, and the description of the same portion as that in the controller IC 400 is omitted.

In the display unit 100A, the controller IC 400A is preferably mounted over the base of the display unit 100A by a COG method. Alternatively, the controller IC 400A may be mounted over an FPC or the like by a COF method. Each of the level shifter 104*a*, the level shifter 104*b*, the gate driver 103*a*, the gate driver 103*b*, and the display portion 106 is preferably formed using OS transistors over the base. The details will be described in Embodiment 4.

The controller IC 400A includes a region 491, and the controller 454 has a function of performing power gating on circuits in the region 491.

As described above, the display unit 100A is a display unit included in a hybrid display device. Thus, a pixel 10 in the display portion 106 of the display unit 100A includes a reflective element 10*a* and a light-emitting element 10*b* as the display element. The reflective element 10*a* is a display element that displays an image on the display portion 106 with use of reflected light, and for example, a liquid crystal element can be used. The light-emitting element 10*b* is a display element that displays an image by self-emission on the display portion 106, and for example, an organic EL element can be used. Note that the light-emitting element 10*b* is not limited to an organic EL element. For example, a transmissive liquid crystal element provided with a backlight, an LED, or a display element utilizing quantum dot may be used. In this case, the controller IC 400A in which a liquid crystal element is used as the reflective element 10*a* and an organic EL element is used as the light-emitting element 10*b* is described.

As described above, the source driver IC 111 is preferably mounted over a base of the display unit 100A by a COG method. Alternatively, the source driver IC 111 may be mounted over a FPC or the like by a COF method. In the configuration example in FIG. 6, the source driver IC 111 includes a source driver IC 111*a* and a source driver IC 111*b*. The source driver IC 111*a* has a function of driving one of the reflective element 10*a* and the light-emitting element 10*b*, and the source driver IC 111*b* has a function of driving the other of the reflective element 10*a* and the light-emitting element 10*b*. Although the source driver of the display portion 106 is formed using two kinds of the source drivers IC 111*a* and 111*b*, the configuration of the source driver is not limited thereto. For example, the display unit 100A may include a source driver IC that enables driving a source driver for driving the reflective element 10*a* and a source driver for driving the light-emitting element 10*b*.

As described in Embodiment 1, the gate drivers 103*a* and 103*b* are formed over the base. The gate driver 103*a* has a function of driving a scanning line for one of the reflective element 10*a* and the light-emitting element 10*b*, and the gate driver 103*b* has a function of driving a scanning line for the other of the reflective element 10*a* and the light-emitting element 10*b*. Although two kinds of gate drivers, the gate drivers 103*a* and 103*b*, of the display portion 106 are used, the structure of the gate driver is not limited thereto. For example, the display unit 100A may include a gate driver that can drive both the reflective element 10*a* and the light-emitting element 10*b*.

The display unit 100A includes an organic EL element as the light-emitting element 10*b*, and thus the EL correction circuit 464 can be provided in the image processing portion 460 of the controller IC 400A. The EL correction circuit 464 is provided in the case where a current detection circuit for detecting the current flowing in the light-emitting element 10*b* is provided for the source driver IC 111 (the source driver IC 111*a* or the source driver IC 111*b*) for driving the light-emitting element 10*b*. The EL correction circuit 464 has a function of adjusting luminance of the light-emitting element 10*b* on the basis of a signal transmitted from the current detection circuit.

In the controller IC 400A, the sensor controller 453 can be electrically connected to the optical sensor 443 as in the controller IC 400. The optical sensor 443 senses external light 445 and generates a sensor signal. The sensor controller 453 generates a control signal on the basis of the sensor signal. The control signal generated in the sensor controller 453 is outputted to the controller 454, for example.

In the case where the reflective element 10*a* and the light-emitting element 10*b* display the same image data, the image processing portion 460 has a function of separately generating image data that the reflective element 10*a* displays and image data that the light-emitting element 10*b* displays. In that case, reflection intensity of the reflective element 10*a* and emission intensity of the light-emitting element 10*b* can be adjusted (dimming treatment) in response to brightness of the external light 445 measured using the optical sensor 443 and the sensor controller 453.

In the case where the display unit 100A is used outdoors in the daytime on a sunny day, it is not necessary to make the light-emitting element 10*b* emit light if sufficient luminance can be obtained only with the reflective element 10*a*. This is because even when the light-emitting element 10*b* is used to perform display, favorable display cannot be obtained owing to the intensity of external light that exceeds the intensity of light emitted from the light-emitting element 10*b*. In contrast, in the case where the display unit 100A is used at night or in a dark place, display is performed by making the light-emitting element 10*b* emit light.

In response to the brightness of external light, the image processing portion 460 can generate image data that only the reflective element 10*a* displays, image data that only the light-emitting element 10*b* displays, or image data that the reflective element 10*a* and the light-emitting element 10*b* display in combination. The display unit 100A can perform favorable display even in an environment with bright external light or an environment with weak external light. Furthermore, power consumption of the display unit 100A can be reduced by making the light-emitting element 10*b* emit no light or reducing the luminance of the light-emitting element 10*b* in the environment with bright external light.

Color tones can be corrected by combining the display by the light-emitting element 10*b* with the display by the reflective element 10*a*. A function of measuring the color tones of the external light 445 may be added to the optical sensor 443 and the sensor controller 453 to perform such tone correction. For example, in the case where the display unit 100 is used in a reddish environment at evening, a blue (B) component or a green (G) component is not sufficient or both of the components are not sufficient only with the display by the reflective element 10*a*; thus, the color tones can be corrected (calibration processing) by making the light-emitting element 10*b* emit light.

The reflective element 10*a* and the light-emitting element 10*b* can display different image data. In general, operation speed of liquid crystal, electronic paper, or the like that can be used as a reflective element is low in many cases (it takes time to display a picture). Thus, a still image to be a background can be displayed on the reflective element 10*a* and a moving mouse pointer or the like can be displayed on the light-emitting element 10*b*. By performing the above IDS driving on a still image and making the light-emitting element 10*b* emit light to display a moving image, the display unit 100A can achieve display of a smooth moving image and reduction of power consumption at the same time. In that case, the frame memory 451 may be provided with regions for storing image data displayed on the reflective element 10*a* and image data displayed on the light-emitting element 10*b*.

The controller IC 400A may be provided with one or both of the TS driver IC 211 and the sense circuit 212. The same applies to the controller IC 400.

OPERATION EXAMPLE

Operation examples of the controller IC 400A and the memory circuit 475 of the display unit 100A before shipment, at boot-up of a display device including the display unit 100A, and at normal operation will be described separately.

<<Before Shipment>>

Parameters relating to the specifications and the like of the display unit 100A are stored in the memory circuit 475 before shipment. These parameters include, for example, the number of pixels, the number of touch sensors, parameters used to generate the variety of timing signals in the timing controller 473, and correction data of the EL correction circuit 464 in the case where the source driver IC (the source driver IC 111*a* or the source driver IC 111*b*) is provided with the current detection circuit that detects current flowing through the light-emitting element 10*b*. These parameters may be stored by providing a dedicated ROM other than the memory circuit 475.

<<At Boot-Up>>

At boot-up of a display device including the display unit 100A, the parameters set by a user or the like which are transmitted from the host device 440 are stored in the memory circuit 475. These parameters include, for example, luminance, color tones, sensitivity of a touch sensor, setting of energy saving (time taken to make display dark or turn off display), and a curve or a table for gamma correction. Note that in storing the parameters in the memory circuit 475, a scan clock signal and data corresponding to the parameters in synchronization with the scan clock signal are transmitted from the controller 454 to the memory circuit 475.

<<Normal Operation>>

Normal operation can be classified into a state of displaying a moving image or the like, a state capable of performing IDS driving while a still image is being displayed, a state of displaying no image, and the like. The image processing portion 460, the timing controller 473, and the like are operating in the state of displaying a moving image or the like; however, the image processing portion 460 and the like are not influenced because only the data of the memory circuit 475 in the scan chain register portion 475A are changed. After the data of the scan chain register portion 475A are changed, the data of the scan chain register portion 475A are loaded in the register portion 475B at the same time, so that change of the data of the memory circuit 475 is completed. The operation of the image processing portion 460 and the like is switched to the operation corresponding to the data.

In the state capable of performing IDS driving while a still image is being displayed, the memory circuit 475 can be power gated in a manner similar to that of the other circuits in the region 490. In that case, the complementary data retained in the flip-flop circuit 59 is stored in the retention circuit 57 in response to the signal SAVE2 before the power gating in the register 430 included in the scan chain register portion 475A.

To restore the data retained in the retention circuit 57 from power gating, the data is loaded in the flip-flop circuit 59 in response to the signal LOAD2 and the data in the flip-flop circuit 59 is loaded in the register 431 in response to the signal LOAD1. In this manner, the data of the memory circuit 475 becomes effective in the same state as before the power gating. Note that even when the memory circuit 475 is in a state of power gating, the parameter of the memory circuit 475 can be changed by canceling the power gating in the case where change of the parameter is requested by the host device 440.

In the state of displaying no image, for example, the circuits (including the memory circuit 475) in the region 490 can be power gated. In that case, the operation of the host device 440 might also be stopped; however, when the data in the frame memory 451 and the memory circuit 475 are restored from the power gating, the frame memory 451 and the memory circuit 475 can perform display (a still image) before power gating without waiting the restore of the host device 440 because they are nonvolatile.

For example, a configuration in which an open/close sensor 444 is electrically connected to the sensor controller 453 in the display unit 100A is considered. In particular, in the case where the display unit 100A with the above configuration is employed for a display portion of a foldable mobile phone, when the mobile phone is folded and the display surface of the display unit 100 is sensed to be unused by a signal from the open/close sensor 444, the sensor controller 453, the touch sensor controller 484, and the like can be power gated in addition to the circuits in the region 490.

When the mobile phone is folded, the operation of the host device 440 might be stopped depending on the standard of the host device 440. Even when the mobile phone is unfolded while the operation of the host device 440 is stopped, the image data in the frame memory 451 can be displayed before image data, a variety of control signals, and the like are transmitted from the host device 440 because the frame memory 451 and the memory circuit 475 are nonvolatile.

In such a manner, the memory circuit 475 includes the scan chain register portion 475A and the register portion 475B and data of the scan chain register portion 475A are changed, so that the data can be changed smoothly without influencing the image processing portion 460, the timing controller 473, and the like. Each register 430 in the scan chain register portion 475A includes the retention circuit 57 and can perform transfer to and restore from a power gated state smoothly.

Note that a configuration the display device of one embodiment of the present invention is not limited to the display device 1000 in FIG. 1 or the display device 1000A in FIG. 6. Depending on the circumstances or conditions or as needed, components of the display device 1000 in FIG. 1 or the display device 1000A in FIG. 6 can be selected as appropriate. For example, in the case where the display device 1000 in FIG. 1 or the display device 1000A in FIG. 6 is used as a display device in an electronic device that is not a foldable device, the display device 1000 in FIG. 1 or the display device 1000A in FIG. 6 is not necessarily provided with the open/close sensor 444.

This embodiment can be combined with any of the other embodiments in this specification as appropriate.

Embodiment 2

In this embodiment, a method for correcting an image using the host device 440, the sensor 441, and the image processing portion 460 in the controller IC 400 or 400A described in Embodiment 1 will be described. Note that for the method for correcting an image, a neural network is used.

A neural network is an information processing system modeled on a biological neural network. A computer having a higher performance than a conventional Neumann computer is expected to be provided by utilizing the neural network, and in these years, a variety of researches on a neural network formed over an electronic circuit have been carried out.

In the neural network, units which resemble neurons are connected to each other through units which resemble synapses. By changing the connection strength, a variety of input patterns are learned, and pattern recognition, associative storage, or the like can be performed at high speed.

For example, a product-sum operation circuit described in this embodiment is used as a feature extraction filter for convolution or a fully connected arithmetic circuit, whereby the feature amount can be extracted using a convolutional neural network (CNN). Note that weight coefficients of the feature extraction filter can be set using random numbers.

<Hierarchical Neural Network>

A hierarchical neural network will be described as a kind of neural networks that can be used for the display device of one embodiment of the present invention.

Figure 7:
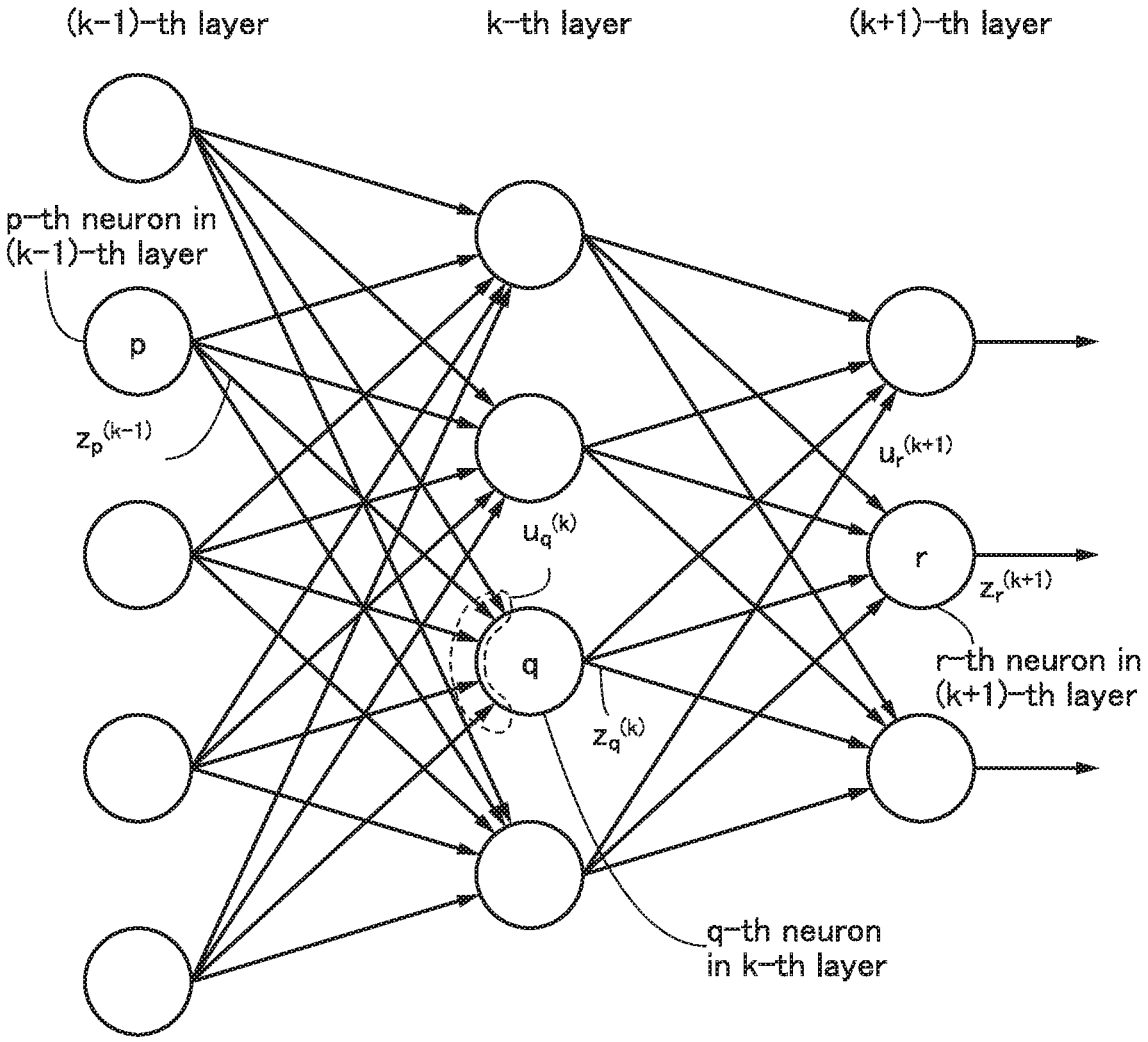
FIG. 7 illustrates an example of a hierarchical neural network.

FIG. 7 is a diagram showing an example of a hierarchical neural network. A (k−1)-th layer (k is an integer greater than or equal to 2) includes P neurons (P is an integer greater than or equal to 1). A k-th layer includes Q neurons (Q is an integer greater than or equal to 1). A (k+1)-th layer includes R neurons (R is an integer greater than or equal to 1).

The product of an output signal $z_p^{(k-1)}$ of the p-th neuron (p is an integer greater than or equal to 1 and less than or equal to P) in the (k−1)-th layer and a weight coefficient $w_{qp}^{(k)}$ is input to the q-th neuron (q is an integer greater than or equal to 1 and less than or equal to Q) in the k-th layer. The product of an output signal $z_q^{(k)}$ of the q-th neuron in the k-th layer and a weight coefficient $w_{rq}^{(k+1)}$ is input to the r-th neuron (r is an integer greater than or equal to 1 and less than or equal to R) in the (k+1)-th layer. The output signal of the r-th neuron in the (k+1)-th layer is $z_r^{(k+1)}$.

In this case, the summation $u_q^{(k)}$ of signals input to the q-th neuron in the k-th layer is expressed by the following formula.

[Formula 1]

$$u_q^{(k)}=\Sigma w_{qp}^{(k)} z_p^{(k-1)} \tag{D1}$$

The output signal $z_q^{(k)}$ from the q-th neuron in the k-th layer is expressed by the following formula.

[Formula 2]

$$z_q^{(k)}=f(u_q^{(k)}) \tag{D2}$$

Figure 10A:
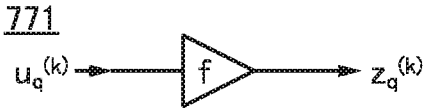
FIGS. 10A to 10D each illustrate a configuration example of a circuit.

A function $f(u_q^{(k)})$ is an activation function. A step function, a linear ramp function, a sigmoid function, or the like can be used as the function $f(u_q^{(k)})$. Product-sum operation of Formula (D1) can be performed with a product-sum operation circuit (semiconductor device 700) to be described later. Formula (D2) can be calculated with a circuit 771 illustrated in FIG. 10A, for example.

Note that the activation function may be the same among all neurons or may be different among neurons. Furthermore, the activation function in one layer may be the same as or different from that in another layer.

Figure 8:
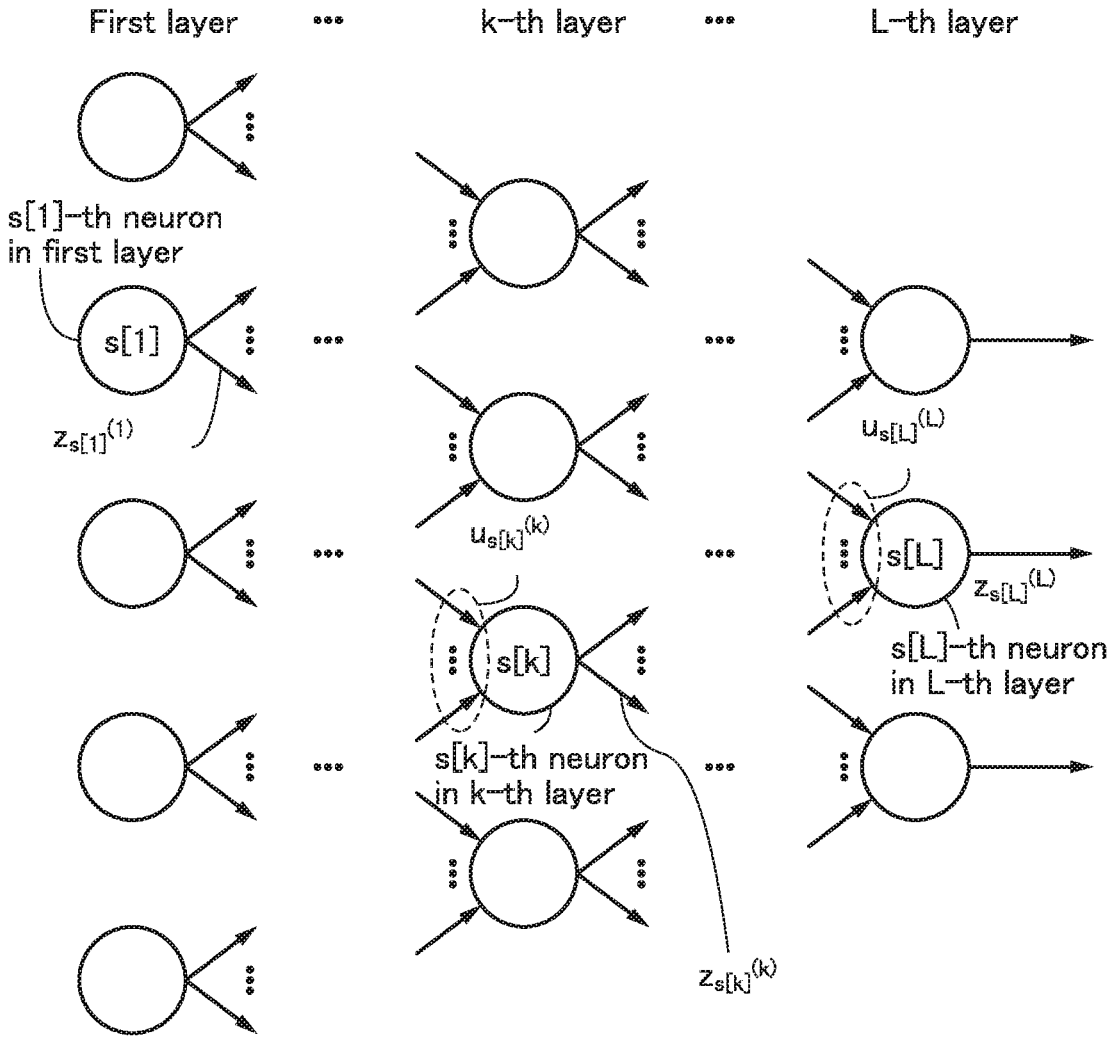
FIG. 8 illustrates an example of a hierarchical neural network.

Here, a hierarchical neural network including L layers (here, L is an integer greater than or equal to three) in total shown in FIG. 8 is described (that is, here, k is an integer greater than or equal to two and less than or equal to (L−1)). A first layer is an input layer of the hierarchical neural network, an L-th layer is an output layer of the hierarchical neural network, and second to (L−1)-th layers are hidden layers of the hierarchical neural network.

The first layer (input layer) includes P neurons, the k-th layer (hidden layer) includes Q[k] neurons (here, Q[k] is an integer greater than or equal to 1), and the L-th layer (output layer) includes R neurons.

An output signal of the s[1]-th neuron in the first layer (here, s[1] is an integer greater than or equal to 1 and less than or equal to P) is $z_{s[1]}^{(1)}$, an output signal of the s[k]-th neuron in the k-th layer (here, s[k] is an integer greater than or equal to 1 and less than or equal to Q[k]) is $z_{s[k]}^{(k)}$, and an output signal of the s[L]-th neuron in the L-th layer (here, s[L] is an integer greater than or equal to 1 and less than or equal to R) is $z_{s[L]}^{(L)}$.

The product $u_{s[k]}^{(k)}$ of an output signal $z_{s[k-1]}^{(k-1)}$ of the s[k−1]-th neuron in the (k−1)-th layer and a weight coefficient $w_{s[k]s[k-1]}^{(k)}$ (here, s[k−1] is an integer greater than or equal to 1 and less than or equal to Q[k−1]) is input to the s[k]-th neuron in the k-th layer. The product $u_{s[L]}^{(L)}$ of an output signal $z_{s[L-1]}^{(L-1)}$ of the s[L−1]-th neuron in the (L−1)-th layer and a weight coefficient $w_{s[L]s[L-1]}^{(L)}$ (here, s[L−1] is an integer greater than or equal to 1 and less than or equal to Q[L−1]) is input to the s[L]-th neuron in the L-th layer.

Next, supervised learning will be described. Supervised learning refers to operation of updating all weight coefficients of a hierarchical neural network on the basis of an output result and a desired result (also referred to as teacher data or a teacher signal in some cases) when the output result and the desired result differ from each other, in functions of the hierarchical neural network.

Figure 9:
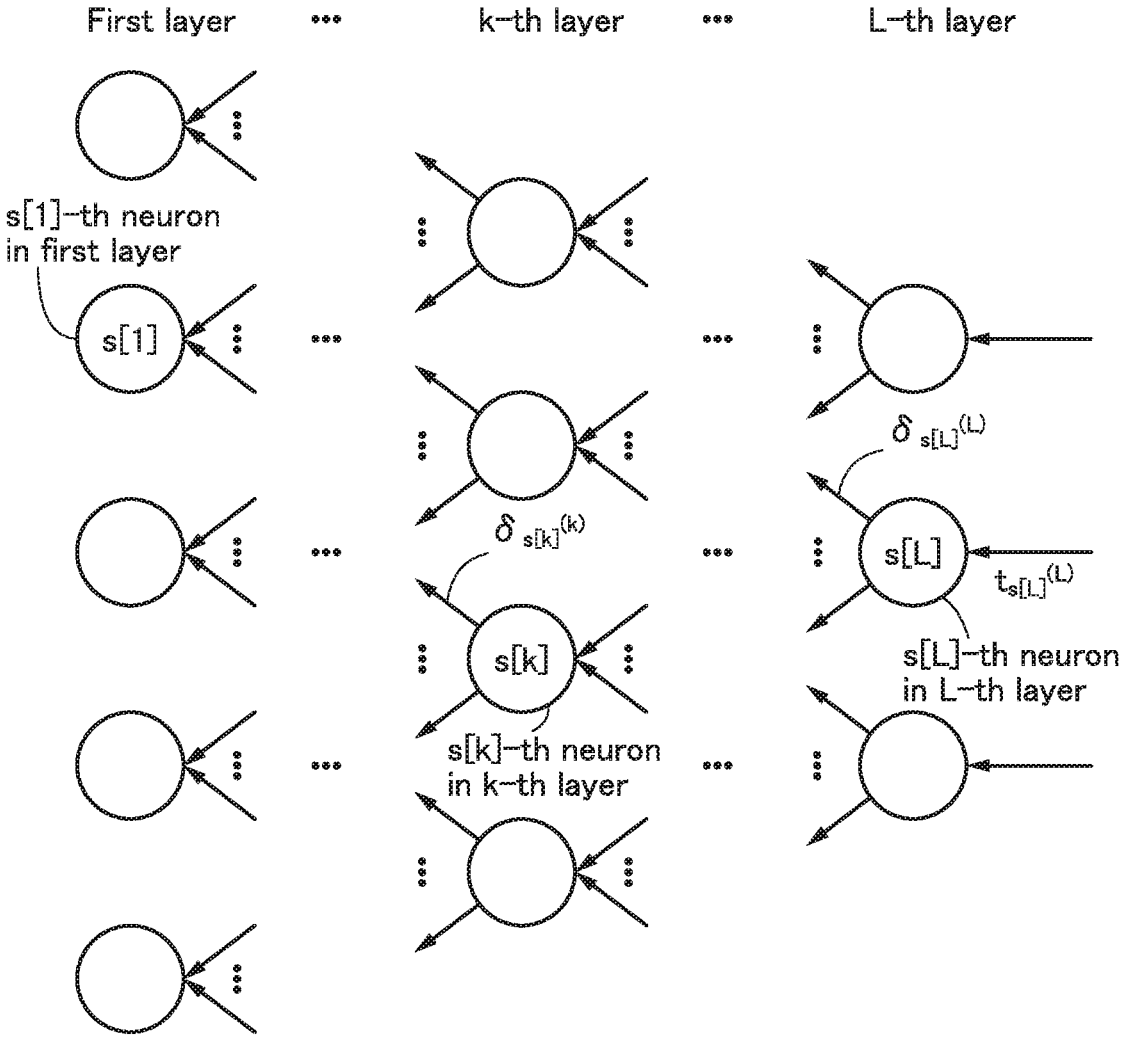
FIG. 9 illustrates an example of a hierarchical neural network.

A learning method using backpropagation will be described as a specific example of supervised learning. FIG. 9 is a diagram illustrating a learning method using backpropagation. Backpropagation is a method for changing a weight coefficient so that an error between an output of a hierarchical neural network and teacher data becomes small.

For example, assume that input data is input to the s[1]-th neuron in the first layer and output data $z_{s[L]}^{(L)}$ is output from the s[L]-th neuron in the L-th layer. Here, error energy E can be expressed using output data $z_{s[L]}^{(L)}$ and a teacher signal $t_{s[L]}^{(L)}$, when a teacher signal for the output data $z_{s[L]}^{(L)}$ is $t_{s[L]}^{(L)}$.

The update amount of a weight coefficient $w_{s[k]s[k-1]}^{(k)}$ of the s[k]-th neuron in the k-th layer with respect to the error energy E is set to $\partial E/\partial w_{s[k]s[k-1]}^{(k)}$, whereby the weight coefficient can be updated. Here, when an error $\delta_{s[k]}^{(k)}$ of the output value $z_{s[k]}^{(k)}$ of the s[k]-th neuron in the k-th layer is defined as $\partial E/\partial u_{s[k]s[k]}^{(k)}$, $\delta_{s[k]}^{(k)}$ and $\partial E/\partial w_{s[k]s[k-1]}^{(k)}$ can be expressed by the following respective formulae.

[Formula 3]

$$\delta_{s[k]}^{(k)} = \sum_{s[k+1]} \delta_{s[k+1]}^{(k+1)} \cdot w_{s[k+1]s[k]}^{(k+1)} \cdot f'\left(u_{s[k]}^{(k)}\right) \tag{D3}$$

[Formula 4]

$$\frac{\partial E}{\partial w_{s[k]s[k-1]}^{(k)}} = \delta_{s[k]}^{(k)} \cdot z_{s[k-1]}^{(k-1)} \tag{D4}$$

Figure 10B:
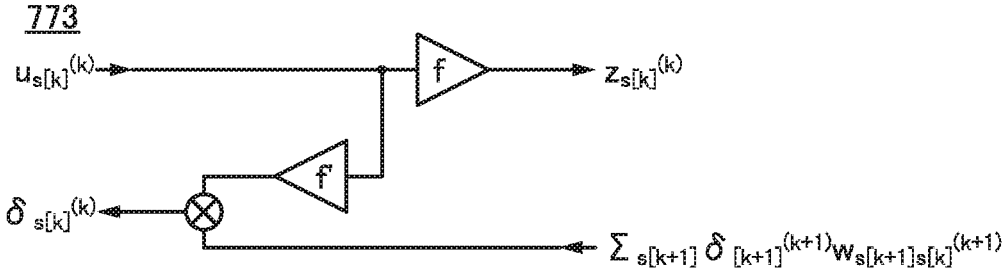
Figure 10C:
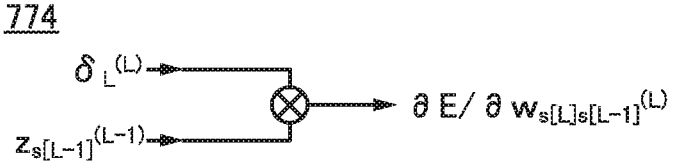

A function $f'(u_{s[k]}^{(k)})$ is the derivative of an activation function. Formula (D3) can be calculated with a circuit 773 illustrated in FIG. 10B, for example. Formula (D4) can be calculated with a circuit 774 illustrated in FIG. 10C, for example. The derived function of the output function can be obtained by connecting an arithmetic circuit, which can execute a desired derived function, to an output terminal of an operational amplifier.

For example, $\Sigma\delta_{s[k+1]}^{(k+1)} \cdot w_{s[k+1] \cdot s[k]}^{(k+1)}$ in Formula (D3) can be calculated with a product-sum operation circuit (semiconductor device 700) to be described later.

Here, when the (k+1)-th layer is an output layer, or the L-th layer, $\delta_{s[L]}^{(L)}$ and $\partial E/\partial w_{s[L]s[L-1]}^{(L)}$ can be expressed by the following respective formulae.

[Formula 5]

$$\delta_{s[L]}^{(L)} = (z_{s[L]}^{(L)} - t_{s[L]}) \cdot f'(u_{s[L]}^{(L)}) \tag{D5}$$

[Formula 6]

$$\frac{\partial E}{\partial w_{s[L]s[L-1]}^{(L)}} = \delta_{s[L]}^{(L)} \cdot z_{s[L-1]}^{(L-1)} \tag{D6}$$

Figure 10D:
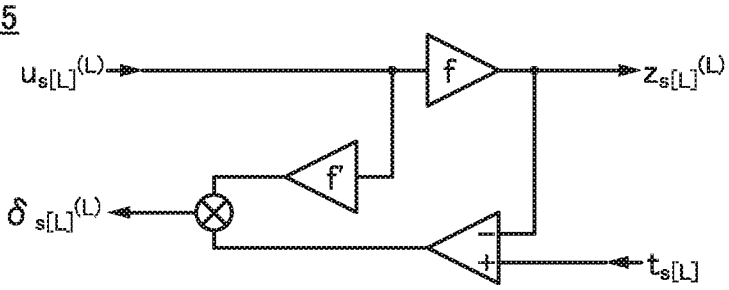

Furthermore, Formula (D5) can be calculated with a circuit 775 illustrated in FIG. 10D. Formula (D6) can be calculated with the circuit 774 illustrated in FIG. 10C.

That is to say, the errors $\delta_{s[k]}^{(k)}$ and $\delta_{s[L]}^{(L)}$ of all neuron circuits can be calculated by Formulae (D1) to (D6). Note that the update amounts of weight coefficients are set on the basis of the errors $\delta_{s[k]}^{(k)}$ and $\delta_{s[L]}^{(L)}$, predetermined parameters, and the like.

As described above, by using the circuits illustrated in FIGS. 10A to 10D and the product-sum operation circuit (semiconductor device 700), calculation of the hierarchical neural network using supervised learning can be performed.

Example 1 of Circuit for Constructing Hierarchical Neural Network

Next, a configuration example of a product-sum operation circuit for constructing the above-described hierarchical neural network will be described.

Figure 11:
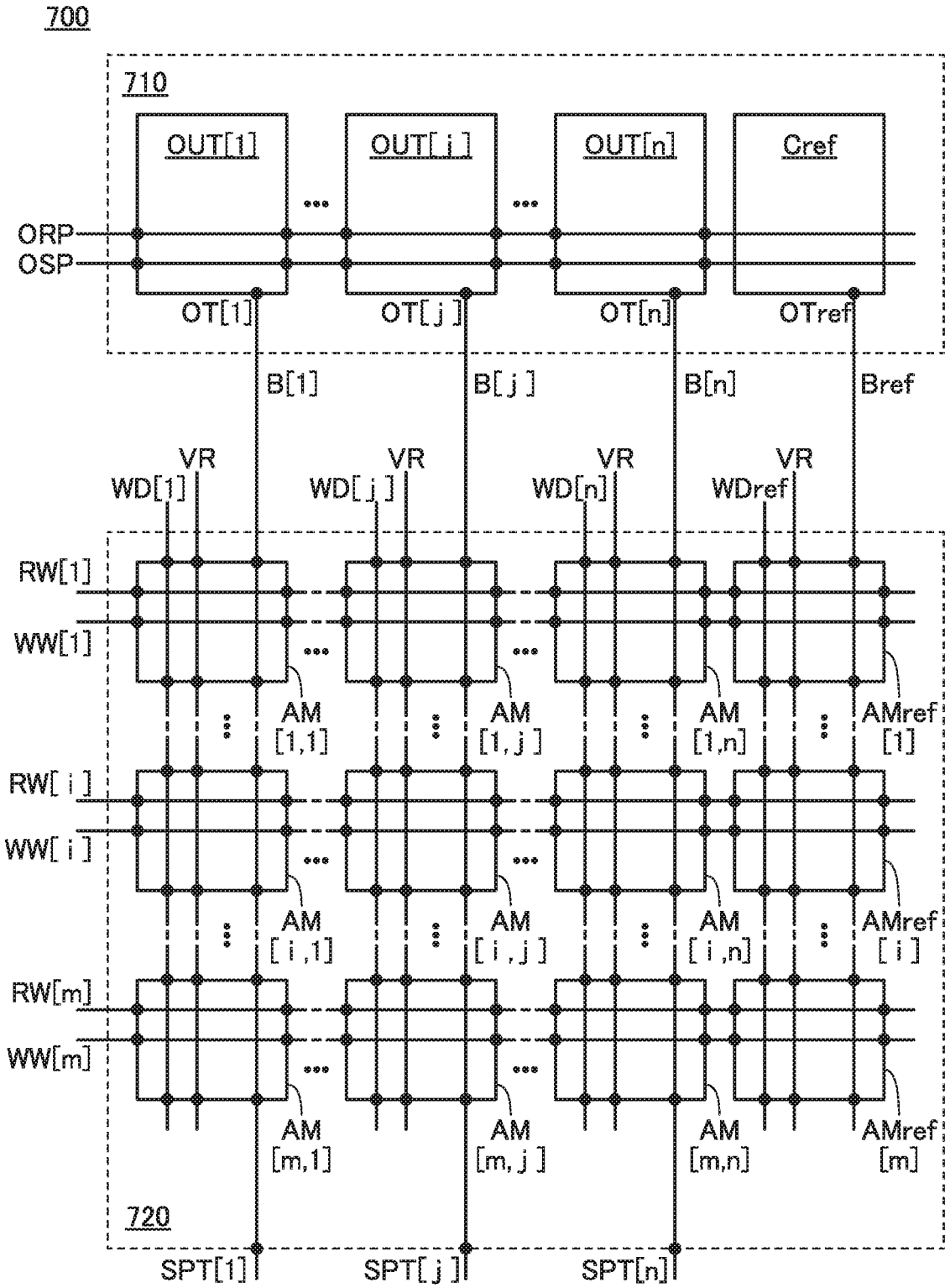
FIG. 11 illustrates an example of a semiconductor device.

FIG. 11 is a block diagram of the semiconductor device 700 that serves as a product-sum operation circuit. The semiconductor device 700 includes an offset circuit 710 and a memory cell array 720.

The offset circuit 710 includes column output circuits OUT[1] to OUT[n] (here, n is an integer greater than or equal to 1) and a reference column output circuit Cref.

In the memory cell array 720, m (here, m is an integer greater than or equal to 1) memory cells AM are arranged in the column direction and n memory cells AM are arranged in the row direction; that is, m×n memory cells AM are provided. The total number of the memory cells AM and the memory cells AMref arranged in a matrix in the memory cell array 720 is m×(n+1). In particular, in the memory cell array 720 in FIG. 11, the memory cell AM positioned in an i-th row and a j-th column is denoted by a memory cell AM[i,j] (here, i is an integer greater than or equal to 1 and less than or equal to m, and j is an integer greater than or equal to 1 and less than or equal to n), and the memory cell AMref positioned in the i-th row is denoted by a memory cell AMref[i].

The memory cell AM retains a potential corresponding to the first analog data, and the memory cell AMref retains a predetermined potential. Note that the predetermined potential is a potential necessary for the product-sum operation, and in this specification, data corresponding to this predetermined potential is referred to as reference analog data in some cases.

The memory cell array 720 includes output terminals SPT[1] to SPT[n].

The column output circuit OUT[j] includes an output terminal OT[j], and the reference column output circuit Cref includes an output terminal OTref.

A wiring ORP is electrically connected to the column output circuits OUT[1] to OUT[n], and a wiring OSP is electrically connected to the column output circuits OUT[1] to OUT[n]. The wiring ORP and the wiring OSP are wirings for supplying a control signal to the offset circuit 710.

An output terminal SPT[j] of the memory cell array 720 is electrically connected to a wiring B[1].

The output terminal OT[j] of the column output circuit OUT[j] is electrically connected to the wiring B[1].

The output terminal OTref of the reference column output circuit Cref is electrically connected to a wiring Bref.

The memory cell AM[i,j] is electrically connected to a wiring RW[i], a wiring WW[i], a wiring WD[j], the wiring B[j], and a wiring VR.

The memory cell AMref[i] is electrically connected to the wiring RW[i], the wiring WW[i], a wiring WDref, the wiring Bref, and the wiring VR.

The wiring WW[i] functions as a wiring for supplying a selection signal to the memory cells AM[i,1] to AM[i,n] and the memory cell AMref[i]. The wiring RW[i] functions as a wiring for supplying either a reference potential or a potential corresponding to the second analog data to the memory cells AM[i,1] to AM[i,n] and the memory cell AMref[i]. The wiring WD[j] functions as a wiring for supplying writing data to the memory cells AM in the j-th column. The wiring VR functions as a wiring for supplying a predetermined potential to the memory cells AM or the memory cells AMref when data is read out from the memory cells AM or the memory cells AMref.

The wiring B[j] functions as a wiring for supplying a signal from the column output circuit OUT[j] to the memory cells AM in the j-th column in the memory cell array 720.

The wiring Bref functions as a wiring for supplying a signal from the reference column output circuit Cref to the memory cells AMref[1] to AMref[m].

In the semiconductor device 700 in FIG. 11, only the following components are shown: the offset circuit 710; the memory cell array 720; the column output circuit OUT[1]; the column output circuit OUT[j]; the column output circuit OUT[n]; the reference column output circuit Cref; an output terminal OT[1]; the output terminal OT[j]; an output terminal OT[n]; the output terminal OTref; the output terminal SPT[1]; the output terminal SPT[j]; the output terminal SPT[n]; a memory cell AM[1,1]; the memory cell AWOL a memory cell AM[m,1]; a memory cell AM[1,j]; the memory cell AM[i,j]; a memory cell AM[m,j]; a memory cell AM[1, n]; the memory cell AM[i,n]; a memory cell AM[m,n]; the memory cell AMref[1]; the memory cell AMref[i]; the memory cell AMref[m]; the wiring OSP; the wiring ORP; a wiring B[1]; the wiring B[j]; a wiring B[n]; the wiring Bref; a wiring WD[1]; the wiring WD[j]; a wiring WD[n]; the wiring WDref; the wiring VR; a wiring RW[1]; the wiring RW[i]; a wiring RW[m]; a wiring WW[1]; the wiring WW[i]; and a wiring WW[m]. Other circuits, wirings, elements, and reference numerals thereof are not shown.

The configuration of the semiconductor device 700 in FIG. 11 is just an example. Depending on circumstances or conditions or as needed, the configuration of the semiconductor device 700 can be changed. For example, depending on a circuit configuration of the semiconductor device 700, one wiring may be provided to serve as the wiring WD[j] and the wiring VR. Alternatively, depending on a circuit configuration of the semiconductor device 700, one wiring may be provided to serve as the wiring ORP and the wiring OSP.

<<Offset Circuit 710>>

Figure 12:
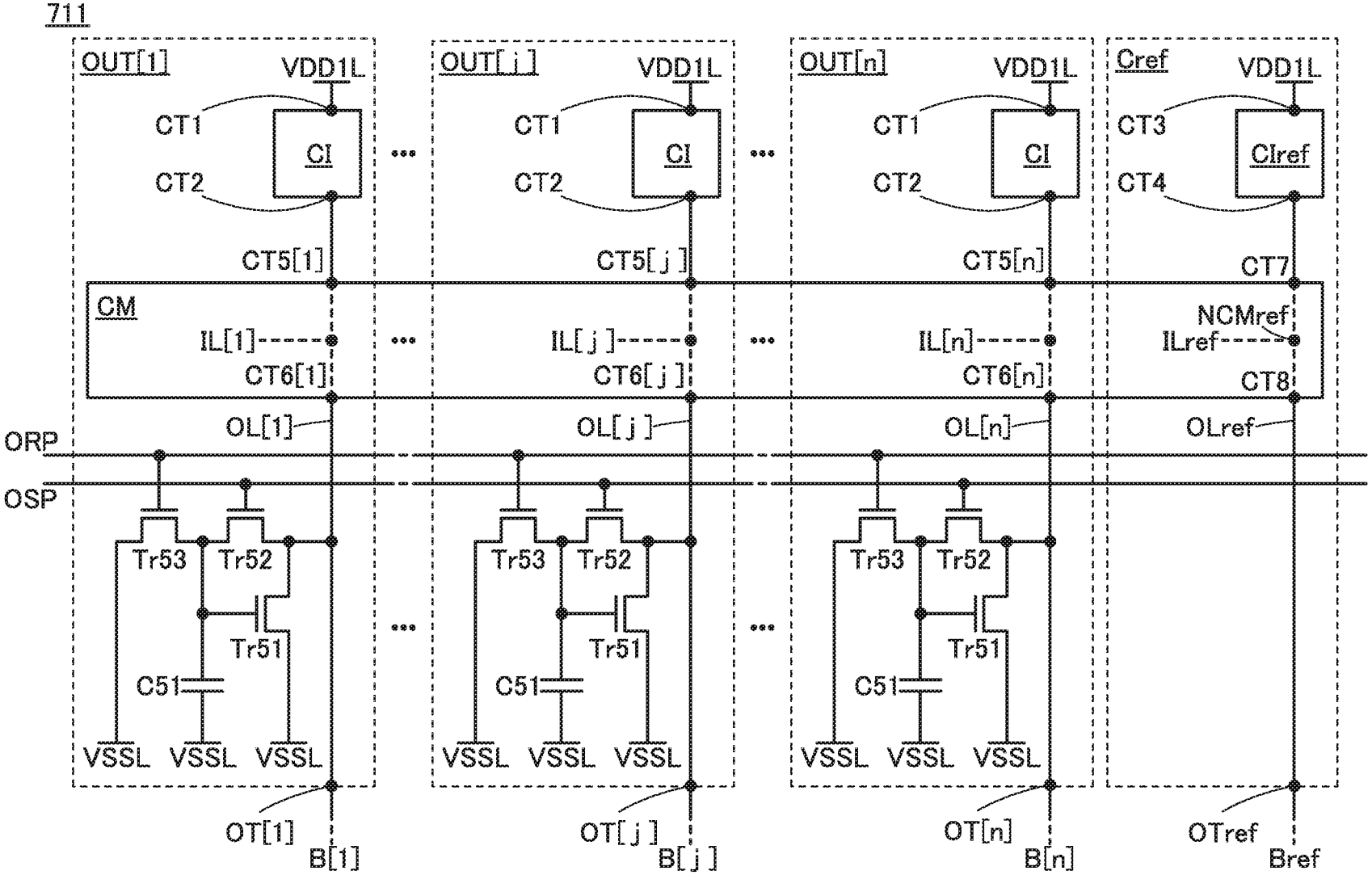
FIG. 12 is a circuit diagram illustrating an example of an offset circuit in the semiconductor device in FIG. 11.

Next, an example of a circuit configuration that can be applied to the offset circuit 710 will be described. FIG. 12 shows an offset circuit 711 as an example of the offset circuit 710.

The offset circuit 711 is electrically connected to a wiring VDD1L and the wiring VSSL for supplying a power supply voltage. Specifically, each of the column output circuits OUT[1] to OUT[n] are electrically connected to the wiring VDD1L and the wiring VSSL, and the reference column output circuit Cref is electrically connected to the wiring VDD1L. Note that a current mirror circuit CM described later is electrically connected to the wiring VSSL in some cases. The wiring VDD1L supplies the high-level potential. The wiring VSSL supplies the low-level potential.

A circuit configuration of an inside of the column output circuit OUT[j] is described below. The column output circuit OUT[j] includes a constant current circuit CI, transistors Tr51 to Tr53, a capacitor C51, and a wiring OL[j]. The current mirror circuit CM is shared between the column output circuits OUT[1] to OUT[n] and the reference column output circuit Cref.

The constant current circuit CI includes a terminal CT1 and a terminal CT2. The terminal CT1 functions as an input terminal of the constant current circuit CI, and the terminal CT2 functions as an output terminal of the constant current circuit CI. The current mirror circuit CM shared between the column output circuits OUT[1] to OUT[n] and the reference column output circuit Cref includes terminals CT5[1] to CT5[*n*], terminals CT6[1] to CT6[*n*], a terminal CT7, and a terminal CTB.

The constant current circuit CI has a function of keeping the amount of current flowing from the terminal CT1 to the terminal CT2 constant.

In the column output circuit OUT[j], a first terminal of the transistor Tr51 is electrically connected to the wiring OL[j], a second terminal of the transistor Tr51 is electrically connected to the wiring VSSL, and a gate of the transistor Tr51 is electrically connected to a first terminal of the capacitor C51. A first terminal of a transistor Tr52 is electrically connected to the wiring OL[j], a second terminal of the transistor Tr52 is electrically connected to the first terminal of the capacitor C51, and a gate of the transistor Tr52 is electrically connected to the wiring OSP. A first terminal of the transistor Tr53 is electrically connected to the first terminal of the capacitor C51, a second terminal of the transistor Tr53 is electrically connected to the wiring VSSL, and a gate of the transistor Tr53 is electrically connected to the wiring ORP. A first terminal of the capacitor C51 is electrically connected to a wiring VSSL. A second terminal of the capacitor C51 is electrically connected to the wiring VSSL.

Note that each of the transistors Tr51 to Tr53 is preferably an OS transistor. In addition, each of channel formation regions in the transistors Tr51 to Tr53 preferably includes CAC-OS described in Embodiment 9.

The OS transistor has a characteristic of extremely low off-state current. Thus, when the OS transistor is in an off state, the amount of leakage current flowing between a source and a drain can be extremely small. With use of the OS transistors as the transistors Tr51 to Tr53, the leakage current of each of the transistors Tr51 to Tr53 can be suppressed, which enables the product-sum operation circuit to have high calculation accuracy in some cases.

In the column output circuit OUT[j], the terminal CT1 of the constant current circuit CI is electrically connected to the wiring VDD1L, and the terminal CT2 of the constant current circuit CI is electrically connected to the terminal CT5[*j*] of the current mirror circuit CM. The terminal CT6[*j*] of the current mirror circuit CM is electrically connected to the output terminal OT[j].

Note that the wiring OL[j] is a wiring for making the terminal CT2 of the constant current circuit CI being electrically connected to the output terminal OT[j] through the terminal CT5[*j*] and the terminal CT6[*j*] of the current mirror circuit CM.

Next, the reference column output circuit Cref is described. The reference column output circuit Cref includes the constant current circuit CIref and a wiring OLref. As described above, the reference column output circuit Cref includes the current mirror circuit CM that is shared with the column output circuits OUT[1] to OUT[n].

The constant current circuit CIref includes a terminal CT3 and a terminal CT4. The terminal CT3 functions as an input terminal of the constant current circuit CIref, and the terminal CT4 functions as an output terminal of the constant current circuit CIref.

The constant current circuit CIref has a function of keeping the amount of current flowing from the terminal CT3 to the terminal CT4 constant.

In the reference column output circuit Cref, the terminal CT3 of the constant current circuit CIref is electrically connected to the wiring VDD1L, and the terminal CT4 of the constant current circuit CIref is electrically connected to the terminal CT7 of the current mirror circuit CM. The terminal CT8 of the current mirror circuit CM is electrically connected to the output terminal OTref.

The wiring OLref is a wiring for making the terminal CT4 of the constant current circuit CIref being electrically connected to the output terminal OTref through the terminal CT7 and the terminal CT8 of the current mirror circuit CM.

In the current mirror circuit CM, the terminal CT5[*j*] is electrically connected to the terminal CT6[*j*], and the terminal CT7 is electrically connected to the terminal CT8. In addition, a wiring IL[j] is electrically connected between the terminal CT5[*j*] and the terminal CT6[*j*], and a wiring ILref is electrically connected between the terminal CT7 and the terminal CT8. Furthermore, a connection portion of the wiring ILref between the terminal CT7 and the terminal CT8 is a node NCMref. The current mirror circuit CM has a function of equalizing the amount of current flowing in the wiring ILref and the amount of current flowing in each of wirings IL[1] to IL[n] with reference to the potential at the node NCMref.

In the offset circuit 711 in FIG. 12, only the following components are shown: the column output circuit OUT[1]; the column output circuit OUT[j]; the column output circuit OUT[n]; the reference column output circuit Cref; the constant current circuit CI; the constant current circuit CIref; the current mirror circuit CM; the output terminal OT[1]; the output terminal OT[j]; the output terminal OT[n]; the output terminal OTref; the terminal CT1; the terminal CT2; the terminal CT3; the terminal CT4; the terminal CT5[1]; the terminal CT5[*j*]; the terminal CT5[*n*]; the terminal CT6[1]; the terminal CT6[*j*]; the terminal CT6[*n*]; the terminal CT7; the terminal CT8; the transistor Tr51; the transistor Tr52; the transistor Tr53; the capacitor C51; a wiring OL[1]; the wiring OL[j]; a wiring OL[n]; the wiring OLref; the wiring ORP; the wiring OSP; the wiring B[1]; the wiring B[j]; the wiring B[n]; the wiring Bref; the wiring IL[1]; the wiring IL[j]; the wiring IL[n]; the wiring ILref; the node NCMref; the wiring VDD1L; and the wiring VSSL. Other circuits, wirings, elements, and reference numerals thereof are not shown.

Note that the configuration of the offset circuit 710 in FIG. 11 is not limited to the configuration of the offset circuit 711 in FIG. 12. Depending on circumstances or conditions or as needed, the configuration of the offset circuit 711 can be changed.

[Constant Current Circuits CI and CIef]

Next, an example of internal configurations of the constant current circuit CI and the constant current circuit CIref is described.

Figure 13:
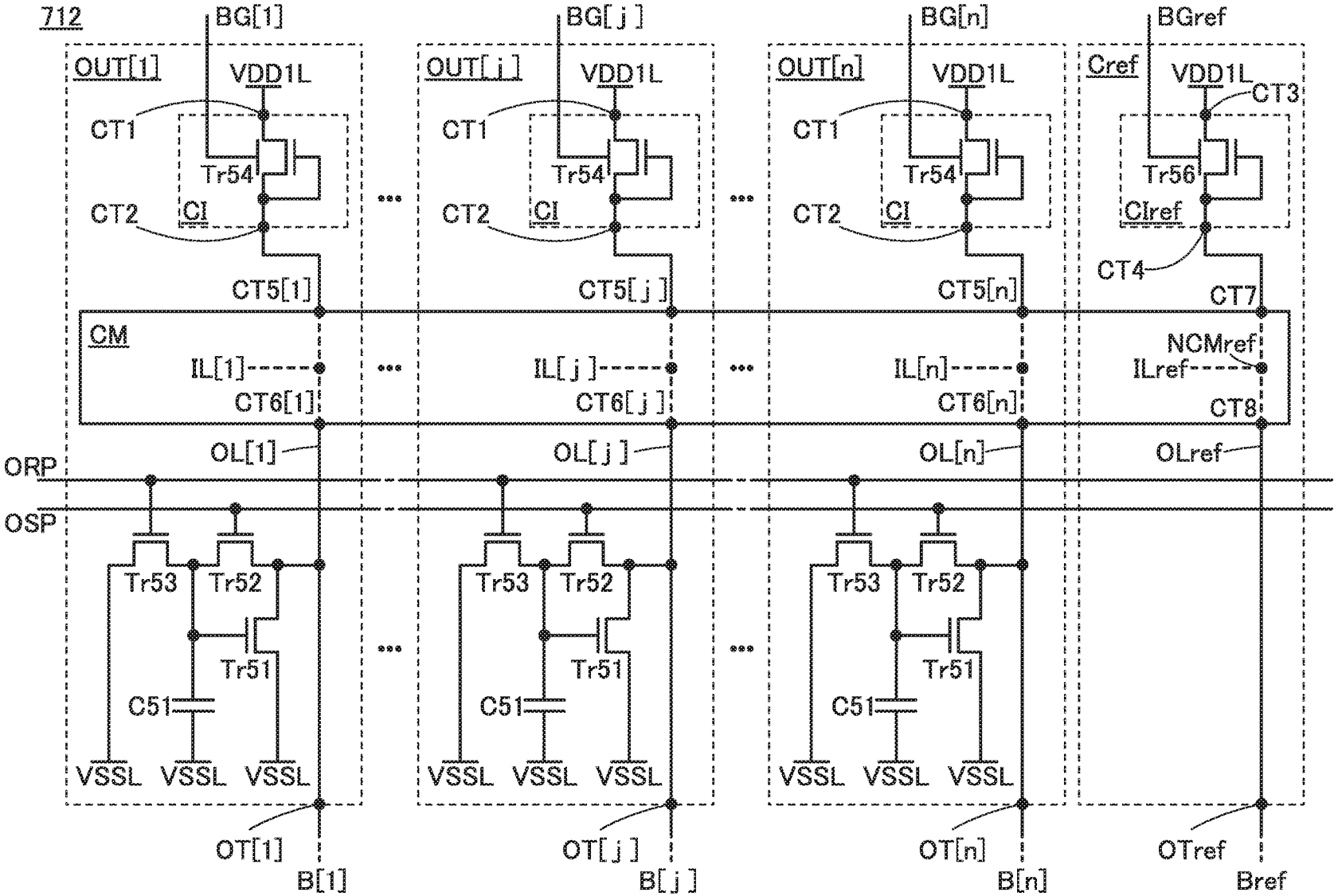
FIG. 13 is a circuit diagram illustrating an example of an offset circuit in the semiconductor device in FIG. 11.

An offset circuit 712 shown in FIG. 13 is a circuit diagram showing an example of internal configurations of the constant current circuit CI and the constant current circuit CIref included in the offset circuit 711 shown in FIG. 12.

In the column output circuit OUT[j], the constant current circuit CI includes a transistor Tr54. The transistor Tr54 has a dual gate structure including a first gate and a second gate.

Note that in this specification, the first gate in the transistor having a dual gate structure indicates a front gate, and a term "first gate" can be replaced with a simple term "gate". Besides, the second gate in the transistor having a dual gate structure indicates a back gate, and a term "second gate" can be replaced with a term "back gate".

A first terminal of the transistor Tr54 is electrically connected to the terminal CT1 of the constant current circuit CI. A second terminal of the transistor Tr54 is electrically connected to the terminal CT2 of the constant current circuit CI. A gate of the transistor Tr54 is electrically connected to the terminal CT2 of the constant current circuit CI. A back gate of the transistor Tr54 is electrically connected to a wiring BG[j].

In the reference column output circuit Cref, the constant current circuit CIref includes a transistor Tr56. The transistor Tr56 has a dual gate structure including a gate and a back gate.

A first terminal of the transistor Tr56 is electrically connected to the terminal CT3 of the constant current circuit CIref. A second terminal of the transistor Tr56 is electrically connected to the terminal CT4 of the constant current circuit CIref. The gate of the transistor Tr56 is electrically connected to the terminal CT4 of the constant current circuit CIref. The back gate of the transistor Tr56 is electrically connected to a wiring BGref.

In the above connection structure, the threshold voltages of the transistor Tr54 and the transistor Tr56 can be controlled by supplying a potential to the wiring BG[j] and the wiring BGref.

Each of the transistor Tr54 and the transistor Tr56 is preferably an OS transistor. In addition, each of channel formation regions of the transistors Tr54 and Tr56 preferably includes CAC-OS described in Embodiment 9.

With use of the OS transistors as the transistors Tr54 and Tr56, the leakage current of each of the transistors Tr54 and Tr56 can be suppressed, which enables a product-sum operation circuit with high calculation accuracy to be fabricated in some cases.

In the offset circuit 712 shown in FIG. 13, only the following components are shown: the column output circuit OUT[1]; the column output circuit OUT[j]; the column output circuit OUT[n]; the reference column output circuit Cref; the constant current circuit CI; the constant current circuit CIref; the current mirror circuit CM; the output terminal OT[1]; the output terminal OT[j]; the output terminal OT[n]; the output terminal OTref; the terminal CT1; the terminal CT2; the terminal CT3; the terminal CT4; the terminal CT5[1]; the terminal CT5[*j*]; the terminal CT5[*n*]; the terminal CT6[1]; the terminal CT6[*j*]; the terminal CT6[*n*]; the terminal CT7; the terminal CTB; the transistor Tr51; the transistor Tr52; the transistor Tr53; the transistor Tr54; the transistor Tr56; the capacitor C51; the wiring OL[1]; the wiring OL[j]; the wiring OL[n]; the wiring OLref; the wiring ORP; the wiring OSP; the wiring B[1]; the wiring B[j]; the wiring B[n]; the wiring Bref; a wiring BG[1]; the wiring BG[j]; a wiring BG[n]; the wiring BGref; the wiring IL[1]; the wiring IL[j]; the wiring IL[n]; the wiring ILref; the node NCMref; the wiring VDD1L; and the wiring VSSL. Other circuits, wirings, elements, and reference numerals thereof are not shown.

[Current Mirror Circuit CM]

Next, an internal configuration example of the current mirror circuit CM will be described.

Figure 14:
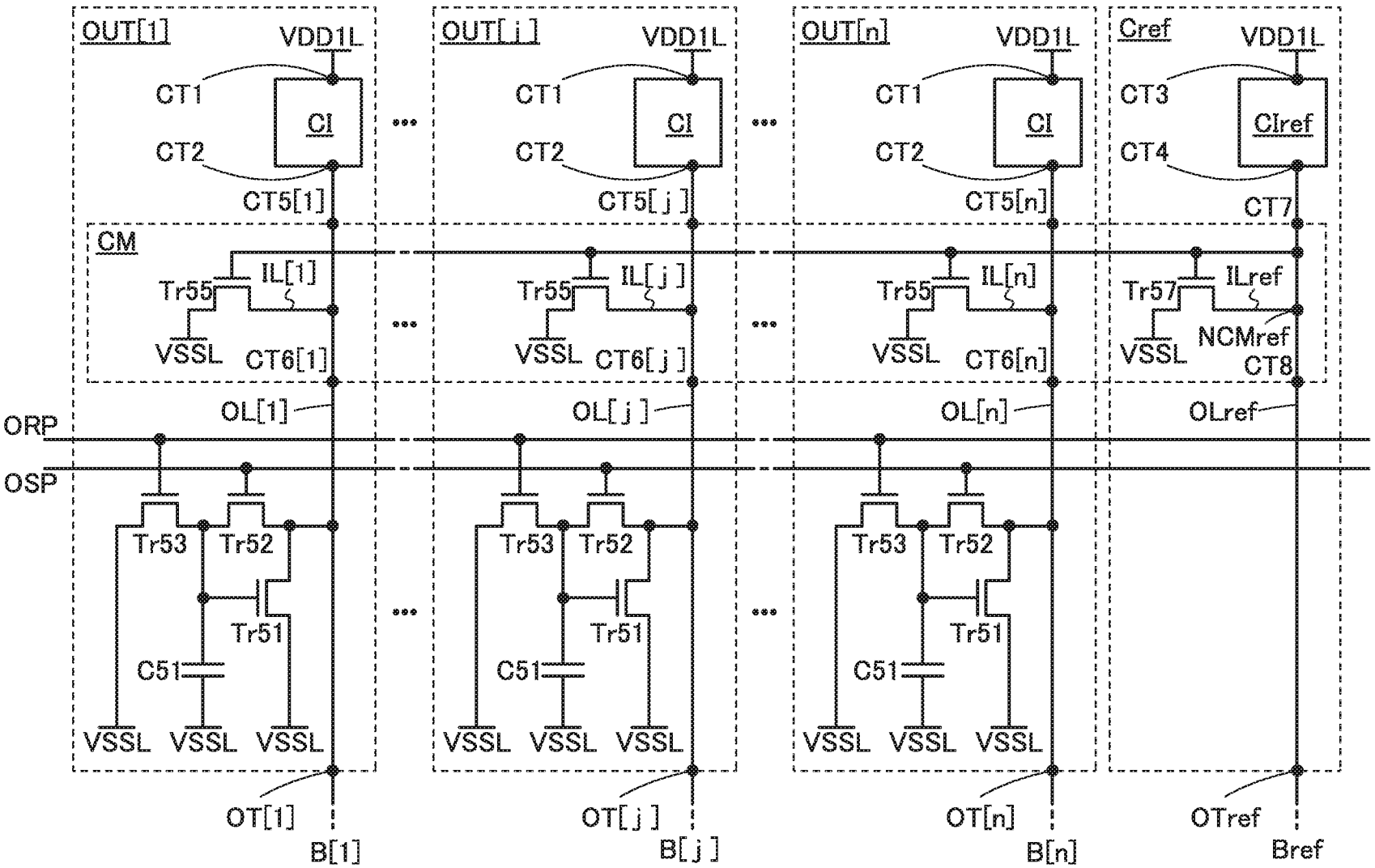
FIG. 14 is a circuit diagram illustrating an example of an offset circuit in the semiconductor device in FIG. 11.

An offset circuit 713 shown in FIG. 14 is a circuit diagram of an internal configuration example of the current mirror circuit CM included in the offset circuit 711 shown in FIG. 12.

In the current mirror circuit CM, each of the column output circuits OUT[1] to OUT[n] includes a transistor Tr55, and the reference column output circuit Cref includes a transistor Tr57.

A first terminal of the transistor Tr55 in the column output circuit OUT[j] is electrically connected to the terminal CT5[*j*] and the terminal CT6[*j*] of the current mirror circuit CM. A second terminal of the transistor Tr55 in the column output circuit OUT[j] is electrically connected to the wiring VSSL. A gate of the transistor Tr55 in the column output circuit OUT[j] is electrically connected to the terminal CT7 and the terminal CT8 in the current mirror circuit CM.

A first terminal of the transistor Tr57 in the reference column output circuit Cref is electrically connected to the terminal CT7 and the terminal CT8 of the current mirror circuit CM. A second terminal of the transistor Tr57 in the reference column output circuit Cref is electrically connected to the wiring VSSL. A gate of the transistor Tr57 in the reference column output circuit Cref is electrically connected to the terminal CT7 and the terminal CT8 of the current mirror circuit CM.

In the above connection structure, a potential of the node NCMref can be applied to the gate of the transistor Tr55 in each of the column output circuits OUT[1] to OUT[n], and the amount of current flowing between a source and a drain of the transistor Tr57 can be equalized to the amount of current flowing between a source and a drain of the transistor Tr55 in each of the column output circuits OUT[1] to OUT[n].

Each of the transistor Tr55 and the transistor Tr57 is preferably an OS transistor. In addition, each of channel formation regions of the transistors Tr55 and Tr57 preferably includes CAC-OS described in Embodiment 9.

With use of the OS transistors as the transistors Tr55 and Tr57, the leakage current of each of the transistors Tr55 and Tr57 can be suppressed, which enables a product-sum operation circuit with high calculation accuracy to be fabricated in some cases.

In the offset circuit 713 shown in FIG. 14, only the following components are shown: the column output circuit OUT[1]; the column output circuit OUT[j]; the column output circuit OUT[n]; the reference column output circuit Cref; the constant current circuit CI; the constant current circuit CIref; the current mirror circuit CM; the output terminal OT[1]; the output terminal OT[j]; the output terminal OT[n]; the output terminal OTref; the terminal CT1; the terminal CT2; the terminal CT3; the terminal CT4; the terminal CT5[1]; the terminal CT5[*j*]; the terminal CT5[*n*]; the terminal CT6[1]; the terminal CT6[*j*]; the terminal CT6[*n*]; the terminal CT7; the terminal CTB; the transistor Tr51; the transistor Tr52; the transistor Tr53; the transistor Tr55; the transistor Tr57; the capacitor C51; the wiring OL[1]; the wiring OL[j]; the wiring OL[n]; the wiring OLref; the wiring ORP; the wiring OSP; the wiring B[1]; the wiring B[j]; the wiring B[n]; the wiring Bref; the wiring IL[1]; the wiring IL[j]; the wiring IL[n]; the wiring ILref; the node NCMref; the wiring VDD1L; and the wiring VSSL. Other circuits, wirings, elements, and reference numerals thereof are not shown.

<<Memory Cell Array 720>>

Figure 15:
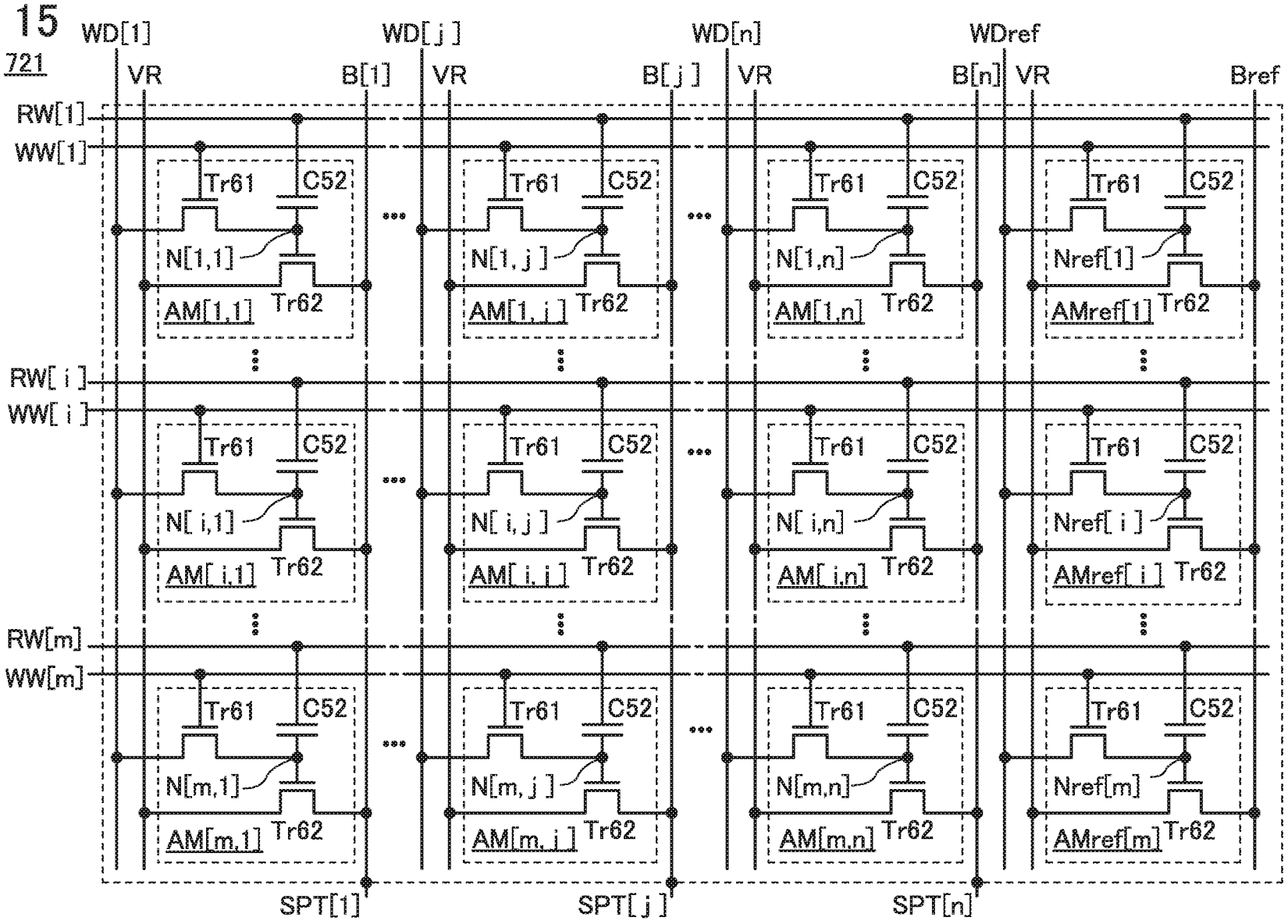
FIG. 15 is a circuit diagram illustrating an example of a memory cell array in the semiconductor device of FIG. 11.

Next, a circuit configuration example that can be employed in the memory cell array 720 will be described. FIG. 15 shows a memory cell array 721 as an example of the memory cell array 720.

The memory cell array 721 includes the memory cells AM and the memory cells AMref Each of the memory cells AM included in the memory cell array 721 includes a transistor Tr61, a transistor Tr62, and a capacitor C52. The memory cells AMref[1] to AMref[m] each include the transistor Tr61, the transistor Tr62, and the capacitor C52.

For the connection structure in the memory cell array 721, the description will be made with a focus on the memory cell AM[i,j]. A first terminal of the transistor Tr61 is electrically connected to a gate of the transistor Tr62 and a first terminal of the capacitor C52. A second terminal of the transistor Tr61 is electrically connected to the wiring WD[j]. A gate of the transistor Tr61 is electrically connected to the wiring WW[i]. A first terminal of the transistor Tr62 is electrically connected to the wiring B[j], and a second terminal of the transistor Tr62 is electrically connected to the wiring VR. A second terminal of the capacitor C52 is electrically connected to the wiring RW[i].

In the memory cell AM[i,j], a connection portion of the first terminal of the transistor Tr61, the gate of the transistor Tr62, and the first terminal of the capacitor C52 is a node N[i,j]. In this embodiment, a potential corresponding to the first analog data is held at the node N[i,j].

Next, the explanation is made with a focus on the memory cell AMref[i]. The first terminal of the transistor Tr61 is electrically connected to the gate of the transistor Tr62 and the first terminal of the capacitor C52. A second terminal of the transistor Tr61 is electrically connected to the wiring WDref. A gate of the transistor Tr61 is electrically connected to the wiring WW[i]. A first terminal of the transistor Tr62 is electrically connected to the wiring Bref. A second terminal of the transistor Tr62 is electrically connected to the wiring VR. A second terminal of the capacitor C52 is electrically connected to the wiring RW[i].

In the memory cell AMref[i], a connection portion of the first terminal of the transistor Tr61, the gate of the transistor Tr62, and the first terminal of the capacitor C52 is a node Nref[i].

Each of the transistor Tr61 and the transistor Tr62 is preferably an OS transistor. In addition, each of channel formation regions of the transistors Tr61 and Tr62 preferably includes CAC-OS described in Embodiment 9.

With use of the OS transistors as the transistors Tr61 and Tr62, the leakage current of each of the transistors Tr61 and Tr62 can be suppressed, which enables the product-sum operation circuit to have high calculation accuracy in some cases. Furthermore, with use of the OS transistor as the transistor Tr61, the amount of leakage current from a holding node to a writing word line can be extremely small when the transistor Tr61 is in an off state. In other words, frequencies of refresh operation at the retention node can be reduced; thus, power consumption of a semiconductor device can be reduced.

Furthermore, when all of the above-described transistors Tr51 to Tr57, Tr61, and Tr62 are OS transistors, a manufacturing process of the semiconductor device can be shortened. Thus, a time needed for manufacturing semiconductor devices can be shortened, and the number of devices manufactured in a certain time period can be increased. In the case where all of the transistors Tr51 to Tr57, the transistor Tr61, and the transistor Tr62 are OS transistors, the semiconductor device 700 can be directly mounted over the base of the display unit 100. This structure is described in detail in Embodiment 4.

Note that the transistors Tr51, Tr54 to Tr57, and Tr62 operate in a saturation region unless otherwise specified. In other words, the gate voltage, source voltage, and drain voltage of each of the transistor Tr51, the transistors Tr54 to Tr57, and the transistor Tr62 are appropriately biased so that the transistors operate in the saturation region. Note that even in the case where the operations of the transistors Tr51, Tr54 to Tr57, and Tr62 deviate from the operations in the ideal saturation region, the gate voltage, source voltage, and drain voltage of each of the transistor Tr51, Tr54 to Tr57, and Tr62 are considered to be appropriately biased as long as the accuracy of output data is obtained within the desired range.

In the memory cell array 721 shown in FIG. 15, only the following components are shown: the memory cell AM[1,1]; the memory cell AM[i,1]; the memory cell AM[m,1]; the memory cell AM[1,j]; the memory cell AM[i,j]; the memory cell AM[m,j]; the memory cell AM[1,n]; the memory cell AM[i,n]; the memory cell AM[m,n]; the memory cell AMref [1]; the memory cell AMref[i]; the memory cell AMref[m]; the wiring RW[1]; the wiring RW[i]; the wiring RW[m]; the wiring WW[1]; the wiring WW[i]; the wiring WW[m]; the wiring WD[1]; the wiring WD[j]; the wiring WD[n]; the wiring WDref; the wiring B[1]; the wiring B[j]; the wiring B[n]; the wiring Bref; the wiring VR; the output terminal SPT[1]; the output terminal SPT[j]; the output terminal SPT[n]; a node N[1,1]; a node N[i,1]; a node N[m,1]; a node N[1,j]; the node N[i,j]; a node N[m,j]; a node N[1,n]; a node N[i,n]; a node N[m,n]; a node Nref[1]; the node Nref[i]; a node Nref[m]; the transistor Tr61; the transistor Tr62; and the capacitor C52. Other circuits, wirings, elements, and reference numerals thereof are not shown.

The semiconductor device 700 may have a structure in which the above-described structures are combined depending on circumstances or conditions or as needed.

Operation Example 1

An example of operation of the semiconductor device 700 will be described. Note that the semiconductor device 700 described in this operation example includes an offset circuit 750 shown in FIG. 16 as the offset circuit 710 and a memory cell array 760 shown in FIG. 17 as the memory cell array 720 of the semiconductor device 700.

Figure 16:
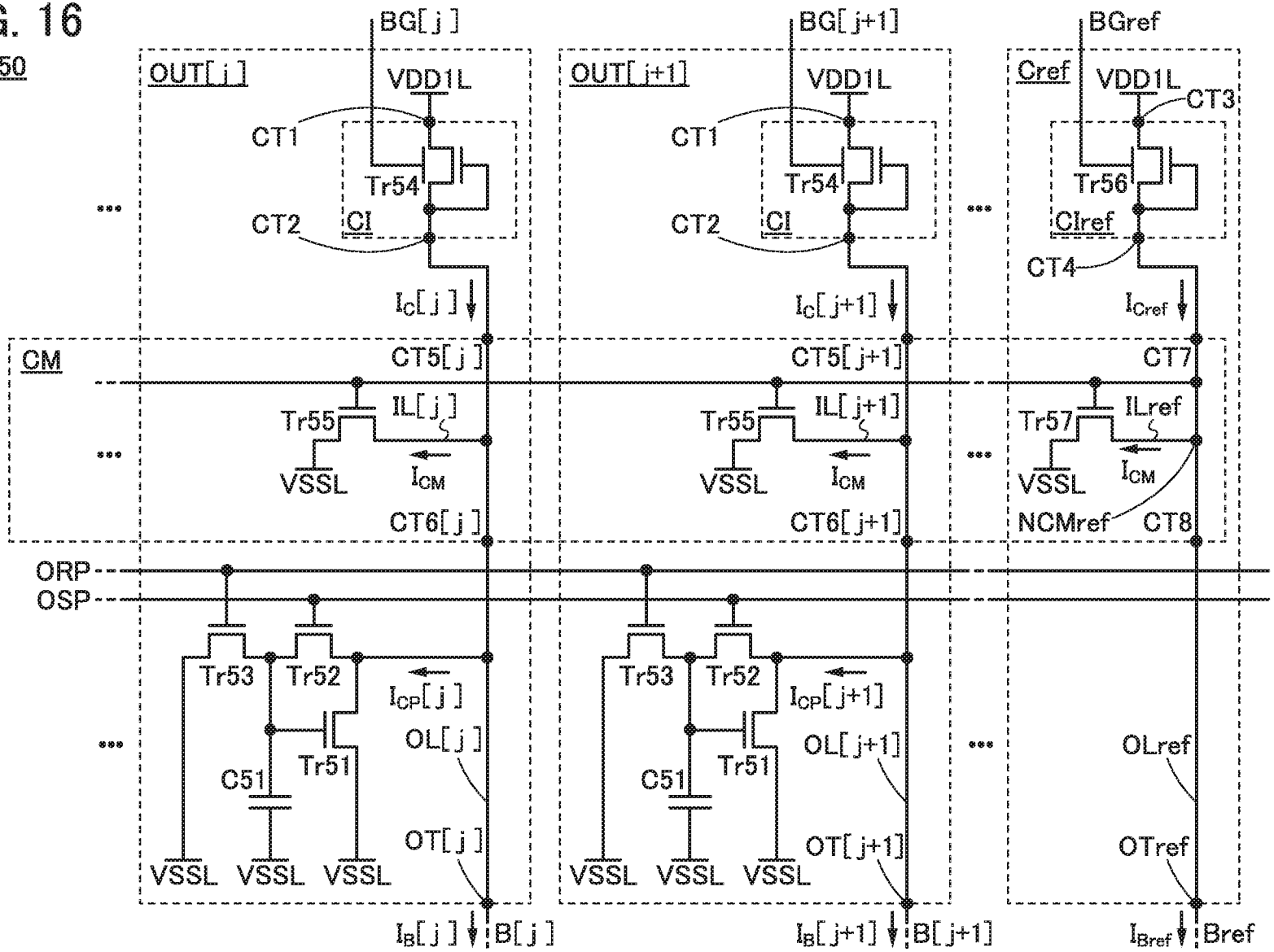
FIG. 16 is a circuit diagram illustrating an example of an offset circuit in the semiconductor device in FIG. 11.

The offset circuit 750 shown in FIG. 16 has a circuit configuration where the constant current circuit CI and the constant current circuit CIref of the offset circuit 712 in FIG. 13 and the current mirror circuit CM of the offset circuit 713 in FIG. 14 are used. With use of the configuration shown in FIG. 16, all of the transistors in the offset circuit 750 can have the same polarity. For the description of this operation example, FIG. 16 shows the column output circuit OUT[j], a column output circuit OUT[j+1], and the reference column output circuit Cref.

In FIG. 16, $I_C$[j] denotes a current flowing from the first to second terminal of the transistor Tr54 in the constant current circuit CI of the column output circuit OUT[j], $I_C$[j+1] denotes a current flowing from the first to second terminal of the transistor Tr54 in the constant current circuit CI of the column output circuit OUT[j+1], and ICref denotes a current flowing from the first to second terminal of the transistor Tr56 in the constant current circuit CIref of the reference column output circuit Cref. In the current mirror circuit CM, $I_{CM}$ collectively denotes a current flowing to the first terminal of the transistor Tr55 through the wiring IL[j] in the column output circuit OUT[j], a current flowing to the first terminal of the transistor Tr55 through a wiring IL[j+1] in the column output circuit OUT[j+1], and a current flowing in the transistor Tr57 through the wiring ILref in the reference column output circuit Cref. Furthermore, $I_{CP}$[j] denotes a current flowing from the wiring OL[j] to the first terminal of the transistor Tr51 or Tr52 in the column output circuit OUT[j], and $I_{CP}$[j+1] denotes a current flowing from a wiring OL[j+1] to the first terminal of the transistor Tr51 or Tr52 in the column output circuit OUT[j+1]. Moreover, $I_B$[j] denotes a current outputted from the output terminal OT[j] of the column output circuit OUT[j] to the wiring B[j], $I_B$[j+1] denotes a current outputted from an output terminal OT[j+1] of the column output circuit OUT[j+1] to a wiring B[j+1], and $I_{Bref}$ denotes a current outputted from the output terminal OTref of the reference column output circuit Cref to the wiring Bref.

Figure 17:
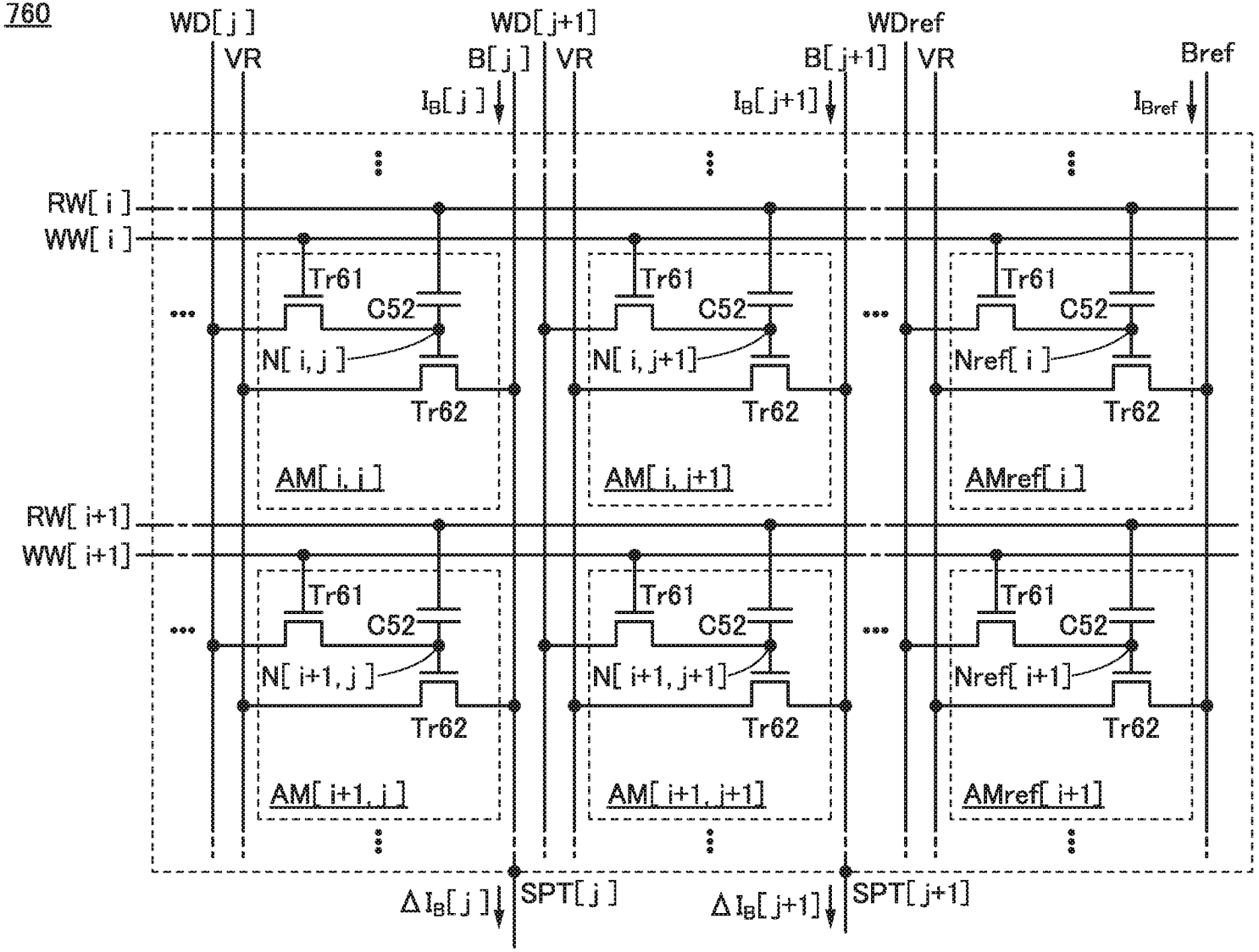
FIG. 17 is a circuit diagram illustrating an example of a memory cell array in the semiconductor device in FIG. 11.

The memory cell array 760 shown in FIG. 17 has a structure similar to that of the memory cell array 721 shown in FIG. 15. For the description of this operation example, FIG. 17 shows the memory cell AM[i,j], a memory cell AM[i+1,j], a memory cell AM[i,j+1], a memory cell AM[i+1,j+1], the memory cell AMref[i], and a memory cell AMref[i+1].

In FIG. 17, $I_B$[j] denotes a current that is inputted from the wiring B[j], $I_B$[j+1] denotes a current that is inputted from the wiring B[j+1], and $I_{Bref}$ denotes a current that is inputted from the wiring Bref. In addition, $\Delta I_B$[j] denotes a current outputted from the output terminal SPT[j] that is electrically connected to the wiring B[j], and $\Delta I_B$[j+1] denotes a current outputted from an output terminal SPT[j+1] that is electrically connected to the wiring B[j+1].

Figure 18:
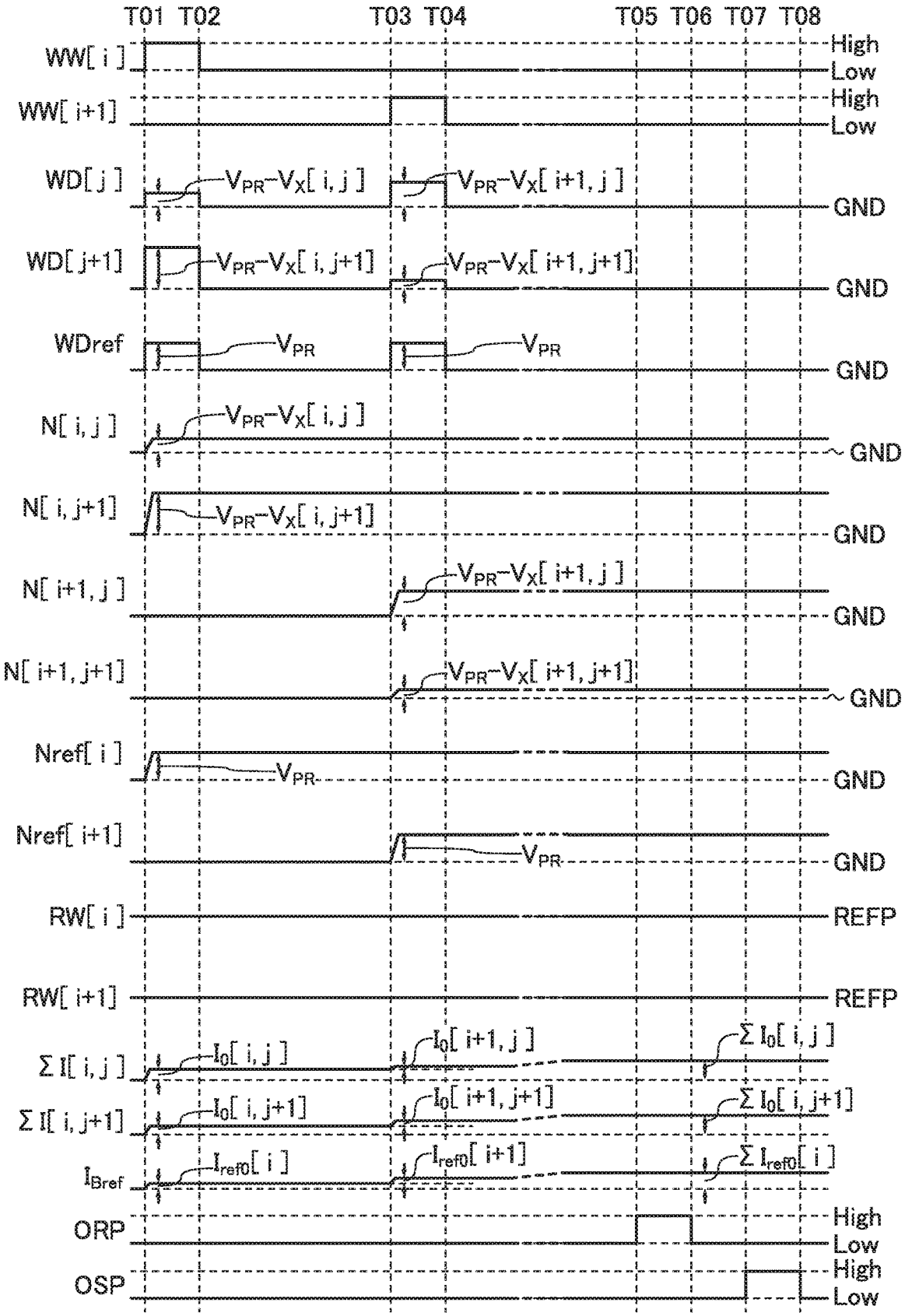
FIG. 18 is a timing chart showing an operation example of a semiconductor device.
Figure 19:
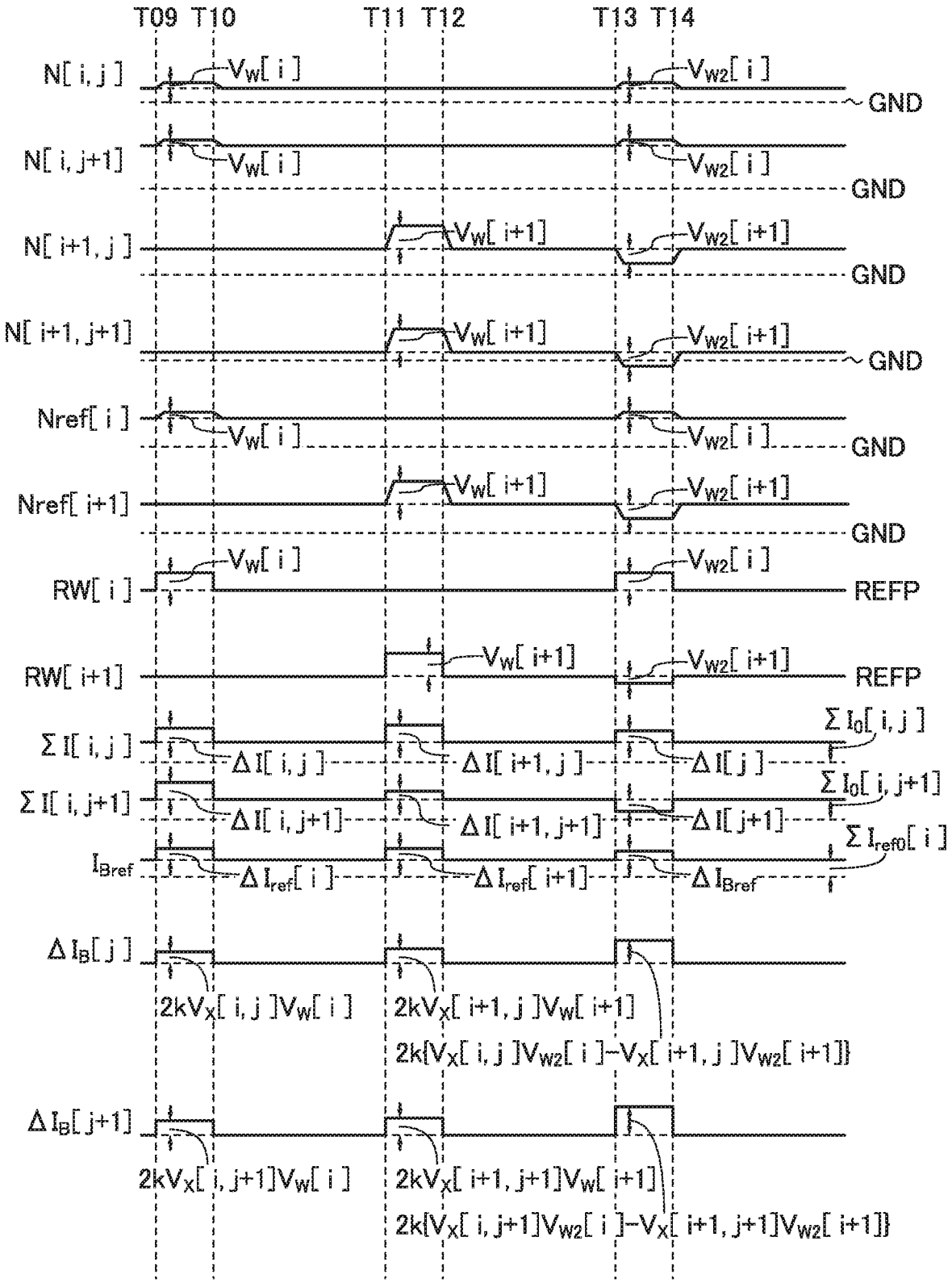
FIG. 19 is a timing chart showing an operation example of a semiconductor device.

FIG. 18 and FIG. 19 are timing charts showing the operation example of the semiconductor device 700. The timing chart in FIG. 18 shows changes in potentials from Time T01 to Time T08 of the wiring WW[i], a wiring WW[i+1], the wiring WD[j], a wiring WD[j+1], the wiring WDref, the node a node N[i,j], a node N[i,j+1], a node N[i+1,j+1], the node Nref[i], a node Nref[i+1], the wiring RW[i], a wiring RW[i+1], the wiring OSP, and the wiring ORP. This timing chart also shows the amount of changes in a current ΣI[i,j], a current ΣI[i,j+1], and a current $I_{Bref}$ from Time T01 to Time T08. Note that the current ΣI[i,j] is the sum of the amounts of current flowing in the transistor Tr62 of the memory cell AM[i,j], which is obtained by summing over i from 1 to m, and the current ΣI[i,j+1] is the sum of the amounts of current flowing in the transistor Tr62 of the memory cell AM[i,j+1], which is obtained by summing over i from 1 to m. The operation example from Time T09 to Time T14 is shown in FIG. 19 as the rest of the operation shown in the timing chart in FIG. 18. At and after Time T09, the potentials of the wiring WW[i], the wiring WW[i+1], the wiring ORP, and the wiring OSP are kept at a low level without any change, and potentials of the wiring WD[j], the wiring WD[j+1], and the wiring WDref are kept at a ground potential without any change. Thus, in the timing chart in FIG. 19, the changes in potentials of the wiring WW[i], the wiring WW[i+1], the wiring WD[j], the wiring WD[j+1], the wiring WDref, the wiring ORP, and the wiring OSP are not shown. Furthermore, the timing chart in FIG. 19 shows variations in the amount of current $\Delta I_B$[j] and the amount of current $\Delta I_B$[j+1] to be described later.

<<Period from Time T01 to Time T02>>

During a period from Time T01 to Time T02, the high-level potential (denoted by High in FIG. 18) is applied to the wiring WW[i], and the low-level potential (denoted by Low in FIG. 18) is applied to the wiring WW[i+1]. Furthermore, a potential higher than the ground potential (denoted by GND in FIG. 18) by $V_{PR}-V_X$[i,j] is supplied to the wiring WD[j], the potential higher than the ground potential by $V_{PR}-V_X$[i,j+1] is supplied to the wiring WD[j+1], and a potential higher than the ground potential by $V_{PR}$ is supplied to the wiring WDref. Moreover, a reference potential (denoted by REFP in FIG. 18) is supplied to the wiring RW[i] and the wiring RW[i+1].

The potential $V_X$[i,j] and the potential $V_X$[i,j+1] each correspond to the first analog data. The potential $V_{PR}$ corresponds to the reference analog data.

In this period, the high-level potential is supplied to the gates of the transistors Tr61 in the memory cell AM[i,j], the memory cell AM[i,j+1], and the memory cell AMref[i]; accordingly, the transistors Tr61 in the memory cell AM[i,j], the memory cell AM[i,j+1], and the memory cell AMref[i] are turned on. Thus, in the memory cell AM[i,j], the wiring WD[j] and the node N[i,j] are electrically connected to each other, and the potential of the node N[i,j] is $V_{PR}-V_X$[i,j]. In the memory cell AM[i,j+1], the wiring WD[j+1] and the node N[i,j+1] are electrically connected to each other, and the potential of the node N[i,j+1] is $V_{PR}-V_X$[i,j+1]. In the memory cell AMref[i], the wiring WDref and the node Nref[i] are electrically connected to each other, and the potential of the node Nref[i] is $V_{PR}$.

A current flowing from the first to second terminal of the transistor Tr62 in each of the memory cell AM[i,j], the memory cell AM[i,j+1], and the memory cell AMref[i] is considered. The current $I_0$[i,j] flowing from the wiring B[j] to the second terminal through the first terminal of the transistor Tr62 in the memory cell AM[i,j] can be expressed by the following formula.

[Formula 7]

$$I_0[i,j]=k(V_{PR}-V_X[i,j]-V_{th})^2 \quad \text{(E1)}$$

In the formula, k is a constant determined by the channel length, the channel width, the mobility, the capacitance of a gate insulating film, and the like of the transistor Tr62. Furthermore, $V_{th}$ is a threshold voltage of the transistor Tr62.

At this time, the current flowing from the output terminal OT[j] of the column output circuit OUT[j] to the wiring B[j] is $I_0[i,j]$.

Similarly, the current $I_0[i,j+1]$ flowing from the wiring B[j+1] to the second terminal of the transistor Tr62 in the memory cell AM[i,j+1] through the first terminal thereof can be expressed by the following formula.

[Formula 8]

$$I_0[i,j+1]=k(V_{PR}-V_X[i,j+1]-V_{th})^2 \quad \text{(E2)}$$

At this time, the current flowing from the output terminal OT[j+1] of the column output circuit OUT[$_j$+1] to the wiring B[j+1] is $I_0[i,j+1]$.

The current $i_{ref0}[i]$ flowing from the wiring Bref to the second terminal through the first terminal of the transistor Tr62 in the memory cell AMref[i] can be expressed by the following formula.

[Formula 9]

$$I_{ref0}[i]=k(V_{PR}-V_t)^2 \quad \text{(E3)}$$

At this time, the current flowing from the output terminal OTref of the reference column output circuit Cref to the wiring Bref is $i_{ref0}[i]$.

Note that since the low-level potential is supplied to the gates of the transistors Tr61 in the memory cell AM[i+1,j], the memory cell AM[i+1,j+1], and the memory cell AMref [i+1], the transistors Tr61 in the memory cell AM[i+1,j], the memory cell AM[i+1,j+1], and the memory cell AMref[i+1] are turned off. Thus, the potentials are not retained at the node N[i+1,j], the node N[i+1,j+1], and the node Nref[i+1].

<<Period from Time T02 to Time T03>>

During a period from Time T02 to Time T03, the low-level potential is applied to the wiring WW[i]. At this time, the low-level potential is supplied to the gates of the transistors Tr61 in the memory cell AM[i,j], the memory cell AM[i,j+1], and the memory cell AMref[i], and accordingly, the transistors Tr61 in the memory cells AM[i,j], AM[i,j+1], and AMref[i] are turned off.

The low-level potential has been applied to the wiring WW[i+1] continuously since before Time T02. Thus, the transistors Tr61 in the memory cell AM[i+1,j], the memory cell AM[i+1,j+1], and the memory cell AMref[i+1] have been kept in an off state since before Time T02.

Since the transistors Tr61 in the memory cell AM[i,j], the memory cell AM[i,j+1], the memory cell AM[i+1,j], the memory cell AM[i+1,j+1], the memory cell AMref[i], and the memory cell AMref[i+1] are each in an off state as described above, the potentials at the node N[i,j], the node N[i,j+1], the node N[i+1,j], the node N[i+1,j+1], the node Nref[i], and the node Nref[i+1] are held in a period from Time T02 to Time T03.

In particular, when an OS transistor is used as each of the transistors Tr61 in the memory cell AM[i,j], the memory cell AM[i,j+1], the memory cell AM[i+1,j], the memory cell AM[i+1j+1], the memory cell AMref[i], and the memory cell AMref[i+1] as described in the circuit configuration of the semiconductor device 700, the amount of leakage current flowing between the source and the drain of each of the transistors Tr61 can be made small, which makes it possible to hold the potentials at the nodes for a long time.

During the period from Time T02 to Time T03, the ground potential is applied to the wiring WD[j], the wiring WD[j+1], and the wiring WDref Since the transistors Tr61 in the memory cell AM[i,j], the memory cell AM[i,j+1], the memory cell AM[i+1,j], the memory cell AM[i+1,j+1], the memory cell AMref[i], and the memory cell AMref[i+1] are each in an off state, the potentials held at the nodes in the memory cell AM[i,j], the memory cell AM[i,j+1], the memory cell AM[i+1,j], the memory cell AM[i+1,j+1], the memory cell AMref[i], and the memory cell AMref[i+1] are not rewritten by application of potentials from the wiring WD[j], the wiring WD[j+1], and the wiring WDref.

<<Period from Time T03 to Time T04>>

During a period from Time T03 to Time T04, the low-level potential is applied to the wiring WW[i], and a high-level potential is applied to the wiring WW[i+1]. Furthermore, the potential higher than the ground potential by $V_{PR}-V_x[i+1,j]$ is applied to the wiring WD[j], the potential higher than the ground potential by $V_{PR}-V_x[i+1,j+1]$ is applied to the wiring WD[j+1], and the potential higher than the ground potential by $V_{PR}$ is applied to the wiring WDref. Moreover, the reference potential is continuously being applied to the wiring RW[i] and the wiring RW[i+1] continuously since Time T02.

Note that the potential $V_x[i+1,j]$ and the potential $V_x[i+1,j+1]$ are each a potential corresponding to the first analog data.

In this period, the high-level potential is supplied to the gates of the transistors Tr61 in the memory cell AM[i+1,j], the memory cell AM[i+1,j+1], and the memory cell AMref [i+1], and accordingly, the transistors Tr61 in the memory cell AM[i+1,j], the memory cell AM[i+1,j+1], and the memory cell AMref[i+1] are each turned on. Thus, the node N[i+1,j] in the memory cell AM[i+1,j] is electrically connected to the wiring WD[j], and the potential of the node N[i+1,j] becomes $V_{PR}-V_x[i+1,j]$. In the memory cell AM[i+1,j+1], the wiring WD[j+1] and the node N[i+1,j+1] are electrically connected to each other, and the potential of the node N[i+1,j+1] becomes $V_{PR}-V_x[i+1,j+1]$. In the memory cell AMref[i+1], the wiring WDref and the node Nref[i+1] are electrically connected to each other, and the potential of the node Nref[i+1] becomes $V_{PR}$.

The current flowing from the first to second terminal of the transistor Tr62 in each of the memory cell AM[i+1,j], the memory cell AM[i+1,j+1], and the memory cell AMref[i+1] is considered. The current $I_0[i+1,j]$ flowing from the wiring B[j] to the second terminal through the first terminal of the transistor Tr62 in the memory cell AM[i+1,j] can be expressed by the following formula.

[Formula 10]

$$I_0[i+1,j]=k(V_{PR}-V_x[i+1,j]-V_{th})^2 \quad \text{(E4)}$$

At this time, the current flowing from the output terminal OT[j] of the column output circuit OUT[j] to the wiring B[j] is $I_0[i,j]+I_0[i+1,j]$.

Similarly, the current $I_0[i+1,j+1]$ flowing from the wiring B[j+1] to the second terminal of the transistor Tr62 in the memory cell AM[i+1,j+1] through the first terminal thereof can be expressed by the following formula.

[Formula 11]

$$I_0[i+1,j+1]=k(V_{PR}-V_X[i-1,j+1]-V_{th})^2 \quad \text{(E5)}$$

At this time, the current flowing from the output terminal OT[j+1] of the column output circuit OUT[j+1] to the wiring B[j+1] is $I_0[i,j+1]+I_0[i+1,j+1]$.

The current $I_{ref0}[i+1]$ flowing from the wiring Bref to the second terminal of the transistor Tr62 in the memory cell AMref[i+1] through the first terminal thereof can be expressed by the following formula.

[Formula 12]

$$I_{ref0}[i+1]=k(V_{PR}-V_{th})^2 \quad \text{(E6)}$$

At this time, the current flowing from the output terminal OTref of the reference column output circuit Cref to the wiring Bref is $I_{ref0}$ [i]+$I_{ref0}$ [i+1].

<<Period from Time T04 to Time T05>>

During a period from Time T04 to Time T05, the potential corresponding to the first analog data is written to the rest of the memory cells AM, and the potential $V_{PR}$ is written to the rest of memory cells AMref, in a manner similar to that of the operation during the period from Time T01 to Time T02 and that of the operation during the period from Time T03 to Time T04. Thus, the sum of the amounts of current flowing in the transistors Tr62 in all of the memory cells AM corresponds to the amount of current flowing from the output terminal OT[j] of the column output circuit OUT[j] to the wiring B[j] that is denoted by $\Sigma I_0[i,j]$ ($\Sigma I_0[i,j]$ represents the summation of the current $I_0[i,j]$ over i from 1 to m).

Here, the reference column output circuit Cref is focused on. The sum of the amounts of current flowing through the transistors Tr62 in the memory cells AMref[1] to AMref[m] flows into the wiring Bref of the reference column output circuit Cref. In other words, the current $I_{Bref}=\Sigma I_{ref0}[i]$ ($\Sigma$ represents the current obtained by summing over i from 1 to m) flows into the wiring Bref.

Although the current flowing in the wiring ILref is denoted by $I_{CM}$ in FIG. 16, the current flowing in the wiring ILref before Time T09 is denoted by $I_{CM0}$ in this specification.

The current ICref is outputted from the terminal CT4 of the constant current circuit CIref. Thus, $I_{CM0}$ is determined by setting the potential of the gate of the transistor Tr57 (the potential of the node NCMref) such that the following formula is satisfied.

[Formula 13]

$$I_{Cref} - I_{CM0} = \sum_i I_{ref0}[i] \quad \text{(E7)}$$

Note that since the potential of the gate of the transistor Tr57 (potential of the node NCMref) is used as a reference in the current mirror circuit CM, the current $I_{CM0}$ also flows in the wirings IL[1] to IL[n] of the column output circuits OUT[1] to OUT[n].

<<Period from Time T05 to Time T06>>

During a period from Time T05 to Time T06, the wiring ORP is set at the high-level potential. At this time, the high-level potential is supplied to the gates of the transistors Tr53 in the column output circuits OUT[1] to OUT[n], so that the transistors Tr53 are turned on. Thus, the low-level potential is supplied to the first terminals of the capacitors C51 in the column output circuits OUT[1] to OUT[n], and thus the potentials of the capacitors C51 are initialized. When Time T06 starts, the low-level potential is applied to the wiring ORP, so that the transistors Tr53 in the column output circuits OUT[1] to OUT[n] are brought into an off state.

<<Period from Time T06 to Time T07>>

During a period from Time T06 to Time T07, the wiring ORP is set to the low-level potential. In the above manner, the low-level potential is supplied to the gates of the transistors Tr53 in the column output circuits OUT[1] to OUT[n], so that the transistors Tr53 are turned off.

<<Period from Time T07 to Time T08>>

During a period from Time T07 to Time T08, the wiring OSP is set at the high-level potential. As described above, the high-level potential is supplied to the gates of the transistors Tr52 in the column output circuits OUT[1] to OUT[n], so that the transistors Tr52 are turned on. At this time, the current flows into the first terminals of the capacitors C51 from the first terminals of the transistors Tr52 through the second terminals of the transistors Tr52, and the potentials are retained in the capacitors C51. Thus, the potentials of the gates of the transistors Tr51 are held, so that the current corresponding to the potentials of the gates of the transistors Tr51 flows between the sources and the drains of the transistors Tr51.

When Time T08 starts, the low-level potential is supplied to the wiring OSP, so that the transistors Tr52 in the column output circuits OUT[1] to OUT[n] are turned off. The potentials of the gates of the transistors Tr51 are retained in the capacitors C51, so that even after Time T08, the same amount of current keeps flowing between the sources and the drains of the transistors Tr51.

Here, the column output circuit OUT[j] is focused on. In the column output circuit OUT[j], the current flowing between the source and the drain of the transistor Tr51 is denoted by $I_{CP}[j]$, and the current flowing between the source and the drain of the transistor Tr54 of the constant current circuit CI[j] is denoted by $I_C[j]$. The current flowing between the source and the drain of the transistor Tr55 through the current mirror circuit CM is $I_{CM0}$. On the assumption that the current is not outputted from the output terminal SPT[j] during the period from Time T01 to Time T08, the sum of the amounts of current flowing through each of the transistors Tr62 in the memory cells AM[1,j] to AM[n,j] flows in the wiring B[j] of the column output circuit OUT[j]. In other words, the current $\Sigma I_0[i,j]$ ($\Sigma$ represents the current obtained by summing over i from 1 to m) flows in the wiring B[j]. Thus, the above satisfies the following formula.

[Formula 14]

$$I_C[j] - I_{CM0} - I_{CP}[j] = \sum_i I_0[i, j] \quad \text{(E8)}$$

<<Period from Time T09 to Time T10>>

The operation after Time T09 will be described with reference to FIG. 19. During a period from Time T09 to Time T10, a potential higher than the reference potential (denoted by REFP in FIG. 19) by $V_W[i]$ is applied to the wiring RW[i]. At this time, the potential $V_W[i]$ is applied to the second terminals of the capacitors C52 in the memory cells AM[i,1] to AM[i,n] and the memory cell AMref[i], so that the potentials of the gates of the transistors Tr62 increase.

Note that the potential $V_W[i]$ is a potential corresponding to the second analog data.

An increase in the potential of the gate of the transistor Tr62 corresponds to the potential obtained by multiplying a change in potential of the wiring RW[i] by a capacitive coupling coefficient determined by the memory cell configuration. The capacitive coupling coefficient is calculated on the basis of the capacitance of the capacitor C52, the gate capacitance of the transistor Tr52, and the parasitic capacitance. In this operation example, to avoid complexity of explanation, a value corresponding to an increase in the potential of the wiring RW[i] is regarded as the same value corresponding to an increase in the potential of the gate of the transistor Tr62. This means that the capacitive coupling coefficient in each of the memory cell AM and the memory cell AMref is regarded as 1.

Note that the capacitive coupling coefficients are each 1. When the potential $V_W$[i] is applied to the second terminals of the capacitors C52 in the memory cell AM[i,j], the memory cell AM[i,j+1], and the memory cell AMref[i], the potentials of the node N[i,j], the node N[i,j+1], and the node Nref[i] each increase by $V_W$[i].

A current flowing from the first to second terminal of the transistor Tr62 in each of the memory cell AM[i,j], the memory cell AM[i,j+1], and the memory cell AMref[i] is considered. The current I[i,j] flowing from the wiring B[j] to the second terminal through the first terminal of the transistor Tr62 in the memory cell AM[i,j] can be expressed by the following formula.

[Formula 15]

$$I[i,j]=k(V_{PR}-V_X[i,j]+V_W[i]-V_{th})^2 \quad \text{(E9)}$$

In other words, by supplying the potential $V_W$[i] to the wiring RW[i], the current flowing from the wiring B[j] to the second terminal of the transistor Tr62 in the memory cell AM[i,j] through the first terminal thereof increases by I[i,j]−$I_0$[i,j] (denoted by ΔI[i,j] in FIG. 19).

Similarly, the current I[i,j+1] flowing from the wiring B[j+1] to the second terminal of the transistor Tr62 in the memory cell AM[i,j++1] through the first terminal thereof can be expressed by the following formula.

[Formula 16]

$$I[i,j+1]=k(V_{PR}-V_X[i,j+1]+V_W[i]-V_{th})^2 \quad \text{(E10)}$$

In other words, by supplying the potential $V_W$[i] to the wiring RW[i], the current flowing from the wiring B[j+1] to the second terminal of the transistor Tr62 in the memory cell AM[i,j+1] through the first terminal thereof increases by I[i,j+1]−$I_0$[i,j+1] (denoted by ΔI[i,j+1] in FIG. 19).

Furthermore, the current $I_{ref}$[i] flowing from the wiring Bref to the second terminal of the transistor Tr62 in the memory cell AMref[i] through the first terminal thereof can be expressed by the following formula.

[Formula 17]

$$I_{ref}[i]=k(V_{PR}+V_W[i]-V_{th})^2 \quad \text{(E11)}$$

In other words, by supplying the potential $V_W$[i] to the wiring RW[i], the current flowing from the wiring Bref to the second terminal of the transistor Tr62 in the memory cell AMref[i] through the first terminal thereof increases by $I_{ref}$[i]−$I_{ref0}$[i] (denoted by $\Delta I_{ref}$[i] in FIG. 19).

Here, the reference column output circuit Cref is focused on. The sum of the amounts of current flowing through the transistors Tr62 in the memory cells AMref[1] to AMref[m] flows into the wiring Bref of the reference column output circuit Cref. In other words, the current $I_{Bref}$=Σ$I_{ref0}$[i] flows into the wiring Bref.

The current ICref is outputted from the terminal CT4 in the constant current circuit CIref. Thus, $I_{CM}$ is determined by setting the potential of the gate of the transistor Tr57 (potential of the node NCMref) so that the following formula is satisfied.

[Formula 18]

$$I_{Cref} - I_{CM} = \sum_i I_{ref}[i] \quad \text{(E12)}$$

Here, the current $\Delta I_B$[j] outputted from the wiring B[j] is focused on. During the period from Time T08 to Time T09, Formula (E8) is satisfied, and the current $\Delta I_B$[j] is not outputted from the terminal SPT[j] that is electrically connected to the wiring B[j].

During the period from Time T09 to Time T10, a potential higher than the reference potential by $V_W$[i] is supplied to the wiring RW[i], and the current flowing between the source and the drain of the transistor Tr62 in the memory cell AM[i,j] changes. Specifically, in the column output circuit OUT[j], the current $I_C$[j] is outputted from the terminal CT2 of the constant current circuit CI, the current $I_{CM}$ flows between the source and the drain of the transistor Tr55, and the current $I_{CP}$[j] flows between the source and the drain of the transistor Tr51. Thus, the current $\Delta I_B$[j] can be expressed by the following formula using ΣI[i,j] where the current flowing between the source and the drain of the transistor Tr62 in the memory cell AM[i,j] is calculated by summing over i from 1 to m.

[Formula 19]

$$\Delta I_B[j] = (I_C[j] - I_{CM} - I_{CP}[j]) - \sum_i I[i, j] \quad \text{(E13)}$$

Formulae (E1), (E3), (E7) to (E9), (E11), and (E12) are used in Formula (E13), so that the following formula can be obtained.

[Formula 20]

$$\Delta I_B[j] = 2k\sum_i (V_X[i, j]V_W[i]) \quad \text{(E14)}$$

According to Formula (E14), the current $\Delta I_B$[j] is a value corresponding to the sum of products of the potential $V_X$[i,j] that is the first analog data and the potential $V_W$[i] that is the second analog data. Thus, when the current $\Delta I_B$[j] is calculated, the value of the sum of products of the first analog data and the second analog data can be obtained.

During the period from Time T09 to Time T10, when all of the wirings RW[1] to RW[m] except the wiring RW[i] are set to have a reference potential, the relation, $V_W$[g]=0 (here, g is an integer that is greater than or equal to 1 and less than or equal to m and not i), is satisfied. Thus, according to Formula (E14), $\Delta I_B$[j]=2k$V_X$[i,j]$V_W$[i] is outputted. In other words, the data corresponding to the product of the first analog data stored in the memory cell AM[i,j] and the second analog data corresponding to a selection signal supplied to the wiring RW[i] is outputted from the output terminal SPT[j] that is electrically connected to the wiring B[j].

Furthermore, a differential current outputted from the output terminal SPT[j+1] that is electrically connected to the wiring B[j+1] is expressed as $\Delta I_B$[j+1]=2k$V_X$[i,j+1]$V_W$[i]. The data corresponding to the product of the first analog data stored in the memory cell AM[i,j+1] and the second analog data corresponding to a selection signal supplied to the wiring RW[i] is outputted from the output terminal SPT[j+1] that is electrically connected to the wiring B[j+1].

<<Period from Time T10 to Time T11>>

During a period from Time T10 to Time T11, the ground potential is applied to the wiring RW[i]. The ground potential is applied to the second terminals of the capacitors C52 in the memory cells AM[i,1] to AM[i,n] and the memory cell AMref[i]. Thus, the potentials of the nodes N[i,1] to N[i,n] and the node Nref[i] return to the potentials during the period from Time T08 to Time T09.

<<Period from Time T11 to Time T12>>

During a period from Time T11 to Time T12, the wirings RW[1] to RW[m] except the wiring RW[i+1] are set to have the reference potential, and a potential higher than the reference potential by $V_W$[i+1] is applied to the wiring RW[i+1]. At this time, as in the operation during the period from Time T09 to Time T10, the potential $V_W$[i+1] is applied to the second terminals of the capacitors C52 in the memory cells AM[i+1,1] to AM[i+1,n] and the memory cell AMref [i+1], so that the potentials of the gates of the transistors Tr62 increase.

The potential $V_W$[i+1] corresponds to the second analog data.

As described above, the capacitive coupling coefficients of the memory cells AM and the memory cell AMref are each 1. When the potential $V_W$[i+1] is applied to the second terminals of the capacitors C52 in the memory cell AM[i+1,j], the memory cell AM[i+1,j+1], and the memory cell AMref[i+1], the potentials of the node N[i+1,j], the node N[i+1,j+1], and the node Nref[i+1] each increase by $V_W$[i+1].

When the potentials of the node N[i+1,j], the node N[i+1,j+1], and the node Nref[i+1] increase by $V_W$[i+1], the amount of current flowing in each of the transistors Tr62 in the memory cell AM[i+1,j], the memory cell AM[i+1,j+1], and the memory cell AMref[i+1] increases. When the current flowing in the transistor Tr62 in the memory cell AM[i+1,j] is denoted by I[i+1,j], the current flowing from the output terminal OT[j] of the column output circuit OUT[j] to the wiring B[j] increases by $I[i+1,j]-I_0[i+1,j]$ (denoted by ΔI[i+1,j] in FIG. 19). Similarly, when the current flowing in the transistor Tr62 in the memory cell AM[i+1,j+1] is denoted by I[i+1,j+1], the current flowing from the output terminal OT[j+1] of the column output circuit OUT[$_j$+1] to the wiring B[j+1] increases by $I[i+1,j+1]-I_0[i+1,j+1]$ (denoted by ΔI[i+1,j+1] in FIG. 19). When the current flowing in the transistor Tr62 in the memory cell AMref[i+1] is denoted by $I_{ref}$[i+1], the current flowing from the output terminal OTref of the reference column output circuit Cref to the wiring Bref increases by $I_{ref}[i+1]-I_{ref0}[i+1]$ (denoted by $\Delta I_{ref}$[i+1] in FIG. 19).

The operation during the period from Time T11 to Time T12 can be similar to the operation during the period from Time T09 to Time T10. Thus, when Formula (F14) is applied to the operation during the period from Time T11 to Time T12, the differential current that is outputted from the wiring B[j] is expressed as $\Delta I_B[j]=2kV_x[i+1,j]V_W[i+1]$. In other words, the data corresponding to the product of the first analog data stored in the memory cell AM[i+1,j] and the second analog data corresponding to a selection signal applied to the wiring RW[i+1] is outputted from the output terminal SPT[j] that is electrically connected to the wiring B[j].

Furthermore, the differential current outputted from the wiring B[j+1] is expressed as $\Delta I_B[j+1]=2kV_x[i+1,j+1]V_W[i+1]$. The data corresponding to the product of the first analog data stored in the memory cell AM[i+1,j+1] and the second analog data corresponding to a selection signal applied to the wiring RW[i+1] is outputted from the output terminal SPT [j+1] that is electrically connected to the wiring B[j+1].

<<Period from Time T12 to Time T13>>

During a period from Time T12 to Time T13, the ground potential is applied to the wiring RW[i+1]. In this period, the ground potential is applied to the second terminals of the capacitors C52 in the memory cells AM[i+1,1] to AM[i+1,n] and the memory cell AMref[i+1], and the potentials of nodes N[i+1,1] to N[i+1,n] and the node Nref[i+1] return to the potentials in the period from Time T10 to Time T11.

<<Period from Time T13 to Time T14>>

During a period from Time T13 to Time T14, the wirings RW[1] to RW[m] except the wiring RW[i] and the wiring RW[i+1] are set to have the reference potential, a potential higher than the reference potential by $V_{W2}$[i] is applied to the wiring RW[i], and a potential lower than the reference potential by $V_{W2}$[i+1] is applied to the wiring RW[i+1]. At this time, as in the operation during the period from Time T09 to Time T10, the potential $V_{W2}$[i] is supplied to the second terminals of the capacitors C52 in the memory cells AM[i,1] to AM[i,n] and the memory cell AMref[i], so that potentials of the gates of the transistors Tr62 in the memory cells AM[i,1] to AM[i,n] and the memory cell AMref[i] increase. Concurrently, the potential $-V_{W2}$[i+1] is applied to the second terminals of the capacitors C52 in the memory cells AM[i+1,1] to AM[i+1,n] and the memory cell AMref [i+1], so that the potentials of the gates of the transistors Tr62 in the memory cells AM[i+1,1] to AM[i+1,n] and the memory cell AMref[i+1] decrease.

The potential $V_{W2}$[i] and the potential $V_{W2}$[i+1] are potentials each corresponding to the second analog data.

Note that the capacitive coupling coefficients of the memory cell AM and the memory cell AMref are each 1. When the potential $V_{W2}$[i] is supplied to the second terminals of the capacitors C52 in the memory cell AM[i,j], the memory cell AM[i,j+1], and the memory cell AMref[i], the potentials of the node N[i,j], the node N[i,j+1], and the node Nref[i] each increase by $V_{W2}$[i]. When the potential $-V_{W2}$[i+1] is supplied to the second terminals of the capacitors C52 in the memory cell AM[i+1,j], the memory cell AM[i+1,j+1], and the memory cell AMref[i+1], the potentials of the node N[i+1,j], the node N[i+1,j+1], and the node Nref[i+1] each decrease by $V_{W2}$[i+1].

When each of the potentials of the node N[i,j], the node N[i,j+1], and the node Nref[i] increases by $V_{W2}$[i], the amount of current flowing in each of the transistors Tr62 in the memory cell AM[i,j], the memory cell AM[i,j+1], and the memory cell AMref[i] increases. Here, the current flowing in the transistor Tr62 in the memory cell AM[i,j] is denoted by I[i,j], the current flowing in the transistor Tr62 in the memory cell AM[i,j+1] is denoted by I[i,j+1], and the current flowing in the transistor Tr62 in the memory cell AMref[i] is denoted by $I_{ref}$[i].

When the potentials of the node N[i+1,j], the node N[i+1,j+1], and the node Nref[i+1] each decrease by $V_{W2}$[i+1], the amount of current flowing in each of the transistors Tr62 in the memory cell AM[i+1,j], the memory cell AM[i+1,j+1], and the memory cell AMref[i+1] decreases. Here, the current flowing in the transistor Tr62 in the memory cell AM[i+1,j] is denoted by $I_2$[i,j], the current flowing in the transistor Tr62 in the memory cell AM[i+1,j+1] is denoted by $I_2$[i,j+1], and the current flowing in the transistor Tr62 in the memory cell AMref[i+1] is denoted by $I_{2ref}$[i+1].

At this time, the current flowing from the output terminal OT[j] of the column output circuit OUT[j] to the wiring B[j] increases by $(I_2[i,j]-I_0[i,j])+(I_2[i+1,j]-I_0[i+1,j])$ (denoted by ΔI[j] in FIG. 19). The current flowing from the output terminal OT[j+1] of the column output circuit OUT[j+1] to the wiring B[j+1] increases by $(I_2[i,j+1]-I_0[i,j+1])+(I_2[i+1,j+1]-I_0[i+1,j+1])$ (denoted by ΔI[j+1] in FIG. 19, which is a negative current). The current flowing from the output terminal OTref of the reference column output circuit Cref to the wiring Bref increases by $(I_{ref}[i,j]-I_{ref0}[i,j])+(I_{ref}[i+1,j]-I_{ref0}[i+1,j])$ (denoted by $\Delta I_{Bref}$ in FIG. 19).

The operation during the period from Time T13 to Time T14 can be similar to the operation during the period from Time T09 to Time T10. When Formula (E14) is applied to the operation during the period from Time T13 to Time T14, the differential current that is outputted from the wiring B[j] is expressed as $\Delta I_B[j]=2k\{V_X[i,j]V_{W2}[i]-V_x[i+1,j]V_{W2}[i+1]\}$. Thus, the data corresponding to the sum of products of the first analog data stored in each of the memory cell AM[i,j] and the memory cell AM[i+1,j] and the second analog data corresponding to a selection signal applied to each of the wiring RW[i] and the wiring RW[i+1] is outputted from the output terminal SPT[j] that is electrically connected from the wiring B[j].

The differential current outputted from the wiring B[j+1] is expressed as $\Delta IB[j+1]=2k\{V_X[i,j+1]V_{W2}[i]-V_x[i+1,j+1]V_{W2}[i+1]\}$. The data corresponding to the product of the first analog data stored in each of the memory cell AM[i,j+1] and the memory cell AM[i+1,j+1] and the second analog data corresponding to a selection signal applied to each of the wiring RW[i] and the wiring RW[i+1] is outputted from the output terminal SPT[j+1] that is electrically connected to the wiring B[j+1].

<<After Time T14>>

From and after Time T14, the ground potential is applied to the wiring RW[i] and the wiring RW[i+1]. At this time, the ground potential is applied to the second terminals of the capacitors C52 in the memory cells AM[i,1] to AM[i,n], the memory cells AM[i+1,1] to AM[i+1,n], the memory cell AMref[i], and the memory cell AMref[i+1]. Thus, the potentials of the nodes N[i,1] to N[i,n], the nodes N[i+1,1] to N[i+1,n], the node Nref[i], and the node Nref[i+1] return to the potentials in the period from Time T12 to Time T13.

As described above, with the circuit configuration shown in FIG. 11, the product-sum operation necessary for calculation of the above neural network can be executed. In addition, since the product-sum operation is not operation using digital values, a large-scale digital circuit is not necessary, and the circuit size can be reduced.

Here, the first analog data serves as weight coefficients and the second analog data corresponds to neuron outputs, whereby calculation of the weighted sums of the neuron outputs can be conducted concurrently. Thus, data corresponding to results of the calculation of the weighted sums, that is, synapse inputs can be obtained as the output signals. Specifically, weight coefficients $w_{s[k]\cdot 1}^{(k)}$ to $w_{s[k]\cdot Q[k-1]}^{(k)}$ of the s[k]-th neuron in the k-th layer are stored as the first analog data in the memory cells AM[1,j] to AM[m,j] and output signals $z_{1\cdot s[k]}^{(k-1)}$ to $z_{Q[k-1]\cdot s[k]}^{(k-1)}$ of the neurons in the (k−1)-th layer are supplied as the second analog data to the wirings RW[1] to RW[m], whereby the summation $u_{s[k]}^{(k)}$ of signals input to the s[k]-th neuron in the k-th layer can be obtained. That is, the product-sum operation expressed by Formula (D1) can be performed with the semiconductor device 700.

In the case where weight coefficients are updated in supervised learning, weight coefficients $w_{1\cdot s[k]}^{(k+1)}$ to $w_{Q[k+1]s[k]}^{(k+1)}$ multiplied by when a signal is transmitted from the s[k]-th neuron in the k-th layer to neurons in the (k+1)-th layer are stored as the first analog data in the memory cells AM[1,j] to AM[m,j] and errors $\delta_1^{(k+1)}$ to $\delta_{Q[k+1]}^{(k+1)}$ of the neurons in the (k+1)-th layer are supplied as the second analog data to the wirings RW[1] to RW[m], whereby a value of $\Sigma w_{s[k+1]\cdot s[k]}^{(k+1)}\cdot\delta_{s[k+1]}^{(k+1)}$ in Formula (D3) can be obtained from the differential current $\Delta I_B[j]$ flowing through the wiring B[j]. That is, part of the operation expressed by Formula (D3) can be performed with the semiconductor device 700.

In an electronic device including the sensor 441 and the display unit 100, information about an incident angle and illuminance of external light obtained from the optical sensor 443 and information about inclination of the electronic device, sensed by the acceleration sensor 446 in the electronic device, are set as data inputted to a neuron in the input layer (first layer), and a set value corresponding to the luminance and color tone meeting the preference of users of the electronic device is set as teacher data. This allows the data processing circuit 465 to output the set value corresponding to the luminance and color tone meeting the preference of the users from an output layer (L-th layer) in accordance with a calculation result of the hierarchical neural network.

Example 2 of Circuit for Constructing Hierarchical Neural Network

Next, another configuration example of a product-sum operation circuit that is different from that in the semiconductor device 700 is described.

Figure 20:
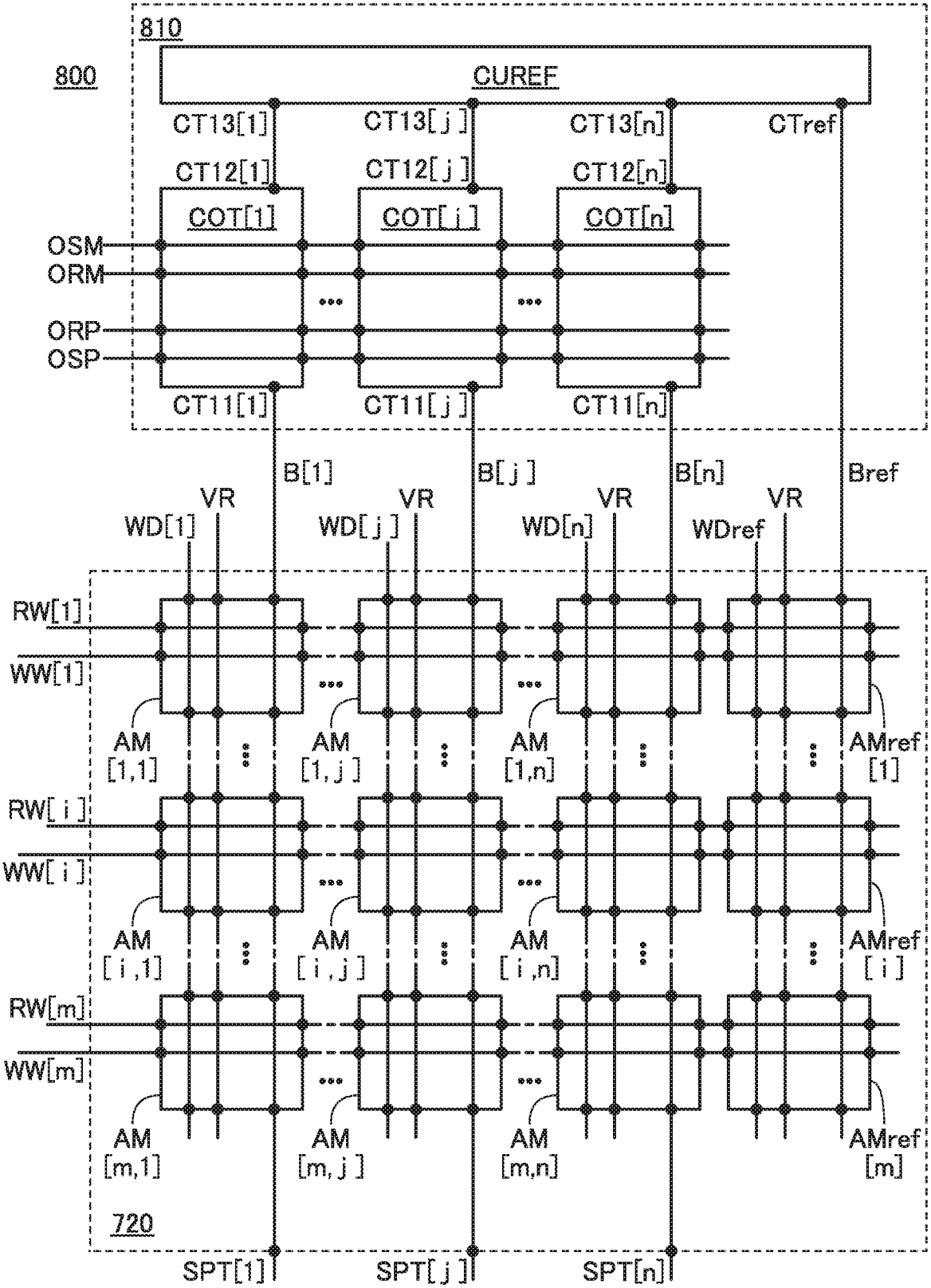
FIG. 20 illustrates an example of a semiconductor device.

FIG. 20 is a block diagram of the semiconductor device 800 that serves as a product-sum operation circuit. The semiconductor device 800 includes an offset circuit 810 and a memory cell array 720.

The offset circuit 810 includes column output circuits COT[1] to COT[n] (here, n is an integer greater than or equal to 1) and a power supply circuit CUREF.

In Example 2 of circuit for constructing hierarchical neural network, description of portions of the memory cell array 720 which are common to the respective portions of the memory cell array 720 in Example 1 of circuit for constructing hierarchical neural network is omitted. The same applies to the memory cell AM and the memory cell AMref included in the memory cell array 720 in Example 2 and connection configuration of wirings therewith.

The column output circuit COT[j] includes a terminal CT11[*j*] and a terminal CT12[*j*]. The power supply circuit CUREF includes terminals CT13[1] to CT13[*n*] and a terminal CTref.

The wiring ORP is electrically connected to the column output circuits COT[1] to COT[n]. The wiring OSP is electrically connected to the column output circuits COT[1] to COT[n]. A wiring ORM is electrically connected to the column output circuits COT[1] to COT[n]. A wiring OSM is electrically connected to the column output circuits COT[1] to COT[n]. The wirings ORP, OSP, ORM, and OSP are each a wiring for supplying a control signal to the offset circuit 810.

The terminal CT11[*j*] of the column output circuit COT[j] is electrically connected to the wiring B[j].

The terminal CTref of the power supply circuit CUREF I is electrically connected to the wiring Bref. In addition, the terminal CT13[*j*] of the power supply circuit CUREF is electrically connected to the terminal CT12[*j*] of the column output circuit COT[j].

The wiring B[j] functions as a wiring for supplying a signal from the column output circuit COT[j] to the memory cells AM in the j-th column in the memory cell array 720.

The wiring Bref functions as a wiring for supplying a signal from the power supply circuit CUREF to memory cells AMref[1] to AMref[m].

In the semiconductor device 800 in FIG. 20, only the following components are shown: the offset circuit 810; the memory cell array 720; the column output circuit COT[1]; the column output circuit COT[j]; the column output circuit COT[n]; the power supply circuit CUREF; the terminal CT11[1]; the terminal CT11[*j*]; the terminal CT11[*n*]; the terminal CT12[1]; the terminal CT12[*n*]; the terminal CT13[1]; the terminal CT13[*j*]; the terminal CT13[*n*]; the terminal CTref; the output terminal SPT[j]; the output terminal SPT[n]; the memory cell AM[1,1]; the memory cell AM[i,1]; the memory cell AM[m,1]; the memory cell AM[1,j]; the memory cell AM[i,j]; the memory cell AM[m,j]; the memory cell AM[1,n]; the memory cell AM[i,n]; a memory cell AM[m,n]; the memory cell AMref[1]; the memory cell AMref[i]; the memory cell AMref[m]; the wiring OSP; the wiring ORP; the wiring ORM; the wiring OSM; the wiring B[1]; the wiring B[j]; the wiring B[n]; the wiring Bref; the wiring WD[1]; the wiring WD[j]; the wiring WD[n]; the wiring WDref; the wiring VR; a wiring RW[1]; the wiring RW[i]; the wiring RW[m]; the wiring WW[1]; the wiring WW[i]; and the wiring WW[m]. Other circuits, wirings, elements, and reference numerals thereof are not shown.

FIG. 20 shows a configuration example of the semiconductor device 800, and depending on circumstances or conditions or as needed, the configuration of the semiconductor device 800 can be changed. For example, depending on a circuit configuration of the semiconductor device 800, one wiring may be provided to serve as the wiring WD[j] and the wiring VR. Alternatively, depending on a circuit configuration of the semiconductor device 800, one wiring may be provided to serve as the wiring ORP and the wiring OSP, or one wiring may be provided to serve as the wiring ORM and the wiring OSM.

<<Offset Circuit 810>>

Figure 21:
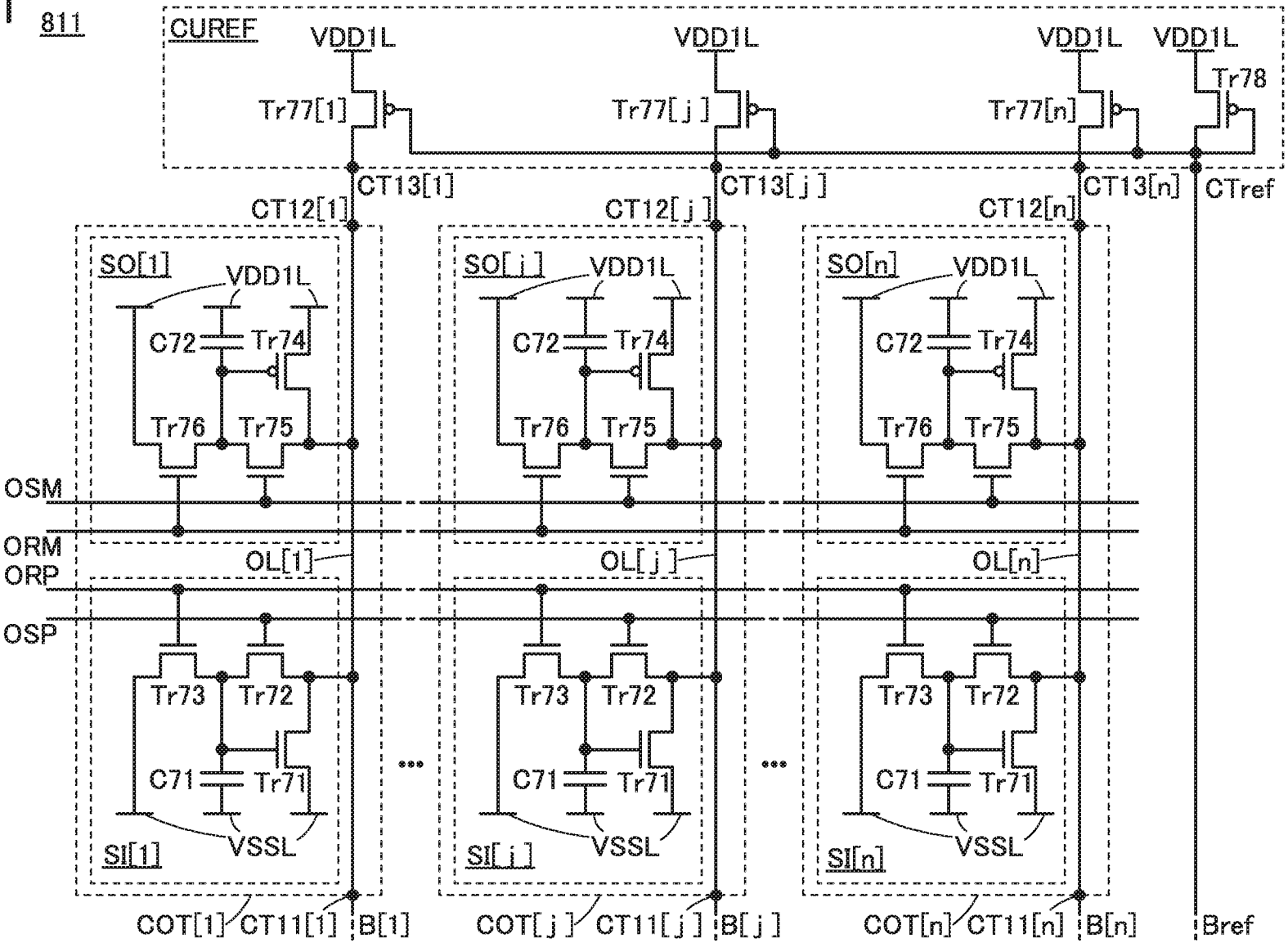
FIG. 21 is a circuit diagram showing an example of an offset circuit in the semiconductor device in FIG. 20.

Next, an example of a circuit configuration that can be applied for the offset circuit 810 is described. FIG. 21 shows an offset circuit 811 as an example of the offset circuit 810.

The offset circuit 811 is electrically connected to the wiring VDD1L and the wiring VSSL for supplying a power supply voltage. Specifically, each of the column output circuits COT[1] to COT[n] are electrically connected to the wiring VDD1L and the wiring VSSL, and the current supply circuit CUREF is electrically connected to the wiring VDD1L. The wiring VDD1L supplies the high-level potential. The wiring VSSL supplies the low-level potential.

The circuit configuration of the inside of the column output circuit COT[j] is described first. The column output circuit COT[j] includes a circuit SI[j], a circuit SO[j], and a wiring OL[j]. In addition, the circuit SI[j] includes transistors Tr71 to Tr73 and a capacitor C71, and the circuit SO[j] includes transistors Tr74 to Tr76 and a capacitor C72. The transistors Tr71 to Tr73, the transistor Tr75, and the transistor Tr76 are n-channel transistors, and the transistor Tr74 is a p-channel transistor.

In the circuit SI[j] of the column output circuit COT[j], a first terminal of the transistor Tr71 is electrically connected to the wiring OL[j], a second terminal of the transistor Tr71 is electrically connected to the wiring VSSL, and a gate of the transistor Tr71 is electrically connected to a first terminal of the capacitor C71. A first terminal of a transistor Tr72 is electrically connected to the wiring OL[j], a second terminal of the transistor Tr72 is electrically connected to the first terminal of the capacitor C71, and a gate of the transistor Tr72 is electrically connected to the wiring OSP. A first terminal of the transistor Tr73 is electrically connected to the first terminal of the capacitor C71, a second terminal of the transistor Tr73 is electrically connected to the wiring VSSL, and a gate of the transistor Tr73 is electrically connected to the wiring ORP. A second terminal of the capacitor C71 is electrically connected to the wiring VSSL. With such a configuration of the circuit SI[j], the circuit SI[j] functions as a current sink circuit discharging current that is to flow in the wiring OL[j].

In the circuit SO[j] of the column output circuit COT[j], a first terminal of the transistor Tr74 is electrically connected to the wiring OL[j], a second terminal of the transistor Tr74 is electrically connected to the wiring VDD1L, and a gate of the transistor Tr74 is electrically connected to a first terminal of the capacitor C72. A first terminal of the transistor Tr75 is electrically connected to the wiring OL[j], a second terminal of the transistor Tr75 is electrically connected to a first terminal of the capacitor C72, and a gate of the transistor Tr75 is electrically connected to the wiring OSM. A first terminal of the transistor Tr76 is electrically connected to the first terminal of the capacitor C72, a second terminal of the transistor Tr76 is electrically connected to the wiring VDD1L, and a gate of the transistor Tr76 is electrically connected to the wiring ORM. A second terminal of the capacitor C72 is electrically connected to the wiring VDD1L. With such a configuration of the circuit SO[j], the circuit SO[j] functions as a current sink circuit discharging current that is to flow in the wiring OL[j].

Note that the each of transistors Tr71 to Tr73, transistor Tr75, and the transistor Tr76 is preferably an OS transistor. Each of channel formation regions of the transistors Tr71 to Tr73, transistor Tr75, and the transistor Tr76 preferably includes CAC-OS described in Embodiment 9.

The OS transistor has a characteristic of extremely low off-state current. Thus, when the OS transistor is in an off state, the amount of leakage current flowing between a source and a drain can be extremely small. With use of the OS transistors as the transistors Tr71 to Tr73, the transistor Tr75 and the transistor Tr76, the leakage current of each of the transistors Tr71 to Tr73, the transistor Tr75 and the transistor Tr76 can be suppressed, which enables the product-sum operation circuit to have high calculation accuracy in some cases.

Next, an internal structure of the current supply circuit CUREF is described. The current supply circuit CUREF includes transistors Tr77[1] to Tr77[*n*] and a transistor Tr78. Note that each of the transistors Tr77[1] to Tr77[*n*] and the transistor Tr78 is a p-channel transistor.

A first terminal of the transistor Tr77[*j*] is electrically connected to the terminal CT13[*j*], a second terminal of the transistor Tr77[*j*] is electrically connected to the wiring VDD1L, and a gate of the transistor Tr77[*j*] is electrically connected to a gate of the transistor Tr78. A first terminal of the transistor Tr78 is electrically connected to the terminal CTref, a second terminal of the transistor Tr78 is electrically connected to the wiring VDD1L, and the gate of the transistor Tr78 is electrically connected to the terminal CTref. In other words, the current supply circuit CUREF functions as a current mirror circuit.

Thus, the current supply circuit CUREF has a function of equalizing the amount of current flowing between a source and a drain of the transistor Tr78 and the amount of current between a source and a drain of the transistor Tr77[*j*] using a potential of the terminal CTref as a reference.

The wiring OL[j] is a wiring for electrically connecting the terminal CT11[*j*] and the terminal CT12[*j*] of the column output circuit COT[j].

In the offset circuit 811 shown in FIG. 21, only the following components are shown: the column output circuit COT[1]; the column output circuit COT[j]; the column output circuit COT[n]; the current supply circuit CUREF; a circuit SI[1]; the circuit SI[j]; a circuit SI[n]; a circuit SO[1]; the circuit SO[j]; a circuit SO[n]; the terminal CT11[1]; the terminal CT11[*j*]; the terminal CT11[*n*]; the terminal CT12[1]; the terminal CT12[*j*]; the terminal CT12[*n*]; the terminal CT13[1]; the terminal CT13[*j*]; the terminal CT13[*n*]; the terminal CTref; the transistor Tr71; the transistor Tr72; the transistor Tr73; the transistor Tr74; the transistor Tr75; the transistor Tr76; the transistor Tr77[1]; the transistor Tr77[*j*]; the transistor Tr77[*n*]; the transistor Tr78; the capacitor C71; the capacitor C72; the wiring OL[1]; the wiring OL[j]; the wiring OL[n]; the wiring ORP; the wiring OSP; the wiring ORM; the wiring B[1]; the wiring B[j]; the wiring B[n]; the wiring Bref; the wiring VDD1L: and the wiring VSSL. Other circuits, wirings, elements, and reference numerals thereof are not shown.

The configuration of the offset circuit 810 in FIG. 20 is not limited to the offset circuit 811 in FIG. 21. Depending on circumstances or conditions or as needed, the configuration of the offset circuit 811 can be changed.

Operation Example 2

An example of operation of the semiconductor device 800 will be described. Note that the semiconductor device 800 described in this operation example includes an offset circuit 815 shown in FIG. 22 as the offset circuit 810 and the memory cell array 760 shown in FIG. 17 as the memory cell array 720 of the semiconductor device 800.

Figure 22:
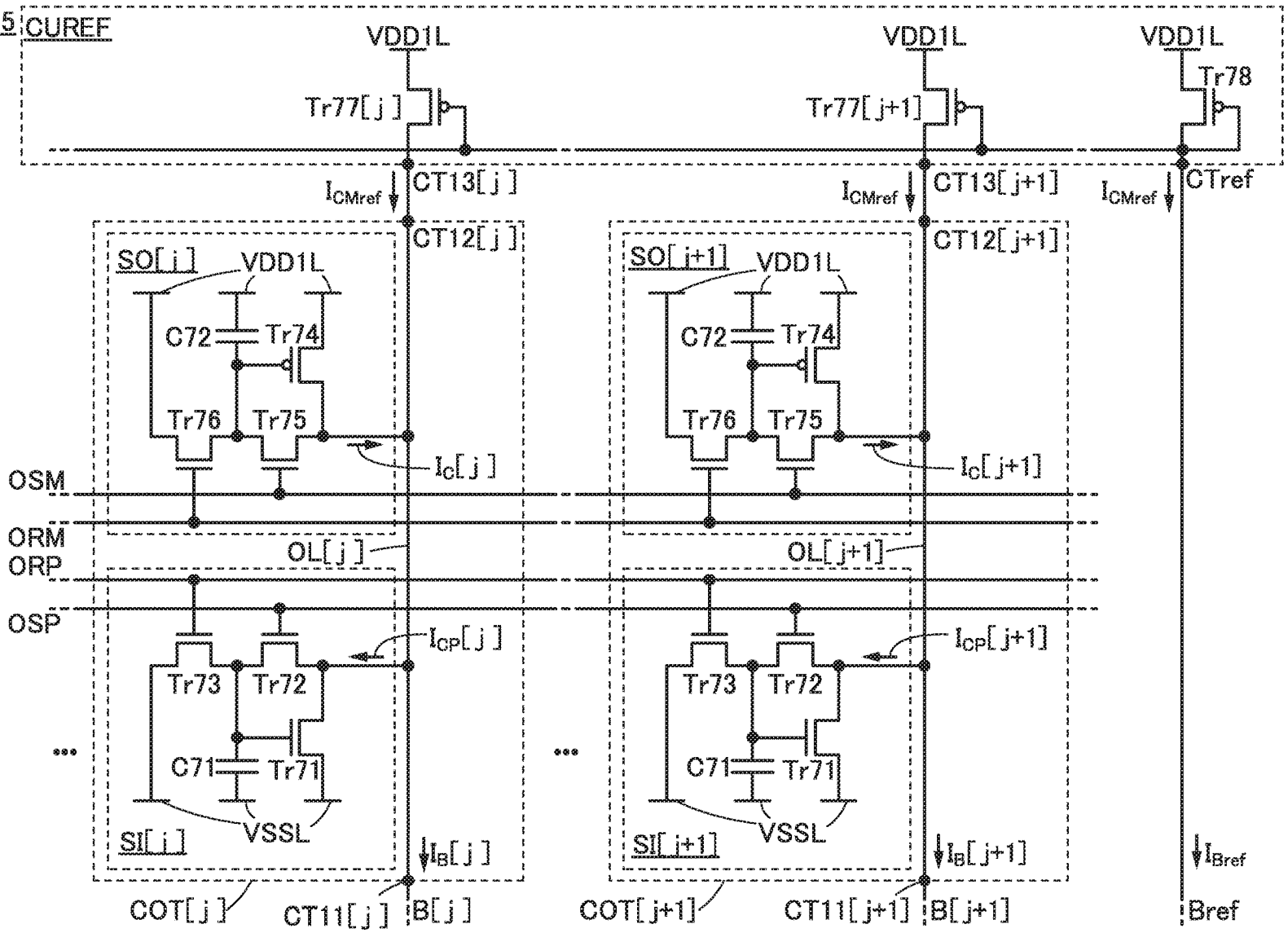
FIG. 22 is a circuit diagram showing an example of an offset circuit in the semiconductor device in FIG. 20.

The offset circuit 815 in FIG. 22 has the configuration similar to that of the offset circuit 811 in FIG. 21 and includes the column output circuit COT[j], the column output circuit COT[j+1], and the current supply circuit CUREF.

In the column output circuit COT[j] in FIG. 22, a current flowing from an electrical connection between the first terminal of the transistor Tr74 and the first terminal of the transistor Tr75 in the circuit SO[j] to the wiring OL[j] is denoted by $I_C$[j]. In the column output circuit COT[j+1], a current flowing from an electrical connection between the first terminal of the transistor Tr74 and the first terminal of the transistor Tr75 in a circuit SO[j+1] to the wiring OL[j+1] is denoted by $I_C$[j+1]. In the current supply circuit CUREF, a current flowing from the terminal CT13[*j*], a current flowing from a terminal CT13[*j*+1], and a current flowing from the terminal CTref are each denoted by $I_{CMref}$. Furthermore, in the column output circuit COT[j], a current flowing from the wiring OL[j] to an electrical connection between the first terminal of the transistor Tr71 and the first terminal of the transistor Tr72 in the circuit SI[j] is denoted by $I_{CP}$[j]. In the column output circuit COT[j+1], a current flowing from the wiring OL[j+1] to an electrical connection between the first terminal of the transistor Tr71 and the first terminal of the transistor Tr72 in the circuit SI[j+1] is denoted by $I_{CP}$[j+1]. Moreover, a current flowing from the terminal CT11[*j*] of the column output circuit COT[j] to the wiring B[j] is denoted by $I_B$[j], and a current flowing from a terminal CT11[*j*+1] of the column output circuit COT[j+1] to the wiring B[j+1] is denoted by $I_B$[j+1].

For the memory cell array 760 described in Operation example 2, the description of the memory cell array 760 in Operation example 1 is referred to.

Figure 23:
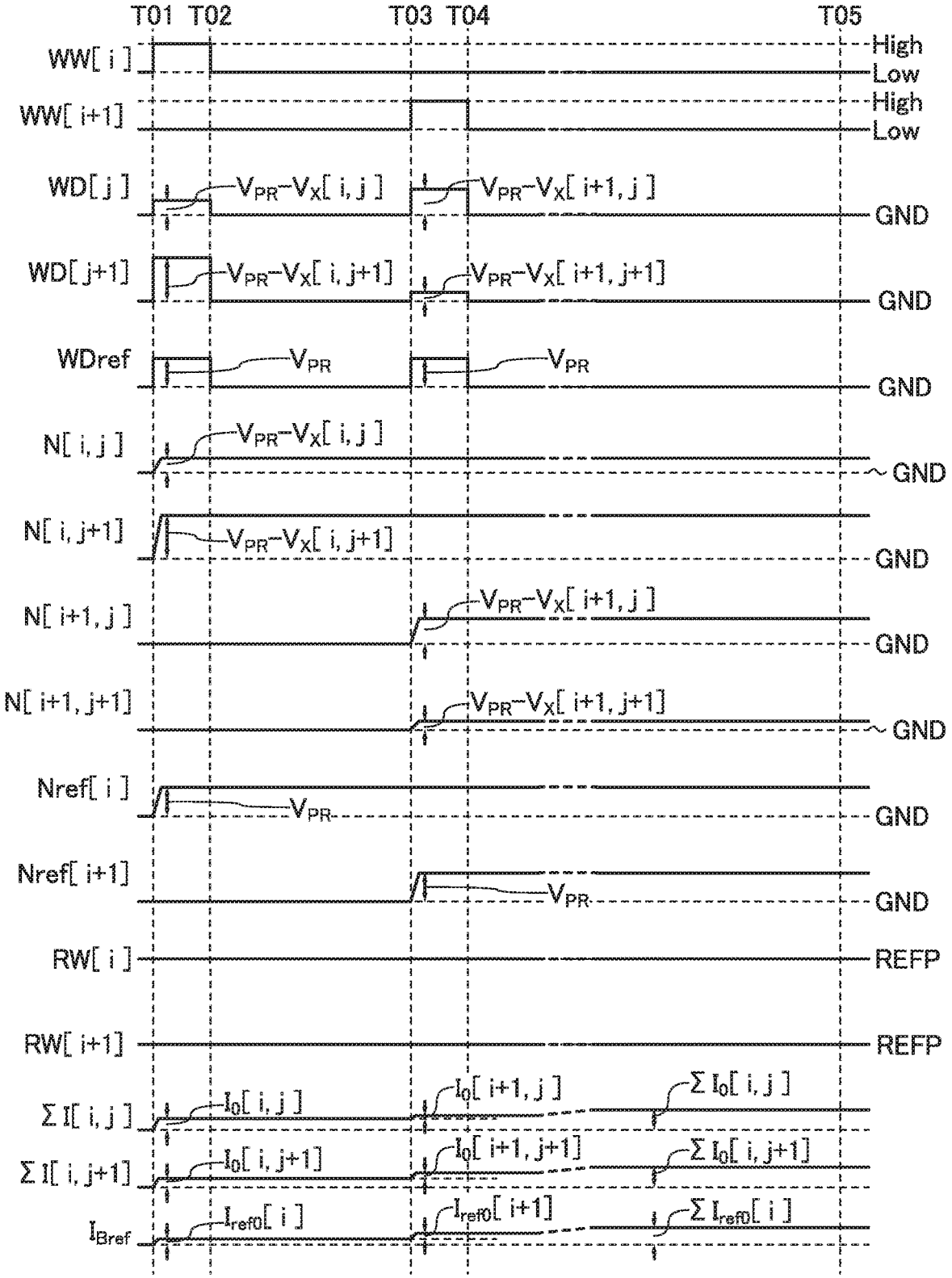
FIG. 23 is a timing chart showing an operation example of a semiconductor device.
Figure 24:
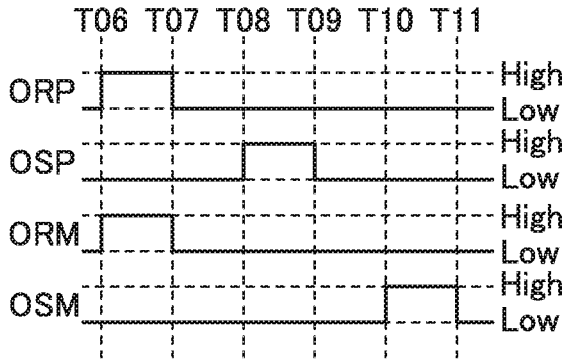
FIG. 24 is a timing chart showing an operation example of a semiconductor device.
Figure 25:
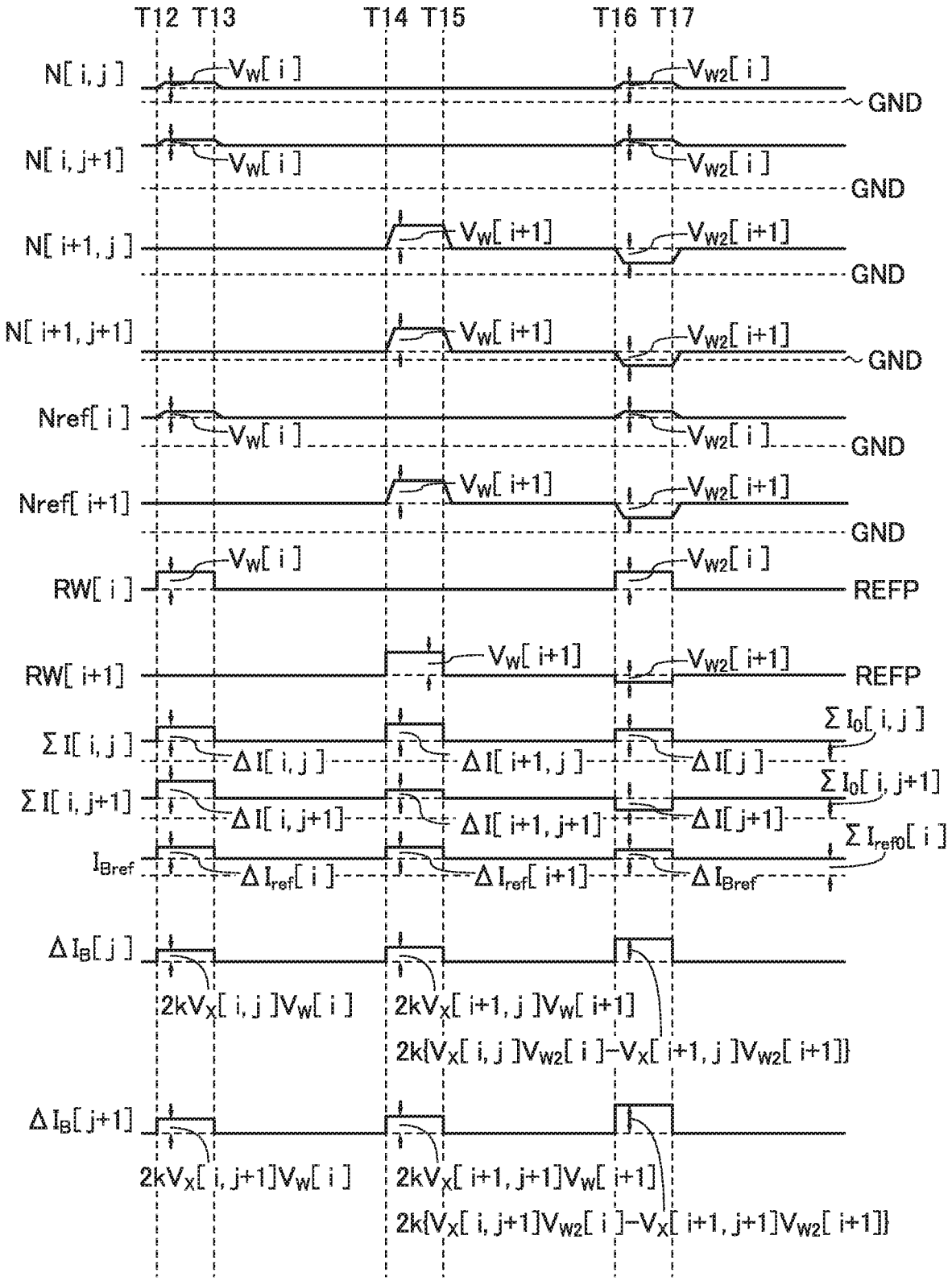
FIG. 25 is a timing chart showing an operation example of a semiconductor device.

FIG. 23 to FIG. 25 are timing charts showing the operation example of the semiconductor device 800. The timing chart in FIG. 23 shows changes in potentials during a period from Time T01 to Time T05 of the wiring WW[i], the wiring WW[i+1], the wiring WD[j], the wiring WD[j+1], the wiring WDref, the node N[i,j], the node N[i,j+1], the node N[i+1,j], the node N[i+1,j+1], the node Nref[i], the node Nref[i+1], the wiring RW[i], and the wiring RW[i+1]. This timing chart also shows the amount of changes in a current ΣI[i,j], a current ΣI[i,j+1], and a current $I_{Bref}$. Note that the current ΣI[i,j] is a value of current flowing in the transistor Tr62 of the memory cell AM[i,j], which is obtained by summing over i from 1 to m, and the current ΣI[i,j+1] is the sum of the amounts of current flowing in the transistor Tr62 of the memory cell AM[i,j+1], which is obtained by summing over i from 1 to m. In the timing chart of FIG. 23, the potentials of the wirings ORP, OSP, ORM, and OSM are constantly low-level potentials (not shown).

The timing chart in FIG. 24 shows the operation during the period after Time T05, which is shown in the timing chart in FIG. 23, to Time T11. The timing chart in FIG. 24 shows the changes in potentials during a period from Time T06 to Time T11 of the wirings ORP, OSP, ORM, and OSM. Note that in Time T06 to Time T11, the potentials of the wiring WW[i], the wiring WW[i+1], the wiring WD[j], the wiring WD[j+1], the wiring WDref, the node N[i,j], the node N[i,j+1], the node N[i+1,j], the node N[i+1,j+1], the node Nref[i], the node Nref[i+1], the wiring RW[i], and the wiring RW[i+1] and the amounts of the current ΣI[i,j], the current ΣI[i,j+1], and the current $I_{Bref}$ are not changed; thus, the changes in the potentials of the wirings and the nodes and in the currents are not shown in FIG. 24.

The timing chart in FIG. 25 shows the operation during the period after Time T11, which is shown in the timing chart in FIG. 24, to Time T17. The timing chart in FIG. 23 shows the changes in potentials during a period from Time T12 to Time T17 of the node N[i,j], the node N[i,j+1], the node N[i+1,j], the node N[i+1,j+1], the node Nref[i], the node Nref[i+1], the wiring RW[i], and the wiring RW[i+1] and the amounts of the current ΣI[i,j], the current ΣI[i,j+1], and the current $I_{Bref}$. The potentials of the wiring WW[i], the wiring WW[i+1], the wiring ORP, the wiring OSP, the wiring ORM, and the wiring OSM are kept at a low level without any change, and the potentials of the wiring WD[j], the wiring WD[j+1], and the wiring WDref are kept at a ground potential without any change. Thus, in the timing chart in FIG. 25, the changes in potentials of the wiring WW[i], the wiring WW[i+1], the wiring WD[j], the wiring WD[j+1], the wiring WDref, the wiring ORP, the wiring OSP, the wiring ORM, and the wiring OSM are not shown. The timing chart in FIG. 25 also shows the changes in the amounts of the current $\Sigma I_B$[j] and the current $\Sigma I_B$[j+1], which are described later.

<<Period from Time T01 to Time T02>>

During a period from Time T01 to Time T02, the high-level potential (denoted by High in FIG. 23) is supplied to the wiring WW[i], and the low-level potential (denoted by Low in FIG. 23) is supplied to the wiring WW[i+1]. Furthermore, a potential higher than the ground potential (denoted by GND in FIG. 23) by $V_{PR}-V_X$[i,j] is applied to the wiring WD[j], the potential higher than the ground potential by $V_{PR}-V_X$[i,j] is applied to the wiring WD[j+1], and a potential higher than the ground potential by $V_{PR}$ is applied to the wiring WDref. Moreover, a reference potential (denoted by REFP in FIG. 23) is applied to the wiring RW[i] and the wiring RW[i+1].

The potential $V_X$[i,j] and the potential $V_X$[i,j+1] each correspond to the first analog data. The potential $V_{PR}$ corresponds to the reference analog data.

In this period, the high-level potential is supplied to the gates of the transistors Tr61 in the memory cell AM[i,j], the memory cell AM[i,j+1], and the memory cell AMref[i]; accordingly, the transistors Tr61 in the memory cell AM[i,j], the memory cell AM[i,j+1], and the memory cell AMref[i] are turned on. Thus, in the memory cell AM[i,j], the wiring WD[j] and the node N[i,j] are electrically connected to each other, and the potential of the node N[i,j] is $V_{PR}-V_X[i,j]$. In the memory cell AM[i,j+1], the wiring WD[j+1] and the node N[i,j+1] are electrically connected to each other, and the potential of the node N[i,j+1] is $V_{PR}-V_X[i,j+1]$. In the memory cell AMref[i], the wiring WDref and the node Nref[i] are electrically connected to each other, and the potential of the node Nref[i] is $V_{PR}$.

A current flowing from the first to second terminal of the transistor Tr62 in each of the memory cell AM[i,j], the memory cell AM[i,j+1], and the memory cell AMref[i] is considered. The current $I_0[i,j]$ flowing from the wiring B[j] to the second terminal through the first terminal of the transistor Tr62 in the memory cell AM[i,j] can be expressed by Formula (E1) described in Operation example 1.

In the formula, k is a constant determined by the channel length, the channel width, the mobility, the capacitance of a gate insulating film, and the like of the transistor Tr62. Furthermore, $V_{th}$ is a threshold voltage of the transistor Tr62.

At this time, the current flowing from the terminal CT11 [*j*] of the column output circuit COT[j] to the wiring B[j] is $I_0[i,j]$.

Similarly, the current $I_0[i,j+1]$ flowing from the wiring B[j+1] to the second terminal of the transistor Tr62 in the memory cell AM[i,j+1] through the first terminal thereof can be expressed by Formula (E2) as in Operation example 1.

At this time, the current flowing from the terminal CT11 [*j*+1] of the column output circuit COT[j+1] to the wiring B[j+1] is $I_0[i,j+1]$.

The current $I_{ref0}[i]$ flowing from the wiring Bref to the second terminal of the transistor Tr62 in the memory cell AMref[i] through the first terminal thereof can be expressed by Formula (E3) described in Operation example 1.

At this time, the current flowing from the terminal CTref of the current supply circuit CUREF to the wiring Bref is $I_{ref0}[i]$.

Note that since the low-level potential is supplied to the gates of the transistors Tr61 in the memory cell AM[i+1,j], the memory cell AM[i+1,j+1], and the memory cell AMref [i+1], the transistors Tr61 in the memory cell AM[i+1,j], the memory cell AM[i+1,j+1], and the memory cell AMref[i+1] are turned off. Thus, the potentials are not retained at the node N[i+1,j], the node N[i+1,j+1], and the node Nref[i+1].

<<Period from Time T02 to Time T03>>

During a period from Time T02 to Time T03, the low-level potential is applied to the wiring WW[i]. At this time, the low-level potential is supplied to the gates of the transistors Tr61 in the memory cell AM[i,j], the memory cell AM[i,j+1], and the memory cell AMref[i], and accordingly, the transistors Tr61 in the memory cells AM[i,j], AM[i,j+1], and AMref[i] are turned off.

The low-level potential has been applied to the wiring WW[i+1] continuously since before Time T02. Thus, the transistors Tr61 in the memory cell AM[i+1,j], the memory cell AM[i+1,j+1], and the memory cell AMref[i+1] have been kept in an off state since before Time T02.

Since the transistors Tr61 in the memory cell AM[i,j], the memory cell AM[i,j+1], the memory cell AM[i+1,j], the memory cell AM[i+1,j+1], the memory cell AMref[i], and the memory cell AMref[i+1] are each in an off state as described above, the potentials at the node N[i,j], the node N[i,j+1], the node N[i+1,j], the node N[i+1,j+1], the node Nref[i], and the node Nref[i+1] are held in a period from Time T02 to Time T03.

In particular, when an OS transistor is used as each of the transistors Tr61 in the memory cell AM[i,j], the memory cell AM[i,j+1], the memory cell AM[i+1,j], the memory cell AM[i+1,j+1], the memory cell AMref[i], and the memory cell AMref[i+1] as described in the circuit configuration of the semiconductor device 700, the amount of leakage current flowing between the source and the drain of each of the transistors Tr61 can be made small, which makes it possible to hold the potentials at the nodes for a long time.

During the period from Time T02 to Time T03, the ground potential is applied to the wiring WD[j], the wiring WD[j+1], and the wiring WDref Since the transistors Tr61 in the memory cell AM[i,j], the memory cell AM[i,j+1], the memory cell AM[i+1,j], the memory cell AM[i+1,j+1], the memory cell AMref[i], and the memory cell AMref[i+1] are each in an off state, the potentials held at the nodes in the memory cell AM[i+1,j+1], the memory cell AM[i,j+1], the memory cell AM[i+1,j], the memory cell AM[i+1,j+1], the memory cell AMref[i], and the memory cell AMref[i+1] are not rewritten by application of potentials from the wiring WD[j], the wiring WD[j+1], and the wiring WDref.

<<Period from Time T03 to Time T04>>

During a period from Time T03 to Time T04, the low-level potential is applied to the wiring WW[i], and a high-level potential is applied to the wiring WW[i+1]. Furthermore, the potential higher than the ground potential by $V_{PR}-V_x[i+1,j]$ is applied to the wiring WD[j], the potential higher than the ground potential by $V_{PR}-V_x[i+1,j+1]$ is applied to the wiring WD[j+1], and the potential higher than the ground potential by $V_{PR}$ is applied to the wiring WDref. Moreover, the reference potential is continuously being applied to the wiring RW[i] and the wiring RW[i+1] continuously since Time T02.

Note that the potential $V_x[i+1,j]$ and the potential $V_x[i+1,j+1]$ are each a potential corresponding to the first analog data.

In this period, the high-level potential is supplied to the gates of the transistors Tr61 in the memory cell AM[i+1,j], the memory cell AM[i+1,j+1], and the memory cell AMref [i+1], and accordingly, the transistors Tr61 in the memory cell AM[i+1,j], the memory cell AM[i+1,j+1], and the memory cell AMref[i+1] are each turned on. Thus, the node N[i+1,j] in the memory cell AM[i+1,j] is electrically connected to the wiring WD[j], and the potential of the node N[i+1,j] becomes $V_{PR}-V_x[i+1,j]$. In the memory cell AM[i+1,j+1], the wiring WD[j+1] and the node N[i+1,j+1] are electrically connected to each other, and the potential of the node N[i+1,j+1] becomes $V_{PR}-V_x[i+1,j+1]$. In the memory cell AMref[i+1], the wiring WDref and the node Nref[i+1] are electrically connected to each other, and the potential of the node Nref[i+1] becomes $V_{PR}$.

The current flowing from the first to second terminal of the transistor Tr62 in each of the memory cell AM[i+1,j], the memory cell AM[i+1,j+1], and the memory cell AMref[i+1] is considered. The current $I_0[i+1,j]$ flowing from the wiring B[j] to the second terminal through the first terminal of the transistor Tr62 in the memory cell AM[i+1,j] can be expressed by Formula (E4).

At this time, the current flowing from the terminal CT11 [*j*] of the column output circuit COT[j] to the wiring B[j] is $I_0[i,j]+I_0[i+1,j]$.

Similarly, the current $I_0[i+1,j+1]$ flowing from the wiring B[j+1] to the second terminal of the transistor Tr62 in the memory cell AM[i+1,j+1] through the first terminal thereof can be expressed by Formula (E5) described in Operation example 1.

At this time, the current flowing from the terminal CT11[*j*+1] of the column output circuit COT[j+1] to the wiring B[j+1] is $I_0[i,j+1]+I_0[i+1,j+1]$.

The current $I_{ref0}[i+1]$ flowing from the wiring Bref to the second terminal through the first terminal of the transistor Tr62 in the memory cell AMref[i+1] can be expressed by Formula (E6).

At this time, the current flowing from the terminal CTref of the current supply circuit CUREF to the wiring Bref is $I_{ref0}[i]+I_{ref0}[i+1]$.

<<Period from Time T04 to Time T05>>

During a period from Time T04 to Time T05, the potential corresponding to the first analog data is written to the rest of the memory cells AM, and the potential $V_{PR}$ is written to the rest of memory cells AMref, in a manner similar to that of the operation during the period from Time T01 to Time T02 and that of the operation during the period from Time T03 to Time T04. Thus, the sum of the amounts of current flowing in the transistors Tr62 in all of the memory cells AM corresponds to the amount of current flowing from the terminal CT11[*j*] of the column output circuit COT[j] to the wiring B[j] that is denoted by $\Sigma I_0[i,j]$ ($\Sigma I_0[i,j]$ represents the summation of the current $I_0[i,j]$ over i from 1 to m).

Here, the description will be made with a focus on the current supply circuit CUREF. The sum of the amounts of current flowing through the transistors Tr62 in the memory cells AMref[1] to AMref[m] flows into the wiring Bref that is electrically connected to the terminal CTref of the current supply circuit CUREF. In other words, the current corresponding to $I_{Bref}=\Sigma I_{ref0}[i]$ (here, $\Sigma I_{ref0}[i]$ is the summation of $I_{ref0}[i]$ over i from 1 to m) flows into the wiring Bref; thus, the current is outputted to the first terminal from the second terminal of the transistor Tr78 in accordance with the potential of the terminal CTref of the current supply circuit CUREF.

In FIG. 23, the current that is outputted from the terminal CTref of the current supply circuit CUREF is denoted by $I_{CMref}$. In this specification, the current that is outputted from the terminal CTref of the current supply circuit CUREF during Time T01 to Time T09 is denoted by $I_{CMref0}$.

Therefore, the current $I_{CMref0}$ that is outputted from the terminal CTref of the current supply circuit CUREF can be represented by the following formula.

[Formula 21]

$$I_{CMref0} = I_{Bref} = \sum_i I_{ref0}[i] \tag{E15}$$

Note that in the current supply circuit CUREF, the potentials of the gates of the transistors Tr77[1] to Tr77[*n*] are each equal to the potential of the gate of the transistor Tr78 (potential of the terminal CTref); accordingly, the currents $I_{CMref0}$ outputted from the terminals CT13[1] to CT13[*n*] are equal to each other. The size and configuration of the transistors Tr77[1] to Tr77[*n*] and the transistor Tr78 are the same as each other.

<<Period from Time T06 to Time T07>>

A period from Time T06 to Time T11 is described with reference to FIG. 24. During the period from Time T06 to Time T07, the wiring ORP is set at the high-level potential, and the wiring ORM is set at the high-level potential. At this time, the high-level potential is supplied to the gates of the transistors Tr73 in the circuits SI[1] to SI[n], so that the transistors Tr73 are turned on. Thus, the low-level potential is supplied to the first terminals of the capacitors C71 in the circuits SI[1] to SI[n], and thus the potentials of the capacitors C51 are initialized. Moreover, the high-level potential is supplied to the gates of the transistors Tr76 in the circuits SO[1] to SO[n], so that the transistors Tr76 are turned on. Thus, the low-level potential is supplied to the first terminals of the capacitors C72 in the column output circuits OUT[1] to OUT[n], and thus the potentials of the capacitors C72 are initialized. When Time T06 starts, the low-level potential is supplied to the wiring OSP, so that the transistors Tr73 in the circuits SI[1] to SI[n] are turned off, and the low-level potential is supplied to the wiring OSM, so that the transistors Tr76 in the circuits SO[1] to SO[n] are turned off.

<<Period from Time T07 to Time T08>>

During a period from Time T07 to Time T08, the wirings ORP and ORM are each set to the low-level potential. At this time, the low-level potential is supplied to the gates of the transistors Tr73 in the circuits SI[1] to SI[n], so that the transistors Tr73 are turned off. Furthermore, the low-level potential is supplied to the gates of the transistors Tr76 in the circuits SO[1] to SO[n], so that the transistors Tr76 are turned off.

<<Period from Time T08 to Time T09>>

During a period from Time T08 to Time T09, the wiring OSP is set at the high-level potential. At this time, the high-level potential is applied to the gates of the transistors Tr72 in the circuits SI[1] to SI[n], so that the transistors Tr72 are brought into an on state. The current $I_B[j]$ outputted from the column output circuit COT[j] is $\Sigma I_0[i,j]$ (here, $\Sigma I_0[i,j]$ is the summation of $I_0[i,j]$ over i from 1 to m). When the current $I_{CMref0}$ is greater than the current $I_B[j]$, current flows into the first terminals of the capacitors C71 from the first terminals of the transistors Tr72 through the second terminals of the transistors Tr72, and positive potentials are held in the capacitors C71. Thus, the potentials of the gates of the transistors Tr71 are held, so that the current corresponding to the potentials of the gates of the transistors Tr71 flows between the sources and the drains of the transistors Tr71.

When Time T09 starts, the low-level potential is supplied to the wiring OSP, so that the transistors Tr72 in the circuits SI[1] to SI[n] are turned off. The potentials of the gates of the transistors Tr71 are held in the capacitors C71, so that even after Time T09, the same amount of current keeps flowing between the source and the drain of each of the transistors Tr71.

<<Period from Time T10 to Time T11>>

During a period from Time T10 to Time T11, the wiring OSM is set at the high-level potential. At this time, the high-level potential is supplied to the gates of the transistors Tr75 in the circuits SO[1] to SO[n], so that the transistors Tr75 are turned on. The current $I_B[j]$ outputted from the column output circuit COT[j] is $\Sigma I_0[i,j]$ (here, $\Sigma I_0[i,j]$ is the summation of $I_0[i,j]$ over i from 1 to m). When the current $I_{CMref0}$ is smaller than the current $I_B[j]$, the current flows into the first terminals of the transistors Tr75 from the first terminals of the capacitors C72 through the second terminals of the transistors Tr75, and negative potentials are held in the capacitors C72. Thus, the potentials of the gates of the transistors Tr74 are held, so that the current corresponding to the potential of the gate of each of the transistors Tr74 flows between the source and the drain of the transistor Tr74.

When Time T11 starts, the low-level potential is supplied to the wiring OSM, so that the transistors Tr75 in the circuits SO[1] to SO[n] are turned off. The potentials of the gates of the transistors Tr74 are held in the capacitors C72, so that even after Time T11, the same amount of current keeps flowing between the source and the drain of each of the transistors Tr74.

Note that in the timing chart in FIG. 24, the operation for switching the conducting and non-conducting states of the transistor Tr72 (during the period from Time T08 to Time T09) is performed before the operation for switching the conducting and non-conducting states of the transistor Tr75 (during the period from Time T10 to Time T11); however, the order of the operation of the offset circuit 815 is not limited thereto. For example, the operation for switching the conducting and non-conducting states of the transistor Tr75 (during the period from Time T10 to Time T11) may be performed first, and then the operation for switching the conducting and non-conducting states of the transistor Tr72 (during the period from Time T08 to Time T09) may be performed.

Here, the description will be made with a focus on the column output circuit COT[$_j$] during a period from Time T06 to Time T12 (shown in FIG. 25). In the column output circuit COT[j], the current flowing from the wiring OL[j] to the first terminal of the transistor Tr71 is denoted by $I_{CP}$[j], and the current flowing from the first terminal of the transistor Tr74 to the wiring OL[1] is denoted by $I_C$[j]. Into the terminal CT12[*j*] of the column output circuit COT[j], the current $I_{CMref0}$ from the terminal CT13[*j*] of the current supply circuit CUREF is inputted. On the assumption that the current is not outputted from the output terminal SPT[$_j$] during the period from Time T1 to Time T12, the sum of the amounts of current flowing through each of the transistors Tr62 in the memory cells AM[1,i] to AM[n,i] flows in the wiring B[$_j$] electrically connected to the column output circuit COT[j]. In other words, the current $\Sigma I_0$[i,j] (Σ represents the current obtained by summing over i from 1 to m) flows in the wiring B[j]. During the period from Time T06 to Time T12, in the column output circuit COT[j], the current $I_{CMref0}$ that is to be inputted is different from $\Sigma I_0$[i,j] that is to be outputted, the current $I_C$[j] is supplied to the wiring OL[$_j$] through the circuit SOUL or the current $I_{CP}$[j] is discharged from the wiring OL[j] through the circuit SI[j]. Thus, the above provides the following formula.

[Formula 22]

$$I_{CMref0} + I_C[j] - I_{CP}[j] = \sum_i I_0[i, j] \quad \text{(E16)}$$

<<Period from Time T12 to Time T13>>

The operation after Time T12 is described with reference to FIG. 25. During a period from Time T12 to Time T13, a potential higher than the reference potential (denoted by REFP in FIG. 25) by $V_W$[i] is applied to the wiring RW[i]. At this time, the potential $V_W$[i] is applied to the second terminals of the capacitors C52 in the memory cells AM[i,1] to AM[i,n] and the memory cell AMref[i], so that the potentials of the gates of the transistors Tr62 increase.

Note that the potential $V_W$[i] is a potential corresponding to the second analog data.

An increase in the potential of the gate of the transistor Tr62 corresponds to the potential obtained by multiplying a change in potential of the wiring RW[i] by a capacitive coupling coefficient determined by the memory cell configuration. The capacitive coupling coefficient is calculated on the basis of the capacitance of the capacitor C52, the gate capacitance of the transistor Tr62, and the parasitic capacitance. In this operation example, to avoid complexity of explanation, a value corresponding to an increase in the potential of the wiring RW[i] is regarded as the same value corresponding to an increase in the potential of the gate of the transistor Tr62. This means that the capacitive coupling coefficient in each of the memory cell AM and the memory cell AMref is regarded as 1.

Note that the capacitive coupling coefficients are each 1. When the potential $V_W$[i] is applied to the second terminals of the capacitors C52 in the memory cell AM[i,j], the memory cell AM[i,j+1], and the memory cell AMref[i], the potentials of the node N[i,j], the node N[i,j+1], and the node Nref[i] each increase by $V_W$[i].

A current flowing from the first to second terminal of the transistor Tr62 in each of the memory cell AM[i,j], the memory cell AM[i,j+1], and the memory cell AMref[i] is considered. The current I[i,j] flowing from the wiring B[j] to the second terminal of the transistor Tr62 in the memory cell AM[i,j] through the first terminal thereof can be expressed by Formula (E9) described in Operation example 1.

In other words, by supplying the potential $V_W$[i] to the wiring RW[i], the current flowing from the wiring B[j] to the second terminal of the transistor Tr62 in the memory cell AM[i,j] through the first terminal thereof increases by I[i,j]−$I_0$[i,j] (denoted by ΔI[i,j] in FIG. 25).

Similarly, the current I[i,j+1] flowing from the wiring B[j+1] to the second terminal of the transistor Tr62 in the memory cell AM[i,j+1] through the first terminal thereof can be expressed by Formula (E10) described in Operation example 1.

In other words, by supplying the potential $V_W$[i] to the wiring RW[i], the current flowing from the wiring B[j+1] to the second terminal of the transistor Tr62 in the memory cell AM[i,j+1] through the first terminal thereof increases by I[i,j+1]−$I_0$[i,j+1] (denoted by ΔI[i,j+1] in FIG. 25).

Furthermore, the current $I_{ref}$[i] flowing from the wiring Bref to the second terminal of the transistor Tr62 in the memory cell AMref[i] through the first terminal thereof can be expressed by Formula (E11) described in Operation example 1.

In other words, by supplying the potential $V_W$[i] to the wiring RW[i], the current flowing from the wiring Bref to the second terminal of the transistor Tr62 in the memory cell AMref[i] through the first terminal thereof increases by $I_{ref}$[i]−$I_{ref0}$[i] (denoted by Δ$I_{ref}$[i] in FIG. 25).

Here, the description will be made with a focus on the current supply circuit CUREF. The sum of the amounts of current flowing through the transistors Tr62 in the memory cells AMref[1] to AMref[n] flows into the wiring Bref that is electrically connected to the current supply circuit CUREF. That is, the current $I_{Bref}$, which is the current $\Sigma I_{ref0}$[i], flows into the wiring Bref (here, $\Sigma I_{ref0}$[i] is the summation of $I_{ref0}$[i] over i from 1 to m). The current flows from the second terminal to the first terminal of the transistor Tr78 in accordance with the potential of the terminal CTref of the current supply circuit CUREF.

Thus, the current $I_{CMref}$ that is outputted from the terminal CTref of the current supply circuit CUREF can be represented by the following formula.

[Formula 23]

$$I_{CMref} = \sum_i I_{ref}[i] \quad \text{(E17)}$$

Note that in the current supply circuit CUREF, the potentials of the gates of the transistors Tr77[1] to Tr77[*n*] are equal to the potential of the gate of the transistor Tr78 (potential of the terminal CTref); accordingly, the currents $I_{CMref}$ outputted from the terminals CT13[1] to CT13[*n*] are equal to each other.

Here, the current $\Delta I_B[j]$ outputted from the wiring B[j] is focused on. During the period from Time T11 to Time T12, Formula (E16) is satisfied, and the current $\Delta I_B[j]$ is not outputted from the terminal SPT[j] that is electrically connected to the wiring B[j].

During the period from Time T12 to Time T13, a potential higher than the reference potential by $V_W[i]$ is applied to the wiring RW[i], and the current flowing between the source and the drain of the transistor Tr62 in the memory cell AM[i,j] changes. Thus, the current $\Delta I_B[j]$ is outputted from the output terminal SPT[j] electrically connected to the wiring B[j]. Specifically, in the column output circuit COT[j], the current $I_C[j]$ flows from the first terminal of the transistor Tr74 in the circuit SO to the wiring OL[j], the current $I_{CP}[j]$ flows from the wiring OL[j] to the first terminal of the transistor Tr71 in the current SI. Then, to the terminal CT12[*j*] of the column output circuit COT[j], the current $I_{CMref}$ is inputted from the terminal CT13[*j*] of the current supply circuit CUREF. Thus, the current $\Delta I_B[j]$ can be represented by the following formula using $\Sigma I[i,j]$, which is the summation of current I[i,j] over i from 1 to m. Here, the current I[i,j] is current flowing between the source and the drain of the transistor Tr62 in the memory cell AM[i,j].

[Formula 24]

$$\Delta I_B[j] = (I_C[j] + I_{CMref} - I_{CP}[j]) - \sum_i I[i, j] \quad \text{(E18)}$$

For Formula (E18), Formulae (E1), (E3), (E9), (E11), (E15), (E16), and (E17) are used, whereby the same formula as Formula (E14) described in Operation example 1 can be obtained.

According to Formula (E14), the current $\Delta I_B[j]$ is a value corresponding to the sum of products of the potential $V_X[i,j]$ that is the first analog data and the potential $V_W[i]$ that is the second analog data. That is, when the current $\Delta I_B[j]$ is calculated, the value of the sum of products of the first analog data and the second analog data can be obtained.

During the period from Time T12 to Time T13, when all of the wirings RW[1] to RW[m] except the wiring RW[i] are set to have a reference potential, the relation, $V_W[g]=0$ (here, g is an integer that is greater than or equal to 1 and less than or equal to m and not i), is satisfied. Thus, according to Formula (E9), $\Delta I_B[j]=2kV_X[i,j]V_W[i]$ is outputted. In other words, the data corresponding to the product of the first analog data stored in the memory cell AM[i,j] and the second analog data corresponding to a selection signal supplied to the wiring RW[i] is outputted from the output terminal SPT[j] that is electrically connected to the wiring B[j].

Furthermore, a differential current outputted from the output terminal SPT[j+1] that is electrically connected to the wiring B[j+1] is expressed as $\Delta I_B[j+1]=2kV_X[i,j+1]V_W[i]$. The data corresponding to the product of the first analog data stored in the memory cell AM[i,j+1] and the second analog data corresponding to a selection signal supplied to the wiring RW[i] is outputted from the output terminal SPT[j+1] that is electrically connected to the wiring B[j+1].

<<Period from Time T13 to Time T14>>

During a period from Time T13 to Time T14, the ground potential is supplied to the wiring RW[i]. The ground potential is supplied to the second terminals of the capacitors C52 in the memory cells AM[i,1] to AM[i,n] and the memory cell AMref[i]. Thus, the potentials of the nodes N[i,1] to N[i,n] and the node Nref[i] return to the potentials during the period from Time T11 to Time T12.

<<Period from Time T14 to Time T15>>

During a period from Time T14 to Time T15, the wirings RW[1] to RW[m] except the wiring RW[i+1] are set to have the reference potential, and a potential higher than the reference potential by $V_W[i+1]$ is applied to the wiring RW[i+1]. At this time, as in the operation during the period from Time T12 to Time T13, the potential $V_W[i+1]$ is supplied to the second terminals of the capacitors C52 in the memory cells AM[i+1,1] to AM[i+1,n] and the memory cell AMref[i+1], so that the potentials of the gates of the transistors Tr62 increase.

The potential $V_W[i+1]$ corresponds to the second analog data.

As described above, the capacitive coupling coefficients of the memory cells AM and the memory cell AMref are each 1. When the potential $V_W[i+1]$ is applied to the second terminals of the capacitors C52 in the memory cell AM[i+1,j], the memory cell AM[i+1,j+1], and the memory cell AMref[i+1], the potentials of the node N[i+1,j], the node N[i+1,j+1], and the node Nref[i+1] each increase by $V_W[i+1]$.

When the potentials of the node N[i+1,j], the node N[i+1,j+1], and the node Nref[i+1] increase by $V_W[i+1]$, the amount of current flowing in each of the transistors Tr62 in the memory cell AM[i+1,j], the memory cell AM[i+1,j+1], and the memory cell AMref[i+1] increases. When the current flowing in the transistor Tr62 in the memory cell AM[i+1,j] is denoted by I[i+1,j], the current flowing from the terminal CT11[*j*] of the column output circuit COT[j] to the wiring B[j] increases by $I[i+1,j]-I_0[i+1,j]$ (denoted by $\Delta I[i+1,j]$ in FIG. 25). Similarly, when the current flowing in the transistor Tr62 in the memory cell AM[i+1,j+1] is denoted by I[i+1,j+1], the current flowing from the terminal CT11[*j*+1] of the column output circuit COT[j+1] to the wiring B[j+1] increases by $I[i+1,j+1]-I_0[i+1,j+1]$ (denoted by $\Delta I[i+1,j+1]$ in FIG. 25). When the current flowing in the transistor Tr62 in the memory cell AMref[i+1] is denoted by $I_{ref}[i+1]$, the current flowing from the output terminal CTref of the current supply circuit CUREF to the wiring Bref increases by $I_{ref}[i+1]-I_{ref0}[i+1]$ (denoted by $\Delta I_{ref}[i+1]$ in FIG. 25).

The operation during the period from Time T14 to Time T15 can be similar to the operation during the period from Time T12 to Time T13. Thus, when Formula (E9) is applied to the operation during the period from Time T14 to Time T15, the differential current that is outputted from the wiring B[j] is expressed as $\Delta I_B[j]=2kV_x[i+1,j]V_W[i+1]$. In other words, the data corresponding to the product of the first analog data stored in the memory cell AM[i+1,j] and the second analog data corresponding to a selection signal applied to the wiring RW[i+1] is outputted from the output terminal SPT[j] that is electrically connected to the wiring B[j].

Furthermore, the differential current outputted from the wiring B[j+1] is expressed as $\Delta I_B[j+1]=2kV_x[i+1,j+1]V_W[i+1]$. The data corresponding to the product of the first analog data stored in the memory cell AM[i+1,j+1] and the second analog data corresponding to a selection signal applied to the wiring RW[i+1] is outputted from the output terminal SPT[j+1] that is electrically connected to the wiring B[j+1].

<<Period from Time T15 to Time T16>>

During a period from Time T12 to Time T13, the ground potential is supplied to the wiring RW[i+1]. In this period, the ground potential is supplied to the second terminals of the capacitors C52 in the memory cells AM[i+1,1] to AM[i+1,n] and the memory cell AMref[i+1], and the potentials of nodes N[i+1,1] to N[i+1,n] and the node Nref[i+1] return to the potentials in the period from Time T13 to Time T14.

<<Period from Time T16 to Time T17>>

During a period from Time T16 to Time T17, the wirings RW[1] to RW[m] except the wiring RW[i] and the wiring RW[i+1] are set to have the reference potential, a potential higher than the reference potential by $V_{W2}[i]$ is applied to the wiring RW[i], and a potential lower than the reference potential by $V_{W2}[i+1]$ is applied to the wiring RW[i+1]. At this time, as in the operation during the period from Time T12 to Time T13, the potential $V_{W2}[i]$ is supplied to the second terminals of the capacitors C52 in the memory cells AM[i,1] to AM[i,n] and the memory cell AMref[i], so that potentials of the gates of the transistors Tr62 in the memory cells AM[i,1] to AM[i,n] and the memory cell AMref[i] increase. Concurrently, the potential $-V_{W2}[i+1]$ is applied to the second terminals of the capacitors C52 in the memory cells AM[i+1,1] to AM[i+1,n] and the memory cell AMref[i+1], so that the potentials of the gates of the transistors Tr62 in the memory cells AM[i+1,1] to AM[i+1,n] and the memory cell AMref[i+1] decrease.

The potential $V_{W2}[i]$ and the potential $V_{W2}[i+1]$ are potentials each corresponding to the second analog data.

Note that the capacitive coupling coefficients of the memory cell AM and the memory cell AMref are each 1. When the potential $V_{W2}[i]$ is supplied to the second terminals of the capacitors C52 in the memory cell AM[i,j], the memory cell AM[i,j+1], and the memory cell AMref[i], the potentials of the node the node N[i,j+1], and the node Nref[i] each increase by $V_{W2}[i]$. When the potential $-V_{W2}[i+1]$ is supplied to the second terminals of the capacitors C52 in the memory cell AM[i+1,j], the memory cell AM[i+1,j+1], and the memory cell AMref[i+1], the potentials of the node N[i+1,j], the node N[i+1,j+1], and the node Nref[i+1] each decrease by $V_{W2}[i+1]$.

When each of the potentials of the node N[i,j], the node N[i,j+1], and the node Nref[i] increases by $V_{W2}[i]$, the amount of current flowing in each of the transistors Tr62 in the memory cell AM[i,j], the memory cell AM[i,j+1], and the memory cell AMref[i] increases. Here, the current flowing in the transistor Tr62 in the memory cell AM[i,j] is denoted by I[i,j], the current flowing in the transistor Tr62 in the memory cell AM[i,j+1] is denoted by I[i,j+1], and the current flowing in the transistor Tr62 in the memory cell AMref[i] is denoted by $I_{ref}[i]$.

When the potentials of the node N[i+1,j], the node N[i+1,j+1], and the node Nref[i+1] each decrease by $V_{W2}[i+1]$, the amount of current flowing in each of the transistors Tr62 in the memory cell AM[i+1,j], the memory cell AM[i+1,j+1], and the memory cell AMref[i+1] decreases. Here, the current flowing in the transistor Tr62 in the memory cell AM[i+1] is denoted by $I_2[i,j]$, the current flowing in the transistor Tr62 in the memory cell AM[i+1,j+1] is denoted by $I_2[i,j+1]$, and the current flowing in the transistor Tr62 in the memory cell AMref[i+1] is denoted by $I_{2ref}[i+1]$.

At this time, the current flowing from the terminal CT11[*j*] of the column output circuit COT[j] to the wiring B[j] increases by $(I_2[i,j]-I_0[i,j])+(I_2[i+1,j]-I_0[i+1,j])$ (denoted by $\Delta I[_j]$ in FIG. 25). The current flowing from the terminal CT11[*j*+1] of the column output circuit COT[j+1] to the wiring B[j+1] increases by $(I_2[i,j+1]-I_0[i,j+1])+(I_2[i+1,j+1]-I_0[i+1,j+1])$ (denoted by ΔI[j+1] in FIG. 25, which is a negative current). The current flowing from the output terminal CTref of the current supply circuit CUREF to the wiring Bref increases by $I_{ref}[i,j]-I_{ref0}[i,j]+I_{ref}[i+1,j]-I_{ref0}[i+1,j]$ (denoted by ΔIBref in FIG. 25).

The operation during the period from Time T16 to Time T17 can be similar to the operation during the period from Time T12 to Time T13. When Formula (E9) is applied to the operation during the period from Time T16 to Time T17, the differential current that is outputted from the wiring B[j] is expressed as $\Delta I_B[j]=2k\{V_X[i,j]V_{W2}[i]-V_x[i+1,j]V_{W2}[i+1]\}$. Thus, the data corresponding to the sum of products of the first analog data stored in each of the memory cell AM[i,j] and the memory cell AM[i+1j] and the second analog data corresponding to a selection signal applied to each of the wiring RW[i] and the wiring RW[i+1] is outputted from the output terminal SPT[j] that is electrically connected from the wiring B[j].

The differential current outputted from the wiring B[j+1] is expressed as $\Delta I_B[j+1]=2k\{V_X[i,j+1]V_{W2}[i]-V_x[i+1,j+1]V_{W2}[i+1]\}$. The data corresponding to the product of the first analog data stored in each of the memory cell AM[i,j+1] and the memory cell AM[i+1,j+1] and the second analog data corresponding to a selection signal applied to each of the wiring RW[i] and the wiring RW[i+1] is outputted from the output terminal SPT[j+1] that is electrically connected to the wiring B[j+1].

<<After Time T17>>

After Time T17, the ground potential is supplied to the wiring RW[i] and the wiring RW[i+1]. At this time, the ground potential is supplied to the second terminals of the capacitors C52 in the memory cells AM[i,1] to AM[i,n], the memory cells AM[i+1,1] to AM[i+1,n], the memory cell AMref[i], and the memory cell AMref[i+1]. Thus, the potentials of the nodes N[i,1] to N[i,n], the nodes N[i+1,1] to N[i+1,n], the node Nref[i], and the node Nref[i+1] return to the potentials in the period from Time T15 to Time T16.

As described above, with the circuit configuration in FIG. 20, which is different from the circuit in FIG. 11, the product-sum operation necessary for the calculation of the neural network can be executed. The product-sum operation is not an operation using digital values; thus, a large-scale digital circuit is not necessary, and the circuit size can be small.

In Example 1 of circuit constructing hierarchical neural network and Example 2 of circuit for constructing hierarchical neural network, the first analog data serves as weight coefficients and the second analog data corresponds to neuron outputs, whereby calculation of the weighted sums of the neuron outputs can be conducted concurrently. Thus, data corresponding to results of the calculation of the weighted sums, that is, synapse inputs can be obtained as the output signals. Specifically, weight coefficients $w_{s[k]\cdot 1}^{(k)}$ to $w_{s[k]\cdot Q[k-1]}^{(k)}$ of the s[k]-th neuron in the k-th layer are stored as the first analog data in the memory cells AM[1,j] to AM[m,j] and output signals $z_{1\cdot s[k]}^{(k-1)}$ to $z_{Q[k-1]\cdot s[k]}^{(k-1)}$ of the neurons in the (k−1)-th layer are supplied as the second analog data to the wirings RW[1] to RW[m], whereby the summation $u_{s[k]}^{(k)}$ of signals inputted to the s[k]-th neuron in the k-th layer can be obtained. That is, the product-sum operation expressed by Formula (D1) can be performed with the semiconductor device 700 or the semiconductor device 800.

In the case where weight coefficients are updated in supervised learning, weight coefficients $w_{1\cdot s[k]}^{(k+1)}$ to $w_{Q[k+1]s[k]}^{(k+1)}$ multiplied by when a signal is transmitted from the s[k]-th neuron in the k-th layer to neurons in the (k+1)-th layer are stored as the first analog data in the memory cells AM[1,j] to AM[m,j] and errors $\delta_1^{(k+1)}$ to $\delta_{Q[k+1]}^{(k+1)}$ of the neurons in the (k+1)-th layer are supplied as the second analog data to the wirings RW[1] to RW[m], whereby a value of $\Sigma w_{s[k+1]\cdot s[k]}^{(k+1)}\cdot\delta_{s[k+1]}^{(k+1)}$ in Formula (D3) can be obtained from the differential current $\Delta I_B[j]$ flowing through the wiring B[j]. That is, part of the operation expressed by Formula (D3) can be performed with the semiconductor device 700 or the semiconductor device 800.

In an electronic device including the sensor 441 and the display unit 100, information about an incident angle and illuminance of external light obtained from the optical sensor 443 and information about inclination of the electronic device, sensed by the acceleration sensor 446 in the electronic device, are set as data inputted to a neuron in the input layer (first layer), and a set value corresponding to the luminance and color tone meeting the preference of users is set as teacher data. This allows the data processing circuit 465 to output the set value corresponding to the luminance and color tone meeting the preference of the users from an output layer (L-th layer) in accordance with a calculation result of the hierarchical neural network.

Note that this embodiment can be combined with any of the other embodiments in this specification as appropriate.

Embodiment 3

In this embodiment, an example of operation for adjusting the luminance and color tone (example of operation for adjusting light and color) of the display unit 100 or the display unit 100A described in Embodiment 1 will be described. To adjust the luminance and color tone in the configuration example shown in FIG. 1, the calculation of the neural network described in Embodiment 2 is conducted with use of the host device 440, the sensor 441, and the image processing portion 460 in the controller IC 400. To adjust the luminance and color tone in the configuration example shown in FIG. 6, the calculation of the neural network described in Embodiment 2 is conducted with use of the host device 440, the sensor 441, and the image processing portion 460 in the controller IC 400A.

Figure 26:
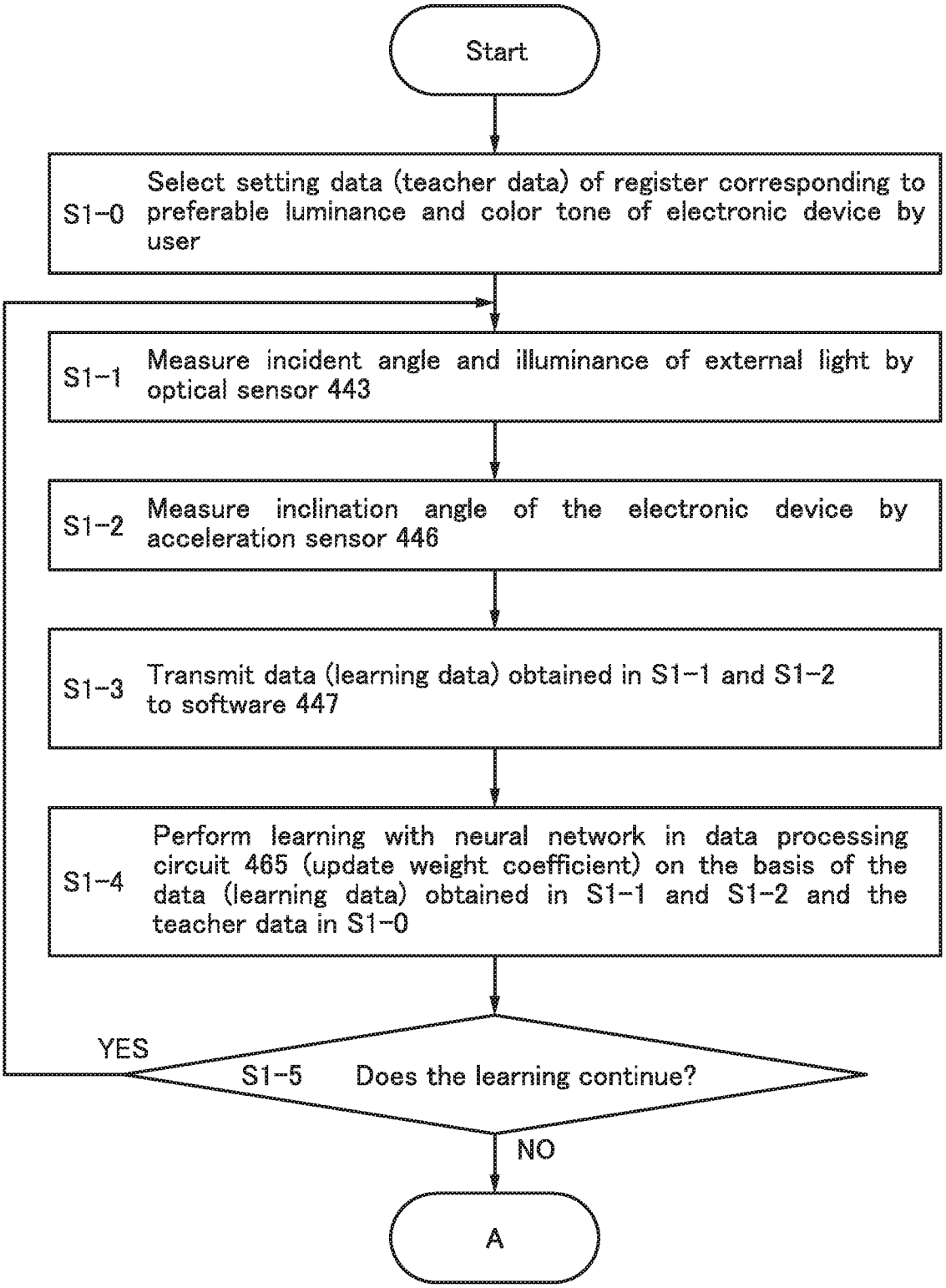
FIG. 26 is a flow chart showing an operation example of an electronic device.
Figure 27:
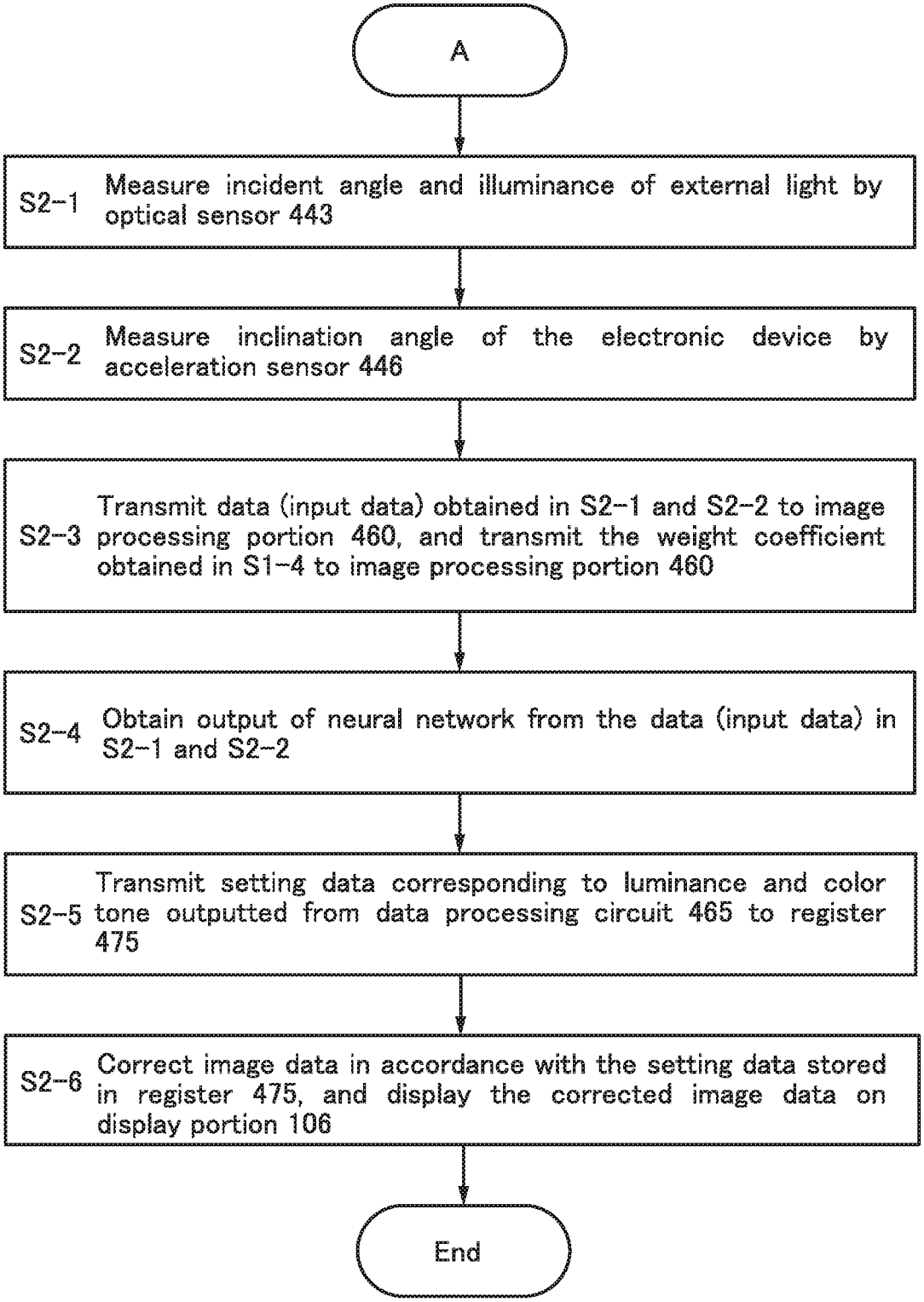
FIG. 27 is a flow chart showing an operation example of an electronic device.

FIG. 26 and FIG. 27 are flow charts showing the operation example. The luminance and color tone of the display device are adjusted through Steps S1-0 to S1-5 and Steps S2-1 to S2-6. Steps S1-0 to S1-5 are an operation process for learning in the neural network, and Steps S2-1 to S2-6 are an operation process for outputting optimal luminance and color tone through the neural network. Note that an electronic device on which an operation example described in this embodiment is conducted included the display device 1000A.

<Learning>

In Step S1-0, a user operates the electronic device to select the luminance and color tone of the display portion 106 of the electronic device to meet his or her preference, thereby indirectly selecting setting data of a register corresponding to the luminance and color tone. The setting data of the register is handled as teacher data in an information processing system using the neural network described in Embodiment 2. The setting data includes a set value corresponding to the luminance and color tone of image data to be displayed by the reflective element 10*a* and a set value corresponding to the luminance and color tone of image data to be displayed by the light-emitting element 10*b*.

Specifically, the user selects luminance and color tone with the touch sensor unit 200 included in the electronic device in accordance with his or her preference. The operation with the touch sensor unit 200 allows an instruction to read the setting data (teacher data) of the register corresponding to the selected luminance and color tone meeting his or her preference to be transmitted via the touch sensor controller 484 and the interface 450. The setting data (teacher data) corresponding to the selected luminance and color tone meeting his or her preference is read from a memory device included in the controller IC 400A or a memory device included in the host device 440, for example.

In the case where the setting data (teacher data) of the register is read out from the memory device included in the controller IC 400A, the setting data is transmitted to the host device 440 and temporarily stored in the memory or the like in the host device 440. In the case where the setting data (teacher data) is read out from the memory device included in the host device 440, the setting data is temporarily stored in the memory or the like in the host device 440.

In Step S1-1, the optical sensor 443 measures the illuminance and incident angle of external light.

In Step S1-2, the inclination angle of the electronic device is measured by the acceleration sensor 446.

In Step S1-3, the incident angle and illuminance of external light obtained in Step S1-1 and the inclination angle obtained in Step S1-2 are transmitted, as learning data to be inputted to an input layer of the neural network, to the host device 440. Specifically, information about the incident angle and illuminance of external light is transmitted as a sensor signal from the optical sensor 443 to the sensor controller 453 and then transmitted to the host device 440 via the controller 454 and the interface 450.

The information about the inclination angle of the electronic device is transmitted as an electric signal from the acceleration sensor 446 to the sensor controller 453 and then transmitted to the host device 440 via the controller 454.

In Step S1-4, the incident angle and illuminance of external light obtained in Step S1-1 and the inclination angle obtained in Step S1-2 are inputted to the software 447 as a parameter. Specifically, the incident angle and illuminance of external light and the inclination angle are handled as learning data to be inputted to neurons of the input layer (first layer) of the neural network in the software 447 as a program. In this manner, learning using the neural network is performed in the software 447.

Note that in initial calculation, the initial values of weights of the neural network may be random numbers. The initial values might affect the degree of learning (e.g., the convergent rate of weight coefficients and the prediction accuracy of the neural network). When the learning speed is low, the initial values may be changed to perform learning again.

When the input data is inputted to neurons of the input layer (first layer) of the neural network of the software 447, output data is outputted from the output layer (L-th layer) of the neural network of the software 447 as a calculation result. In the case where a difference between the output data and the teacher data is out of the allowable range, weight values are updated using the teacher data. Note that for example, backpropagation described in Embodiment 2 can be used to update the weight values.

After the weight values are updated, the incident angle and illuminance of external light and the inclination angle are inputted to the neurons of the input layer (first layer) of the neural network in the software 447 and calculation is performed again. Update of the weight values and calculation using the neural network are repeated until the error between the calculation result (the output data output from the output layer (L-th layer) of the neural network) and the teacher data falls within the allowable range. Note that the allowable range of an error with which calculation is finished does not need to be narrow and may be wide within the allowable range for the user of the electronic device.

Calculation using the neural network is repeatedly performed in this manner, and finally output data having no difference or a small difference from the teacher data is outputted from the output layer (L-th layer). The weight coefficients included in the neural network at this time are stored in a predetermined memory device so that they can be associated with the set value corresponding to luminance and color tone meeting the user's preference (teacher data), the incident angle and illuminance of external light, and the inclination angle (learning data). Note that the predetermined memory device refers to, for example, the memory device included in the controller IC 400A or the memory device included in the host device 440.

Steps S1-0 to S1-4 are performed in the above manner and weight coefficients when no difference or a small difference exists between the teacher data and the output data are obtained, whereby learning using the neural network is completed.

In Step S1-5, whether learning is continued is determined. For example, in the case where there is a change in the external light environment of the electronic device, learning is performed again in accordance with the external light environment. In that case, operation is performed from Step S1-1 again; the incident angle and illuminance of external light and the inclination angle of the electronic device are obtained through Steps S1-1 to S1-3 and learning is performed in Step S1-4. In the case where the setting data of the register corresponding to the luminance and color tone that meet the user's preference (teacher data) is desired to be changed, operation is performed from Step S1-0 again to change the setting data (teacher data) and Step S1-1 and the following steps are performed.

In the case where learning does not need to be continued in Step S1-5, the process proceeds to Step A in FIG. 26. In that case, the process moves on to Step A in the flow chart of FIG. 27 and the processing is continued.

Application of the above operation example is not limited to the display unit 100A. The above operation example can also be applied to the display unit 100 in a similar manner. In that case, calculation may be performed with use of the setting data (teacher data) of the register corresponding to the selected luminance and color tone that meet the user's preference as a set value corresponding to the luminance and color tone of image data displayed on one kind of display elements of a liquid crystal element, a light-emitting element, and the like.

<Acquisition of Luminance and Color Tone>

As in Step S1-1, in Step S2-1, the incident angle and illuminance of external light is measured by the optical sensor 443.

As in Step S1-2, in Step S2-2, the inclination angle of the electronic device is measured by the acceleration sensor 446.

As in Step S1-3, in Step S2-3, the incident angle and illuminance of external light obtained in Step S2-1 and the inclination angle obtained in Step S2-2 are sent, as data to be inputted to an input layer of the neural network, to the image processing portion 460.

In Step S2-3, weight coefficients corresponding to the incident angle and illuminance of external light and the inclination angle of the electronic device that are obtained in Steps S2-1 and S2-2 are read from the predetermined memory device. Specifically, the incident angle and illuminance of external light and the inclination angle of the electronic device obtained through Steps S2-1 and S2-2 that are coincident with the learning data obtained through Steps S1-1 and S1-2 and stored in the predetermined memory device are searched. After that, the weight coefficients obtained in Step S1-4 that are associated with the learning data obtained in Steps S1-1 and S1-2 are read from the predetermined memory device and transmitted to the image processing portion 460.

In Step S2-4, the incident angle and illuminance of external light obtained in Step S2-1 and the inclination angle obtained in Step S2-2 are inputted to the data processing circuit 465. Specifically, the incident angle and illuminance of external light and the inclination angle are handled as input data to be inputted to neurons of the input layer (first layer) of the neural network in the data processing circuit 465.

Then, the weight coefficients read in the previous step are inputted to the data processing circuit 465. Specifically, the weight coefficients are set as weights included in the neural network of the data processing circuit 465.

By the above operation, calculation using the neural network is performed, and setting data corresponding to luminance and color tone that meet the user's preference is outputted from the output layer (L-th layer) of the neural network. Consequently, the setting data meeting the preference of the user of the electronic device can be acquired. Specifically, the following set values included in the setting data can be acquired: a set value corresponding to luminance and color tone that are reflected on an image to be displayed by the reflective element 10*a* (hereinafter referred to as a set value A); and a set value corresponding to luminance and color tone that are reflected on an image to be displayed by the light-emitting element 10*b* (hereinafter referred to as a set value B).

In Step S2-5, the setting data acquired in Step S2-4 is transmitted to the memory circuit 475 to be held therein.

In Step S2-6, the setting data held in the memory circuit 475 is transmitted to the dimming circuit 462 and the toning circuit 463, so that the image data are corrected on the basis of the set values. Since the image data is displayed by the reflective element 10*a* and the light-emitting element 10*b*, correction is performed for each of the image data to be displayed by the elements. That is to say, the image data to be displayed by the reflective element 10*a* is corrected by the set value A, and the image data to be displayed by the light-emitting element 10*b* is corrected by the set value B. The corrected image data are transmitted to the source driver IC 111, and subjected to, for example, serial-parallel conversion or digital-analog conversion by the source driver IC 111. The image data processed by the source driver IC 111 is transmitted to the reflective element 10*a* and the light-emitting element 10*b* in the display portion 106, and an image is displayed on the display portion 106.

Through Steps S1-0 to S1-5 and S2-1 to S2-6, the display device 1000A can display an image whose luminance and color tone are set according to the user's preference. When the learning of the neural network is conducted by the software 447 in the host device 440, it is not necessary to perform the calculation for learning of the neural network in the data processing circuit 465 of the image processing portion 460, and thus, a circuit having a leaning function is not necessarily provided for the data processing circuit 465 of the image processing portion 460. As a result, a process of neural network for obtaining the luminance and color tone can be conducted efficiently.

Application of the above operation example is not limited to the display unit 100A. The above application example can also be applied to the display unit 100 in a similar manner. In that case, by the calculation of neural network, a set value corresponding to the luminance and color tone of image data displayed on one kind of display elements of a liquid crystal element, a display element, and the like can be obtained. In other words, an image is corrected with use of the set value, whereby an image whose luminance and color tone are set according to the user's preference can be displayed in the display unit 100.

Note that the operation method for correcting an image is not limited to Steps S1-0 to S1-5 and S2-1 to S2-6 described above. In this specification and the like, processes shown in a flow chart are classified according to functions and shown as independent steps. However, in an actual process and the like, it is sometimes difficult to classify processes shown in a flow chart functionally, and there is a case where a plurality of steps are associated with one step or a case where one step is associated with a plurality of steps. Thus, processes shown in a flow chart are not limited to steps described in the specification and can be replaced as appropriate depending on circumstances. Specifically, depending on circumstances or conditions or as needed, the order of steps can be changed or a step can be added or omitted, for example.

For example, the order of the step of obtaining the incident angle of external light by the optical sensor 443 and the step of obtaining the inclination angle of the electronic device by the acceleration sensor 446 is not limited to that in the flow chart of FIG. 26. Thus, Step S1-1 and Step S1-2 may be interchanged in the flow chart of FIG. 26.

Furthermore, the electronic device may store the incident angle of external light obtained in Step S2-1 and the inclination angle obtained in Step S2-2 in the predetermined memory device so as to be associated with the set values obtained as a result of calculation in Step S2-4. In addition, the set value that is the calculation result may be read out from the incident angle, the illuminance, and the inclination angle. With such a configuration, when the incident angle of external light obtained in Step S2-1, the illuminance, and the inclination angle obtained in Step S2-2 are coincident with data acquired in the past, the corresponding past set values can be read from the memory device. This can omit calculation using the neural network.

Note that this embodiment can be combined with any of the other embodiments in this specification as appropriate.

Embodiment 4

In this embodiment, the display unit 100 and the display unit 100A described in Embodiment 1 will be described.

Figure 28A:
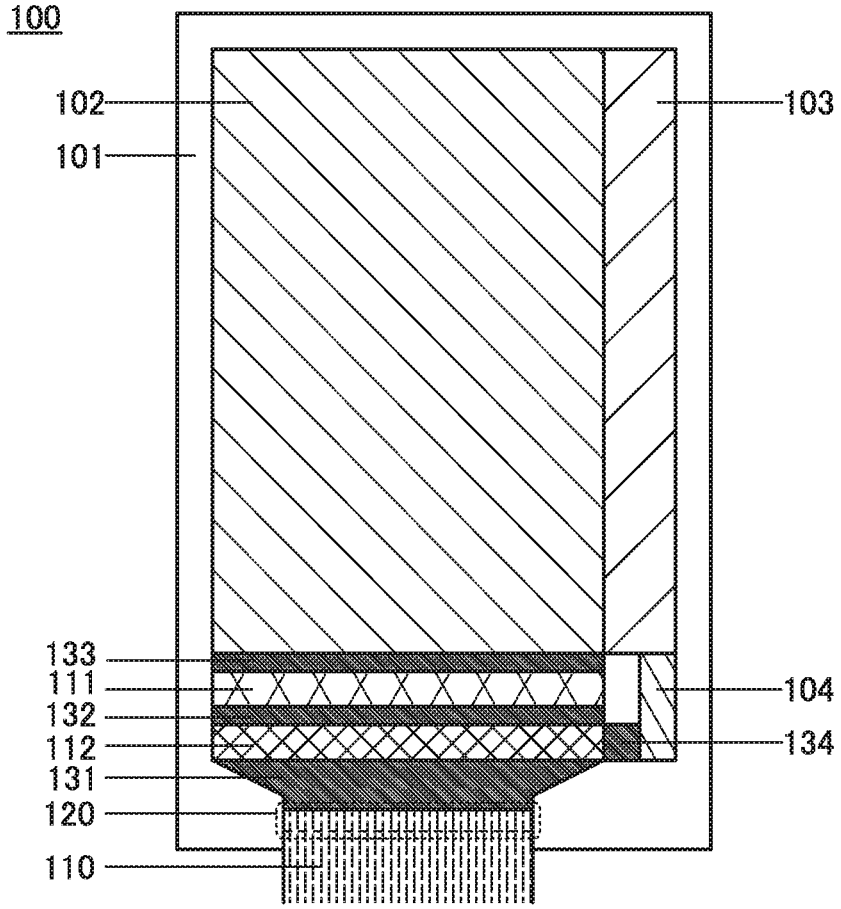
FIGS. 28A and 28B are a top view and a perspective view illustrating an example of a display unit.
Figure 28B:
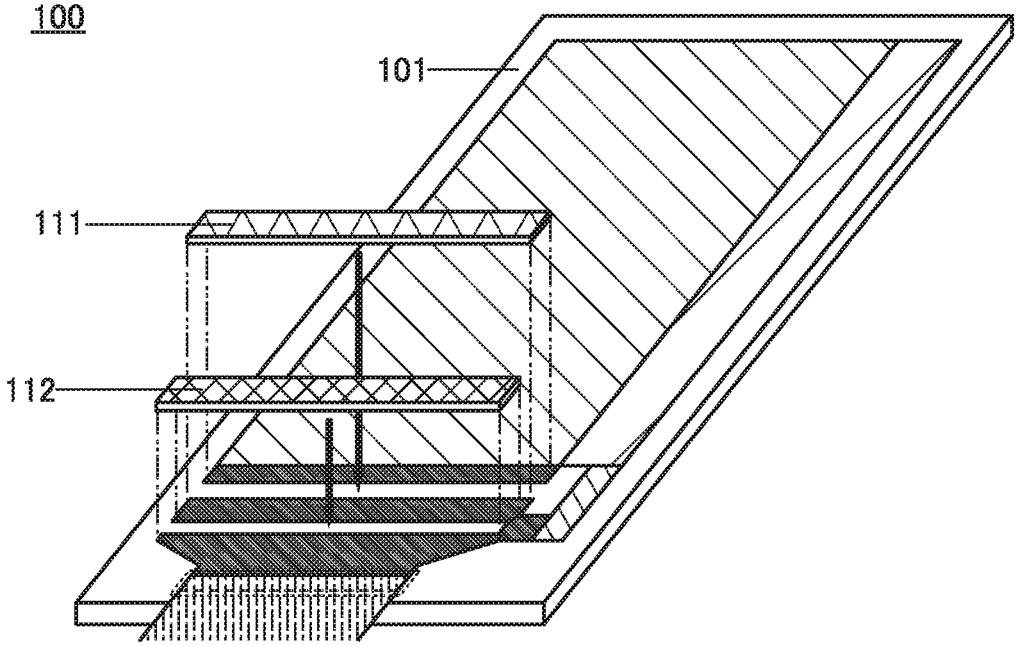

FIG. 28A illustrates an example of an external view of the display unit 100. The display unit 100 includes the display portion 102, the gate driver 103, the level shifter 104, the source driver IC 111, and a controller IC 112 over a base 101. The controller IC 112 in FIG. 28A is an example of the controller IC 400 described in Embodiment 1. The display portion 102, the gate driver 103, and the level shifter 104 are formed over the base 101. The source driver IC 111 and the controller IC 112 are mounted as components of an IC chip or the like, over the base 101, using an anisotropic conductive adhesive or an anisotropic conductive film by a COG method. FIG. 28B illustrates a state where the source driver IC 111 and the controller IC 112 are mounted. The display unit 100 is electrically connected to the FPC 110 as a unit for inputting a signal or the like from the outside. The source driver IC 111 and/or the controller IC 112 may be mounted on the FPC 110 or the like by a COF method instead of a COG method.

In addition, wirings 131 to 134 are formed over the base 101 so that the circuits are electrically connected to each other. In the display unit 100, the controller IC 112 is electrically connected to the FPC 110 through the wiring 131, and the source driver IC 111 is electrically connected to the controller IC 112 through the wiring 132. The display portion 102 is electrically connected to the source driver IC 111 through the wiring 133. The level shifter 104 is electrically connected to the controller IC 112 through the wiring 134.

The gate driver 103 is electrically connected to the display portion 102, and the level shifter 104 is electrically connected to the gate driver 103.

A connection portion 120 between the wiring 131 and the FPC 110 has an anisotropic conductive adhesive, whereby electrical conduction between the FPC 110 and the wiring 131 can be obtained.

The gate driver 103 has a function of selecting a plurality of pixel circuits in the display portion 102, and the source driver IC 111 has a function of transmitting image data to the pixel circuits in the display portion 102.

The display portion 102, the gate driver 103, and the level shifter 104 can be formed, for example, using OS transistors, over the base 101. In other words, a step of forming OS transistors over the base 101 is performed, whereby the display portion 102, the gate driver 103, and the level shifter 104 can be formed.

The source driver IC 111 and the controller IC 112 can be formed, for example, using Si transistors, over the base 101. In the case where IC chips (integrated circuits) for the source driver IC 111 and the controller IC 112 are formed using Si transistors, a Si wafer is preferably used for a base where the Si transistors are formed. Thus, Si transistors are formed on a top surface of the Si wafer or the like, whereby the source driver IC 111 and/or the controller IC 112 can be formed.

The controller IC 112 includes a frame memory, a register, or the like, as described in Embodiment 1. Such circuits are preferably formed using Si transistors with a logic process (hereinafter, referred to as logic Si transistors).

Furthermore, when a circuit storing data, such as a frame memory or a register, is formed, an OS transistor with an extremely low off-state current is preferably used as a transistor holding a potential corresponding to the data. In other words, it is further preferable that the controller IC 112 include a logic Si transistor and an OS transistor. Specifically, the logic Si transistor is formed on the Si wafer, an interlayer film is formed over the logic Si transistor, and then the OS transistor is formed over the interlayer film.

Although the source driver IC 111 will be described in detail in Embodiment 6, the source driver IC 111 includes a shift register, a level shifter, a digital analog conversion circuit, a buffer, and the like. Such circuits are preferably formed using Si transistors with a process for a driver IC (high withstand-voltage process) (such a Si transistor is hereinafter referred to as a high withstand-voltage Si transistor).

The high withstand-voltage Si transistor has lower resistance to heat treatment than the logic Si transistor in some cases. When the source driver IC 111 is formed using the high withstand-voltage Si transistors and the OS transistors for which heat treatment is necessary, it is difficult to exert the potential performance in some cases. Thus, the source driver IC 111 is preferably formed using only high withstand-voltage Si transistors.

As described above, the controller IC 112 including the logic Si transistors and the OS transistors and the source driver IC 111 including the high withstand-voltage Si transistors are mounted over the base 101 where the OS transistors are formed, so that the transistors having different levels of resistance to heat treatment, i.e., the logic Si transistors, the high withstand-voltage Si transistors, and the OS transistors, can be provided in the display unit 100. With such a structure, degradation of transistor characteristics, caused by a difference in heat treatment conditions, can be prevented, and all of the logic Si transistor, the high withstand-voltage Si transistor, and the OS transistor, which have favorable transistor characteristics, can be used in one device. As a result, a display device with high driving performance can be achieved.

Figure 29A:
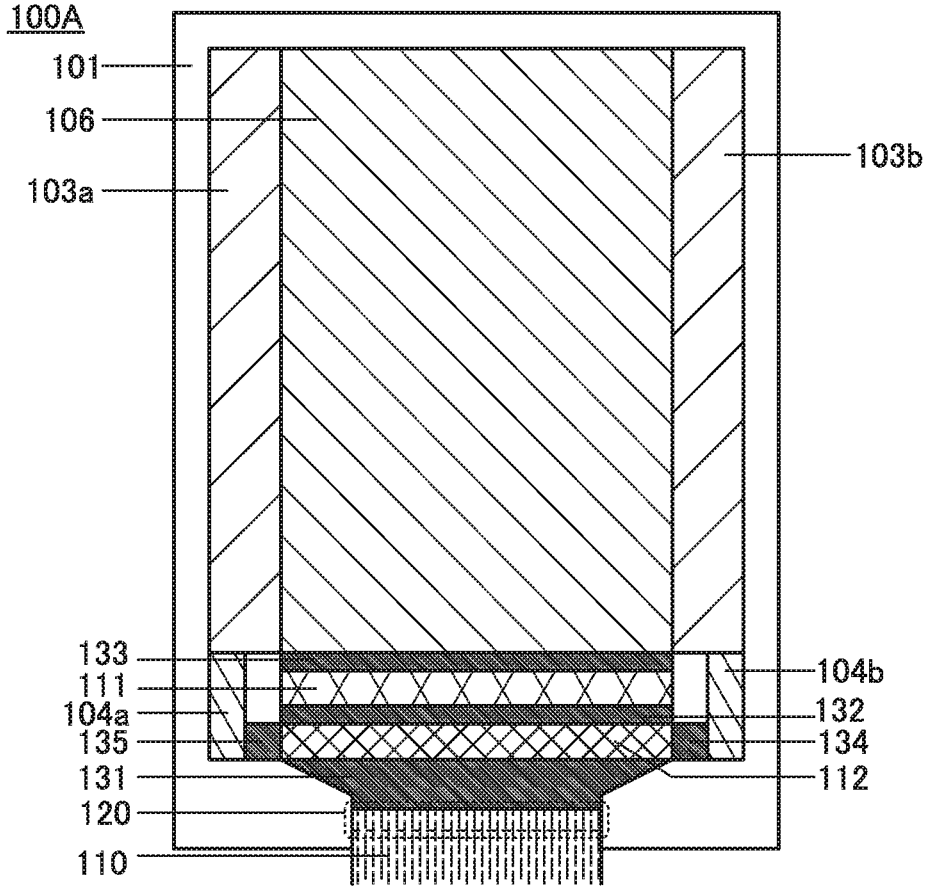
FIGS. 29A and 29B are a top view and a perspective view illustrating an example of a display unit.

FIG. 29A illustrates a display unit having another structure of the display unit 100 in FIG. 28A.

Figure 29B:
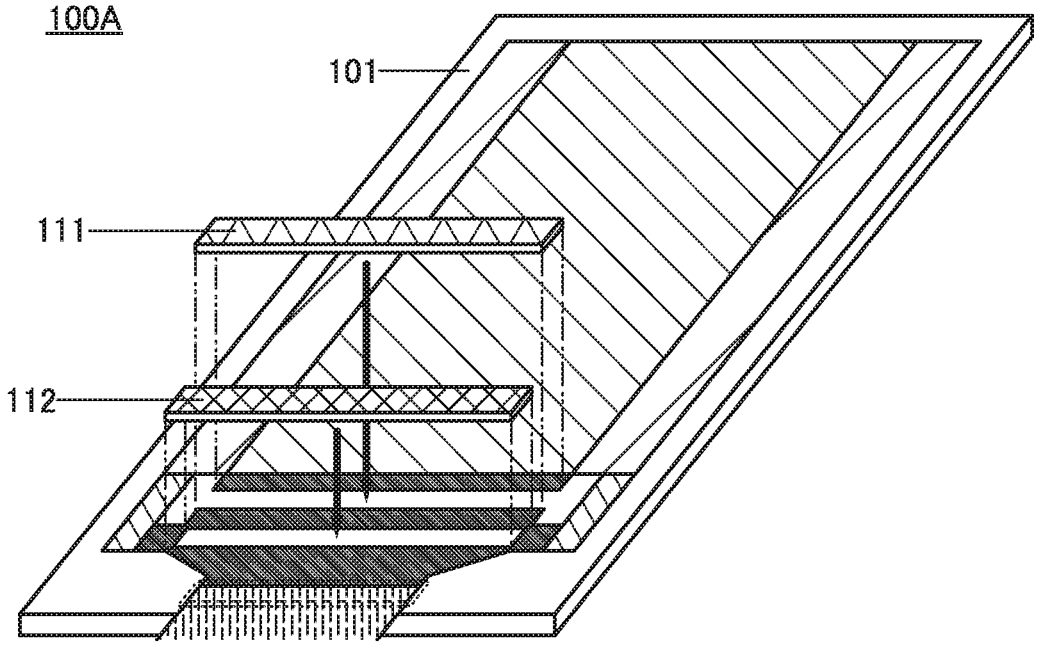

The display unit 100A includes the display portion 106, the gate driver 103*a*, the gate driver 103*b*, the level shifter 104*a*, the level shifter 104*b*, the source driver IC 111, and the controller IC 112 over the base 101. The controller IC 112 in FIG. 29A is an example of the controller IC 400A described in Embodiment 1. The display portion 106, the gate driver 103*a*, the gate driver 103*b*, the level shifter 104*a*, and the level shifter 104*b* are formed over the base 101. The source driver IC 111 and the controller IC 112 are mounted as components of an IC chip or the like, over the base 101, using an anisotropic conductive adhesive or an anisotropic conductive film by a COG method. FIG. 29B illustrates a state where the source driver IC 111 and the controller IC 112 are mounted. The display unit 100A is electrically connected to the FPC 110 as a unit for inputting a signal or the like from the outside. The source driver IC 111 and/or the controller IC 112 may be mounted on the FPC 110 or the like by a COF method instead of a COG method.

In addition, wirings 131 to 135 are formed over the base 101 so that the circuits are electrically connected to each other. In the display unit 100, the controller IC 112 is electrically connected to the FPC 110 through the wiring 131, and the source driver IC 111 is electrically connected to the controller IC 112 through the wiring 132. The display portion 106 is electrically connected to the source driver IC 111 through the wiring 133. The level shifter 104*a* is electrically connected to the controller IC 112 through the wiring 134, and the level shifter 104*b* is electrically connected to the controller IC 112 through the wiring 135.

The connection portion 120 between the wiring 131 and the FPC 110 has an anisotropic conductive adhesive, whereby electrical conduction between the FPC 110 and the wiring 131 can be obtained.

The gate driver 103*a* has a function of selecting one of the reflective element and the light-emitting element in the display portion 106. The gate driver 103*b* has a function of selecting the other of the reflective element and the light-emitting element in the display portion 106. The source driver IC 111 has a function of transmitting image data to the reflective element or the light-emitting element in the display portion 106.

The display portion 106, the gate driver 103*a*, the gate driver 103*b*, the level shifter 104*a*, and the level shifter 104*b* can be formed, for example, using OS transistors, over the base 101. In other words, a step of forming OS transistors over the base 101 is performed, whereby the display portion 106, the gate driver 103*a*, the gate driver 103*b*, the level shifter 104*a*, and the level shifter 104*b* can be formed.

As for transistors included in the IC chips of the source driver IC 111 and the controller IC 112, the description of the display unit 100 can be referred to. As in the case of the display unit 100, the source driver IC 111 is preferably formed using high withstand-voltage Si transistors, and the controller IC 112 is preferably formed using logic Si transistors and OS transistors.

As described above, as in the case of the display unit 100, the controller IC 112 including the logic Si transistors and the OS transistors and the source driver IC 111 including the high withstand-voltage Si transistors are mounted over the base 101 where the OS transistors are formed, so that the transistors having different levels of resistance to heat treatment, i.e., the logic Si transistors, the high withstand-voltage Si transistors, and the OS transistors, can be provided in the display unit 100A. As a result, a display device with high driving performance can be achieved.

Figure 30A:
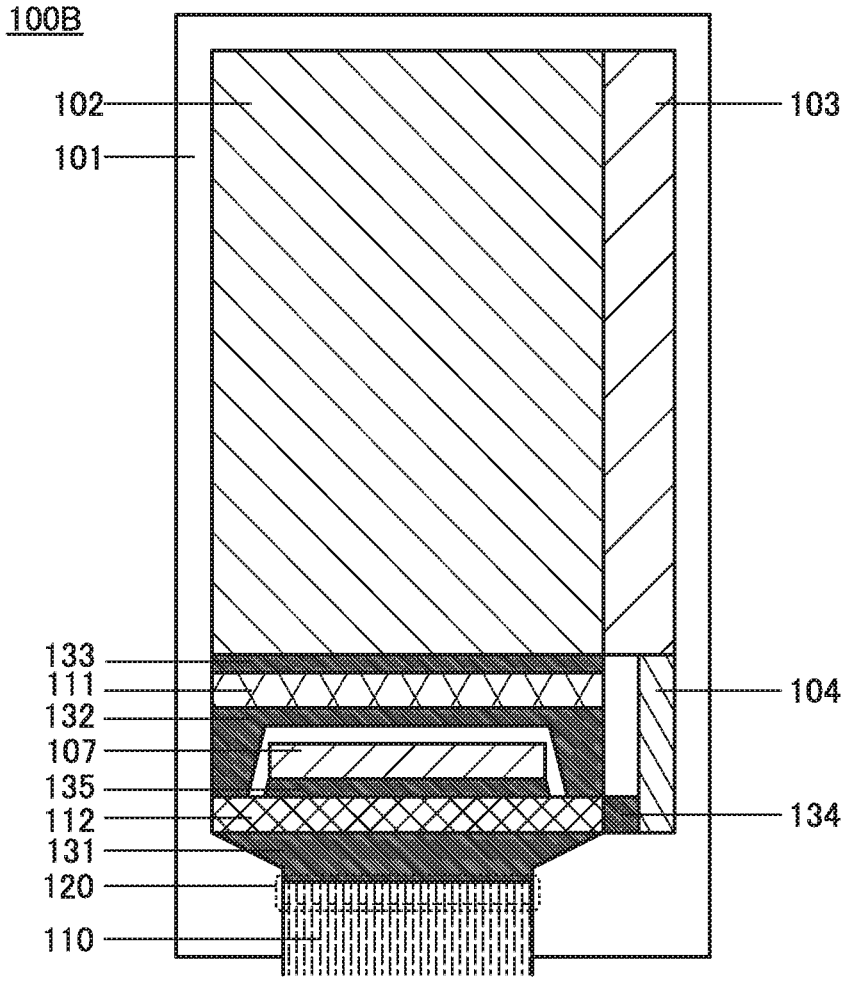
FIGS. 30A and 30B are a top view and a perspective view illustrating an example of a display unit.

In the image processing portion 460 of the display unit 100 or the display unit 100A, the data processing circuit 465, particularly, the product-sum operation circuit 465*a*, can be formed using OS transistors without Si transistors as described in Embodiment 2. Thus, the data processing circuit 465 that can be formed using OS transistors can be formed over the base 101, instead of being formed in the controller IC 112. FIG. 30A illustrates an example of an external view of a display unit in that case. In a display unit 100B, instead of the data processing circuit 465 inside the controller IC 112, a data processing circuit 107 is formed over the base 101 of the display unit 100. The data processing circuit 107 is electrically connected to the controller IC 112 through the wiring 135.

Figure 31:
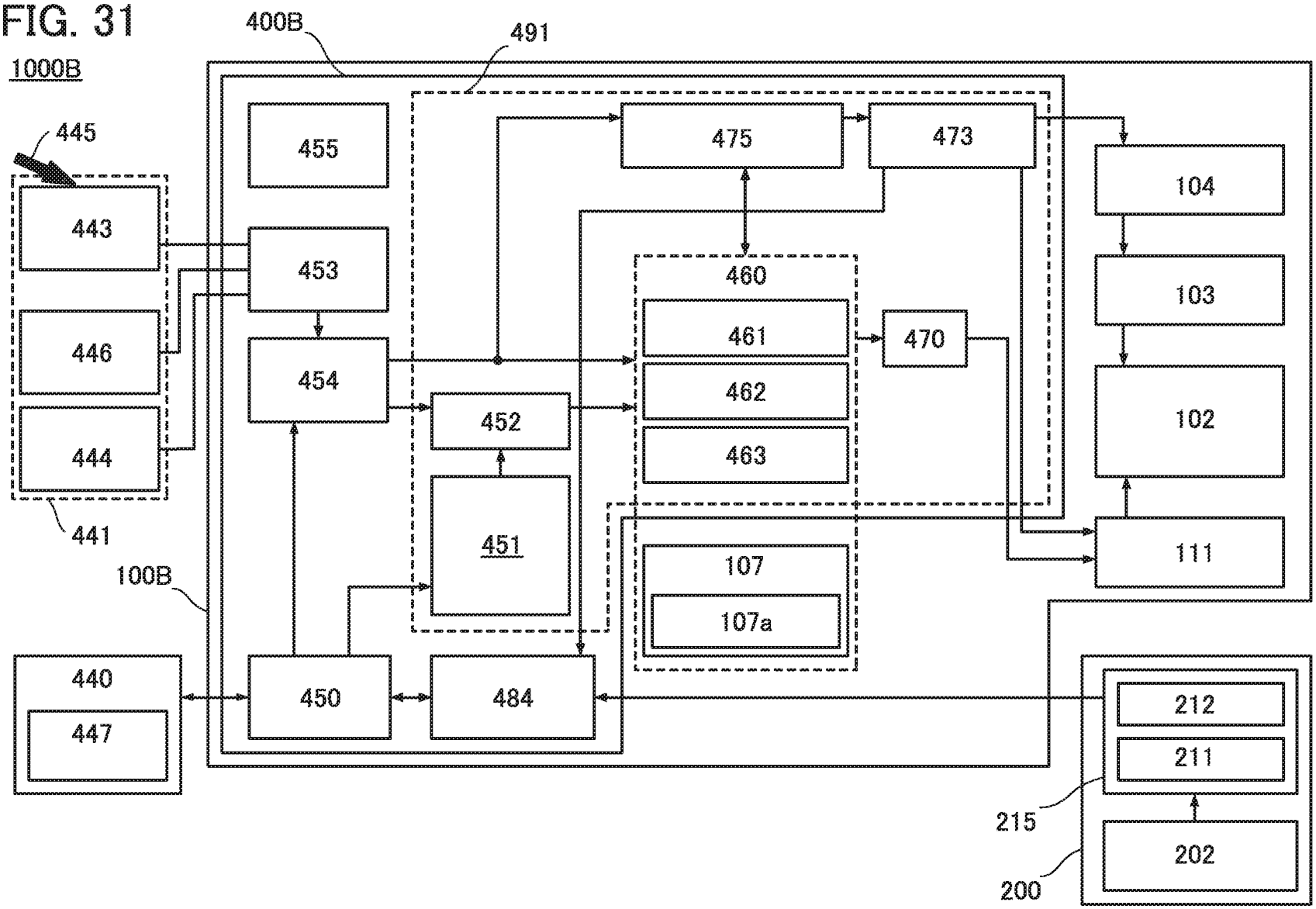
FIG. 31 is a block diagram showing a configuration example of a display device.

A block diagram in this case is shown in FIG. 31. In a display device 1000B, a controller IC 400B is provided with the data processing circuit 107 outside the controller IC 400, instead of the data processing circuit 465 of the controller IC 400. In this block diagram, a product-sum operation circuit 107*a* corresponds to the product-sum operation circuit 465*a*. Of the circuits included in the image processing portion 460, a circuit formed using OS transistors without Si transistors is formed outside the controller IC 400B, that is, formed over the base 101, in a manner similar to those of the display portion 102, the gate driver 103, and the level shifter 104. With this configuration, the cost for manufacturing a chip of the controller IC can be reduced in some cases.

Figure 30B:
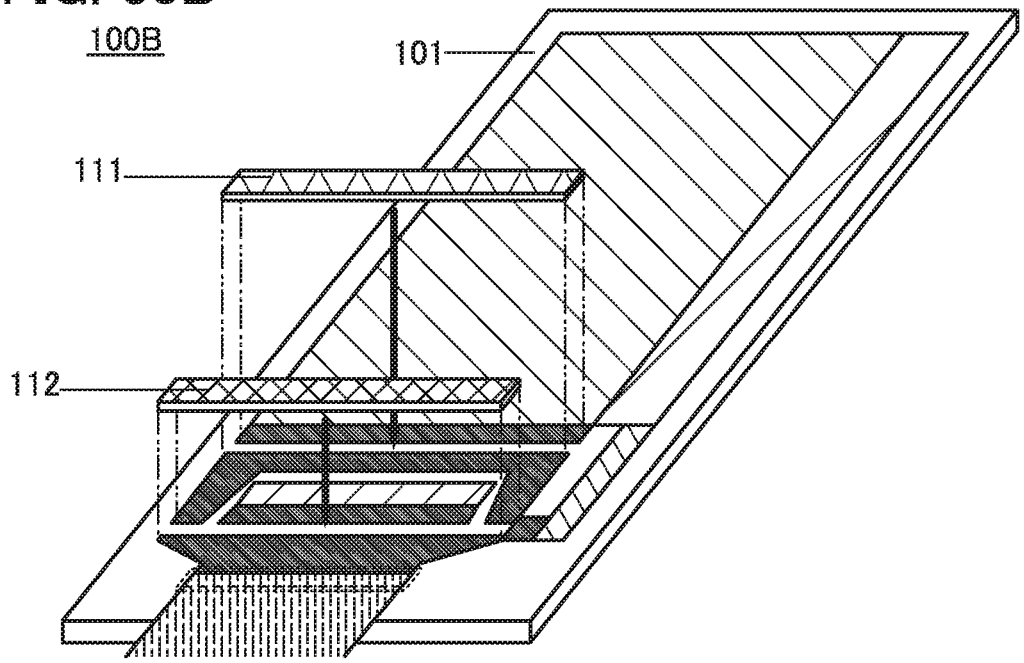

The source driver IC 111 and the controller IC 112 may be mounted over the display unit 100B using an anisotropic conductive adhesive or an anisotropic conductive film by a COG method, as described with FIG. 28B. FIG. 30B illustrates a state where the source driver IC 111 and the controller IC 112 are mounted. Furthermore, the source driver IC 111 and the controller IC 112 may be mounted over a FPC or the like by a COF method.

Figure 32:
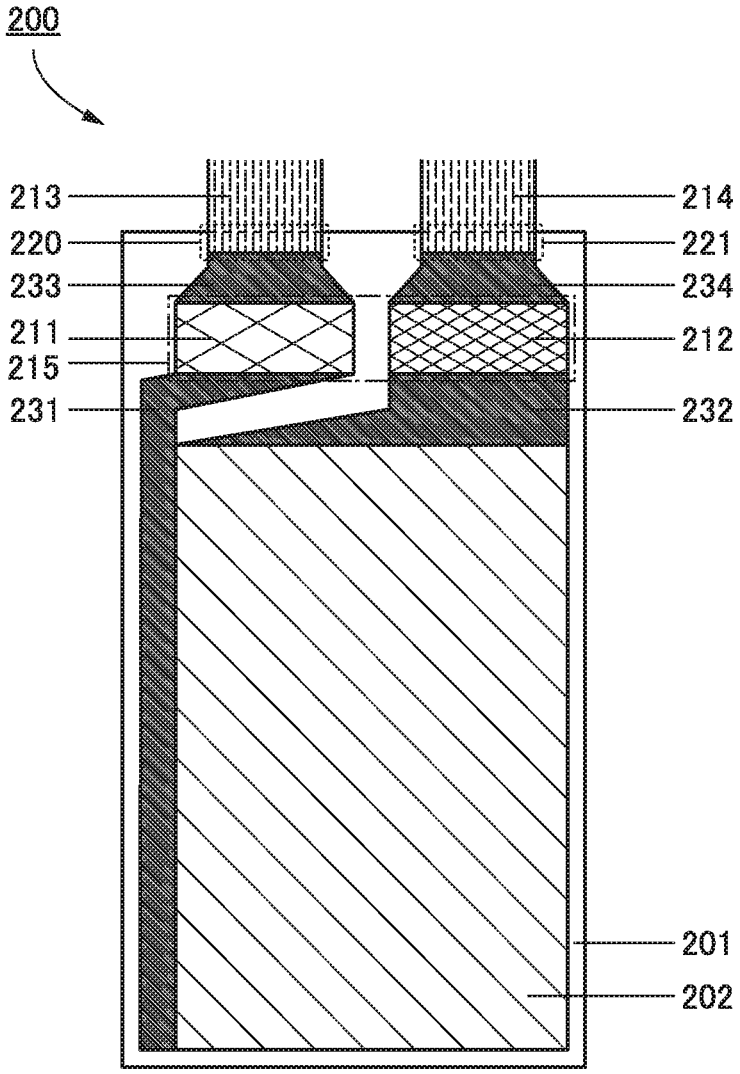
FIG. 32 is a top view illustrating an example of a touch sensor unit.
Figure 33:
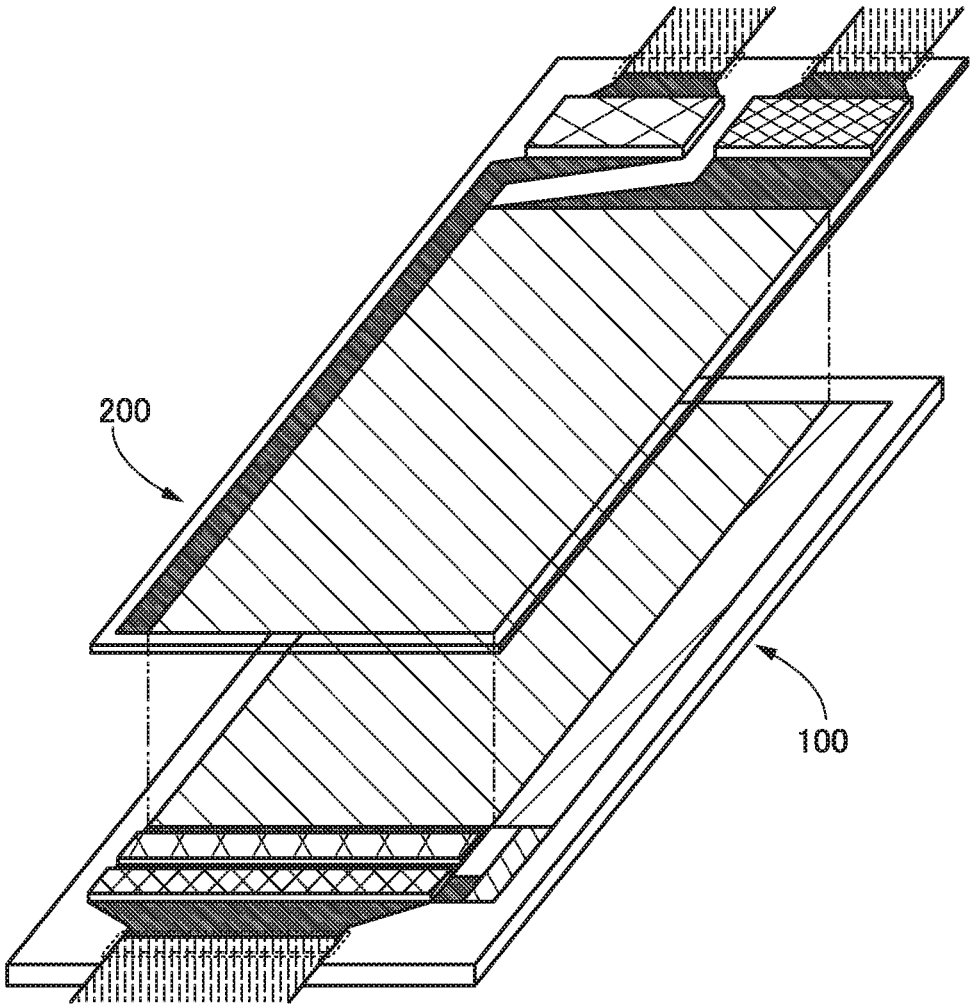
FIG. 33 is a perspective view illustrating an example in which a touch sensor unit is mounted over a display unit.

The display unit 100, the display unit 100A, or the display unit 100B may be provided with a touch sensor unit. FIG. 32 illustrates a touch sensor unit that can be provided for the display unit 100, the display unit 100A, or the display unit 100B, and FIG. 33 illustrates an example in which a touch sensor unit is provided for the display unit 100.

The touch sensor unit 200 includes a sensor array 202, the touch sensor (TS) driver IC 211, and the sensing circuit 212 over a base 201. In FIG. 33, the TS driver IC 211 and the sensing circuit 212 are collectively shown as the peripheral circuit 215. The sensor array 202 is formed over the base 201. The TS driver IC 211 and the sensing circuit 212 are mounted as components of an IC chip or the like, over the base 201, using an anisotropic conductive adhesive or an anisotropic conductive film by a COG method. The touch sensor unit 200 is electrically connected to an FPC 213 and an FPC 214 as units for inputting a signal or the like from the outside. The TS driver IC 211 and the sensing circuit 212 may be mounted on the FPC 213, the FPC 214, or the like by a COF method instead of a COG method.

In addition, wirings 231 to 234 are formed over the base 201 so that the circuits are electrically connected to each other. In the touch sensor unit 200, the TS driver IC 211 is electrically connected to the sensor array 202 through the wiring 231, and the TS driver IC 211 is electrically connected to the FPC 213 through the wiring 233. The sensing circuit 212 is electrically connected to the sensor array 202 through the wiring 232, and the TS driver IC 211 is electrically connected to the FPC 214 through the wiring 234.

A connection portion 220 between the wiring 233 and the FPC 213 has an anisotropic conductive adhesive, whereby electrical conduction between the FPC 213 and the wiring 233 can be obtained. Also, a connection portion 221 between the wiring 234 and the FPC 214 has an anisotropic conductive adhesive, whereby electrical conduction between the FPC 214 and the wiring 234 can be obtained.

The touch sensor unit 200 is provided to overlap with the display unit 100, the display unit 100A, or the display unit 100B, so that the display unit 100, the display unit 100A, or the display unit 100B can have a function of a touch panel. FIG. 33 illustrates an example in which the touch sensor unit 200 overlaps with the display unit 100 so that the display unit 100 has a function of a touch panel.

This embodiment can be combined with any of the other embodiments in this specification as appropriate.

Embodiment 5

In this embodiment, the base 101 that can be used for the display unit 100, the display unit 100A, or the display unit 100B described in the above embodiment, and a circuit that can be formed over the base 101 will be described.

<Base 101>

As the base 101, an insulator substrate or a conductor substrate can be used, for example. As the insulator substrate, a glass substrate, a quartz substrate, a sapphire substrate, a stabilized zirconia substrate (e.g., an yttria-stabilized zirconia substrate), or a resin substrate is used, for example. As the conductor substrate, for example, a graphite substrate, a metal substrate, an alloy substrate, a conductive resin substrate, or the like is used. A substrate including a metal nitride, a substrate including a metal oxide, or the like is used. An insulator substrate provided with a conductor or a semiconductor, a conductor substrate provided with a semiconductor or an insulator, or the like is used. Alternatively, any of these substrates over which an element is provided may be used. As the element provided over the substrate, a capacitor, a resistor, a switching element, a light-emitting element, a memory element, or the like is used.

Furthermore, as the base 101, a flexible substrate can be used. As a method for providing an element over a flexible substrate, an element is formed over a non-flexible substrate, and then the element is separated and transferred to a flexible substrate. In that case, a separation layer is preferably provided between the non-flexible substrate and the element. As the base 101, a sheet, a film, or foil containing a fiber may be used. The base 101 may have elasticity. The base 101 may have a property of returning to its original shape when bending or pulling is stopped. Alternatively, the base 101 may have a property of not returning to its original shape. The thickness of the base 101 is, for example, greater than or equal to 5 μm and less than or equal to 700 μm, preferably greater than or equal to 10 μm and less than or equal to 500 μm, further preferably greater than or equal to 15 μm and less than or equal to 300 μm. When the base 101 has a small thickness, the weight of the display unit 100 can be reduced. When the base 101 has a small thickness, even in the case of using glass or the like, the base 101 may have elasticity or a property of returning to its original shape when bending or pulling is stopped. Therefore, an impact applied to the semiconductor device over the base 101, which is caused by dropping or the like, can be reduced. That is, a durable semiconductor device can be provided.

For the flexible substrate, for example, metal, an alloy, a resin, glass, or fiber thereof can be used. The flexible substrate preferably has a lower coefficient of linear expansion because deformation due to an environment is suppressed. The flexible substrate is formed using, for example, a material whose coefficient of linear expansion is lower than or equal to $1\times10^{-3}$/K, lower than or equal to $5\times10^{-5}$/K, or lower than or equal to $1\times10^{-5}$/K. Examples of the resin include polyester, polyolefin, polyamide (e.g., nylon or aramid), polyimide, polycarbonate, acrylic, and polytetrafluoroethylene (PTFE). In particular, aramid is preferably used for the flexible substrate because of its low coefficient of linear expansion.

<Pixel Circuit Included in Display Portion>

Next, a pixel circuit included in the display portion 102 and a pixel circuit included in the display portion 106 are described.

The pixel circuit in the display portion 102 includes one kind of a display element such as a liquid crystal element or a light-emitting element. The configuration of the pixel circuit in the display portion 102 depends on the kind of display element.

Figure 34A:
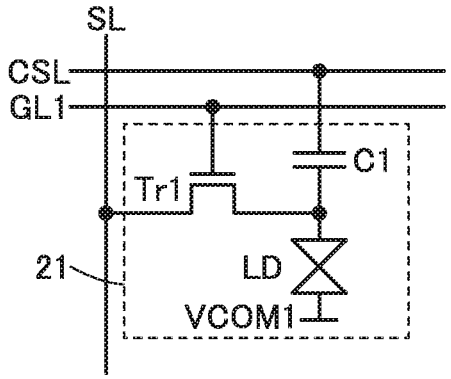
FIGS. 34A to 34E are circuit diagrams each illustrating a configuration example of a pixel.

FIG. 34A illustrates an example of a pixel circuit in which a liquid crystal element is used as a display element of the display portion 102. A pixel circuit 21 includes a transistor Tr1, a capacitor C1, and a liquid crystal element LD.

A first terminal of the transistor Tr1 is electrically connected to a wiring SL, a second terminal of the transistor Tr1 is electrically connected to a first terminal of the liquid crystal element LD, and a gate of the transistor Tr1 is electrically connected to a wiring GL1. A first terminal of the capacitor C1 is electrically connected to a wiring CSL, and a second terminal of the capacitor C1 is electrically connected to the first terminal of the liquid crystal element LD. A second terminal of the liquid crystal element LD is electrically connected to a wiring VCOM1.

The wiring SL functions as a signal line that supplies an image signal to the pixel circuit 21. A wiring GL2 functions as a scanning line that selects the pixel circuit 21. The wiring CSL functions as a capacitor wiring that holds a potential of the first terminal of the capacitor C1, i.e., a potential of the first terminal of the liquid crystal element LD. The wiring VCOM1 is a wiring that supplies a fixed potential such as 0 V or a GND potential as a common potential to the second terminal of the liquid crystal element LD.

In the case where a liquid crystal element is used as a display element of the display portion 102, the pixel circuit 21 is employed in the display portion 102, whereby an image can be displayed on the display portion 102.

Figure 34B:
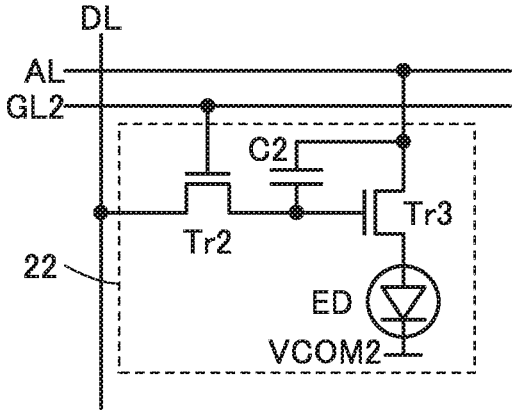

FIG. 34B illustrates an example of a pixel circuit in which a light-emitting element is used as a display element of the display portion 102. Note that the light-emitting element is an organic electroluminescence (EL) element. A pixel circuit 22 includes a transistor Tr2, a transistor Tr3, a capacitor C2, and a light-emitting element ED.

A first terminal of the transistor Tr2 is electrically connected to a wiring DL, a second terminal of the transistor Tr2 is electrically connected to a gate of the transistor Tr3, and a gate of the transistor Tr2 is electrically connected to the wiring GL2. A first terminal of the transistor Tr3 is electrically connected to a first terminal of the light-emitting element ED, and a second terminal of the transistor Tr3 is electrically connected to a wiring AL. A first terminal of the capacitor C2 is electrically connected to the second terminal of the transistor Tr3, and a second terminal of the capacitor C2 is electrically connected to the gate of the transistor Tr3. A second terminal of the light-emitting element ED is electrically connected to a wiring VCOM2.

The wiring DL functions as a signal line that supplies an image signal to the pixel circuit 22. The wiring GL2 functions as a scanning line that selects a pixel circuit 22. The wiring AL functions as a current supply line that supplies a current to the light-emitting element ED. The wiring VCOM2 is a wiring that supplies a fixed potential such as 0 V or a GND potential as a common potential to the second terminal of the light-emitting element ED.

The capacitor C2 has a function of holding a voltage between the second terminal of the transistor Tr3 and the gate of the transistor Tr3. Thus, the on-state current flowing through the transistor Tr3 can be kept constant. In the case where parasitic capacitance between the second terminal of the transistor Tr3 and the gate of the transistor Tr3 is large, the capacitor C2 is not necessarily provided.

Figure 34C:
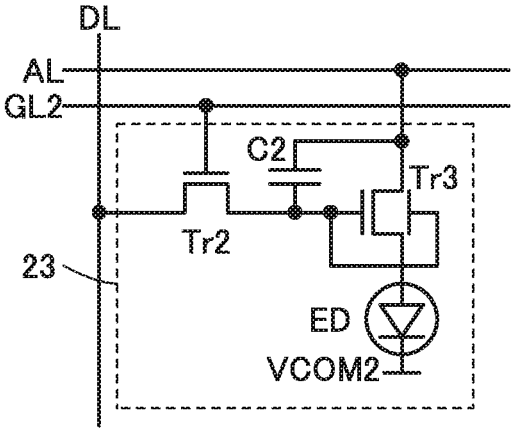

In the case where a light-emitting element is used as a display element of the display portion 102, a pixel circuit 23 illustrated in FIG. 34C, which has a different configuration from the pixel circuit 22, may be employed.

The pixel circuit 23 has a configuration where a back gate is provided for the transistor Tr3 in the pixel circuit 22, and the back gate of the transistor Tr3 is electrically connected to the gate of the transistor Tr3. Such a configuration enables an increase in the amount of on-state current flowing through the transistor Tr3.

Figure 34D:
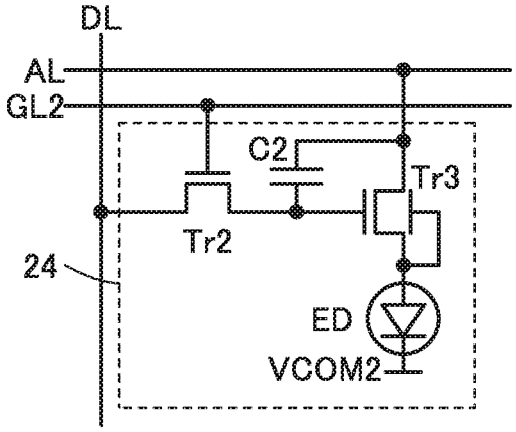

In the case where a light-emitting element is used as a display element of the display portion 102, a pixel circuit 24 illustrated in FIG. 34D, which has a different configuration from the pixel circuit 22 and the pixel circuit 23, may be used.

The pixel circuit 24 has a configuration where a back gate is provided for the transistor Tr3 in the pixel circuit 22, and the back gate of the transistor Tr3 is electrically connected to the first terminal of the transistor Tr3. Such a configuration enables suppression of a shift of the threshold voltage of the transistor Tr3. For this reason, the reliability of the transistor Tr3 can be improved.

Figure 34E:
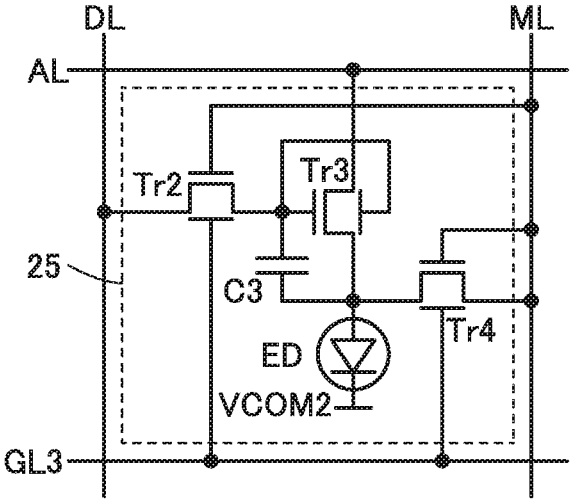

In the case where a light-emitting element is used as a display element of the display portion 102, a pixel circuit 25 illustrated in FIG. 34E, which is a different configuration from the pixel circuits 22 to 24, may be used.

The pixel circuit 25 includes the transistor Tr2, the transistor Tr3, and a transistor Tr4, a capacitor C3, and the light-emitting element ED.

The first terminal of the transistor Tr2 is electrically connected to the wiring DL, the second terminal of the transistor Tr2 is electrically connected to the gate of the transistor Tr3, the gate of the transistor Tr2 is electrically connected to a wiring ML, and the back gate of the transistor Tr2 is electrically connected to a wiring GL3. The first terminal of the transistor Tr3 is electrically connected to the first terminal of the light-emitting element ED, the second terminal of the transistor Tr3 is electrically connected to the wiring AL, and the gate of the transistor Tr3 is electrically connected to the back gate of the transistor Tr3. A first terminal of the transistor Tr4 is electrically connected to the first terminal of the light-emitting element ED, a second terminal of the transistor Tr4 is electrically connected to the wiring ML, a gate of the transistor Tr4 is electrically connected to the wiring ML, and a back gate of the transistor Tr4 is electrically connected to the wiring GL3. A first terminal of the capacitor C3 is electrically connected to the gate of the transistor Tr3, and the second terminal of the capacitor C3 is electrically connected to the first terminal of the transistor Tr3. A second terminal of the light-emitting element ED is electrically connected to a wiring VCOM2.

The wiring DL functions as a signal line that supplies an image signal to the pixel circuit 25. The wiring GL3 functions as a wiring which applies a fixed potential to control threshold voltages of the transistor Tr2 and the transistor Tr4. The wiring ML is a wiring that applies a fixed potential to the gate of the transistor Tr2, the second terminal of the transistor Tr4, and the gate of the transistor Tr4, which functions as a scanning line that selects the pixel circuit 22. For the wiring AL and the wiring VCOM2, the description of the wiring AL and the wiring VCOM2 for the pixel circuit 22 is referred to.

With such a configuration, the threshold voltages of the transistor Tr2 and the transistor Tr4 are controlled, whereby a variation in luminance of a plurality of light-emitting elements ED in the display portion 106 can be corrected. Thus, when the pixel circuit 25 is used in the display portion 102, the display unit 100 with favorable display quality can be provided.

Next, a pixel circuit of the display portion 106 is described. As described above, the display portion 106 is provided in a hybrid display device, and thus both a reflective element and a light-emitting element are provided. In other words, a pixel configuration in the display portion 106 is different from the pixel configuration in the display portion 102. Here, a case in which a liquid crystal element and an organic EL element are used as the reflective element and the light-emitting element, respectively, is considered. In this case, a pixel circuit used in the display portion 106 is described.

Figure 35A:
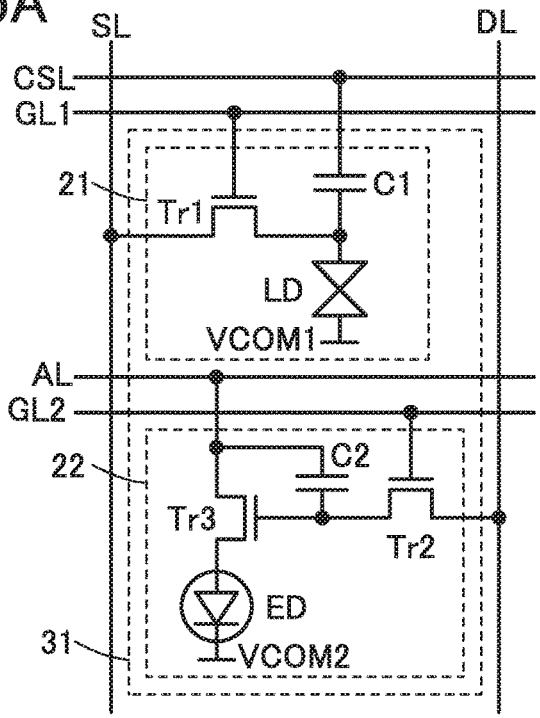
FIGS. 35A and 35B are circuit diagrams each illustrating a configuration example of a pixel.

FIG. 35A illustrates an example of a pixel circuit used in the display portion 106. A pixel circuit 31 includes the pixel circuit 21 and the pixel circuit 22. In the pixel circuit 31, the pixel circuit 21 is supplied with an image signal from the wiring SL, and the pixel circuit 22 is supplied with an image signal from the wiring DL, whereby a luminance expressed by the liquid crystal element LD and a luminance expressed by the light-emitting element ED can be controlled independently.

FIG. 35A illustrates an example of a pixel circuit including one pixel circuit 21 and one pixel circuit 22; however, the configuration of the pixel circuit in the display portion 106 is not limited thereto. The pixel circuit in the display portion 106 may include a plurality of pixel circuits 21 or a plurality of pixel circuits 22.

Figure 35B:
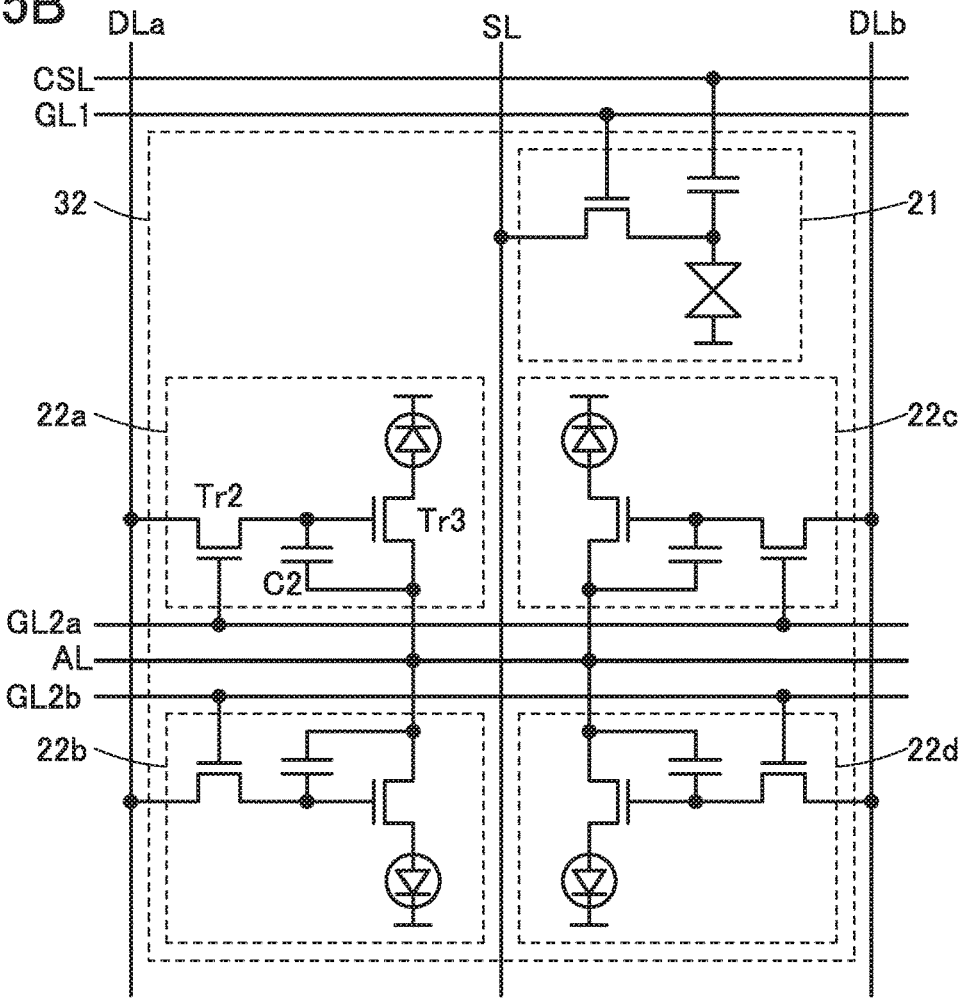

As an example, FIG. 35B illustrates a pixel circuit including one pixel circuit 21 and four pixel circuits 22. A pixel circuit 32 includes the pixel circuit 21 and pixel circuits 22*a* to 22*d*. Each of the pixel circuits 22*a* to 22*d* has the same configuration as the pixel circuit 22.

The gate of the transistor Tr2 included in each of the pixel circuits 22*a* and 22*c* is electrically connected to a wiring GL2*a*. The gate of the transistor Tr2 included in each of the pixel circuits 22*b* and 22*d* is electrically connected to a wiring GL2*b*.

The first terminal of the transistor Tr2 included in each of the pixel circuits 22*a* and 22*b* is electrically connected to a wiring DLa. The first terminal of the transistor Tr2 included in each of the pixel circuits 22*c* and 22*d* is electrically connected to a wiring DLb.

The second terminal of the transistor Tr3 included in each of the pixel circuits 22*a* to 22*d* is electrically connected to the wiring AL.

Each of the wiring GL2*a* and the wiring GL2*b* has a function similar to that of the wiring GL2 for the pixel circuit 22. Each of the wiring DLa and the wiring DLb has a function similar to that of the wiring DL for the pixel circuit 22.

As described above, in the pixel circuits 22*a* to 22*d*, the wiring GL2*a* is shared between the pixel circuit 22*a* and the pixel circuit 22*c*, and the wiring GL2*b* is shared between the pixel circuit 22*b* and the pixel circuit 22*d*. However, such a configuration that one wiring GL2 is shared between all of the pixel circuits 22*a* to 22*d* may be employed. In this case, it is preferable that the pixel circuits 22*a* to 22*d* be electrically connected to respective four wirings DL.

The light-emitting elements ED included in the pixel circuits 22*a* to 22*d* emit light having wavelengths in different ranges; thus, the display device including the display portion 106 can display a color image.

For example, light emitted from the light-emitting element ED included in the pixel circuit 22*a* is red light, light emitted from the light-emitting element ED included in the pixel circuit 22*b* is green light, and light emitted from the light-emitting element ED included in the pixel circuit 22*c* is blue light. Accordingly, the pixel circuit 32 can emit light of three primary colors. Thus, the pixel circuit 32 can express a variety of colors in accordance with a supplied image signal.

In addition to the above, for example, when light emitted from the light-emitting element ED included in the pixel circuit 22*d* is white light, the emission luminance of the display portion 106 can be improved. Furthermore, the color temperature of the white light is adjusted, whereby display quality of the display device including the display portion 106 can be improved.

Figure 36A:
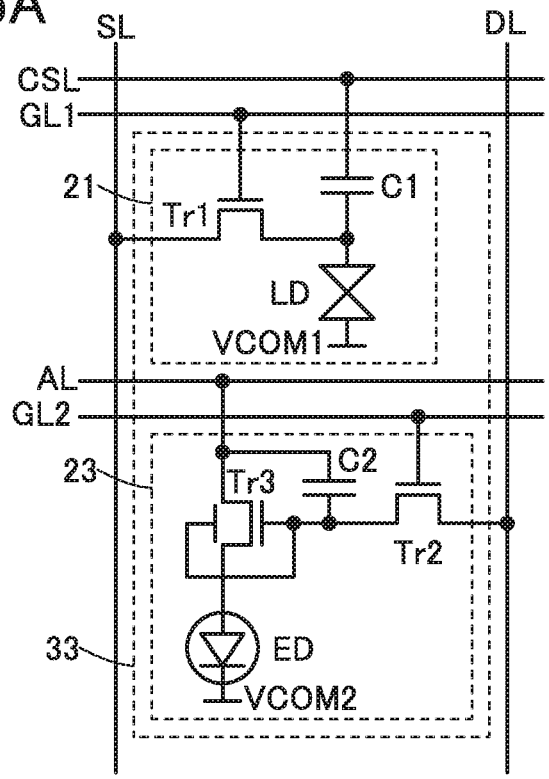
FIGS. 36A and 36B are circuit diagrams each illustrating a configuration example of a pixel.

FIG. 36A illustrates a pixel circuit that can be used in the display portion 106 and is a different from the pixel circuit 31 and the pixel circuit 32. A pixel circuit 33 includes the pixel circuit 21 and the pixel circuit 23. As in the pixel circuit 31, in the pixel circuit 33, the pixel circuit 21 is supplied with an image signal from the wiring SL, and the pixel circuit 23 is supplied with an image signal from the wiring DL, whereby a luminance expressed by the liquid crystal element LD and a luminance expressed by the light-emitting element ED can be controlled independently.

As described above, in the pixel circuit 23, the gate of the transistor Tr3 is electrically connected to the back gate of the transistor Tr3, so that the on-state current of the transistor Tr3 can be increased.

Although the pixel circuit 33 in FIG. 36A includes one pixel circuit 21 and one pixel circuit 23, a configuration of a pixel circuit in the display portion 106 is not limited thereto. The pixel circuit included in the display portion 106 may include a plurality of pixel circuits 21 or a plurality of pixel circuits 23. For example, the pixel circuit in the display portion 106 may include one pixel circuit 21 and four pixel circuits 23 as in the pixel circuit 32 illustrated in FIG. 35B. Such a circuit configuration (not illustrated) is obtained by electrically connecting the gates of the transistors Tr3 to the respective back gates of the transistors Tr3 in the pixel circuits 22*a* to 22*d* in the pixel circuit 32 illustrated in FIG. 35B.

Figure 36B:
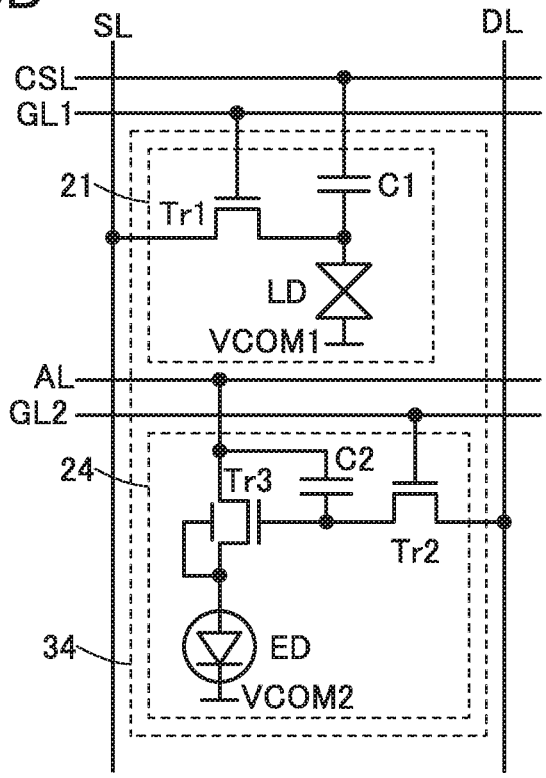

FIG. 36B illustrates a pixel circuit that can be used in the display portion 106 and is different from the pixel circuits 31 to 33. A pixel circuit 34 includes the pixel circuit 21 and the pixel circuit 24. In the pixel circuit 34, as in the pixel circuit 31 and the pixel circuit 33, the pixel circuit 21 is supplied with an image signal from the wiring SL, and the pixel circuit 24 is supplied with an image signal from the wiring DL, whereby a luminance expressed by the liquid crystal element LD and a luminance expressed by the light-emitting element ED can be controlled independently.

As described above, in the pixel circuit 24, the first terminal of the transistor Tr3 is electrically connected to the back gate of the transistor Tr3, so that a shift of the threshold voltage of the transistor Tr3 can be suppressed.

Although the pixel circuit 34 in FIG. 36B includes one pixel circuit 21 and one pixel circuit 23, a configuration of a pixel circuit in the display portion 106 is not limited thereto. The pixel circuit included in the display portion 106 may include a plurality of pixel circuits 21 or a plurality of pixel circuits 24. For example, the pixel circuit in the display portion 106 may include one pixel circuit 21 and four pixel circuits 24 as in the pixel circuit 32 illustrated in FIG. 35B. Such a circuit configuration (not illustrated) is obtained by electrically connecting the first terminals of the transistors Tr3 to the respective back gates of the transistors Tr3 in the pixel circuits 22*a* to 22*d* in the pixel circuit 32 illustrated in FIG. 35B.

Figure 37:
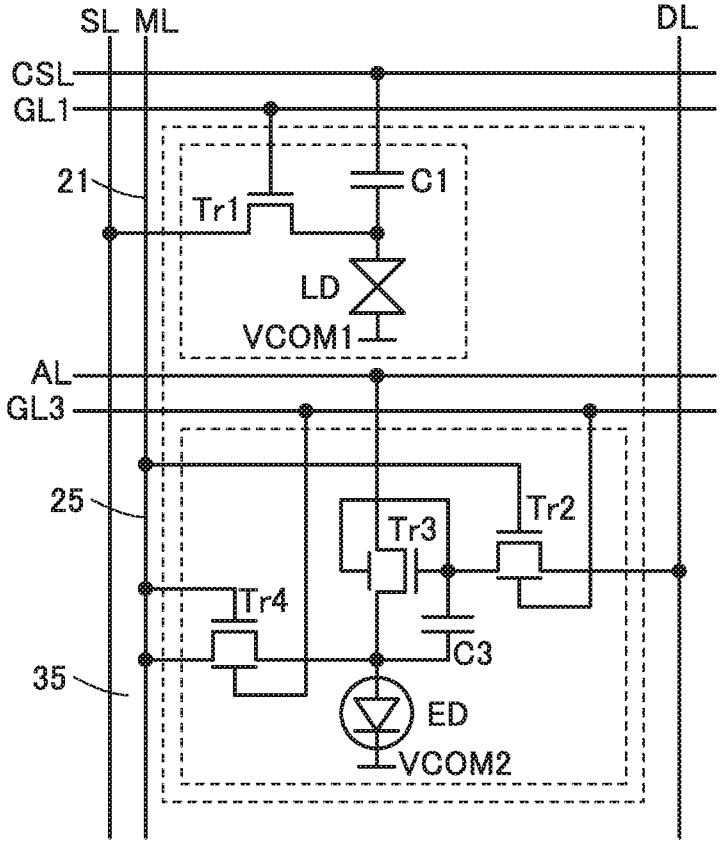
FIG. 37 is a circuit diagram illustrating a configuration example of a pixel.

FIG. 37 illustrates a pixel circuit that can be used in the display portion 106 and is different from the pixel circuits 31 to 34. A pixel circuit 35 includes the pixel circuit 21 and the pixel circuit 25. In the pixel circuit 35, as in the pixel circuit 31 and the pixel circuit 34, the pixel circuit 21 is supplied with an image signal from the wiring SL, and the pixel circuit 25 is supplied with an image signal from the wiring DL, whereby a luminance expressed by the liquid crystal element LD and a luminance expressed by the light-emitting element ED can be controlled independently.

As described above, in the pixel circuit 25, the back gate of the transistor Tr2 and the back gate of the transistor Tr4 are electrically connected to the wiring GL3, so that the threshold voltages of the transistor Tr2 and the transistor Tr4 can be controlled. Thus, a variation in luminance of a plurality of light-emitting elements ED in the display portion 106 can be corrected.

Figure 38:
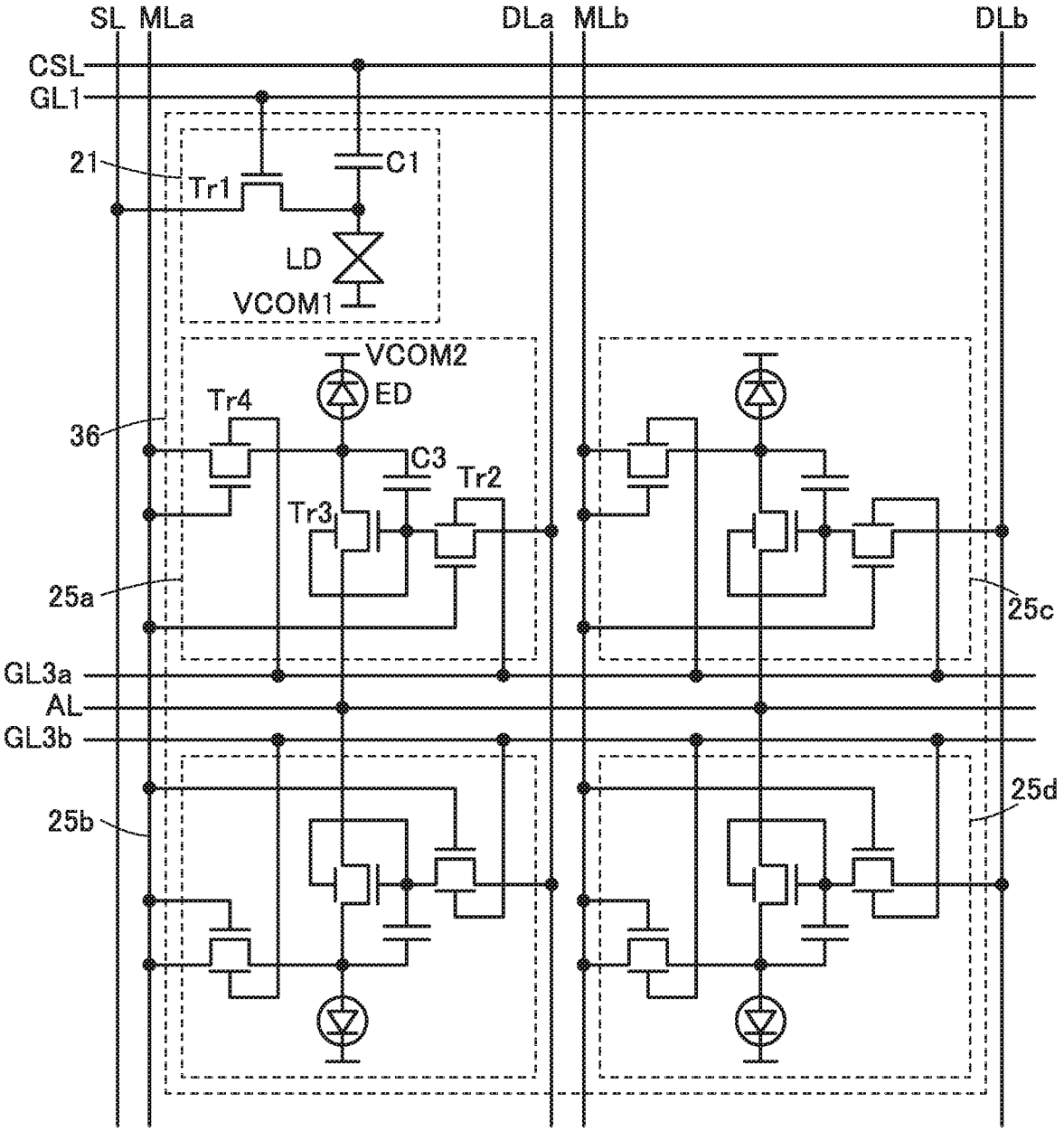
FIG. 38 is a circuit diagram illustrating a configuration example of a pixel.

Although the pixel circuit 35 in FIG. 38 includes one pixel circuit 21 and one pixel circuit 25, a configuration of a pixel circuit in the display portion 106 is not limited thereto. The pixel circuit included in the display portion 106 may include a plurality of pixel circuits 21 or a plurality of pixel circuits 25. For example, the pixel circuit in the display portion 106 may one pixel circuit 21 and four pixel circuits 25 as in the pixel circuit 32 illustrated in FIG. 35B. FIG. 38 illustrates a circuit configuration in this case. A pixel circuit 36 includes the pixel circuit 21 and pixel circuits 25*a* to 25*d*. Each of the pixel circuits 25*a* to 25*d* has the same configuration as the pixel circuit 25.

The back gate of the transistor Tr2 and the back gate of the transistor Tr4 included in each of the pixel circuits 25*a* and 25*c* are electrically connected to a wiring GL3*a*. The back gate of the transistor Tr2 and the back gate of the transistor Tr4 included in each of the pixel circuits 25*b* and 25*d* are electrically connected to a wiring GL3*b*.

The first terminal of the transistor Tr2 included in each of the pixel circuits 25*a* and 25*b* is electrically connected to a wiring DLa. The first terminal of the transistor Tr2 included in each of the pixel circuits 25*c* and 25*d* is electrically connected to a wiring DLb.

The second terminal of the transistor Tr4 included in each of the pixel circuits 25*a* and 25*b* is electrically connected to a wiring MLa. The second terminal of the transistor Tr4 included in each of the pixel circuits 25*c* and 25*d* is electrically connected to a wiring MLb.

The second terminal of the transistor Tr3 included in each of the pixel circuits 25*a* to 25*d* is electrically connected to the wiring AL.

The wiring GL3*a* and the wiring GL3*b* have a function similar to that of the wiring GL2 of the pixel circuit 25. The wiring DLa and the wiring DLb have a function similar to that of the wiring DL of the pixel circuit 25. The wiring MLa and the wiring MLb have a function similar to that of the wiring ML of the pixel circuit 25.

As described above, in the pixel circuits 25*a* to 25*d*, the wiring GL3*a* is shared between the pixel circuit 25*a* and the pixel circuit 25*c*, and the wiring GL3*b* is shared between the pixel circuit 25*b* and the pixel circuit 25*d*. However, such a configuration that one wiring GL3 is shared between all of the pixel circuits 25*a* to 25*d* may be employed. In this case, it is preferable that the pixel circuits 25*a* to 25*d* be electrically connected to respective four wirings DL.

When the light-emitting elements ED included in the pixel circuits 25*a* to 25*d* emit light having wavelengths in different ranges as in the case of the pixel circuit 32, the display device including the display portion 106 can display a color image. For this configuration, the description of the pixel circuit 32 is referred to.

<Gate Driver>

Next, an example of the gate driver 103 that can be formed over the base 101 is described.

<<Circuit Configuration of Gate Driver>>

Figure 39A:
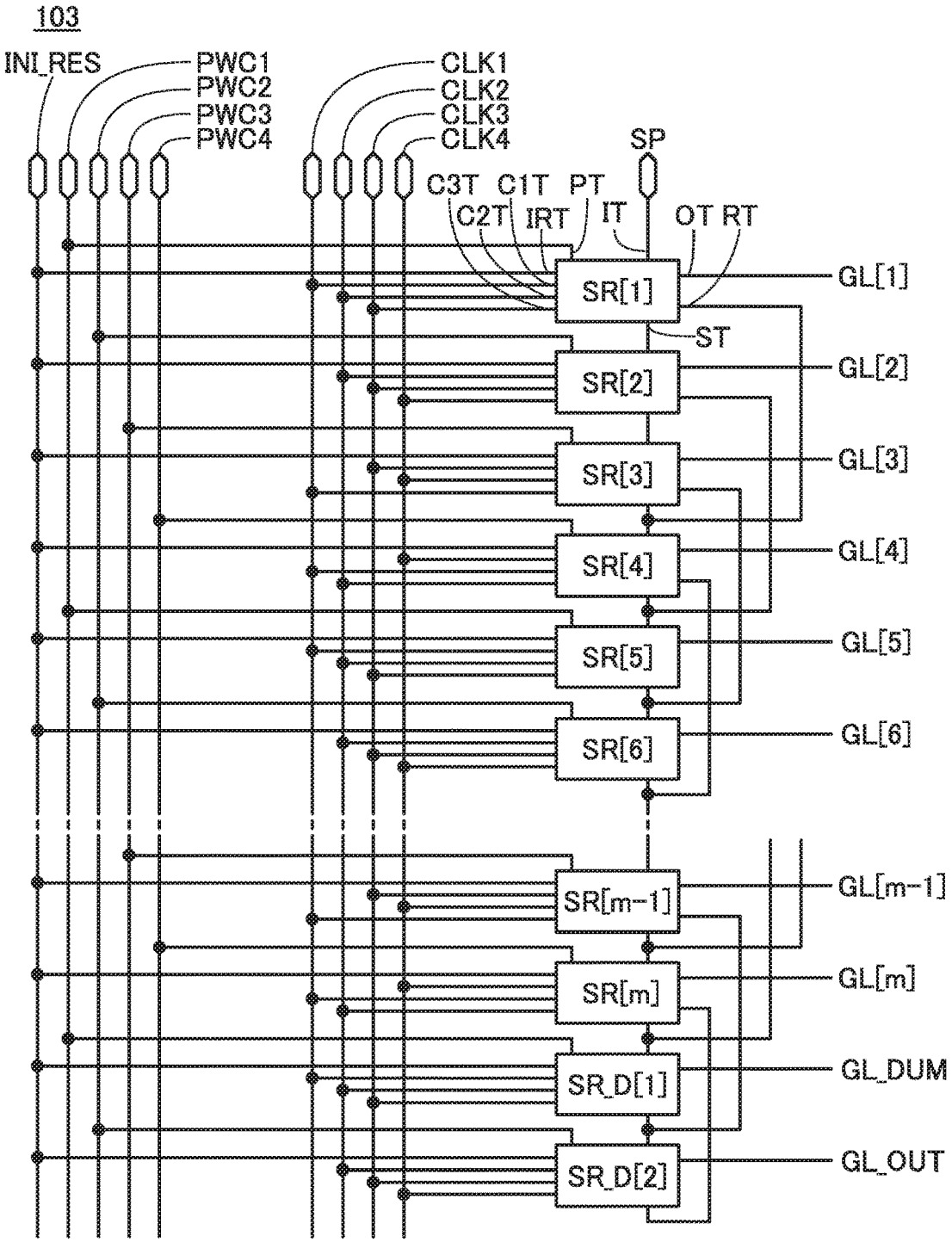
FIGS. 39A to 39C are a block diagram illustrating a configuration example of a gate driver, and diagrams illustrating circuits included in the gate driver.

FIG. 39A is a circuit diagram illustrating an example of the gate driver 103. The gate driver 103 includes circuits SR[1] to SR[m], a circuit SR_D[1], and a circuit SR_D[2]. In the gate driver 103, a shift register is composed of the circuits SR[1] to SR[m], the circuit SR_D[1], and the circuit SR_D[2]. Note that m is an integer greater than or equal to 1, which indicates the number of pixel circuits in one column of the display portion 102 or the display portion 106.

Figure 39B:
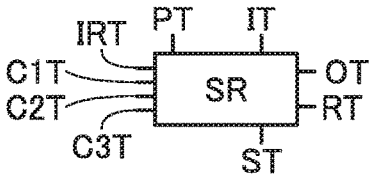
Figure 39C:
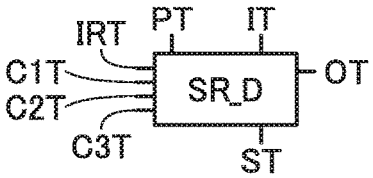

With use of FIGS. 39B and 39C, terminals provided for the circuits SR[1] to SR[m], the circuit SR_D[1], and the circuit SR_D[2] are described. In FIG. 39B, a circuit SR represents one of the circuits SR[1] to SR[m]. In FIG. 39C, a circuit SR_D represents either the circuit SR_D[1] or the circuit SR_D[2].

The circuit SR includes a terminal IT, a terminal OT, a terminal RT, a terminal ST, a terminal PT, a terminal IRT, a terminal C1T, a terminal C2T, and a terminal C3T. The circuit SR_D includes the terminal IT, the terminal OT, the terminal ST, the terminal PT, the terminal IRT, the terminal C1T, the terminal C2T, and the terminal C3T.

The terminal IT is an input terminal to which a start pulse signal or a signal outputted from the terminal ST of the circuit SR in the previous stage is inputted. The terminal OT is an output terminal that is electrically connected to a pixel circuit in the display portion 102. The terminal ST is an output terminal that transmits a signal to the circuit SR in a next stage. To the terminal RT, a signal from the terminal ST of the circuit SR in a stage that follows the next stage.

A start pulse signal SP is a signal that is inputted when the gate driver 103 is driven. The start pulse signal SP is inputted to the gate driver 103 from the controller IC 112 through the level shifter 104 every time an image for one frame is displayed on the display unit 100.

To the terminal PT, a signal (pulse width control signal) that controls the pulse width of a signal outputted from the terminal OT is inputted. Pulse width control signals PWC1 to PWC4 are signals controlling widths of pulse signals outputted to wirings GL[1] to GL[m], a wiring GL_DUM, and a wiring GL_OUT.

To the terminal IRT, an initialization reset signal INI_RES is inputted. Clock signals different from each other are inputted to the terminal C1T, the terminal C2T, and the terminal C3T.

A clock signal CLK2 has the same wavelength and the same cycle as the clock signal CLK1, and the transmission of the clock signal CLK2 is delayed from that of the clock signal CLK1 by a ¼ cycle. A clock signal CLK3 is an inverted signal of the clock signal CLK1, and a clock signal CLK4 is an inverted signal of the clock signal CLK2.

Next, a specific circuit configuration of the gate driver 103 will be described. The start pulse signal SP is inputted to the terminal IT of the circuit SR[1]. The terminal ST of the circuit SR[i] (i is an integer greater than or equal to 1 and less than or equal to (m−1)) is electrically connected to the terminal IT of the circuit SR[i+1]. The terminal ST of the circuit SR[m] is electrically connected to the terminal IT of the circuit SR_D[1], and the terminal ST of the circuit SR_D[1] is electrically connected to the terminal IT of the circuit SR_D[2].

The terminal RT of the circuit SR[p] (p is an integer greater than or equal to 1 and less than or equal to (m−2)) is electrically connected to the terminal ST of the circuit SR[p+2]. The terminal RT of the circuit SR[m−1] is electrically connected to the terminal ST of the circuit SR_D[1], and the terminal RT of the circuit SR[m] is electrically connected to the terminal ST of the circuit SR_D[2].

The terminal OT of the circuit SR[x] (x is an integer greater than or equal to 1 and less than or equal to m) is electrically connected to a wiring GL[x]. The terminal OT of the circuit SR_D[1] is electrically connected to the wiring GL_DUM, and the terminal OT of the circuit SR_D[2] is electrically connected to the wiring GL_OUT. The wiring GL_DUM functions as a dummy wiring, and the wiring GL_OUT has a function of transmitting a data signal informing that the start pulse signal reaches the circuit SR_D[2] (the last stage of the shift register of the gate driver 103).

To the terminal IRT of the circuit SR[x], the initialization reset signal INI_RES is inputted.

To the terminal C1T of the circuit SR[s] (s is an integer greater than or equal to 1 and less than or equal to m, where the relation, s=4a+1, is satisfied, and a is an integer greater than or equal to 0), the clock signal CLK1 is inputted. To the terminal C2T of the circuit SR[s], the clock signal CLK2 is inputted. To the terminal C3T of the circuit SR[s], the clock signal CLK3 is inputted. To the terminal PT of the circuit SR[s], the pulse width control signal PWC1 is inputted.

To the terminal C1T of the circuit SR[s+1], the clock signal CLK2 is inputted. To the terminal C2T of the circuit SR[s+1], the clock signal CLK3 is inputted. To the terminal C3T of the circuit SR[s+1], the clock signal CLK4 is inputted. To the terminal PT of the circuit SR[s+1], the pulse width control signal PWC2 is inputted.

To the terminal C1T of the circuit SR[s+2], the clock signal CLK3 is inputted. To the terminal C2T of the circuit SR[s+2], the clock signal CLK4 is inputted. To the terminal C3T of the circuit SR[s+2], the clock signal CLK1 is inputted. To the terminal PT of the circuit SR[s+2], the pulse width control signal PWC3 is inputted.

To the terminal C1T of the circuit SR[s+3], the clock signal CLK4 is inputted. To the terminal C2T of the circuit SR[s+3], the clock signal CLK1 is inputted. To the terminal C3T of the circuit SR[s+3], the clock signal CLK2 is inputted. To the terminal PT of the circuit SR[s+3], the pulse width control signal PWC4 is inputted.

Note that in the gate driver 103 in FIG. 39A, the input of the clock signal and the pulse width control signal to the circuit SR[m−1] is performed in a manner similar to that of the input of the clock signal and the pulse width control signal to the circuit SR[s+2]. Furthermore, the input of the clock signal and the pulse width control signal to the circuit SR[m] is performed in a manner similar to that of the input of the clock signal and the pulse width control signal to the circuit SR[s+3]. Furthermore, the input of the clock signal and the pulse width control signal to the circuit SR_D[1] is performed in a manner similar to that of the input of the clock signal and the pulse width control signal to the circuit SR[s]. The input of the clock signal and the pulse width control signal to the circuit SR_D[2] is performed in a manner similar to that of the input of the clock signal and the pulse width control signal to the circuit SR[s+1].

Note that in this specification, the clock signal CLK1, the clock signal CLK2, the clock signal CLK3, the clock signal CLK4, the pulse width control signal PWC1, the pulse width control signal PWC2, the pulse width control signal PWC3, the pulse width control signal PWC4, and the start pulse signal SP are collectively referred to as a timing signal in some cases. In a display device of one embodiment of the present invention, the timing signal is generated by the controller IC 112.

Note that in the gate driver 103 in FIG. 39A, only the following components are illustrated: the circuit SR[1], the circuit SR[2], the circuit SR[3], the circuit SR[4], the circuit SR[5], the circuit SR[6], the circuit SR[m−1], the circuit SR[m], the circuit SR_D[1], the circuit SR_D[2], the wiring GL[1], the wiring GL[2], the wiring GL[3], the wiring GL[4], the wiring GL[5], the wiring GL[6], the wiring GL[m−1], the wiring GL[m], the wiring GL_DUM, the wiring GL_OUT, the terminal IT, the terminal OT, the terminal RT, the terminal ST, the terminal PT, the terminal IRT, the terminal C1T, the terminal C2T, the terminal C3T, the clock signal CLK1, the clock signal CLK2, the clock signal CLK3, the clock signal CLK4, the pulse width control signal PWC1, the pulse width control signal PWC2, the pulse width control signal PWC3, the pulse width control signal PWC4, and the initialization reset signal INI_RES. Description of the other circuits, wirings, and numerals are omitted.

Figure 40:
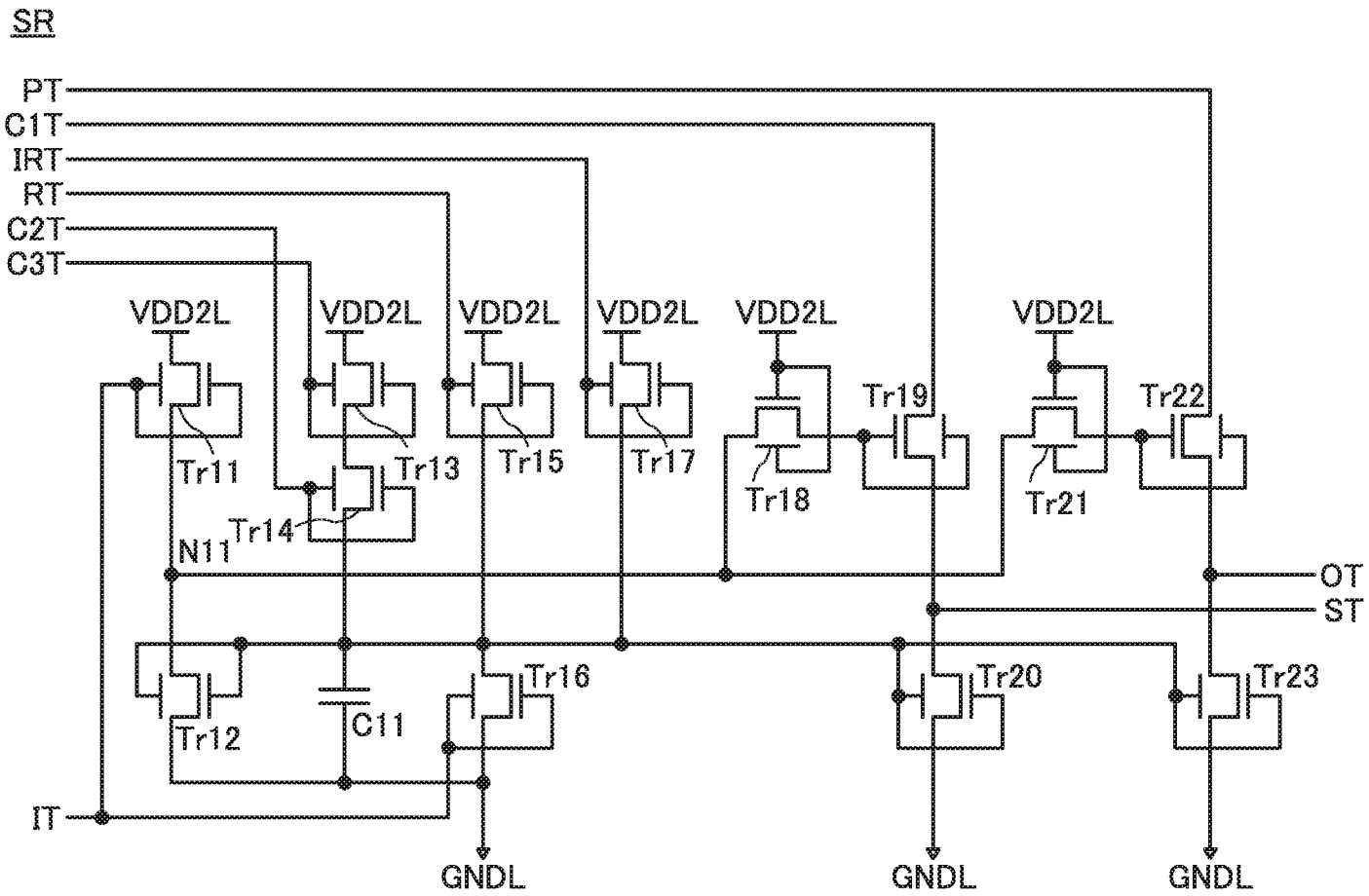
FIG. 40 is a circuit diagram illustrating a circuit included in a gate driver.

Next, circuit configurations of the circuits SR[1] to SR[m] are described. FIG. 40 illustrates a configuration of the circuit SR in FIG. 39B.

The circuit SR is formed not using a p-channel transistor but using an n-channel transistor. The circuit SR includes transistors Tr11 to Tr23 and a capacitor C11. Note that each of the transistors Tr11 to Tr23 is provided with a back gate.

A wiring VDD2L illustrated in the circuit SR in FIG. 40 is a wiring for applying a potential VDD that is a high-level potential. A wiring GNDL illustrated in the circuit SR in FIG. 40 is a wiring for applying a GND potential.

A first terminal of the transistor Tr11 is electrically connected to the wiring VDD2L, a second terminal of the transistor Tr11 is electrically connected to a first terminal of the transistor Tr21, and a gate and the back gate of the transistor Tr11 are electrically connected to the terminal IT. A first terminal of the transistor Tr12 is electrically connected to the first terminal of the transistor Tr21, a second terminal of the transistor Tr12 is electrically connected to the wiring GNDL, and a gate and a back gate of the transistor Tr12 are electrically connected to a gate and the back gate of the transistor Tr23. A connection portion between the second terminal of the transistor Tr11 and the first terminal of the transistor Tr12 is referred to as a node N11.

A first terminal of the transistor Tr13 is electrically connected to the wiring VDD2L, a second terminal of the transistor Tr13 is electrically connected to a first terminal of the transistor Tr14, and a gate and the back gate of the transistor Tr13 are electrically connected to the terminal C3T. A second terminal of the transistor Tr14 is electrically connected to the gate and the back gate of the transistor Tr23, and a gate and the back gate of the transistor Tr14 are electrically connected to the terminal C2T. A first terminal of the capacitor C11 is electrically connected to the gate and the back gate of the transistor Tr23, and a second terminal of the capacitor C11 is electrically connected to the wiring GNDL.

A first terminal of the transistor Tr15 is electrically connected to the wiring VDD2L, a second terminal of the transistor Tr15 is electrically connected to the gate and the back gate of the transistor Tr23, and a gate and the back gate of the transistor Tr15 are electrically connected to the terminal RT. A first terminal of the transistor Tr16 is electrically connected to the gate and the back gate of the transistor Tr23, a second terminal of the transistor Tr16 is electrically connected to the wiring GNDL, and a gate and the back gate of the transistor Tr16 are electrically connected to the terminal IT.

A first terminal of the transistor Tr17 is electrically connected to the wiring VDD2L, a second terminal of the transistor Tr17 is electrically connected to the gate and the back gate of the transistor Tr23, and a gate and the back gate of the transistor Tr17 is electrically connected to the terminal IRT.

A first terminal of the transistor Tr18 is electrically connected to the first terminal of the transistor Tr21, a second terminal of the transistor Tr18 is electrically connected to a gate and the back gate of the transistor Tr19, and a gate and the back gate of the transistor Tr18 is electrically connected to the wiring VDD2L. A first terminal of the transistor Tr19 is electrically connected to the terminal C1T, and a second terminal of the transistor Tr19 is electrically connected to the terminal ST. A first terminal of the transistor Tr20 is electrically connected to the terminal ST, a second terminal of the transistor Tr20 is electrically connected to the wiring GNDL, and a gate and the back gate of the transistor Tr20 are electrically connected to the gate and the back gate of the transistor Tr23.

A second terminal of the transistor Tr21 is electrically connected to a gate and the back gate of the transistor Tr22, and a gate and the back gate of the transistor Tr21 is electrically connected to the wiring VDD2L. A first terminal of the transistor Tr22 is electrically connected to the terminal PT, and a second terminal of the transistor Tr22 is electrically connected to the terminal OT. A first terminal of the transistor Tr23 is electrically connected to the terminal OT, and a second terminal of the transistor Tr23 is electrically connected to the terminal OT.

Figure 41:
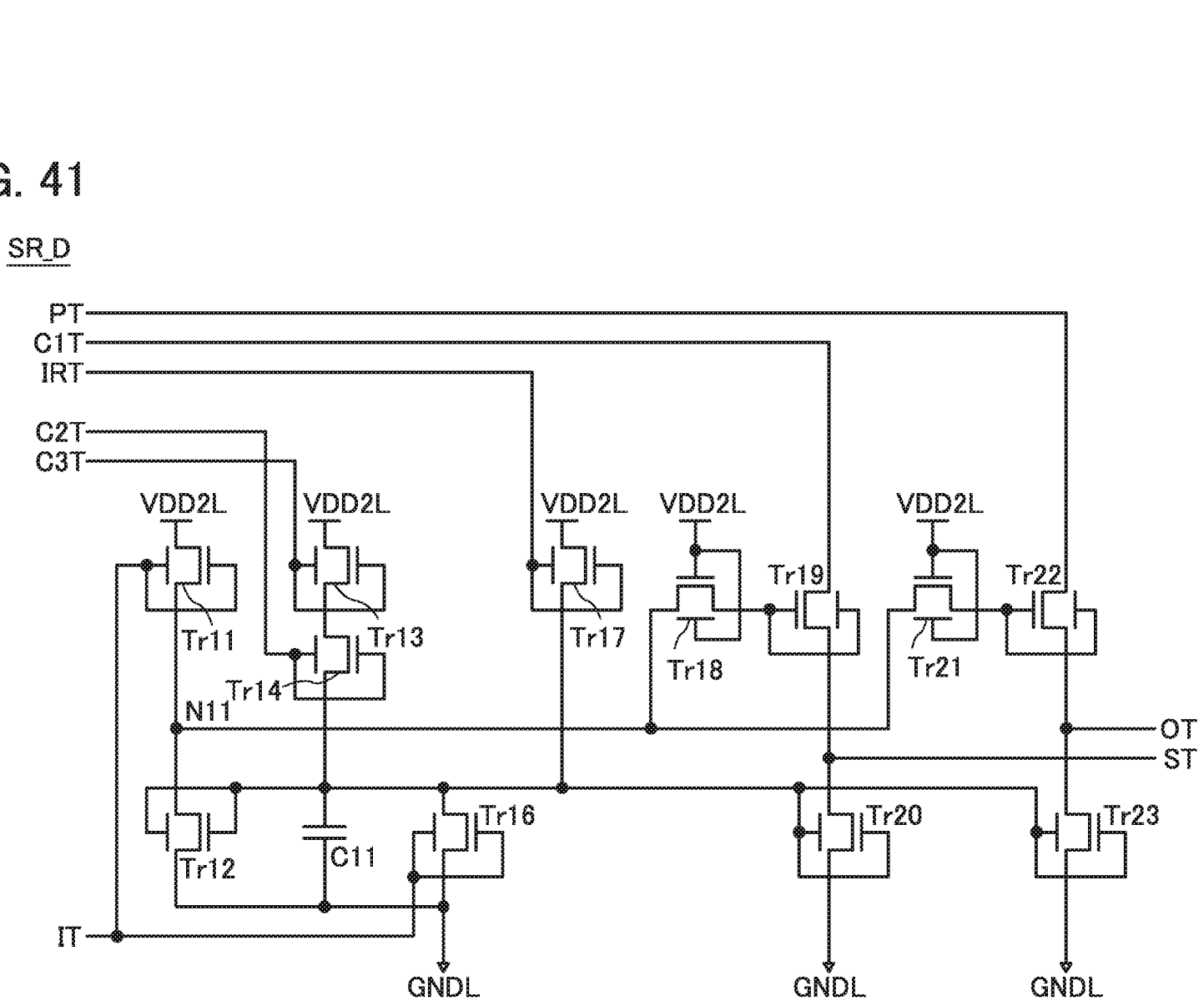
FIG. 41 is a circuit diagram illustrating a circuit included in a gate driver.

Next, circuit configurations of the circuit SR_D[1] and the circuit SR_D[2] are described. FIG. 41 illustrates a circuit configuration of the circuit SR_D in FIG. 39C.

The circuit SR_D has a configuration in which the terminal RT is removed from the circuit SR. Thus, the circuit SR_D has a configuration in which the transistor Tr15 is removed from the circuit SR.

Note that all of the transistors included in the circuit SR in FIG. 40 and the circuit SR_D in FIG. 41 is provided with a back gate, and the back gates are electrically connected to respective gates. This configuration enables an increase in the amount of on-state current flowing through the transistors.

Although all of the transistors included in the circuit SR in FIG. 40 and the circuit SR_D in FIG. 41 is provided with a back gate, the circuit SR and the circuit SR_D may include a transistor without a back gate. In this case, only the gate may be electrically connected to a predetermined element or a predetermined wiring because the gate and the back gate are electrically connected to each other in each of the transistors in the circuit SR and the circuit SR_D.

<<Operation of Gate Driver>>

Figure 42:
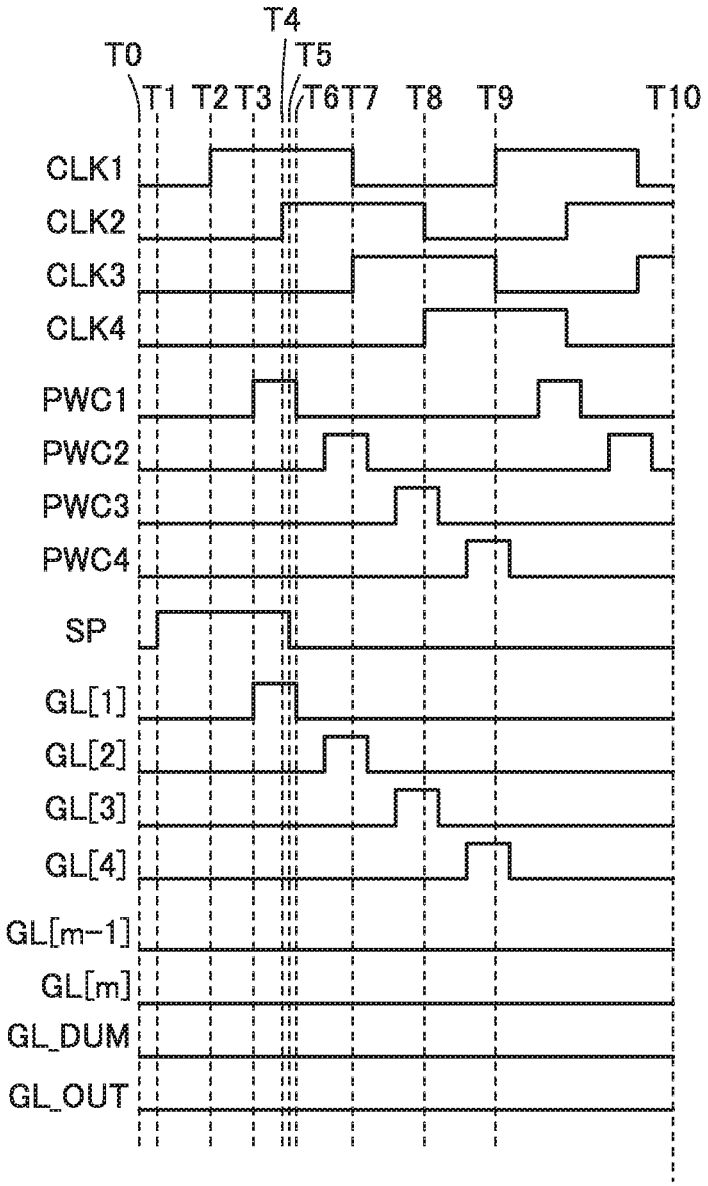
FIG. 42 is a timing chart illustrating an operation example of a gate driver.

Next, operation of the gate driver 103 is described. FIG. 42 is a timing chart showing an operation example of the gate driver 103, which shows changes in potentials of the clock signal CLK1, the clock signal CLK2, the clock signal CLK3, the clock signal CLK4, the pulse width control signal PWC1, the pulse width control signal PWC2, the pulse width control signal PWC3, and the pulse width control signal PWC4, from time T0 to time T10. In addition, the timing chart shows changes in potentials of the wiring GL[1], the wiring GL[2], the wiring GL[3], the wiring GL[4], the wiring GL[m−1], the wiring GL[m], the wiring GL_DUM, and the wiring GL_OUT each of which serves as an output wiring of the gate driver 103.

[Circuit SR[1]]

As shown in FIGS. 39A to 39C, the clock signal CLK1 is inputted to the terminal C1T of the circuit SR[1], the clock signal CLK2 is inputted to the terminal C2T of the circuit SR[1], the clock signal CLK3 is inputted to the terminal C3T of the circuit SR[1], and the pulse width control signal PWC1 is inputted to the terminal PT of the circuit SR[1].

At the time T1, a high-level potential is inputted as a start pulse signal to the terminal IT of the circuit SR[1] in the gate driver 103. Thus, the transistor Tr11 and the transistor Tr16 are turned on.

When the transistor Tr11 is turned on, the potential VDD is applied to the first terminal of the transistor Tr12, the first terminal of the transistor Tr18, and the first terminal of the transistor Tr21. Note that the transistor Tr18 and the transistor Tr21 are always in an on state for the circuit configuration. Accordingly, the potential VDD is applied to the gate and the back gate of the transistor Tr19 and the gate and the back gate of the transistor Tr22, and the transistor Tr19 and the transistor Tr22 are turned on.

Thus, the terminal PT and the terminal OT are electrically connected to each other, and the terminal C1T and the terminal ST are electrically connected to each other.

When the transistor Tr16 is turned on, the GND potential is applied to the gate and the back gate of the transistor Tr12, the gate and the back gate of the transistor Tr20, and the gate and the back gate of the transistor Tr23. Thus, the transistor Tr12, the transistor Tr20, and the transistor Tr23 are in an off state.

At the time T2, a high-level potential is inputted as the clock signal CLK1 to the gate driver 103. Thus, the high-level potential is inputted from the terminal C1T through the transistor Tr19 to the terminal ST in the circuit SR[1].

At the time T3, a high-level potential is inputted as the pulse width control signal PWC1 to the gate driver 103. Thus, the high-level potential is inputted from the terminal PT through the transistor Tr22 to the terminal OT in the circuit SR[1]. Thus, the wiring GL[1] electrically connected to the terminal OT of the circuit SR[1] has a high-level potential.

At the time T4, a high-level potential is inputted as the clock signal CLK2 to the gate driver 103. Thus, the high-level potential is inputted from the terminal C2T in the circuit SR[1], and the high-level potential is applied to the gate and the back gate of the transistor Tr14. Thus, the transistor Tr14 is turned on.

At the time TS, a low-level potential is inputted as a start pulse signal to the terminal IT of the circuit SR[1] in the gate driver 103. Thus, the transistor Tr11 and the transistor Tr16 are turned off.

When the transistor Tr11 is turned off, the node N11 becomes in a floating state. Thus, the gate and the back gate of the transistor Tr19 and the gate and the back gate of the transistor Tr22 hold potentials VDD. Thus, the transistor Tr19 and the transistor Tr22 are each kept in an on state.

At the time T6, a low-level potential is inputted as the pulse width control signal PWC1 to the gate driver 103. Thus, the low-level potential is inputted from the terminal PT through the transistor Tr22 to the terminal OT in the circuit SR[1]. Thus, the wiring GL[1] electrically connected to the terminal OT of the circuit SR[1] has the low-level potential.

At the time T7, a low-level potential is inputted as the clock signal CLK1 to the gate driver 103, and a high-level potential is inputted as the clock signal CLK3 to the gate driver 103. Thus, the low-level potential is inputted from the terminal C1T through the transistor Tr19 to the terminal ST in the circuit SR[1]. Furthermore, in the circuit SR[1], the high-level potential is applied from the terminal C3T, and accordingly, the high-level potential is applied to the gate and the back gate of the transistor Tr13. Thus, the transistor Tr13 is turned on.

At this time, the transistor Tr14 is also in an on state; thus, the potential VDD is applied to the gate and the back gate of the transistor Tr12, the gate and the back gate of the transistor Tr20, the gate and the back gate of the transistor Tr23, and the capacitor C11. Thus, the transistor Tr12, the transistor Tr20, and the transistor Tr23 are turned on.

When the transistor Tr20 is turned on, the GND potential is applied to the terminal ST. In addition, when the transistor Tr23 is turned on, the GND potential is applied to the terminal OT.

When the transistor Tr12 is turned on, the GND potential is applied to the second terminal of the transistor Tr11, the first terminal of the transistor Tr18, and the first terminal of the transistor Tr21. Note that the transistor Tr18 and the transistor Tr21 are always in an on state for the circuit configuration, and the GND potential is applied to the gate and the back gate of the transistor Tr19 and the gate and the back gate of the transistor Tr22. Thus, the transistor Tr19 and the transistor Tr22 are turned off.

The potential VDD is applied to the first terminal of the capacitor C11. Since the transistor Tr16 is in an off state, the capacitor C11 holds the potential VDD. The transistor Tr16 is not turned on unless the high-level potential is inputted from the terminal IT. In other words, the capacitor C11 holds the potential VDD until the high-level potential is inputted from the terminal IT.

[Circuit SR[2] and Thereafter]

In the case of the circuit SR[2], as shown in FIG. 39A, the clock signal CLK2 is inputted to the terminal C1T of the circuit SR[2], the clock signal CLK3 is inputted to the terminal C2T of the circuit SR[2], the clock signal CLK4 is inputted to the terminal C3T of the circuit SR[2], and the pulse width control signal PWC2 is inputted to the terminal PT of the circuit SR[2].

In the operation of the circuit SR[1], from the time T2 to the time 17, the terminal ST has a high-level potential. In other words, from the time T2 to the time T7, the high-level potential outputted from the terminal ST of the circuit SR[1] is inputted to the terminal IT of the circuit SR[2].

The circuit SR[2] has a circuit configuration similar to that of the circuit SR[1], and thus, the circuit SR[2] operates in a manner similar to that of the circuit SR[1]. From the time T2 to the time T7, the high-level potential is inputted to the terminal IT of the circuit SR[2]. When the high-level potential is inputted as the pulse width control signal PWC2 to the terminal PT of the circuit SR[2] while the terminal IT of the circuit SR[2] has the high-level potential, the high-level potential is outputted from the terminal OT of the circuit SR[2]. Furthermore, when the clock signal CLK2 has the high-level potential (from the time T4 to a time T8), the high-level potential is outputted from the terminal ST of the circuit SR[2]. From the time T8 to a time T9, the low-level potential is outputted from the terminal ST of the circuit SR[2], and the potential VDD is held at the capacitor C11 of the circuit SR[2].

Figure 43:
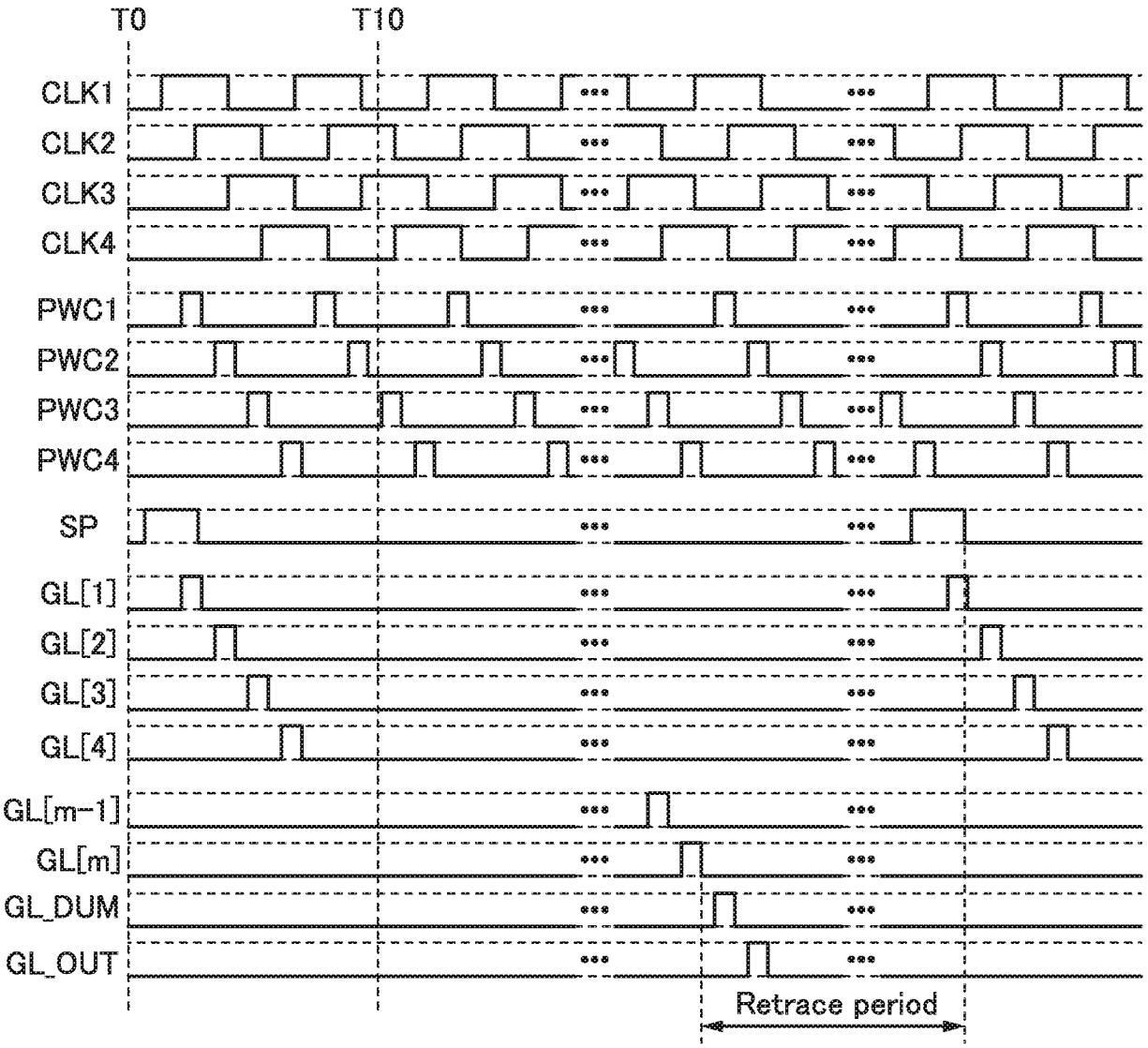
FIG. 43 is a timing chart illustrating an operation example of a gate driver.

In the circuit SR[3] and the subsequent circuits SR, the high-level potential is inputted to the terminal IT, and the high-level potential is inputted to the terminal C1T, the terminal C2T, the terminal C3T, and the terminal PT at a predetermined timing, whereby the high-level potential can be outputted from the terminal OT and the terminal ST in an operation similar to those of the circuit SR[1] and the circuit SR[2]. FIG. 43 is a timing chart showing operations following the time T10 of the gate driver 103 in addition to the operations from the time T0 to the time T10. After the high-level potential is outputted from the wiring GL[m], a high-level potential is inputted as a start pulse signal to the terminal IT of the circuit SR[1] during a retrace period. Note that the retrace period indicates a period from a time at which the potential of the wiring GL[m] decreases from the high-level potential to the low-level potential to a time at which the potential of the start pulse signal decreases from the high-level potential to the low-level potential.

[Terminal RT of Circuit SR]

The terminal RT of the circuit SR[p] is electrically connected to the terminal ST of the circuit SR[p+2]. In other words, when the high-level potential is outputted from the terminal ST of the circuit SR[p+2], a high-level potential is inputted to the terminal RT of the circuit SR[p], and accordingly, the transistor Tr15 of the circuit SR[p] is turned on. Thus, the potential VDD is applied to the gate and the back gate of the transistor Tr12, the gate and the back gate of the transistor Tr20, the gate and the back gate of the transistor Tr23, and the capacitor C11.

When the transistor Tr20 is turned on, the GND potential is applied to the terminal ST. In addition, when the transistor Tr23 is turned on, the GND potential is applied to the terminal OT. Moreover, when the transistor Tr12 is turned on, the GND potential is applied to the second terminal of the transistor Tr11, the first terminal of the transistor Tr18, and the first terminal of the transistor Tr21. Note that the transistor Tr18 and the transistor Tr21 are always in an on state for the circuit configuration, and the GND potential is applied to the gate and the back gate of the transistor Tr19 and the gate and the back gate of the transistor Tr22. Thus, the transistor Tr19 and the transistor Tr22 are turned off.

In other words, when the high-level potential is outputted from the terminal ST of the circuit SR[p+2] to the terminal RT of the circuit SR[p], the GND potential is outputted from each of the terminal OT and the terminal ST as in a manner similar to that of the circuit SR[1] from the time T7 to the time T8.

[Terminal IRT of Circuit SR]

The initialization reset signal INI_RES is inputted to each of the terminals IRT of the circuits SR[1] to SR[m], the circuit SR_D[1], and the circuit SR_D[2]. When the initialization reset signal INI_RES has a high-level potential, the high-level potential is inputted to each of the terminals IRT of the above circuits. The transistor Tr17 of each circuit is turned on.

Thus, the potential VDD is applied to the gate and the back gate of the transistor Tr12, the gate and the back gate of the transistor Tr20, the gate and the back gate of the transistor Tr23, and the capacitor C11.

When the transistor Tr20 is turned on, the GND potential is applied to the terminal ST of each circuit. In addition, when the transistor Tr23 is turned on, the GND potential is applied to the terminal OT of each circuit. Moreover, when the transistor Tr12 is turned on, the GND potential is applied to the second terminal of the transistor Tr11, the first terminal of the transistor Tr18, and the first terminal of the transistor Tr21. Note that the transistor Tr18 and the transistor Tr21 are always in an on state for the circuit configuration, and the GND potential is applied to the gate and the back gate of the transistor Tr19 and the gate and the back gate of the transistor Tr22. Thus, the transistor Tr19 and the transistor Tr22 are turned off.

In other words, a high-level potential is inputted as the initialization reset signal INI_RES, the GND potential is outputted from the terminal OT and the terminal ST of each of the circuits SR[1] to SR[m], the circuit SR_D[1], and the circuit SR_D[2].

<Level Shifter>

Figure 44:
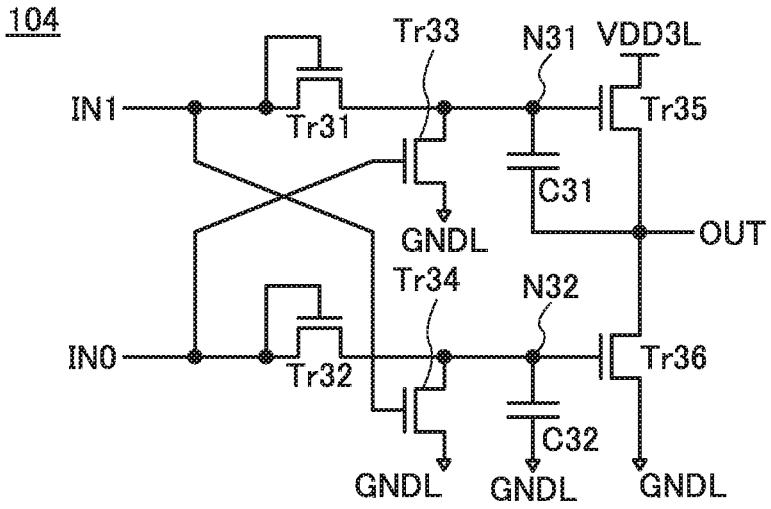
FIG. 44 is a circuit diagram showing a configuration example of a level shifter.

Next, the level shifter 104 that can be formed over the base 101 is described. FIG. 44 illustrates a configuration example of the level shifter 104.

The level shifter 104 illustrated in FIG. 44 is formed using only n-channel transistors without p-channel transistors. The level shifter 104 includes a transistor Tr31 to a transistor Tr36, a capacitor C31, and a capacitor C32.

A first terminal of the transistor Tr31 is electrically connected to an input terminal IN1, a second terminal of the transistor Tr31 is electrically connected to a gate of the transistor Tr35, and a gate of the transistor Tr31 is electrically connected to the first terminal of the transistor Tr31. That is, the transistor Tr31 has a diode-connected structure. A first terminal of the transistor Tr32 is electrically connected to an input terminal IN0, a second terminal of the transistor Tr32 is electrically connected to a gate of the transistor Tr36, and a gate of the transistor Tr32 is electrically connected to the first terminal of the transistor Tr32. The transistor Tr32 has a diode-connected structure. A first terminal of the transistor Tr33 is electrically connected to the gate of the transistor Tr35, a second terminal of the transistor Tr33 is electrically connected to the wiring GNDL, and a gate of the transistor Tr33 is electrically connected to the input terminal IN0. A first terminal of the transistor Tr34 is electrically connected to a gate of the transistor Tr36, a second terminal of the transistor Tr34 is electrically connected to the wiring GNDL, and a gate of the transistor Tr34 is electrically connected to the input terminal IN1. A first terminal of the transistor Tr35 is electrically connected to a wiring VDD3L, and a second terminal of the transistor Tr35 is electrically connected to an output terminal OUT. A first terminal of the transistor Tr36 is electrically connected to the wiring GNDL, and a second terminal of the transistor Tr36 is electrically connected to the output terminal OUT.

A first terminal of the capacitor C31 is electrically connected to the gate of the transistor Tr35, and a second terminal of the capacitor C31 is electrically connected to the output terminal OUT. A first terminal of the capacitor C32 is electrically connected to the gate of the transistor Tr36, and a second terminal of the capacitor C32 is electrically connected to the wiring GNDL.

Note that a connection portion between the first terminal of the capacitor C31 and the gate of the transistor Tr35 is referred to as a node N31. In addition, a connection portion between the first terminal of the capacitor C32 and the gate of the transistor Tr36 is referred to as a node N32.

The wiring VDD3L is a wiring that supplies a potential higher than a high-level potential described later. The wiring GNDL is a wiring that supplies the GND potential.

Figure 45:
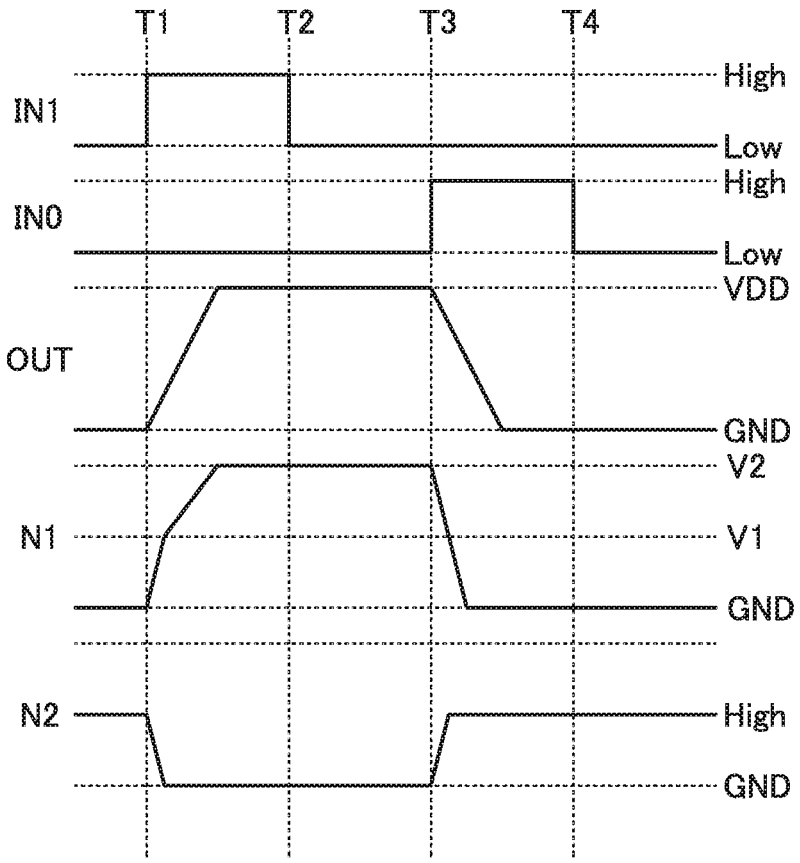
FIG. 45 is a timing chart illustrating an operation example of a level shifter.

FIG. 45 is a timing chart showing an operation example of the level shifter 104. The timing chart shows changes in potentials of the input terminal IN1, the input terminal IN0, the output terminal OUT, the node N31, and the node N32 from the time T1 to the time T4.

To the input terminal IN1, either a low-level potential (denoted by Low in FIG. 45) or a high-level potential (denoted by High in FIG. 45) is applied, and to the input terminal IN0, either a low-level potential or a high-level potential is applied.

From the output terminal OUT, the potential VDD higher than the high-level potential or the GND potential is outputted.

At the time T1, the high-level potential is inputted to the input terminal IN1, and the low-level potential is inputted to the input terminal IN0. The transistor Tr31 has a diode-connected structure; thus, the potential of the node N31 electrically connected to the second terminal of the transistor Tr31 increases up to the high-level potential (up to V1 in FIG. 45). Since the high-level potential is applied to the gate of the transistor Tr34, the transistor Tr34 is turned on, and the potential of the node N32 electrically connected to the first terminal of the transistor Tr34 decreases to the GND potential. Since the low-level potential is applied to the gate of the transistor Tr33, the transistor Tr33 is turned off.

Here, the node N31 and the transistor Tr35 are focused on. Since the transistor Tr35 is in an on state, a potential outputted from the output terminal OUT gradually increases. Since the transistor Tr36 is in an off state, a potential of the second terminal of the capacitor C31 increases with an increase of the potential outputted from the output terminal OUT. Thus, by the boosting effect of the capacitor C31, the potential of the node N31 also increases (up to V2 in FIG. 45). That is, the potential of the gate of the transistor Tr35 increases, and accordingly, the amount of on-state current flowing through the transistor Tr35 increases. Thus, the potential outputted from the output terminal OUT increases to VDD.

At the time T2, the low-level potential is inputted to the input terminal IN1. The low-level potential is inputted to the input terminal IN0 continuously since before the time T2. The transistor Tr31 becomes in an off state due to the low-level potential inputted from the input terminal IN1, and the transistor Tr32 is continuously in an off state due to the low-level potential inputted from the input terminal IN0. In addition, the low-level potential is inputted to the gate of the transistor Tr34, and accordingly, the transistor Tr34 is in an off state. By the above operation, the node N31 and the node N32 are in a floating state, and the potentials of the node N31 and the node N32 are held. Thus, the potential outputted from the output terminal OUT is not changed.

At the time T3, the low-level potential is inputted to the input terminal IN1 continuously since before the time T3. The high-level potential is inputted to the input terminal IN0. The transistor Tr32 has a diode-connected structure, and thus the potential of the node N32 electrically connected to the second terminal of the transistor Tr32 increases. The high-level potential is inputted from the input terminal IN0 to the gate of the transistor Tr33, and thus, the potential of the node N31 electrically connected to the first terminal of the transistor Tr33 increases.

Here, the transistor Tr36 is focused on. Since the transistor Tr36 is in an on state, the potential outputted from the output terminal OUT gradually decreases and comes to be the GND potential.

At the time T4, the low-level potential is inputted to the input terminal IN1 continuously since before the time T4. The low-level potential is inputted to the input terminal IN0. The transistor Tr31 is continuously in an off state due to the low-level potential inputted from the input terminal IN1, and the transistor Tr32 is in an off state due to the low-level potential inputted from the input terminal IN0. In addition, the low-level potential is inputted to the gate of the transistor Tr33, and accordingly, the transistor Tr33 becomes in an off state. By the above operation, the node N31 and the node N32 are in a floating state, and the potentials of the node N31 and the node N32 are held. Thus, the potential outputted from the output terminal OUT is not changed.

When the level shifter 104 has the configuration illustrated in FIG. 44, the level of the potential of the input voltage can be shifted higher.

OS transistors can be used for the transistors Tr1 to Tr4, the transistors Tr11 to Tr23, and the transistors Tr31 to Tr36 included in the pixel circuits 21 to 25, and the pixel circuits 31 to 36.

In particular, in the case where the gate driver 103 is formed using only OS transistors, a timing signal inputted to the gate driver 103 is preferably set to a high voltage because the field-effect mobility of the OS transistor is lower than that of a Si transistor in some cases. In such a case, it is necessary that the timing signal inputted to the gate driver 103 be raised by the level shifter 104. Thus, as illustrated in FIGS. 28A and 28B, the display unit 100 preferably has such a configuration that the timing signal is transmitted from the controller IC 112 to the level shifter 104 and the potential of the timing signal is shifted by the level shifter 104 to be inputted to the gate driver 103.

In such a configuration, the level shifter 104 is preferably formed using only OS transistors. With such a configuration, a reduction in power consumption, a reduction in signal delay, and an improvement in operation characteristics can be achieved. Furthermore, the level shifter 104 can be formed concurrently with the gate driver 103 over the base 101, and thus, a fabrication process of the display unit 100 can be shortened.

Note that this embodiment is effective not only in the display unit 100 but also in the display unit 100A and the display unit 100B.

This embodiment can be combined with any of the other embodiments in this specification as appropriate.

Embodiment 6

In this embodiment, a source driver IC that can be mounted over the display unit 100 or the display unit 100A described in the above embodiment.

<Source Driver IC>

Figure 46:
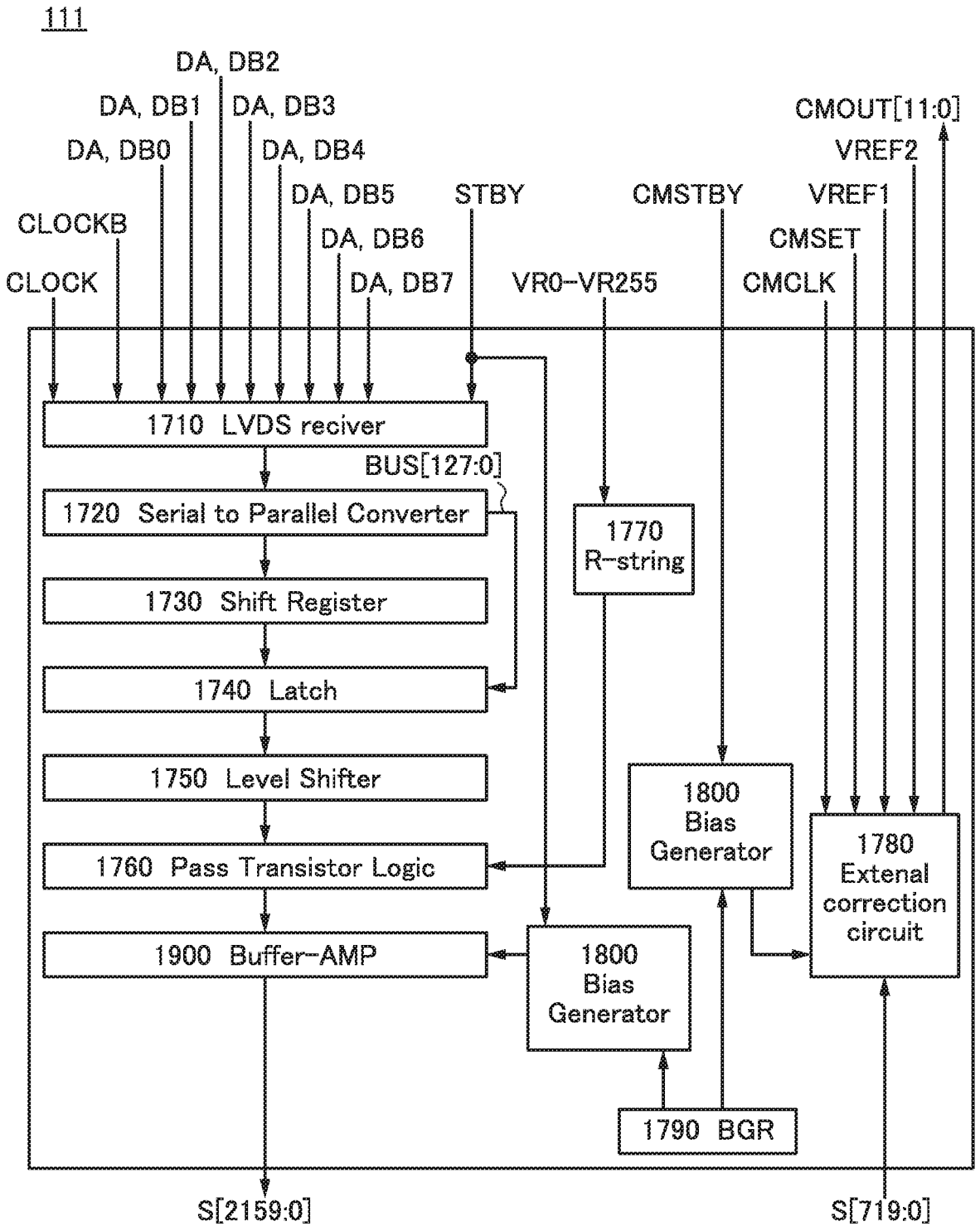
FIG. 46 is a block diagram illustrating a structure example of a source driver IC.

FIG. 46 is a block diagram illustrating an example of a source driver IC. The source driver IC 111 includes a low voltage differential signaling (LVDS) receiver 1710, a serial-parallel converter circuit 1720, a shift register circuit 1730, a latch circuit 1740, a level shifter 1750, a pass transistor logic circuit 1760, a resistor string circuit 1770, an external correction circuit 1780, a band gap reference (BGR) circuit 1790, bias generators 1800, and a buffer amplifier 1900. Note that the number of the bias generators 1800 included in the source driver IC 111 in FIG. 46 is two.

The LVDS receiver 1710 is electrically connected to an external host processor. The LVDS receiver 1710 has a function of receiving video signals from the host processor. Moreover, the LVDS receiver 1710 converts a differential signal into a single-ended signal and sends the signal to the serial-parallel converter circuit 1720. In FIG. 46, an analog voltage signal DA,DB0, an analog voltage signal DA,DB1, an analog voltage signal DA,DB2, an analog voltage signal DA,DB3, an analog voltage signal DA,DB4, an analog voltage signal DA,DB5, an analog voltage signal DA,DB6, and an analog voltage signal DA,DB7 are inputted as video signals to the LVDS receiver. Note that the LVDS receiver 1710 sequentially operates in response to inputs of a clock signal CLOCK and a clock signal CLOCKB and can change from a driving state to a standby state (can be temporarily stopped) in response to a standby signal STBY. Note that the clock signal CLOCKB is an inverted signal of the clock signal CLOCK.

The serial-parallel converter circuit 1720 is electrically connected to the LVDS receiver 1710. The serial-parallel converter circuit 1720 has a function of receiving a single-ended signal from the LVDS receiver 1710. Moreover, the serial-parallel converter circuit 1720 converts the single-ended signal into parallel signals and transmits the signals as signals BUS[127:0] to internal buses.

The shift register circuit 1730 is electrically connected to the serial-parallel converter circuit 1720, and the latch circuit 1740 is electrically connected to the shift register circuit 1730. The shift register circuit 1730 has a function of designating the timing at which data in the internal bus is stored in the latch circuit 1740 in each line, in synchronization with the serial-parallel converter circuit 1720.

The level shifter 1750 is electrically connected to the latch circuit 1740. The level shifter 1750 has a function of shifting the level of data in all the lines when the data in all the lines is stored in the latch circuit 1740.

The pass transistor logic circuit 1760 is electrically connected to the level shifter 1750 and the resistor string circuit 1770. Note that the pass transistor logic circuit 1760 and the resistor string circuit 1770 form a digital to analog converter (DAC). An 8-bit signal (denoted by VR0-VR255 in FIG. 46) is inputted to the resistor string circuit 1770, and the resistor string circuit 1770 outputs a potential corresponding to the signal to the pass transistor logic circuit 1760. The pass transistor logic circuit 1760 has a function of digital-analog conversion of the data with the shifted levels when the potential is supplied.

The buffer amplifier 1900 is electrically connected to the pass transistor logic circuit 1760. The buffer amplifier 1900 has a function of amplifying the data subjected to digital-analog conversion and sending the amplified data as a data signal (denoted by S[2159:0] in FIG. 46) to a pixel array.

The BGR circuit 1790 has a function of generating a voltage serving as a reference for driving the source driver IC 111. The BGR circuit 1790 is electrically connected to each of the bias generators.

One of the bias generators 1800 is electrically connected to the BGR circuit 1790 and the buffer amplifier 1900. The one bias generator 1800 has a function of generating a bias voltage for driving the buffer amplifier 1900 on the basis of the voltage serving as a reference that is generated in the BGR circuit 1790. Note that the standby signal STBY is inputted to the one bias generator 1800 at the same timing as the input of the standby signal STBY to the LVDS receiver 1710 to cause the one bias generator 1800 to enter a standby state (to stop temporarily or to enter an idling stop state).

The other of the bias generators 1800 is electrically connected to the external correction circuit 1780. The other bias generator 1800 has a function of generating a bias voltage for driving the external correction circuit 1780 on the basis of the voltage serving as a reference that is generated in the BGR circuit 1790. Note that when the external correction circuit 1780 does not need to operate, a standby signal CMSTBY is transmitted to the other bias generator 1800 to cause the other bias generator 1800 to enter a standby state (to stop temporarily or to enter an idling stop state).

The external correction circuit 1780 is electrically connected to transistors included in pixels. When pixel transistors in the pixel array have variations in voltage-current characteristics, the variations influence an image displayed on the display device, causing reduction in the display quality of the display device. The external correction circuit 1780 has a function of measuring the amount of a current flowing in the pixel transistors and appropriately adjust the amount of the current flowing in the pixel transistors depending on the amount of the current. The external correction circuit 1780 is initialized with input of a set signal CMSET. A clock signal CMCLK is inputted to the external correction circuit 1780 to operate the external correction circuit 1780. The external correction circuit 1780 is supplied with signals (denoted by S[719:0] in FIG. 46) from the transistors included in the pixel circuits, and makes determination related to image correction with a reference potential VREF1 and a reference potential VREF2 that are supplied to the external correction circuit 1780, used as references. A result of the determination relating to correction is transmitted as an output signal CMOUT[11:0] to an image processor provided in the outside of the source driver IC 111. The image processor corrects image data on the basis of the contents of CMOUT[11:0].

Note that the source driver IC 111 is not necessarily provided with the external correction circuit 1780. For example, instead of the external correction circuit 1780 provided in the source driver IC 111, a correction circuit may be provided in each pixel included in the pixel array. Alternatively, for example, the external correction circuit 1780 may be provided in a controller IC described later, instead of being provided in the source driver IC 111.

To form circuits in the source driver IC 111, high withstand-voltage Si transistors are preferably used. With the high withstand-voltage Si transistors, miniaturization of the circuits in the source driver IC 111 becomes possible in some cases, and thus, a high-resolution display device can be achieved.

This embodiment can be combined with any of the other embodiments in this specification as appropriate.

Embodiment 7

In this embodiment, a specific structure example of the display unit 100A included in a hybrid display device will be described.

<Cross-Sectional View>

Figure 47:
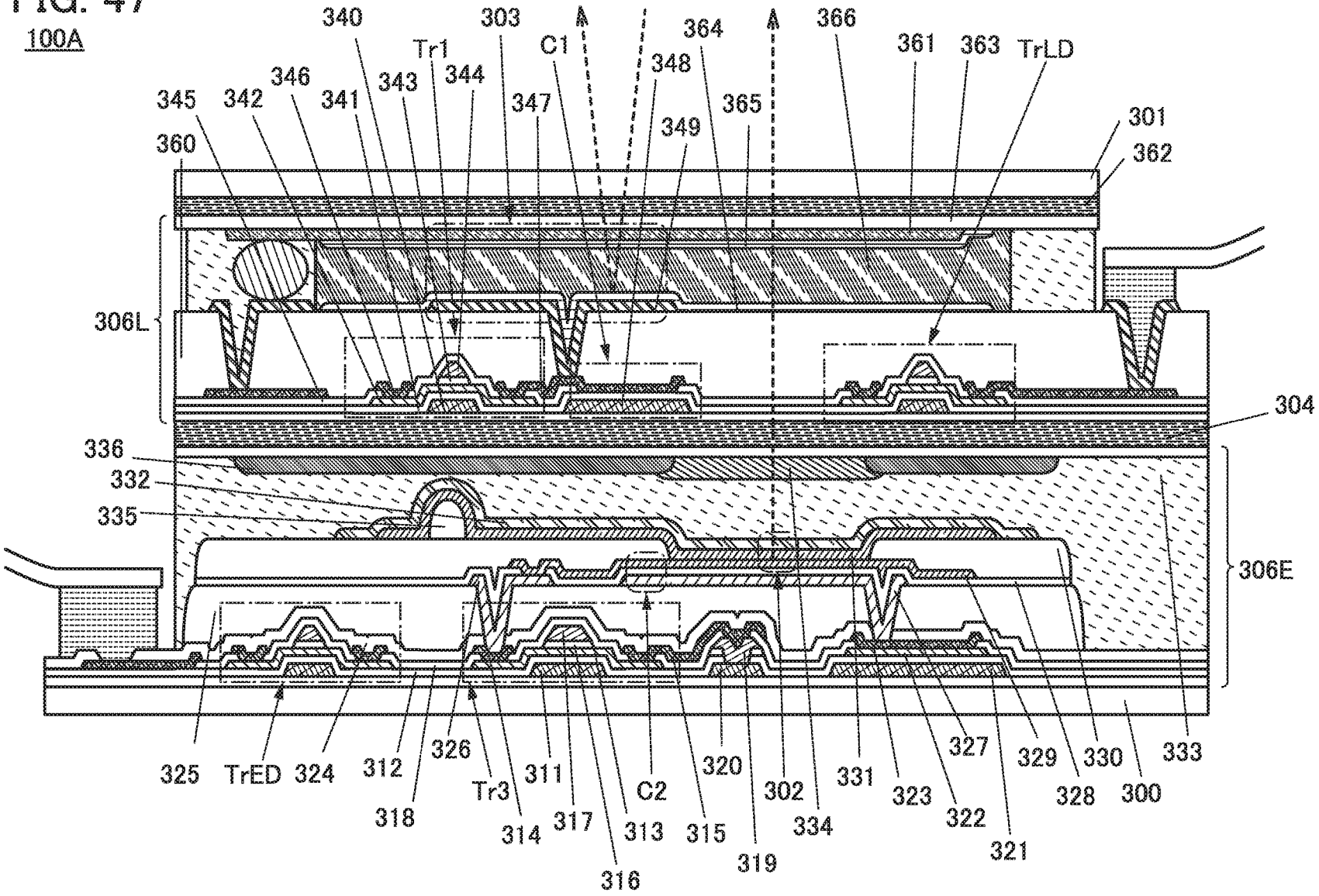
FIG. 47 is a cross-sectional view illustrating an example of a display unit.

FIG. 47 is a cross-sectional view illustrating the display unit 100A. The display unit 100A in FIG. 47 includes the pixel circuit 35 or the pixel circuit 36 described in Embodiment 5.

The display unit 100A in FIG. 47 has such a structure that a display portion 306E and a display portion 306L are stacked between a substrate 300 and a substrate 301. Specifically, the display portion 306E and the display portion 306L are bonded to each other with a bonding layer 304 in FIG. 47.

In addition, a light-emitting element 302, the transistor Tr3, and the capacitor C2 included in a pixel of the display portion 306E, and a transistor TrED included in a driver circuit of the display portion 306E are illustrated in FIG. 47. The light-emitting element 302 corresponds to the light-emitting element 10*b* in the other embodiment. The transistor Tr3 and the capacitor C2 are each described in Embodiment 5.

FIG. 47 also illustrates a liquid crystal element 303, the transistor Tr1, and the capacitor C1, which are included in a pixel of the display portion 306L, and a transistor TrLD included in a driver circuit of the display portion 306L. The liquid crystal element 303 corresponds to the reflective element 10*a* described in the other embodiment. The transistor Tr1 and the capacitor C1 are described in Embodiment 5.

The transistor Tr3 includes a conductive layer 311 functioning as a back gate, an insulating layer 312 over the conductive layer 311, a semiconductor layer 313 which is provided over the insulating layer 312 to overlap with the conductive layer 311, an insulating layer 316 over the semiconductor layer 313, a conductive layer 317 which functions as a gate and is positioned over the insulating layer 316, and conductive layers 314 and 315 which are positioned over an insulating layer 318 over the conductive layer 317 and electrically connected to the semiconductor layer 313.

The conductive layer 315 is electrically connected to a conductive layer 319, and the conductive layer 319 is electrically connected to a conductive layer 320. The conductive layer 319 is formed in the same layer as the conductive layer 317. The conductive layer 320 is formed in the same layer as the conductive layer 311.

A conductive layer 321 which functions as a back gate of the transistor Tr2 (not illustrated) is positioned in the same layer as the conductive layers 311 and 320. The insulating layer 312 is positioned over the conductive layer 321, and a semiconductor layer 322 having a region overlapping with the conductive layer 321 is positioned over the insulating layer 312. The semiconductor layer 322 includes a channel formation region of the transistor Tr2 (not illustrated). The insulating layer 318 is positioned over the semiconductor layer 322, and a conductive layer 323 is positioned over the insulating layer 318. The conductive layer 323 is electrically connected to the semiconductor layer 322 and serves as a source electrode or a drain electrode of the transistor Tr2 (not illustrated).

The transistor TrED has the same structure as the transistor Tr3, and therefore, detailed description thereof is omitted.

An insulating layer 324 is positioned over the transistor Tr3, the conductive layer 323, and the transistor TrED, and an insulating layer 325 is positioned over the insulating layer 324. A conductive layer 326 and a conductive layer 327 are positioned over the insulating layer 325. The conductive layer 326 is electrically connected to the conductive layer 314. The conductive layer 327 is electrically connected to the conductive layer 323. An insulating layer 328 is positioned over the conductive layers 326 and 327, and a conductive layer 329 is positioned over the insulating layer 328. The conductive layer 329 is electrically connected to the conductive layer 326 and serves as a pixel electrode of the light-emitting element 302.

A region where the conductive layer 327, the insulating layer 328, and the conductive layer 329 overlap with one another functions as the capacitor C2.

An insulating layer 330 is positioned over the conductive layer 329, an EL layer 331 is positioned over the insulating layer 330, and a conductive layer 332 serving as a counter electrode is positioned over the EL layer 331. The conductive layer 329, the EL layer 331, and the conductive layer 332 are electrically connected to each other in an opening of the insulating layer 330. A region where the conductive layer 329, the EL layer 331, and the conductive layer 332 are electrically connected to each other serves as the light-emitting element 302. The light-emitting element 302 has a top emission structure in which light is emitted in a direction indicated by a dotted arrow from the conductive layer 332 side.

One of the conductive layers 329 and 332 serves as an anode, and the other serves as a cathode. When a voltage higher than the threshold voltage of the light-emitting element 302 is applied between the conductive layer 329 and the conductive layer 332, holes are injected to the EL layer 331 from the anode side and electrons are injected to the EL layer 331 from the cathode side. The injected electrons and holes are recombined in the EL layer 331 and a light-emitting substance contained in the EL layer 331 emits light.

Note that in the case where a metal oxide (oxide semiconductor) is used for the semiconductor layers 313 and 322, in order to improve the reliability of the display unit 100A, it is preferable to use an insulating material containing oxygen for the insulating layer 318 and it is preferable to use a material through which impurities such as water and hydrogen do not easily diffuse for the insulating layer 324.

In the case where an organic material is used for the insulating layer 325 or 330, when the insulating layer 325 or 330 is exposed at an end portion of the display unit 100A, impurities such as water may enter the light-emitting element 302 and the like from the outside of the display unit 100A through the insulating layer 325 or 330. Deterioration of the light-emitting element 302 due to the entry of impurities can lead to deterioration of the display device. For this reason, the insulating layers 325 and 330 are preferably not positioned at the end portion of the display unit 100A, as illustrated in FIG. 47.

The light-emitting element 302 overlaps with a coloring layer 334 with an adhesive layer 333 provided therebetween. A spacer 335 overlaps with a light-blocking layer 336 with the adhesive layer 333 provided therebetween. Although FIG. 47 illustrates the case where a space is provided between the conductive layer 332 and the light-blocking layer 336, the conductive layer 332 and the light-blocking layer 336 may be in contact with each other.

The coloring layer 334 is a colored layer that transmits light in a specific wavelength range. For example, a color filter that transmits light in a specific wavelength range, such as red, green, blue, or yellow light, can be used.

Note that one embodiment of the present invention is not limited to a color filter method, and a separate coloring method, a color conversion method, a quantum dot method, and the like may be employed.

The transistor Tr1 in the display portion 306L includes a conductive layer 340 functioning as a back gate, an insulating layer 341 over the conductive layer 340, a semiconductor layer 342 which is provided over the insulating layer 341 to overlap with the conductive layer 340, an insulating layer 343 over the semiconductor layer 342, a conductive layer 344 which functions as a gate and is positioned over the insulating layer 343, and conductive layers 346 and 347 which are positioned over an insulating layer 345 over the conductive layer 344 and electrically connected to the semiconductor layer 342.

A conductive layer 348 is positioned in the same layer as the conductive layer 340. The insulating layer 341 is positioned over the conductive layer 348, and the conductive layer 347 is positioned over the insulating layer 341 and in a region overlapping with the conductive layer 348. A region where the conductive layer 347, the insulating layer 341, and the conductive layer 348 overlap with one another functions as the capacitor C1.

The transistor TrLD has the same structure as the transistor Tr1, and therefore, detailed description thereof is omitted.

An insulating layer 360 is positioned over the transistor Tr1, the capacitor C1, and the transistor TrLD. A conductive layer 349 is positioned over the insulating layer 360. The conductive layer 349 is electrically connected to the conductive layer 347 and serves as a pixel electrode of the liquid crystal element 303. An alignment film 364 is positioned over the conductive layer 349.

A conductive layer 361 serving as a common electrode is positioned over the substrate 301. Specifically, in FIG. 47, an insulating layer 363 is bonded to the substrate 301 with an adhesive layer 362 interposed therebetween, and the conductive layer 361 is positioned over the insulating layer 363. An alignment film 365 is positioned over the conductive layer 361, and a liquid crystal layer 366 is positioned between the alignment film 364 and the alignment film 365.

In FIG. 47, the conductive layer 349 has a function of reflecting visible light, and the conductive layer 361 has a function of transmitting visible light; accordingly, light entering through the substrate 301 can be reflected by the conductive layer 349 and then exits through the substrate 301, as shown by an arrow of a broken line.

For example, a material containing one of indium (In), zinc (Zn), and tin (Sn) is preferably used for the conductive material that transmits visible light. Specifically, indium oxide, indium tin oxide (ITO), indium zinc oxide, indium oxide containing tungsten oxide, indium zinc oxide containing tungsten oxide, indium oxide containing titanium oxide, indium tin oxide containing titanium oxide, indium tin oxide containing silicon oxide (ITSO), zinc oxide, and zinc oxide containing gallium are given, for example. Note that a film including graphene can be used as well. The film including graphene can be formed, for example, by reducing a film containing graphene oxide.

Examples of a conductive material that reflects visible light include aluminum, silver, and an alloy including any of these metal elements. Furthermore, a metal material such as gold, platinum, nickel, tungsten, chromium, molybdenum, iron, cobalt, copper, or palladium or an alloy containing any of these metal materials can be used. Furthermore, lanthanum, neodymium, germanium, or the like may be added to the metal material or the alloy. Furthermore, an alloy containing aluminum (an aluminum alloy) such as an alloy of aluminum and titanium, an alloy of aluminum and nickel, an alloy of aluminum and neodymium, or an alloy of aluminum, nickel, and lanthanum (Al—Ni—La), or an alloy containing silver such as an alloy of silver and copper, an alloy of silver, palladium, and copper (also referred to as Ag—Pd—Cu or APC), or an alloy of silver and magnesium may be used.

Although the structure of the display unit including a top-gate transistor with a back gate is illustrated in FIG. 47, the display unit described in this embodiment may include a transistor without a back gate or a transistor including a back gate.

There is no particular limitation on the crystallinity of a semiconductor material used for the transistor, and an amorphous semiconductor or a semiconductor having crystallinity (a microcrystalline semiconductor, a polycrystalline semiconductor, a single crystal semiconductor, or a semiconductor partly including crystal regions) may be used. A semiconductor having crystallinity is preferably used, in which case deterioration of the transistor characteristics can be suppressed.

As a semiconductor material used for the transistor, a metal oxide (oxide semiconductor) can be used. Typically, a metal oxide containing indium or the like can be used. In particular, a CAC-OS to be described in Embodiment 9 is preferably used as a metal oxide in the transistor.

In particular, a semiconductor material having a wider band gap and a lower carrier density than silicon is preferably used because off-state current of the transistor can be reduced.

The semiconductor layer preferably includes, for example, a film represented by an In-M-Zn-based oxide that contains at least indium, zinc, and M (a metal such as aluminum, titanium, gallium, germanium, yttrium, zirconium, lanthanum, cerium, tin, neodymium, or hafnium). In order to reduce variations in electrical characteristics of the transistors including the metal oxide, the oxide preferably contains a stabilizer in addition to In and Zn.

Examples of the stabilizer, including metals that can be used as M, are gallium, tin, hafnium, aluminum, and zirconium. As another stabilizer, lanthanoid such as lanthanum, cerium, praseodymium, neodymium, samarium, europium, gadolinium, terbium, dysprosium, holmium, erbium, thulium, ytterbium, or lutetium can be given.

As a metal oxide included in the semiconductor layer, any of the following can be used, for example: an In—Ga—Zn-based oxide, an In—Al—Zn-based oxide, an In—Sn—Zn-based oxide, an In—Hf—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, an In—Lu—Zn-based oxide, an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, and an In—Hf—Al—Zn-based oxide.

Note that here, for example, an "In—Ga—Zn-based oxide" means an oxide containing In, Ga, and Zn as its main components and there is no limitation on the ratio of In:Ga:Zn. Further, a metal element in addition to In, Ga, and Zn may be contained.

Note that although the structure of the display unit in which a liquid crystal element is used as a reflective display element is exemplified in this embodiment, a display element using a microcapsule method, an electrophoretic method, an electrowetting method, an Electronic Liquid Powder (registered trademark) method, or the like can also be used, other than micro electro mechanical systems (MEMS) shutter element or an optical interference type MEMS element.

As a light-emitting display element, a self-luminous light-emitting element such as an organic light-emitting diode (OLED), a light-emitting diode (LED), and a quantum-dot light-emitting diode (QLED) can be used.

The liquid crystal element can employ, for example, a vertical alignment (VA) mode. Examples of the vertical alignment mode include a multi-domain vertical alignment (MVA) mode, a patterned vertical alignment (PVA) mode, and an advanced super view (ASV) mode.

The liquid crystal element can employ a variety of modes. For example, a liquid crystal element using, instead of a vertical alignment (VA) mode, a twisted nematic (TN) mode, an in-plane switching (IPS) mode, a fringe field switching (FFS) mode, an axially symmetric aligned micro-cell (ASM) mode, an optically compensated birefringence (OCB) mode, a ferroelectric liquid crystal (FLC) mode, an antiferroelectric liquid crystal (AFLC) mode, or the like can be used.

As the liquid crystal used for the liquid crystal element, thermotropic liquid crystal, low-molecular liquid crystal, high-molecular liquid crystal, polymer dispersed liquid crystal (PDLC), ferroelectric liquid crystal, anti-ferroelectric liquid crystal, or the like can be used. Such a liquid crystal material exhibits a cholesteric phase, a smectic phase, a cubic phase, a chiral nematic phase, an isotropic phase, or the like depending on conditions.

As the liquid crystal material, either of a positive liquid crystal and a negative liquid crystal may be used, and an appropriate liquid crystal material can be used depending on the mode or design to be used.

An alignment film can be provided to adjust the alignment of a liquid crystal. In the case where a horizontal electric field mode is employed, a liquid crystal exhibiting a blue phase for which an alignment film is unnecessary may be used. A blue phase is one of liquid crystal phases, which is generated just before a cholesteric phase changes into an isotropic phase while temperature of cholesteric liquid crystal is increased. Since the blue phase appears only in a narrow temperature range, a liquid crystal composition in which a chiral material is mixed to account for several weight percent or more is used for the liquid crystal layer in order to improve the temperature range. The liquid crystal composition which includes liquid crystal exhibiting a blue phase and a chiral material has a short response time and optical isotropy, which makes the alignment process unneeded. In addition, the liquid crystal composition which includes liquid crystal exhibiting a blue phase and a chiral material has a small viewing angle dependence. In addition, since an alignment film does not need to be provided and rubbing treatment is unnecessary, electrostatic discharge damage caused by the rubbing treatment can be prevented and defects and damage of the liquid crystal display unit can be reduced in the manufacturing process.

<Pixel Portion>

Figure 48:
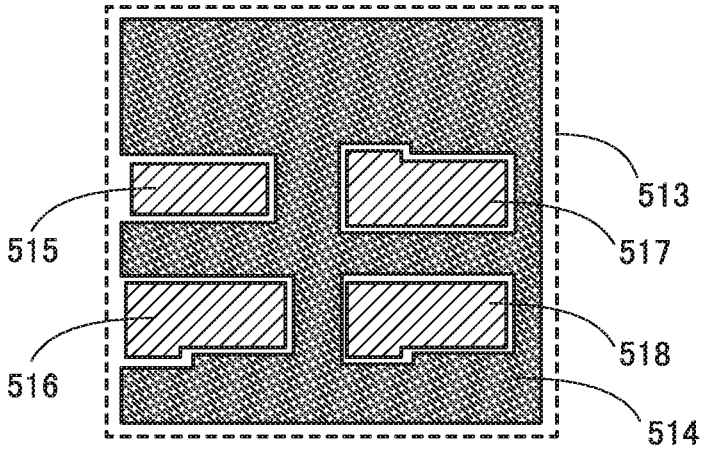
FIG. 48 is a top view illustrating an example of a pixel.

FIG. 48 is an example of a top view illustrating one pixel included in the display portion 106 of the display unit 100A. Specifically, FIG. 48 illustrates an example of a layout of a display region by a liquid crystal element and a layout of a display region of a light-emitting element in a pixel 513 in the display portion 106.

The pixel 513 in FIG. 48 includes a display region 514 of the liquid crystal element, a display region 515 of a light-emitting element corresponding to yellow, a display region 516 of a light-emitting element corresponding to green, a display region 517 of a light-emitting element corresponding to red, and a display region 518 of a light-emitting element corresponding to blue.

Note that in order to display black with high color reproducibility by using the light-emitting elements corresponding to green, blue, red, and yellow, the amount of current flowing to the light-emitting element corresponding to yellow per unit area needs to be the smallest among those flowing to the light-emitting elements. In FIG. 48, the display region 516 of the light-emitting element corresponding to green, the display region 517 of the light-emitting element corresponding to red, and the display region 518 of the light-emitting element corresponding to blue have substantially the same area, and the display region 515 of the light-emitting element corresponding to yellow has a slightly smaller area than the other display regions. Therefore, black can be displayed with high color reproducibility.

This embodiment can be combined with any of the other embodiments as appropriate.

Embodiment 8

In this embodiment, the touch sensor unit 200 will be described.

Figure 49:
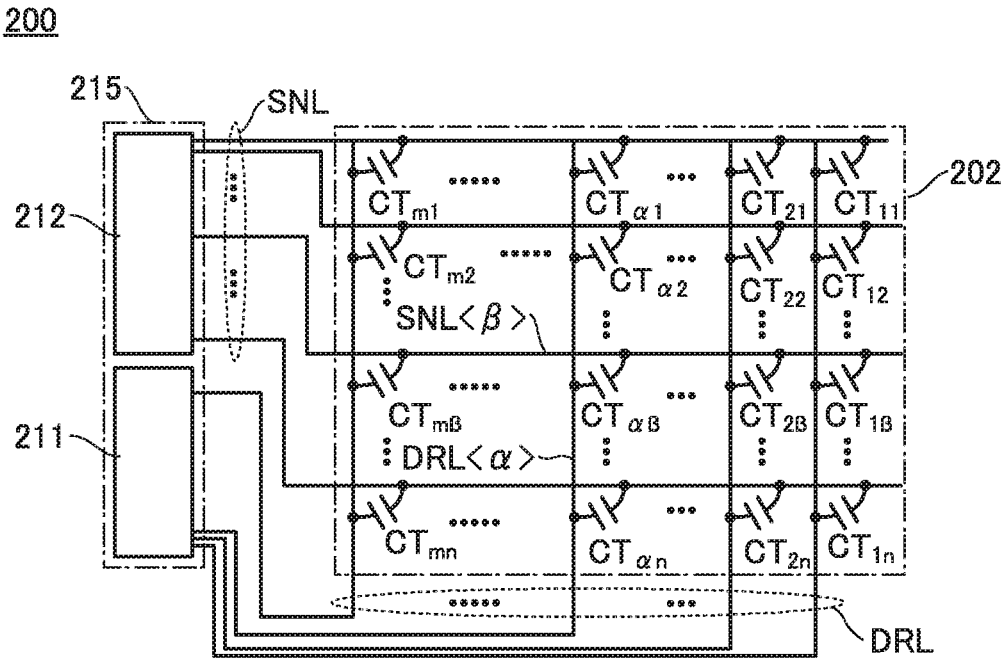
FIG. 49 is a circuit diagram illustrating an example of a touch sensor unit.

FIG. 49 illustrates a configuration example of the touch sensor unit 200. The touch sensor unit 200 includes the sensor array 202, the TS driver IC 211, and the sensing circuit 212. In FIG. 49, the TS driver IC 211 and the sensing circuit 212 are collectively referred to as the peripheral circuit 215.

Here, the touch sensor unit 200 is a mutual capacitive touch sensor unit as an example. The sensor array 202 includes m wirings DRL and n wirings SNL, where m is an integer greater than or equal to 1 and n is an integer greater than or equal to 1. The wiring DRL is a driving line, and the wiring SNL is a sensing line. Here, the α-th wiring DRL is referred to as a wiring DRL<α>, and the β-th wiring SNL is referred to as a wiring SNL<β>. A capacitor $CT_{\alpha\beta}$ refers to a capacitor formed between the wiring DRL<α> and the wiring SNL<β>.

The m wirings DRL are electrically connected to the TS driver IC 211. The TS driver IC 211 has a function of driving the wirings DRL. The n wirings SNL are electrically connected to the sensing circuit 212. The sensing circuit 212 has a function of sensing signals of the wirings SNL. A signal of the wiring SNL<β> at the time when the wiring DRL<α> is driven by the TS driver IC 211 has information on the change amount of capacitance of the capacitor $CT_{\alpha\beta}$. By analyzing signals of n wirings SNL, information on the presence or absence of touch, the touch position, and the like can be obtained.

This embodiment can be combined with any of the other embodiments in this specification as appropriate.

Embodiment 9

<Composition of CAC-OS>

Described below will be the composition of a cloud-aligned composite oxide semiconductor (CAC-OS) applicable to a transistor of one embodiment of the present invention.

The CAC-OS has, for example, a composition in which elements included in a metal oxide are unevenly distributed. Materials including unevenly distributed elements each have a size greater than or equal to 0.5 nm and less than or equal to 10 nm, preferably greater than or equal to 1 nm and less than or equal to 2 nm, or a similar size. Note that in the following description of a metal oxide, a state in which one or more metal elements are unevenly distributed and regions including the metal element(s) are mixed is referred to as a mosaic pattern or a patch-like pattern. The regions each have a size greater than or equal to 0.5 nm and less than or equal to 10 nm, preferably greater than or equal to 1 nm and less than or equal to 2 nm, or a similar size.

Note that a metal oxide preferably contains at least indium. In particular, indium and zinc are preferably contained. In addition, aluminum, gallium, yttrium, copper, vanadium, beryllium, boron, silicon, titanium, iron, nickel, germanium, zirconium, molybdenum, lanthanum, cerium, neodymium, hafnium, tantalum, tungsten, magnesium, and the like may be contained.

For example, of the CAC-OS, an In—Ga—Zn oxide with the CAC composition (such an In—Ga—Zn oxide may be particularly referred to as CAC-IGZO) has a composition in which materials are separated into indium oxide ($InO_{X1}$, where X1 is a real number greater than 0) or indium zinc oxide ($In_{X2}Zn_{Y2}O_{Z2}$, where X2, Y2, and Z2 are real numbers greater than 0), and gallium oxide ($GaO_{X3}$, where X3 is a real number greater than 0), or gallium zinc oxide ($Ga_{X4}Zn_{Y4}O_{Z4}$, where X4, Y4, and Z4 are real numbers greater than 0), and a mosaic pattern is formed. Then, $InO_{X1}$ or $In_{X2}Zn_{Y2}O_{Z2}$ forming the mosaic pattern is evenly distributed in the film. This composition is also referred to as a cloud-like composition.

That is, the CAC-OS is a composite metal oxide with a composition in which a region including $GaO_{X3}$ as a main component and a region including $In_{X2}Zn_{Y2}O_{Z2}$ or $InO_{X1}$ as a main component are mixed. Note that in this specification, for example, when the atomic ratio of In to an element M in a first region is greater than the atomic ratio of In to an element M in a second region, the first region has higher In concentration than the second region.

Note that a compound including In, Ga, Zn, and O is also known as IGZO. Typical examples of IGZO include a crystalline compound represented by $InGaO_3(ZnO)_{m1}$ (m1 is a natural number) and a crystalline compound represented by $In_{(1+x0)}Ga_{(1-x0)}O_3(ZnO)_{m0}$ ($-1 \leq x0 \leq 1$; m0 is a given number).

The above crystalline compounds have a single crystal structure, a polycrystalline structure, or a CAAC structure. Note that the CAAC structure is a crystal structure in which a plurality of IGZO nanocrystals have c-axis alignment and are connected in the a-b plane direction without alignment.

On the other hand, the CAC-OS relates to the material composition of a metal oxide. In a material composition of a CAC-OS including In, Ga, Zn, and O, nanoparticle regions including Ga as a main component are observed in part of the CAC-OS and nanoparticle regions including In as a main component are observed in part thereof. These nanoparticle regions are randomly dispersed to form a mosaic pattern. Therefore, the crystal structure is a secondary element for the CAC-OS.

Note that in the CAC-OS, a stacked-layer structure including two or more films with different atomic ratios is not included. For example, a two-layer structure of a film including In as a main component and a film including Ga as a main component is not included.

A boundary between the region including $GaO_{X3}$ as a main component and the region including $In_{X2}Zn_{Y2}O_{Z2}$ or $InO_{X1}$ as a main component is not clearly observed in some cases.

In the case where one or more of aluminum, yttrium, copper, vanadium, beryllium, boron, silicon, titanium, iron, nickel, germanium, zirconium, molybdenum, lanthanum, cerium, neodymium, hafnium, tantalum, tungsten, magnesium, and the like are contained instead of gallium in a CAC-OS, nanoparticle regions including the selected metal element(s) as a main component(s) are observed in part of the CAC-OS and nanoparticle regions including In as a main component are observed in part thereof, and these nanoparticle regions are randomly dispersed to form a mosaic pattern in the CAC-OS.

The CAC-OS can be formed by a sputtering method under conditions where a substrate is not heated, for example. In the case of forming the CAC-OS by a sputtering method, one or more selected from an inert gas (typically, argon), an oxygen gas, and a nitrogen gas may be used as a deposition gas. The ratio of the flow rate of an oxygen gas to the total flow rate of the deposition gas at the time of deposition is preferably as low as possible, and for example, the flow ratio of an oxygen gas is preferably higher than or equal to 0% and less than 30%, further preferably higher than or equal to 0% and less than or equal to 10%.

The CAC-OS is characterized in that no clear peak is observed in measurement using $\theta/2\theta$ scan by an out-of-plane method, which is an X-ray diffraction (XRD) measurement method. That is, X-ray diffraction shows no alignment in the a-b plane direction and the c-axis direction in a measured region.

In an electron diffraction pattern of the CAC-OS which is obtained by irradiation with an electron beam with a probe diameter of 1 nm (also referred to as a nanometer-sized electron beam), a ring-like region with high luminance and a plurality of bright spots in the ring-like region are observed. Therefore, the electron diffraction pattern indicates that the crystal structure of the CAC-OS includes a nanocrystal (nc) structure with no alignment in plan-view and cross-sectional directions.

For example, an energy dispersive X-ray spectroscopy (EDX) mapping image confirms that an In—Ga—Zn oxide with the CAC composition has a structure in which a region including $GaO_{X3}$ as a main component and a region including $In_{X2}Zn_{Y2}O_{Z2}$ or $InO_{X1}$ as a main component are unevenly distributed and mixed.

The CAC-OS has a structure different from that of an IGZO compound in which metal elements are evenly distributed, and has characteristics different from those of the IGZO compound. That is, in the CAC-OS, regions including $GaO_{X3}$ or the like as a main component and regions including $In_{X2}Zn_{Y2}O_{Z2}$ or $InO_{X1}$ as a main component are separated to form a mosaic pattern.

The conductivity of a region including $In_{X2}Zn_{Y2}O_{Z2}$ or $InO_{X1}$ as a main component is higher than that of a region including $GaO_{X3}$ or the like as a main component. In other words, when carriers flow through regions including $In_{X2}Zn_{Y2}O_{Z2}$ or $InO_{X1}$ as a main component, the conductivity of a metal oxide is exhibited. Accordingly, when regions including $In_{X2}Zn_{Y2}O_{Z2}$ or $InO_{X1}$ as a main component are distributed in a metal oxide like a cloud, high field-effect mobility (μ) can be achieved.

In contrast, the insulating property of a region including $GaO_{X3}$ or the like as a main component is higher than that of a region including $In_{X2}Zn_{Y2}O_{Z2}$ or $InO_{X1}$ as a main component. In other words, when regions including $GaO_{X3}$ or the like as a main component are distributed in a metal oxide, leakage current can be suppressed and favorable switching operation can be achieved.

Accordingly, when a CAC-OS is used for a semiconductor element, the insulating property derived from $GaO_{X3}$ or the like and the conductivity derived from $In_{X2}Zn_{Y2}O_{Z2}$ or $InO_{X1}$ complement each other, whereby high on-state current (Ion) and high field-effect mobility (μ) can be achieved.

A semiconductor element including a CAC-OS has high reliability. Thus, the CAC-OS is suitably used in a variety of semiconductor devices typified by a display.

At least part of this embodiment can be implemented in combination with any of the other embodiments and the other examples described in this specification as appropriate.

Embodiment 10

In this embodiment, examples of electronic devices including the display unit 100, the display unit 100A, or the display unit 100B described in the above embodiment will be described. Electronic devices described in the following examples can include the display unit 100, the display unit 100A, or the display unit 100B described in the above embodiment. Alternatively, electronic devices described in the following examples can include the touch sensor unit 200 described in the above embodiment, in addition to the display unit 100, the display unit 100A, or the display unit 100B. Moreover, in the case where the electronic devices described in the following examples each include the controller IC described in the above embodiment, the power consumption of the electronic devices can be reduced.

In particular, an IC chip in a source driver or the like mounted over a display device or a hybrid display device is miniaturized easily; thus, a display device with high resolution can be achieved.

<Tablet Information Terminal>

Figure 50A:
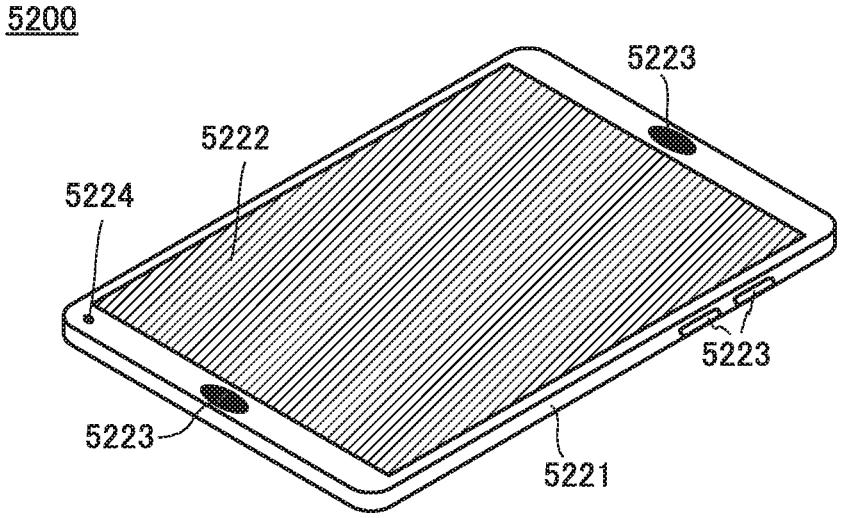
FIGS. 50A and 50B are perspective views each illustrating an example of an electronic device.

FIG. 50A illustrates a tablet information terminal 5200, which includes a housing 5221, a display portion 5222, operation buttons 5223, and a speaker 5224. A display device with a position input function may be used for a display portion 5222. Note that the position input function can be added by provision of a touch panel in a display device. Alternatively, the position input function can be added by providing a photoelectric conversion element called a photosensor in a pixel area of a display device. As the operation buttons 5223, any one of a power switch for starting the information terminal 5200, a button for operating an application of the information terminal 5200, a volume control button, a switch for turning on or off the display portion 5222, and the like can be provided. Although the number of the operation buttons 5223 is four in the information terminal 5200 illustrated in FIG. 50A, the number and position of operation buttons included in the information terminal 5200 is not limited to this example.

Although not illustrated, the information terminal 5200 illustrated in FIG. 50A may include a microphone. With this structure, the information terminal 5200 can have a telephone function like a mobile phone, for example.

Although not illustrated, the information terminal 5200 illustrated in FIG. 50A may include a camera. Although not illustrated, the information terminal 5200 illustrated in FIG. 50A may include a light-emitting device for use as a flashlight or a lighting device.

Although not illustrated, the information terminal 5200 illustrated in FIG. 50A may include a sensor (which measures force, displacement, position, speed, acceleration, angular velocity, rotational frequency, distance, light, liquid, magnetism, temperature, a chemical substance, a sound, time, hardness, electric field, current, voltage, electric power, radiation, flow rate, humidity, gradient, oscillation, smell, infrared rays, or the like) inside the housing 5221. In particular, when a sensing device including a sensor for sensing inclination such as a gyroscope sensor or an acceleration sensor is provided, display on the screen of the display portion 5222 can be automatically changed in accordance with the orientation of the information terminal 5200 illustrated in FIG. 50A by determining the orientation of the information terminal 5200 (the orientation of the information terminal with respect to the vertical direction).

Although not illustrated, the information terminal 5200 illustrated in FIG. 50A may include a device for obtaining biological information such as fingerprints, veins, iris, voice prints, or the like. With this structure, the information terminal 5200 can have a biometric identification function.

In the case where the information terminal 5200 includes a microphone, it can have a speech interpretation function. With the speech interpretation function, the information terminal 5200 can have a function of operating the information terminal 5200 by speech recognition, a function of interpreting a speech or a conversation and creating a summary of the speech or the conversation, and the like. This can be utilized to create meeting minutes or the like, for example.

For the display portion 5222, a flexible base may be used. Specifically, the display portion 5222 may be formed by providing a transistor, a capacitor, and a display element, for example, over a flexible base. With this structure, an electronic device with a housing having a curved surface can be fabricated as well as the electronic device with the housing 5221 having a flat surface, such as the information terminal 5200 illustrated in FIG. 50A.

Figure 50B:
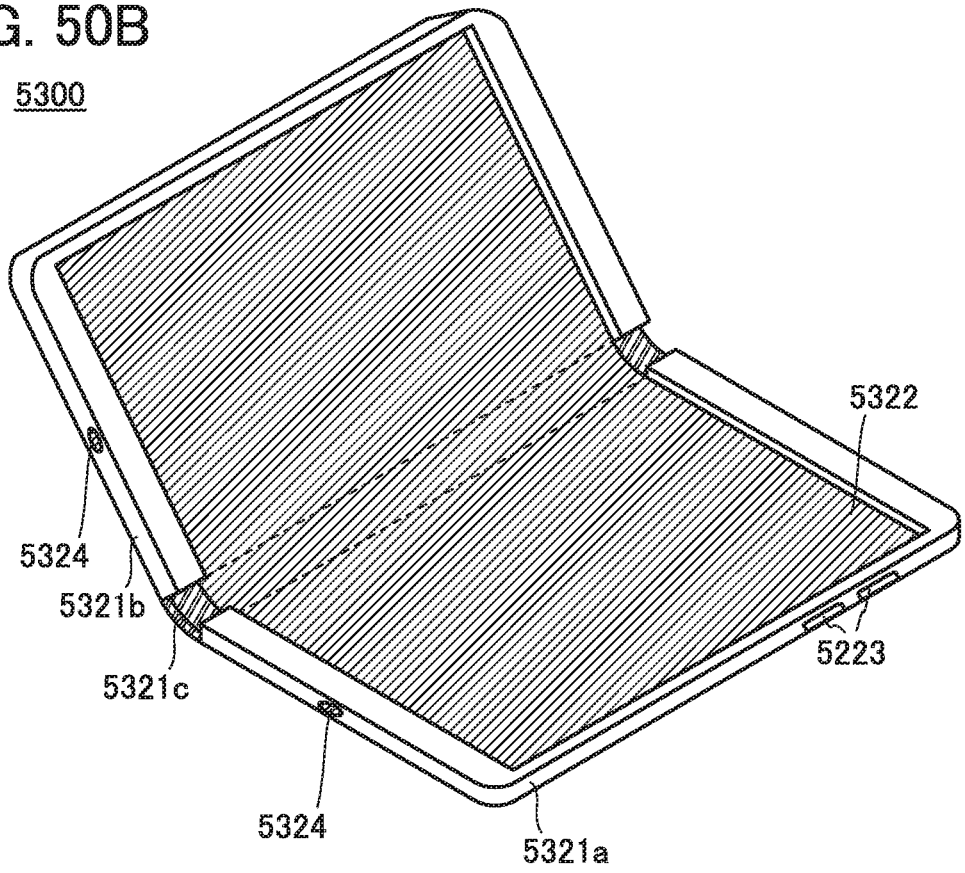

Furthermore, a flexible base may be used for the display portion 5222 of the information terminal 5200 so that the display portion 5222 is freely foldable. FIG. 50B illustrates such a structure. An information terminal 5300 is a tablet information terminal similar to the information terminal 5200 and includes a housing 5321*a*, a housing 5321*b*, a display portion 5322, operation buttons 5323, and speakers 5324.

The housing 5321*a* and the housing 5321*b* are connected to each other with a hinge portion 5321*c* that allows the display portion 5322 to be folded in half. The display portion 5322 is provided in the housing 5321*a* and the housing 5321*b* and over the hinge portion 5321*c*.

As a flexible base that can be used for the display portion 5222, any of the following materials that transmit visible light can be used: a poly(ethylene terephthalate) resin (PET), a poly(ethylene naphthalate) resin (PEN), a poly(ether sulfone) resin (PES), a polyacrylonitrile resin, an acrylic resin, a polyimide resin, a poly(methyl methacrylate) resin, a polycarbonate resin, a polyamide resin, a polycycloolefin resin, a polystyrene resin, a poly(amide imide) resin, a polypropylene resin, a polyester resin, a poly(vinyl halide)

resin, an aramid resin, an epoxy resin, or the like. Alternatively, a mixture or a stack including any of these materials may be used.

In the information terminal 5300 illustrated in FIG. 50B, when a controller IC, a driver IC, or the like is mounted over the display portion 5222, it is preferably that the controller IC, the driver IC, or the like is not mounted in a folded portion of the display portion 5222. In this manner, the interference between a curved portion caused by folding and the controller IC, the driver IC, or the like is prevented.

The display device 1000, the display device 1000A, or the display device 1000B disclosed in this specification is used for the information terminal 5200 or the information terminal 5300, whereby power consumption of the information terminal 5200 or the information terminal 5300 in IDS driving can be reduced, and a high-definition image can be displayed on the information terminal 5200 or the information terminal 5300.

<Portable Game Console>

Figure 51A:
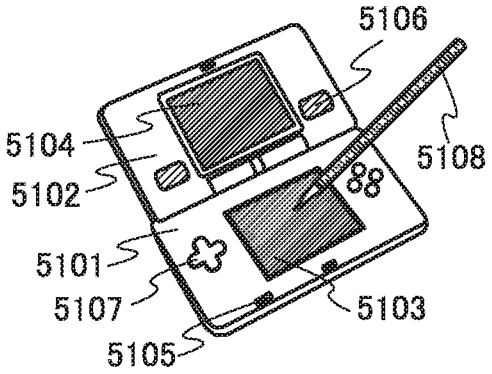
FIGS. 51A to 51F are perspective views each illustrating an example of an electronic device.

FIG. 51A illustrates a portable game console including a housing 5101, a housing 5102, a display portion 5103, a display portion 5104, a microphone 5105, speakers 5106, operation keys 5107, a stylus 5108, and the like. The display device of one embodiment of the present invention can be used for a portable game machine. Although the portable game machine in FIG. 51A has the two display portions 5103 and 5104, the number of display portions included in a portable game machine is not limited to this.

<Portable Information Terminal>

Figure 51B:
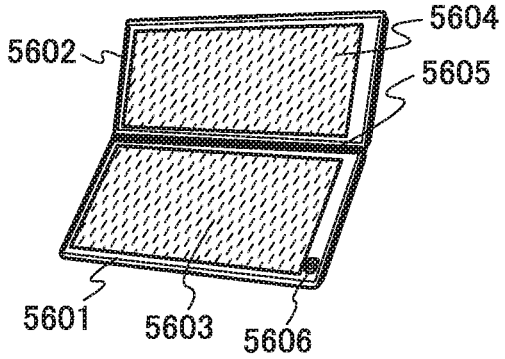

FIG. 51B illustrates a portable information terminal, which includes a first housing 5601, a second housing 5602, a first display portion 5603, a second display portion 5604, a joint 5605, an operation key 5606, and the like. The display device of one embodiment of the present invention can be used for a portable information terminal. The first display portion 5603 is provided in the first housing 5601, and the second display portion 5604 is provided in the second housing 5602. The first housing 5601 and the second housing 5602 are connected to each other with the joint 5605, and the angle between the first housing 5601 and the second housing 5602 can be changed with the joint 5605. Images displayed on the first display portion 5603 may be switched in accordance with the angle at the joint 5605 between the first housing 5601 and the second housing 5602. A display device with a position input function may be used as at least one of the first display portion 5603 and the second display portion 5604. Note that the position input function can be added by providing a touch panel in a display device. Alternatively, the position input function can be added by provision of a photoelectric conversion element called a photosensor in a pixel portion of a display device.

<Laptop Personal Computer>

Figure 51C:
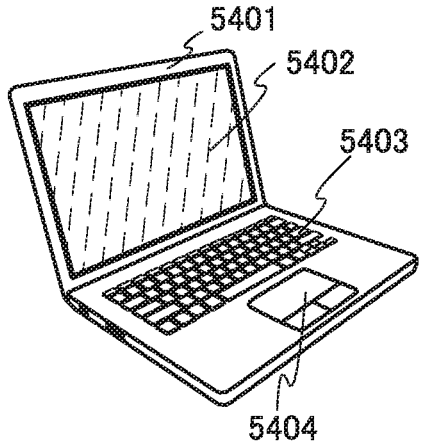

FIG. 51C illustrates a laptop personal computer including a housing 5401, a display portion 5402, a keyboard 5403, a pointing device 5404, and the like. The display device according to one embodiment of the present invention can be used as the display portion 5402.

<Smart Watch>

Figure 51D:
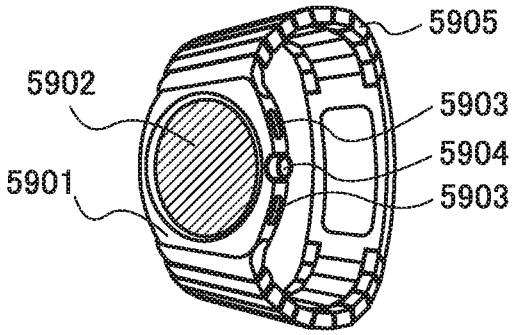

FIG. 51D illustrates a smart watch which is one of wearable terminals. The smart watch includes a housing 5901, a display portion 5902, operation buttons 5903, an operator 5904, and a band 5905. The display device of one embodiment of the present invention can be applied to the smart watch. A display device with a position input function may be used as a display portion 5902. Note that the position input function can be added by provision of a touch panel in a display device. Alternatively, the position input function can be added by providing a photoelectric conversion element called a photosensor in a pixel area of a display device. As the operation buttons 5903, any one of a power switch for starting the smart watch, a button for operating an application of the smart watch, a volume control button, a switch for turning on or off the display portion 5902, and the like can be used. Although the smart watch in FIG. 51D includes two operation buttons 5903, the number of the operation buttons included in the smart watch is not limited to two. The operator 5904 functions as a crown performing time adjustment in the smart watch. The operator 5904 may be used as an input interface for operating an application of the smart watch as well as the crown for a time adjustment. Although the smart watch illustrated in FIG. 51D includes the operator 5904, one embodiment of the present invention is not limited thereto and the operator 5904 is not necessarily provided.

<Video Camera>

Figure 51E:
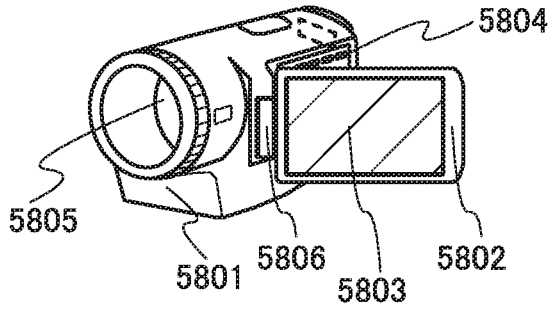

FIG. 51E illustrates a video camera including a first housing 5801, a second housing 5802, a display portion 5803, operation keys 5804, a lens 5805, a joint 5806, and the like. The display device of one embodiment of the present invention can be used for the video camera. The operation keys 5804 and the lens 5805 are provided in the first housing 5801, and the display portion 5803 is provided in the second housing 5802. The first housing 5801 and the second housing 5802 are connected to each other with the joint 5806, and the angle between the first housing 5801 and the second housing 5802 can be changed with the joint 5806. Images displayed on the display portion 5803 may be switched in accordance with the angle at the joint 5806 between the first housing 5801 and the second housing 5802.

<Mobile Phone>

Figure 51F:
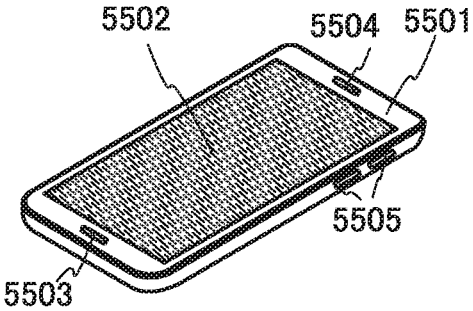

FIG. 51F illustrates a mobile phone having a function of an information terminal. The mobile phone includes a housing 5501, a display portion 5502, a microphone 5503, a speaker 5504, and operation buttons 5505. The display device of one embodiment of the present invention can be used for the mobile phone. A display device with a position input function may be used as the display portion 5502. Note that the position input function can be added by provision of a touch panel in a display device. Alternatively, the position input function can be added by providing a photoelectric conversion element called a photosensor in a pixel area of a display device. As operation buttons 5505, any one of a power switch for starting the mobile phone, a button for operating an application of the mobile phone, a volume control button, a switch for turning on or off the display portion 5502, and the like can be used.

Although the mobile phone in FIG. 51F includes two operation buttons 5505, the number of the operation buttons included in the mobile phone is not limited to two. Although not illustrated, the mobile phone illustrated in FIG. 51F may be provided with a camera. Although not illustrated, the mobile phone illustrated in FIG. 51F may include a light-emitting device used for a flashlight or a lighting purpose.

<Moving Vehicle>

The display device described above can also be used around a driver's seat in an automobile, which is a moving vehicle.

Figure 52:
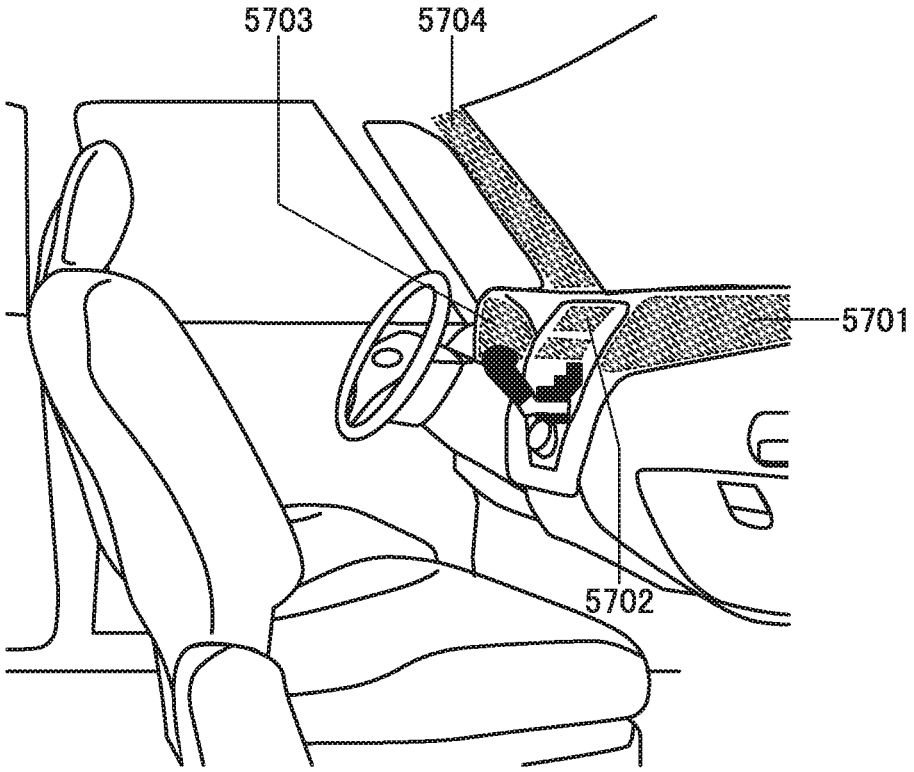
FIG. 52 illustrates a usage example of a display device in a moving vehicle.

FIG. 52 illustrates a front glass and its vicinity inside a car, for example. FIG. 52 illustrates a display panel 5701, a display panel 5702, and a display panel 5703 which are attached to a dashboard, and a display panel 5704 attached to a pillar.

The display panels 5701 to 5703 can display a variety of kinds of information such as navigation information, a speedometer, a tachometer, a mileage, a fuel meter, a gearshift indicator, air-condition setting, and the like. The content, layout, or the like of the display on the display panels can be changed freely to suit the user's preferences, so that the design can be improved. The display panels 5701 to 5703 can also be used as lighting devices.

The display panel 5704 can compensate for the view obstructed by the pillar (blind areas) by showing an image taken by an imaging means provided for the car body. That is, displaying an image taken by an imaging unit provided on the outside of the car body leads to elimination of blind areas and enhancement of safety. In addition, showing an image so as to compensate for the area which a driver cannot see makes it possible for the driver to confirm safety easily and comfortably. The display panel 5704 can also be used as a lighting device.

In this specification and the like, a display element, a display device which is a device including a display element, a light-emitting element, and a light-emitting device which is a device including a light-emitting element can employ various modes or can include various elements. For example, the display element, the display device, the light-emitting element, or the light-emitting device includes at least one of an electroluminescence (EL) element (e.g., an EL element including organic and inorganic materials, an organic EL element, or an inorganic EL element), a light-emitting diode (LED) chip (e.g., a white LED chip, a red LED chip, a green LED chip, or a blue LED chip), a transistor (a transistor that emits light depending on current), a plasma display panel (PDP), an electron emitter, a display element including a carbon nanotube, a liquid crystal element, electronic ink, an electrowetting element, an electrophoretic element, a display element using micro electro mechanical systems (MEMS) (such as a grating light valve (GLV), a digital micromirror device (DMD), a digital micro shutter (DMS), MIRASOL (registered trademark), an interferometric modulation (IMOD) element, a MEMS shutter display element, an optical-interference-type MEMS display element, or a piezoelectric ceramic display), quantum dots, and the like. Other than the above, a display medium whose contrast, luminance, reflectance, transmittance, or the like is changed by electric or magnetic action may be included in the display element, the display device, the light-emitting element, or the light-emitting device. Note that examples of display devices having EL elements include an EL display. Examples of a display device including an electron emitter include a field emission display (FED), an SED-type flat panel display (SED: surface-conduction electron-emitter display), and the like. Examples of display devices including liquid crystal elements include a liquid crystal display (e.g., a transmissive liquid crystal display, a transflective liquid crystal display, a reflective liquid crystal display, a direct-view liquid crystal display, or a projection liquid crystal display). Examples of a display device including electronic ink, Electronic Liquid Powder (registered trademark), or an electrophoretic element include electronic paper. Examples of display devices containing quantum dots in each pixel include a quantum dot display. Note that quantum dots may be provided not as display elements but as part of a backlight. The use of quantum dots enables display with high color purity. In the case of a transflective liquid crystal display or a reflective liquid crystal display, some of or all of pixel electrodes function as reflective electrodes. For example, some or all of pixel electrodes are formed to contain aluminum, silver, or the like. In such a case, a memory circuit such as an SRAM can be provided under the reflective electrodes. Thus, the power consumption can be further reduced. Note that in the case of using an LED chip, graphene or graphite may be provided under an electrode or a nitride semiconductor of the LED chip. Graphene or graphite may be a multilayer film in which a plurality of layers are stacked. As described above, the provision of graphene or graphite enables easy formation of a nitride semiconductor thereover, such as an n-type GaN semiconductor layer including crystals. Furthermore, a p-type GaN semiconductor layer including crystals or the like can be provided thereover, and thus the LED chip can be formed. Note that an AlN layer may be provided between the n-type GaN semiconductor layer including crystals and graphene or graphite. The GaN semiconductor layers included in the LED chip may be formed by MOCVD. Note that when the graphene is provided, the GaN semiconductor layers included in the LED chip can also be formed by a sputtering method. In the case of a display element including microelectromechanical systems (MEMS), a dry agent may be provided in a space where the display element is sealed (e.g., between an element substrate over which the display element is placed and a counter substrate opposed to the element substrate). Providing a dry agent can prevent MEMS and the like from becoming difficult to move or deteriorating easily because of moisture or the like.

This embodiment can be combined with any of the other embodiments in this specification as appropriate.

(Notes on the Description in this Specification and the Like)

The following are notes on the structures in the above embodiments.

<Notes on One Embodiment of the Present Invention Described in Embodiments>

One embodiment of the present invention can be constituted by appropriately combining the structure described in an embodiment with any of the structures described in the other embodiments. In addition, in the case where a plurality of structure examples are described in one embodiment, some of the structure examples can be combined as appropriate.

Note that what is described (or part thereof) in an embodiment can be applied to, combined with, or replaced with another content in the same embodiment and/or what is described (or part thereof) in another embodiment or other embodiments.

Note that in each embodiment, a content described in the embodiment is a content described with reference to a variety of diagrams or a content described with text disclosed in this specification.

Note that by combining a diagram (or part thereof) described in one embodiment with another part of the diagram, a different diagram (or part thereof) described in the embodiment, and/or a diagram (or part thereof) described in another embodiment or other embodiments, much more diagrams can be formed.

<Notes on Ordinal Numbers>

In this specification and the like, ordinal numbers such as first, second, and third are used in order to avoid confusion among components. Thus, the terms do not limit the number or order of components. Thus, the terms do not limit the number or order of components. In the present specification and the like, for example, a "first" component in one embodiment can be referred to as a "second" component in other embodiments or claims. Furthermore, in the present specification and the like, for example, a "first" component in one embodiment can be referred to without the ordinal number in other embodiments or claims.

<Notes on the Description for Drawings>

However, the embodiments can be implemented with various modes. It will be readily appreciated by those skilled in the art that modes and details can be changed in various ways without departing from the spirit and scope of the present invention. Thus, the present invention should not be interpreted as being limited to the description of the embodiments. Note that in the structures of the embodiments, the same portions or portions having similar functions are denoted by the same reference numerals in different drawings, and the description of such portions is not repeated.

In this specification and the like, the terms for explaining arrangement, such as "over" and "under", are used for convenience to describe the positional relation between components with reference to drawings. Furthermore, the positional relation between components is changed as appropriate in accordance with a direction in which the components are described. Therefore, the terms for explaining arrangement are not limited to those used in this specification and may be changed to other terms as appropriate depending on the situation.

The term "over" or "under" does not necessarily mean that a component is placed directly over or directly under and directly in contact with another component. For example, the expression "electrode B over insulating layer A" does not necessarily mean that the electrode B is on and in direct contact with the insulating layer A and can mean the case where another component is provided between the insulating layer A and the electrode B.

Furthermore, in a block diagram in this specification and the like, components are functionally classified and shown by blocks that are independent from each other. However, in an actual circuit and the like, such components are sometimes hard to classify functionally, and there is a case in which one circuit is concerned with a plurality of functions or a case in which a plurality of circuits are concerned with one function. Therefore, blocks in a block diagram do not necessarily show components described in the specification, which can be explained with another term as appropriate depending on the situation.

In drawings, the size, the layer thickness, or the region is determined arbitrarily for description convenience. Therefore, the size, the layer thickness, or the region is not limited to the illustrated scale. Note that the drawings are schematically shown for clarity, and embodiments of the present invention are not limited to shapes or values shown in the drawings. For example, the following can be included: variation in signal, voltage, or current due to noise or difference in timing.

In drawings such as a perspective view, some components might not be illustrated for clarity of the drawings.

In the drawings, the same components, components having similar functions, components formed of the same material, or components formed at the same time are denoted by the same reference numerals in some cases, and the description thereof is not repeated in some cases.

<Notes on Expressions that can be Rephrased>

In this specification or the like, the terms "one of a source and a drain" (or a first electrode or a first terminal) and "the other of the source and the drain" (or a second electrode or a second terminal) are used to describe the connection relation of a transistor. This is because a source and a drain of a transistor are interchangeable depending on the structure, operation conditions, or the like of the transistor. Note that the source or the drain of the transistor can also be referred to as a source (or drain) terminal, a source (or drain) electrode, or the like as appropriate depending on the situation. In this specification and the like, two terminals except a gate are sometimes referred to as a first terminal and a second terminal or as a third terminal and a fourth terminal.

A transistor is an element having three terminals: a gate, a source, and a drain. A gate is a terminal which functions as a control terminal for controlling the conduction state of a transistor. Functions of input/output terminals of the transistor depend on the type and the levels of potentials applied to the terminals, and one of the two terminals serves as a source and the other serves as a drain. Therefore, the terms "source" and "drain" can be switched in this specification and the like. In this specification and the like, two terminals except a gate are sometimes referred to as a first terminal and a second terminal or as a third terminal and a fourth terminal.

In addition, in this specification and the like, the term such as an "electrode" or a "wiring" does not limit a function of the component. For example, an "electrode" is used as part of a "wiring" in some cases, and vice versa. Further, the term "electrode" or "wiring" can also mean a combination of a plurality of "electrodes" and "wirings" formed in an integrated manner.

In this specification and the like, "voltage" and "potential" can be replaced with each other. The term "voltage" refers to a potential difference from a reference potential. When the reference potential is a ground potential, for example, "voltage" can be replaced with "potential". The ground potential does not necessarily mean 0 V. Potentials are relative values, and the potential applied to a wiring or the like is changed depending on the reference potential, in some cases.

In this specification and the like, the terms "film" and "layer" can be interchanged with each other depending on the case or circumstances. For example, the term "conductive layer" can be changed into the term "conductive film" in some cases. Moreover, the term "insulating film" can be changed into the term "insulating layer" in some cases, or can be replaced with a word not including the term "film" or "layer" depending on the case or circumstances. For example, the term "conductive layer" or "conductive film" can be changed into the term "conductor" in some cases. Furthermore, for example, the term "insulating layer" or "insulating film" can be changed into the term "insulator" in some cases.

In this specification and the like, the terms "wiring," "signal line," "power supply line," and the like can be interchanged with each other depending on circumstances or conditions. For example, the term "wiring" can be changed into the term "signal line" in some cases. For example, the term "wiring" can be changed into the term such as "signal line" or "power source line" in some cases. The term such as "signal line" or "power source line" can be changed into the term "wiring" in some cases. The term such as "power source line" can be changed into the term such as "signal line" in some cases. The term such as "signal line" can be changed into the term such as "power source line" in some cases. The term "potential" that is applied to a wiring can be changed into the term "signal" or the like depending on circumstances or conditions. Inversely, the term "signal" or the like can be changed into the term "potential" in some cases.

<Notes on Definitions of Terms>

The following are definitions of the terms mentioned in the above embodiments.

<<Impurity in Semiconductor>>

Note that an impurity in a semiconductor refers to, for example, elements other than the main components of a semiconductor layer. For example, an element with a concentration lower than 0.1 atomic % is an impurity. When an impurity is contained, the density of states (DOS) may be formed in a semiconductor, the carrier mobility may be decreased, or the crystallinity may be decreased. In the case where the semiconductor is an oxide semiconductor, examples of an impurity which changes characteristics of the semiconductor include Group 1 elements, Group 2 elements, Group 13 elements, Group 14 elements, Group 15 elements, and transition metals other than the main components of the semiconductor; specifically, there are hydrogen (included in water), lithium, sodium, silicon, boron, phosphorus, carbon, and nitrogen, for example. When the semiconductor is an oxide semiconductor, oxygen vacancies may be formed by entry of impurities such as hydrogen, for example. Furthermore, when the semiconductor layer is silicon, examples of an impurity which changes the characteristics of the semiconductor include oxygen, Group 1 elements except hydrogen, Group 2 elements, Group 13 elements, and Group 15 elements.

<<Transistor>>

In this specification, a transistor is an element having at least three terminals of a gate, a drain, and a source. The transistor has a channel formation region between the drain (a drain terminal, a drain region, or a drain electrode) and the source (a source terminal, a source region, or a source electrode). A voltage is applied between a gate and the source, whereby a channel can be formed in the channel formation region, and current can flow between the drain and the source.

Furthermore, functions of a source and a drain might be switched when transistors having different polarities are employed or a direction of current flow is changed in circuit operation, for example. Therefore, the terms "source" and "drain" can be switched in this specification and the like.

<<Switch>>

In this specification and the like, a switch is conducting (on state) or not conducting (off state) to determine whether current flows therethrough or not. Alternatively, a switch has a function of selecting and changing a current path.

Examples of a switch are an electrical switch, a mechanical switch, and the like. That is, any element can be used as a switch as long as it can control current, without limitation to a certain element.

Examples of the electrical switch are a transistor (e.g., a bipolar transistor or a MOS transistor), a diode (e.g., a PN diode, a PIN diode, a Schottky diode, a metal-insulator-metal (MIM) diode, a metal-insulator-semiconductor (MIS) diode, or a diode-connected transistor), and a logic circuit in which such elements are combined.

In the case of using a transistor as a switch, an "on state" of the transistor refers to a state in which a source electrode and a drain electrode of the transistor are electrically short-circuited. Furthermore, an "off state" of the transistor refers to a state in which the source electrode and the drain electrode of the transistor are electrically cut off. In the case where a transistor operates just as a switch, the polarity (conductivity type) of the transistor is not particularly limited to a certain type.

An example of a mechanical switch is a switch formed using a micro electro mechanical systems (MEMS) technology, such as a digital micromirror device (DMD). Such a switch includes an electrode which can be moved mechanically, and operates by controlling conduction and non-conduction in accordance with movement of the electrode.

<<Connection>>

In this specification and the like, when it is described that X and Y are connected, the case where X and Y are electrically connected, the case where X and Y are functionally connected, and the case where X and Y are directly connected are included therein. Accordingly, another element may be interposed between elements having a connection relation shown in drawings and texts, without limiting to a predetermined connection relation, for example, the connection relation shown in the drawings and the texts.

Here, X, Y, and the like each denote an object (e.g., a device, an element, a circuit, a line, an electrode, a terminal, a conductive film, a layer, or the like).

For example, in the case where X and Y are electrically connected, one or more elements that enable an electrical connection between X and Y (e.g., a switch, a transistor, a capacitor, an inductor, a resistor, a diode, a display element, a light-emitting element, or a load) can be connected between X and Y. Note that the switch is controlled to be turned on or off. That is, a switch is conducting or not conducting (is turned on or off) to determine whether current flows therethrough or not.

For example, in the case where X and Y are functionally connected, one or more circuits that enable functional connection between X and Y (e.g., a logic circuit such as an inverter, a NAND circuit, or a NOR circuit; a signal converter circuit such as a DA converter circuit, an AD converter circuit, or a gamma correction circuit; a potential level converter circuit such as a power source circuit (e.g., a step-up converter or a step-down converter) or a level shifter circuit for changing the potential level of a signal; a voltage source; a current source; a switching circuit; an amplifier circuit such as a circuit that can increase signal amplitude, the amount of current, or the like, an operational amplifier, a differential amplifier circuit, a source follower circuit, or a buffer circuit; a signal generation circuit; a memory circuit; and/or a control circuit) can be connected between X and Y. For example, even when another circuit is interposed between X and Y, X and Y are functionally connected if a signal output from X is transmitted to Y.

Note that when it is explicitly described that X and Y are connected, the case where X and Y are electrically connected (i.e., the case where X and Y are connected with another element or another circuit provided therebetween), the case where X and Y are functionally connected (i.e., the case where X and Y are functionally connected with another circuit provided therebetween), and the case where X and Y are directly connected (i.e., the case where X and Y are connected without another element or another circuit provided therebetween) are included therein. That is, the explicit expression "X and Y are electrically connected" is the same as the explicit simple expression "X and Y are connected".

For example, any of the following expressions can be used for the case where a source (or a first terminal or the like) of a transistor is electrically connected to X through (or not through) Z1 and a drain (or a second terminal or the like) of the transistor is electrically connected to Y through (or not through) Z2, or the case where a source (or a first terminal or the like) of a transistor is directly connected to one part of Z1 and another part of Z1 is directly connected to X while a drain (or a second terminal or the like) of the transistor is directly connected to one part of Z2 and another part of Z2 is directly connected to Y.

Examples of the expressions include, "X, Y, a source (or a first terminal or the like) of a transistor, and a drain (or a second terminal or the like) of the transistor are electrically connected to each other, and X, the source (or the first terminal or the like) of the transistor, the drain (or the second terminal or the like) of the transistor, and Y are electrically connected to each other in this order", "a source (or a first terminal or the like) of a transistor is electrically connected to X, a drain (or a second terminal or the like) of the transistor is electrically connected to Y, and X, the source (or the first terminal or the like) of the transistor, the drain (or the second terminal or the like) of the transistor, and Y are electrically connected to each other in this order", and "X is electrically connected to Y through a source (or a first terminal or the like) and a drain (or a second terminal or the like) of a transistor, and X, the source (or the first terminal or the like) of the transistor, the drain (or the second terminal or the like) of the transistor, and Y are provided to be connected in this order". When the connection order in a circuit configuration is defined by an expression similar to the above examples, a source (or a first terminal or the like) and a drain (or a second terminal or the like) of a transistor can be distinguished from each other to specify the technical scope. Note that these expressions are examples and there is no limitation on the expressions. Here, X, Y, Z1, and Z2 each denote an object (e.g., a device, an element, a circuit, a wiring, an electrode, a terminal, a conductive film, and a layer).

Even when independent components are electrically connected to each other in a circuit diagram, one component has functions of a plurality of components in some cases. For example, when part of a wiring also functions as an electrode, one conductive film functions as the wiring and the electrode. Thus, "electrical connection" in this specification includes in its category such a case where one conductive film has functions of a plurality of components.

<<Parallel and Perpendicular>>

In this specification, the term "parallel" indicates that the angle formed between two straight lines is greater than or equal to −10° and less than or equal to 10°, and accordingly also includes the case where the angle is greater than or equal to −5° and less than or equal to 5°. In addition, the term "substantially parallel" indicates that the angle formed between two straight lines is greater than or equal to −30° and less than or equal to 30°. The term "perpendicular" indicates that the angle formed between two straight lines is greater than or equal to 80° and less than or equal to 100°. Thus, the case where the angle is greater than or equal to 85° and less than or equal to 95° is also included. In addition, the term "substantially perpendicular" indicates that the angle formed between two straight lines is greater than or equal to 60° and less than or equal to 120°.

<<Trigonal and Rhombohedral>>

In this specification, trigonal and rhombohedral crystal systems are included in a hexagonal crystal system.

REFERENCE NUMERALS

Tr1: transistor, Tr2: transistor, Tr3: transistor, Tr4: transistor, Tr11: transistor, Tr12: transistor, Tr13: transistor, Tr14: transistor, Tr15: transistor, Tr16: transistor, Tr17: transistor, Tr18: transistor, Tr19: transistor, Tr20: transistor, Tr21: transistor, Tr22: transistor, Tr23: transistor, Tr31: transistor, Tr32: transistor, Tr33: transistor, Tr34: transistor, Tr35: transistor, Tr36: transistor, Tr41: transistor, Tr42: transistor, Tr43: transistor, Tr44: transistor, Tr45: transistor, Tr46: transistor, Tr51: transistor, Tr52: transistor, Tr53: transistor, Tr54: transistor, Tr55: transistor, Tr56: transistor, Tr57: transistor, Tr61: transistor, Tr62: transistor, Tr71: transistor, Tr72: transistor, Tr73: transistor, Tr74: transistor, Tr75: transistor, Tr76: transistor, Tr77[1]: transistor, Tr77[*j*]: transistor, Tr77[*n*]: transistor, Tr77[*j*+1]: transistor, Tr78: transistor, TrED: transistor, TrLD: transistor, MW1: transistor, C1: capacitor, C2: capacitor, C3: capacitor, C11: capacitor, C31: capacitor, C32: capacitor, C41: capacitor, C42: capacitor, C51: capacitor, C52: capacitor, C71: capacitor, C72: capacitor, CS1: capacitor, $CT_{\alpha\mu}$: capacitor, N11: node, N31: node, N32: node, LD: liquid crystal element, ED: light-emitting element, SL: wiring, DL: wiring, DLa: wiring, DLb: wiring, GL1: wiring, GL2: wiring, GL2*a*: wiring, GL2*b*: wiring, GL3: wiring, GL3*a*: wiring, GL3*b*: wiring, CSL: wiring, AL: wiring, ML: wiring, MLa: wiring, MLb: wiring, VCOM1: wiring, VCOM2: wiring, WL: wiring, LBL: wiring, LBLB: wiring, BGL: wiring, CSEL: wiring, GBL: wiring, GBLB: wiring, SR: circuit, SR[1]: circuit, SR[2]: circuit, SR[3]: circuit, SR[4]: circuit, SR[5]: circuit, SR[6]: circuit, SR[m−1]: circuit, SR[m]: circuit, SR_D: circuit, SR_D[1]: circuit, SR_D[2]: circuit, IT: terminal, OT: terminal, RT: terminal, ST: terminal, PT: terminal, IRT: terminal, C1T: terminal, C2T: terminal, C3T: terminal, GL[1]: wiring, GL[2]: wiring, GL[3]: wiring, GL[4]: wiring, GL[5]: wiring, GL[6]: wiring, GL[m−1]: wiring, GL[m]: wiring, GL_DUM: wiring, GL_OUT: wiring, SP: start pulse signal, CLK1: clock signal, CLK2: clock signal, CLK3: clock signal, CLK4: clock signal, PWC1: pulse width control signal, PWC2: pulse width control signal, PWC3: pulse width control signal, PWC4: pulse width control signal, INI_RES: initialization reset signal, SAVE1: signal, SAVE2: signal, LOAD1: signal, LOAD2: signal, VDD2L: wiring, VDD3L: wiring, GNDL: wiring, IN0: input terminal, IN1: input terminal, OUT: output terminal, Q1: terminal, Q2: terminal, SNL: wiring, DRL: wiring, OUT[1]: column output circuit, OUT[j]: column output circuit, OUT[n]: column output circuit, Cref: reference column output circuit, CI: constant current circuit, CIref: constant current circuit, CM: current mirror circuit, COT[1]: column output circuit, COT[j]: column output circuit, COT[n]: column output circuit, COT[j+1]: column output circuit, CUREF: power supply circuit, SI[1]: circuit, SI[j]: circuit, SI [n]: circuit, SI[j+1]: circuit, SO[1]: circuit, SO[j]: circuit, SO [n]: circuit, SO[j+1]: circuit, AM[1,1]: memory cell, AM[i,1]: memory cell, AM[m,1]: memory cell, AM[1,j]: memory cell, AM[i,j]: memory cell, AM[m,j]: memory cell, AM[1,n] memory cell, AM[i,n]: memory cell, AM[m,n]: memory cell, AM[i+1,j]: memory cell, AM[i,j+1]: memory cell, AM[i+1,j+1]: memory cell, AMref[1]: memory cell, AMref[i]: memory cell, AMref[m]: memory cell, AMref[i+1]: memory cell, N[1,1]: node, N[i,1]: node, N[m,1]: node, N[1,j]: node, N[i,j]: node, N[m,j]: node, N[1,n]: node, N[i,n]: node, N[m,n]: node, N[i,j+1]: node, N[i+1,j]: node, N[i+1,j+1]: node, Nref[1]: node, Nref[i]: node, Nref[m]: node, Nref[i+1]: node, NCMref: node, OT[1]: output terminal, OT[j]: output terminal, OT[n]: output terminal, OTref: output terminal, CT1: terminal, CT2: terminal, CT3: terminal, CT4: terminal, CT5[1]: terminal, CT5[*j*]: terminal, CT5[*n*]: terminal, CT6[1]: terminal, CT6[*j*]: terminal, CT6[*n*]: terminal, CT7: terminal, CTB: terminal, CT11[1]: terminal, CT11[*j*]: terminal, CT11[*n*]: terminal, CT12[1]: terminal, CT12[*j*]: terminal, CT12[*n*]: terminal, CT13[1]: terminal, CT13[*j*]: terminal, CT13[*n*]: terminal, CTref: terminal, BG: wiring, BGref: wiring, OSP: wiring, ORP: wiring, OSM: wiring, ORM: wiring, RW[1]: wiring, RW[i]: wiring, RW[m]: wiring, RW[i+1]: wiring, WW[1]: wiring, WW[i]: wiring, WW[m]: wiring, WW[i+1]: wiring, WD[1]: wiring, WD[j]: wiring, WD[n]: wiring, WD[j+1]: wiring, WDref: wiring, B[1]: wiring, B[j]: wiring, B[n]: wiring, Bref: wiring, IL[1]: wiring, IL[j]: wiring, IL[n]: wiring, ILref: wiring, OL[1]: wiring, OL[j]: wiring, OL[n]: wiring, OLref: wiring, VR: wiring, VDD1L: wiring, VSSL: wiring, 10: pixel, 10*a*: reflective element, 10*b*: light-emitting element, 21: pixel circuit, 22: pixel circuit, 22*a*: pixel circuit, 22*b*: pixel circuit, 22*c*: pixel circuit, 22*d*: pixel circuit, 23: pixel circuit, 24: pixel circuit, 25: pixel circuit, 25*a*: pixel circuit, 25*b*: pixel circuit, 25*c*: pixel circuit, 25*d*: pixel circuit, 31: pixel circuit, 32: pixel circuit, 33: pixel circuit, 34: pixel circuit, 35: pixel circuit, 36: pixel circuit, 57: retention circuit, 58: selector, 59: flip-flop circuit, 60: inverter, 61: inverter, 62: inverter, 63: inverter, 64: inverter, 65: inverter, 67: analog switch, 68: analog switch, 71: inverter, 72: inverter, 73: inverter, 74: clocked inverter, 75: analog switch, 76: buffer, 100: display unit, 100A: display unit, 100B: display unit, 101: base, 102: display portion, 103: gate driver, 103*a*: gate driver, 103*b*: gate driver, 104: level shifter, 104*a*: level shifter, 104*b*: level shifter, 106: display portion, 107: data processing circuit, 107*a*: product-sum operation circuit, 110: FPC, 111: source driver IC, 111*a*: source driver IC, 111*b*: source driver IC, 112: controller IC, 120: connection portion, 131: wiring, 132: wiring, 133: wiring, 134: wiring, 135: wiring, 200: touch sensor unit, 201: base, 202: sensor array, 211: TS driver IC, 212: sensing circuit, 213: FPC, 214: FPC, 215: peripheral circuit, 220: connection portion, 221: connection portion, 231: wiring, 232: wiring, 233: wiring, 234: wiring, 300: substrate, 301: substrate, 302: light-emitting element, 303: liquid crystal element, 304: bonding layer, 306E: display portion, 306L: display portion, 311: conductive layer, 312: insulating layer, 313: semiconductor layer, 314: conductive layer, 315: conductive layer, 316: insulating layer, 317: conductive layer, 318: insulating layer, 319: conductive layer, 320: conductive layer, 321: conductive layer, 322: semiconductor layer, 323: conductive layer, 324: insulating layer, 325: insulating layer, 326: conductive layer, 327: conductive layer, 328: insulating layer, 329: conductive layer, 330: insulating layer, 331: EL layer, 332: conductive layer, 333: bonding layer, 334: coloring layer, 335: spacer, 336: light-blocking layer, 340: conductive layer, 341: insulating layer, 342: semiconductor layer, 343: insulating layer, 344: conductive layer, 345: insulating layer, 346: conductive layer, 347: conductive layer, 348: conductive layer, 349: conductive layer, 360: insulating layer, 361: conductive layer, 362: bonding layer, 363: insulating layer, 364: alignment film, 365: alignment film, 366: liquid crystal layer, 400: controller IC, 400A: controller IC, 400B: controller IC, 430: register, 431: register, 440: host device, 443: optical sensor, 444: open/close sensor, 445: external light, 450: interface, 451: frame memory, 452: decoder, 453: sensor controller, 454: controller, 455: clock generation circuit, 460: image processing portion, 461: gamma correction circuit, 462: dimming circuit, 463: toning circuit, 464: EL correction circuit, 465: data processing circuit, 465*a*: product-sum operation circuit, 470: memory, 473: timing controller, 475: memory circuit, 475A: scan chain register portion, 475B: register portion, 484: touch sensor controller, 490: region, 491: region, 504: sense amplifier circuit, 505: driver, 506: main amplifier, 507: input/output circuit, 508: peripheral circuit, 509: memory cell, 513: pixel, 514: display region, 515: display region, 516: display region, 517: display region, 518: display region, 700: semiconductor device, 710: offset circuit, 711: offset circuit, 712: offset circuit, 713: offset circuit, 720: memory cell array, 721: memory cell array, 750: offset circuit, 760: memory cell array, 771: circuit, 773: circuit, 774: circuit, 775: circuit, 800: semiconductor device, 810: offset circuit, 811: offset circuit, 815: offset circuit, 1000: display device, 1000A: display device, 1000B: display device, 1710: LVDS receiver, 1720: serial-parallel converter circuit, 1730: shift register circuit, 1740: latch circuit, 1750: level shifter, 1760: pass transistor logic circuit, 1770: resistor string circuit, 1780: external correction circuit, 1790: BGR circuit, 1800: bias generator, 1900: buffer amplifier, 5101: housing, 5102: housing, 5103: display portion, 5104: display portion, 5105: microphone, 5106: speaker, 5107: operation key, 5108: stylus, 5200: information terminal, 5221: housing, 5222: display portion, 5223: operation button, 5224: speaker, 5300: information terminal, 5321*a*: housing, 5321*b*: housing, 5321*c*: hinge portion, 5322: display portion, 5323: operation button, 5324: speaker, 5401: housing, 5402: display portion, 5403: keyboard, 5404: pointing device, 5501: housing, 5502: display portion, 5503: microphone, 5504: speaker, 5505: operation button, 5601: first housing, 5602: second housing, 5603: first display portion, 5604: second display portion, 5605: connection portion, 5606: operation key, 5701: display panel, 5702: display panel, 5703: display panel, 5704: display panel, 5801: first housing, 5802: second housing, 5803: display portion, 5804: operation key, 5805: lens, 5806: connection portion, 5901: housing, 5902: display portion, 5903: operation button, 5904: operator, 5905: band This application is based on Japanese Patent Application Serial No. 2016-165511 filed with Japan Patent Office on Aug. 26, 2016, and Japanese Patent Application Serial No. 2016-165512 filed with Japan Patent Office on Aug. 26, 2016, the entire contents of which are hereby incorporated by reference.

The invention claimed is:

1. A display system comprising:

a processing circuit; and a host device, wherein the host device is configured to perform a first arithmetic operation using a neural network on software and to perform supervised learning with the neural network, wherein the processing circuit is configured to perform a second arithmetic operation using a neural network on hardware, wherein the host device is configured to generate a weight coefficient based on a first data and a teacher data and to input the weight coefficient to the processing circuit, wherein the teacher data has a first set value corresponding to a first luminance and a first color tone, wherein the processing circuit is configured to generate a second data based on the first data and the weight coefficient, wherein the processing circuit comprises a first memory cell, a second memory cell, and an offset circuit, wherein the first memory cell is configured to output a first current corresponding to a first analog data stored in the first memory cell, wherein the second memory cell is configured to output a second current corresponding to a reference analog data stored in the second memory cell, wherein the offset circuit is configured to output a third current corresponding to a differential current between the first current and the second current, wherein the first memory cell is configured to output a fourth current corresponding to the first analog data stored in the first memory cell when a second analog data is supplied as a selection signal, wherein the second memory cell is configured to output a fifth current corresponding to the reference analog data stored in the second memory cell when the second analog data is supplied as the selection signal, wherein the processing circuit is configured to obtain a sixth current corresponding to a differential current between the fourth current and the fifth current and to output a seventh current depending on a sum of products of the first analog data and the second analog data, and wherein the first analog data is a data corresponding to the weight coefficient.

2. The display system according to claim 1, further comprising:

a sensor; and a display portion, wherein the display portion comprises a display element, wherein the sensor is configured to obtain the first data, wherein the second data has a second set value corresponding to a second luminance and a second color tone, and wherein the display element is configured to display an image corresponding to the second set value.

3. The display system according to claim 1, further comprising:

a sensor; and a display portion, wherein the display portion comprises a first display element and a second display element, wherein the sensor is configured to obtain the first data, wherein the second data has a second set value corresponding to a second luminance and a second color tone and a third set value corresponding to a third luminance and a third color tone, wherein the first display element is configured to display an image corresponding to the second set value by reflection of external light, and wherein the second display element is configured to display an image corresponding to the third set value.

4. The display system according to claim 1, wherein the processing circuit is configured to output the seventh current by subtracting the third current from the sixth current.

5. The display system according to claim 1, wherein each of the first memory cell, the second memory cell, and the offset circuit comprises a first transistor, and wherein the first transistor comprises a metal oxide in a channel formation region.

6. The display system according to claim 1, wherein the offset circuit comprises a first current generation circuit, and a second current generation circuit, wherein the first current generation circuit is configured to generate the third current when an amount of the first current is smaller than an amount of the second current, and to retain a potential corresponding to the third current, wherein the second current generation circuit is configured to generate an eighth current corresponding to a difference between the first current and the second current when an amount of the first current is larger than an amount of the second current, and to retain a potential corresponding to the eighth current, and wherein the processing circuit is configured to output the seventh current by subtracting the third current or the eighth current from the seventh sixth current.

7. The display system according to claim 2, further comprising:

a base; and a first integrated circuit, wherein the display portion is formed over the base, wherein the first integrated circuit is mounted over the base, wherein the processing circuit is formed over the base, wherein the first integrated circuit comprises an image processing portion, and wherein the image processing portion is configured to process an image data based on the second data.

8. The display system according to claim 7, wherein the processing circuit is included in the image processing portion.

9. The display system according to claim 7, wherein the first integrated circuit comprises a second transistor, and wherein the second transistor comprises silicon in a channel formation region.

10. The display system according to claim 7, wherein the first integrated circuit comprises a third transistor, and wherein the third transistor comprises a metal oxide in a channel formation region.

11. The display system according to claim 7, further comprising:

a first circuit;

a second circuit; and a second integrated circuit, wherein the first circuit is formed over the base, wherein the second circuit is formed over the base, wherein the second integrated circuit is mounted over the base, wherein the first circuit is configured to operate as a gate driver of the display portion, wherein the second circuit is configured to shift a level of an inputted voltage on a high potential side, and wherein the second integrated circuit is configured to operate as a source driver of the display portion.

12. The display system according to claim 11, wherein each of the display portion, the first circuit, and the second circuit comprises a fourth transistor, and wherein the fourth transistor comprises a metal oxide in a channel formation region.

13. The display system according to claim 11, wherein the second integrated circuit comprises a fifth transistor, and wherein the fifth transistor comprises silicon in a channel formation region.

14. The display system according to claim 11, wherein the first integrated circuit comprises a controller, and wherein the controller is configured to control supplying power to at least one of the first circuit, the second circuit, the second integrated circuit, and the image processing portion.

15. A display device comprising a processing circuit, wherein the processing circuit is configured to perform an arithmetic operation using a neural network on hardware, wherein a weight coefficient based on a first data and a teacher data is generated by a host device using a neural network on software and is input to the processing circuit, wherein the teacher data has a first set value corresponding to a first luminance and a first color tone, wherein the processing circuit is configured to generate a second data based on the first data and the weight coefficient, wherein the processing circuit comprises a first memory cell, a second memory cell, and an offset circuit, wherein the first memory cell is configured to output a first current corresponding to a first analog data stored in the first memory cell, wherein the second memory cell is configured to output a second current corresponding to a reference analog data stored in the second memory cell, wherein the offset circuit is configured to output a third current corresponding to a differential current between the first current and the second current, wherein the first memory cell is configured to output a fourth current corresponding to the first analog data stored in the first memory cell when a second analog data is supplied as a selection signal, wherein the second memory cell is configured to output a fifth current corresponding to the reference analog data stored in the second memory cell when the second analog data is supplied as the selection signal, wherein the processing circuit is configured to obtain a sixth current corresponding to a differential current between the fourth current and the fifth current and to output a seventh current depending on a sum of products of the first analog data and the second analog data, and wherein the first analog data is a data corresponding to the weight coefficient.

16. The display device according to claim 15, further comprising:

a sensor; and a display portion, wherein the display portion comprises a display element, wherein the sensor is configured to obtain the first data, wherein the second data has a second set value corresponding to a second luminance and a second color tone, and wherein the display element is configured to display an image corresponding to the second set value.

17. The display device according to claim 15, further comprising:

a sensor; and a display portion, wherein the display portion comprises a first display element and a second display element, wherein the sensor is configured to obtain the first data, wherein the second data has a second set value corresponding to a second luminance and a second color tone and a third set value corresponding to a third luminance and a third color tone, wherein the first display element is configured to display an image corresponding to the second set value by reflection of external light, and wherein the second display element is configured to display an image corresponding to the third set value.

18. The display device according to claim 15, wherein the processing circuit is configured to output the seventh current by subtracting the third current from the sixth current.

19. The display device according to claim 15, wherein each of the first memory cell, the second memory cell, and the offset circuit comprises a first transistor, and wherein the first transistor comprises a metal oxide in a channel formation region.

20. The display device according to claim 15, wherein the offset circuit comprises a first current generation circuit, and a second current generation circuit, wherein the first current generation circuit is configured to generate the third current when an amount of the first current is smaller than an amount of the second current, and to retain a potential corresponding to the third current, wherein the second current generation circuit is configured to generate an eighth current corresponding to a difference between the first current and the second current when an amount of the first current is larger than an amount of the second current, and to retain a potential corresponding to the eighth current, and wherein the processing circuit is configured to output the seventh current by subtracting the third current or the eighth current from the sixth current.

* * * * *